US007849993B2

(12) United States Patent
Finkenzeller et al.

(10) Patent No.: US 7,849,993 B2
(45) Date of Patent: Dec. 14, 2010

(54) DEVICES AND METHOD FOR THE PRODUCTION OF SHEET MATERIAL

(75) Inventors: Klaus Finkenzeller, Munich (DE); Thomas Giering, Kirchseeon (DE); Manfred Heim, Munich (DE); Thomas Hildebrandt, Kirchheim (DE); Ralf Hobmeier, Munich (DE); Lars Hoffmann, Freising (DE); Norbert Holl, Germering (DE); Wittich Kaule, Emmering (DE); Friedrich Kretschmar, Munich (DE); Markus Krombholz, Bad Berneck (DE); Ralf Liebler, Gmund (DE); Thorsten Pillo, Holzkirchen (DE); Harald Reiner, Munich (DE); Walter Schneider, Miesbach (DE); Eckart Schroeder-Bergen, Eichenau (DE); Martin Seysen, Munich (DE); Dieter Stein, Holzkirchen (DE); Alexander Steinkogler, Munich (DE); Christian Voellmer, Munich (DE); Bernd Wunderer, Munich (DE); Fabiola Bellersheim, Icking (DE); Marius Dichtl, Munich (DE); Juergen Schuetzmann, Pfaffenhofen (DE)

(73) Assignee: Giesecke & Devrient GmbH, Munich (DE)

( * ) Notice: Subject to any disclaimer, the term of this patent is extended or adjusted under 35 U.S.C. 154(b) by 1023 days.

(21) Appl. No.: 10/499,018
(22) PCT Filed: Dec. 19, 2002
(86) PCT No.: PCT/EP02/14606

§ 371 (c)(1),
(2), (4) Date: Jan. 28, 2005

(87) PCT Pub. No.: WO03/054808

PCT Pub. Date: Jul. 3, 2003

(65) Prior Publication Data

US 2005/0150740 A1 Jul. 14, 2005

(30) Foreign Application Priority Data

Dec. 21, 2001 (DE) ..... 101 63 266
Dec. 21, 2001 (DE) ..... 101 63 267

(51) Int. Cl.
*G07F 7/04* (2006.01)

(52) U.S. Cl. ..... 194/206; 194/205; 194/210; 194/211; 194/212; 194/213; 194/207

(58) Field of Classification Search ..... 194/205–213; 209/534
See application file for complete search history.

(56) References Cited

U.S. PATENT DOCUMENTS 5,316,900 A * 5/1994 Tsujioka et al. ..... 430/270.15
(Continued)

FOREIGN PATENT DOCUMENTS

DE 196 19 851 A 6/1997
(Continued)

OTHER PUBLICATIONS

Connelly, J., "Analogous Integrated Circuits," Mir, 1977, p. 11.

(Continued)

*Primary Examiner*—Jeffrey A Shapiro
(74) *Attorney, Agent, or Firm*—Rothwell, Figg, Ernst & Manbeck, P.C.

(57) ABSTRACT

The invention relates to sheet material having an electrical circuit and to apparatuses and methods for processing said sheet material.

Figure 1:
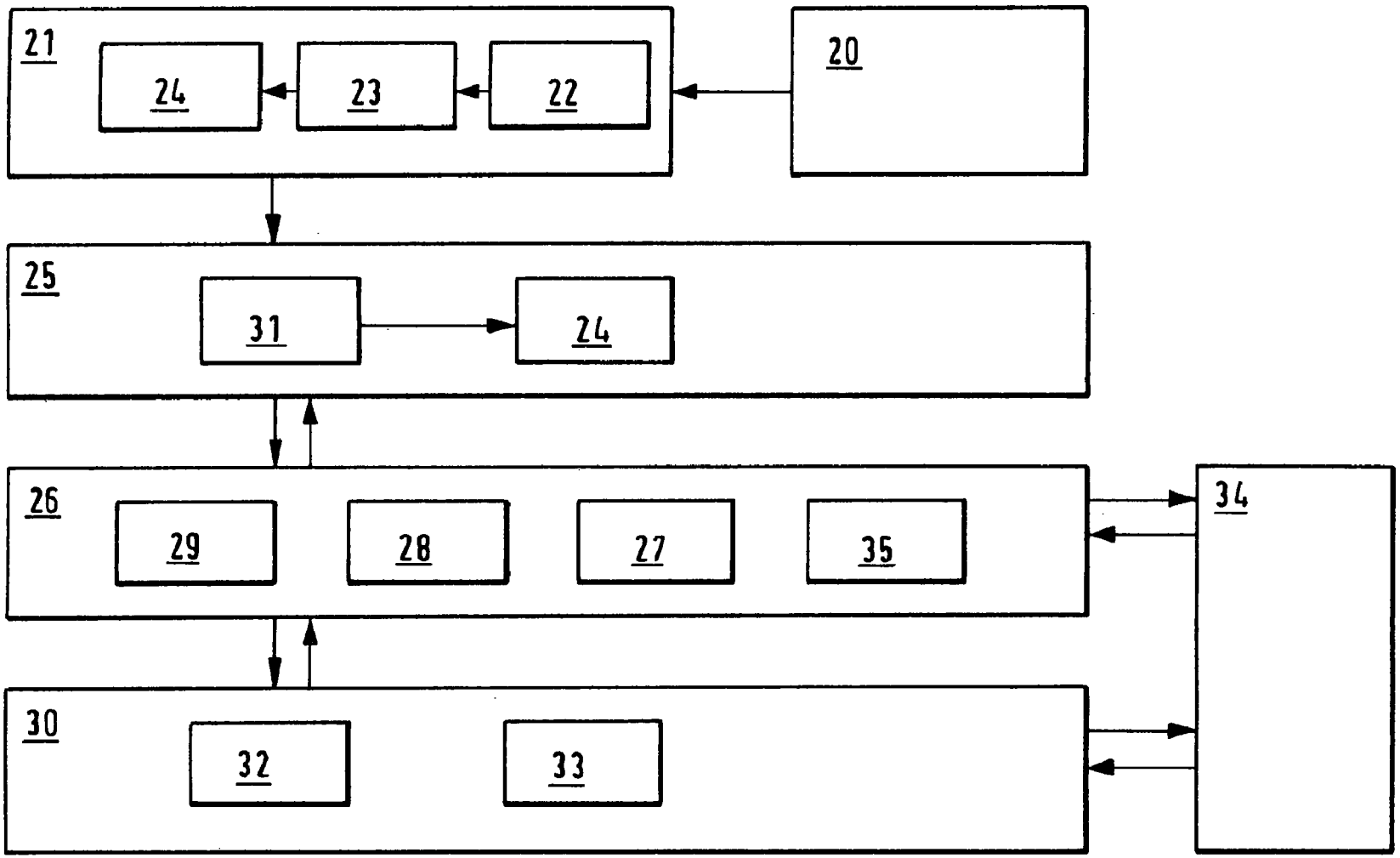

The present invention describes sheet material having an electrical circuit as well as apparatuses and methods for processing same, which reduce the effort required for processing the sheet material and/or facilitate processing and/or improve it and/or make it more reliable. For this purpose, the sheet material has at least one electrical circuit, with energy and/or data being transmitted from the apparatus to the electrical circuit and/or from the electrical circuit to the apparatus and at least part of the transmitted data being used for processing.

87 Claims, 39 Drawing Sheets

(Continued)

U.S. PATENT DOCUMENTS

| | | | | |
|---|---|---|---|---|
| 5,595,955 | A * | 1/1997 | Chang et al. | 503/201 |
| 5,678,863 | A * | 10/1997 | Knight et al. | 283/113 |
| 5,892,239 | A * | 4/1999 | Nagase | 250/556 |
| 6,514,140 | B1 * | 2/2003 | Storch | 463/25 |
| 6,547,151 | B1 * | 4/2003 | Baldi | 235/492 |
| 6,648,221 | B2 * | 11/2003 | Thawley et al. | 235/379 |
| 6,659,353 | B1 * | 12/2003 | Okamoto et al. | 235/492 |
| 6,697,419 | B1 * | 2/2004 | Pascal | 375/219 |
| 6,732,011 | B1 * | 5/2004 | Hart et al. | 700/223 |
| RE38,663 | E * | 11/2004 | Kayani et al. | 382/135 |
| 6,830,192 | B1 * | 12/2004 | Krul et al. | 235/492 |
| 6,955,263 | B2 * | 10/2005 | Steinkogler et al. | 209/534 |
| 6,991,260 | B2 * | 1/2006 | Fan et al. | 283/72 |
| 7,032,828 | B2 * | 4/2006 | Krul et al. | 235/492 |
| 7,040,664 | B2 * | 5/2006 | Taylor et al. | 283/72 |
| 7,249,709 | B2 * | 7/2007 | Van Rens | 235/451 |
| 7,309,019 | B2 * | 12/2007 | Okamoto et al. | 235/492 |
| 2001/0026220 | A1 * | 10/2001 | Miura et al. | 340/572.1 |
| 2002/0040865 | A1 * | 4/2002 | Steinkogler et al. | 209/534 |
| 2002/0117845 | A1 * | 8/2002 | Ahlers et al. | 283/72 |
| 2002/0158397 | A1 * | 10/2002 | Wilfer et al. | 270/52.01 |
| 2003/0006121 | A1 * | 1/2003 | Lee et al. | 194/206 |
| 2003/0023342 | A1 * | 1/2003 | Christl et al. | 700/213 |
| 2003/0187798 | A1 * | 10/2003 | McKinley et al. | 705/50 |
| 2004/0012144 | A1 * | 1/2004 | Matzig et al. | 271/279 |
| 2004/0099580 | A1 * | 5/2004 | Brotherston et al. | 209/583 |
| 2006/0004483 | A1 * | 1/2006 | Neff et al. | 700/219 |

FOREIGN PATENT DOCUMENTS

| | | | |
|---|---|---|---|
| DE | 296 23 930 | U | 9/2000 |
| EP | 0 905 657 | A1 | 3/1999 |
| EP | 1 134 694 | A | 9/2001 |
| EP | 1 139 302 | A1 | 10/2001 |
| RU | 2 170 684 | C1 | 7/2001 |
| WO | WO 00 07151 | A | 2/2000 |

OTHER PUBLICATIONS

Tolkovyj slovar' po radioelectronike, Mockba, 1993, pp. 75, 242-243, 168-171.

Polytechnichelskij slovar', pp. 182, 203, 266, 331, 402, 270, 20, 520, 496, 157.

Tolkovyj slovar' russkogo jazyka, pp. 235, 153.

* cited by examiner

FIG.22
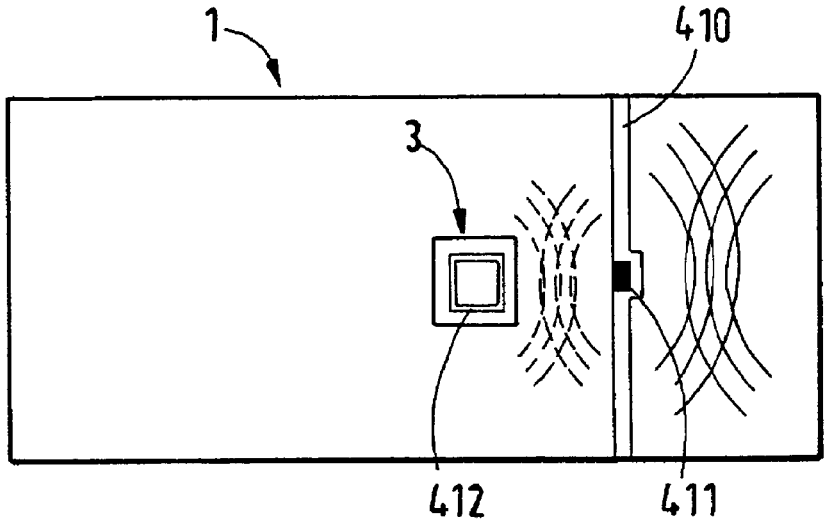
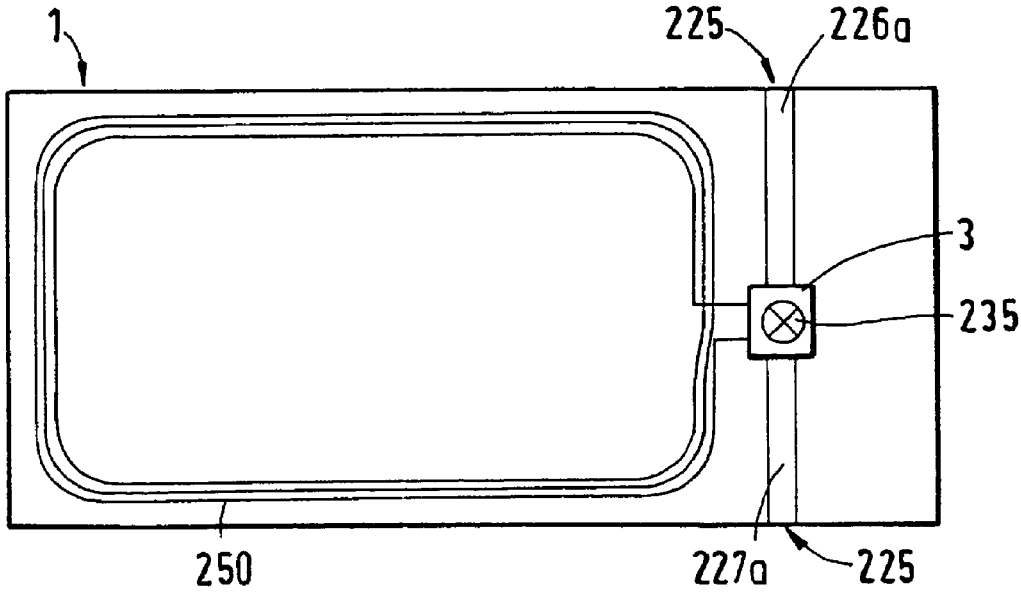
FIG.23

FIG.24
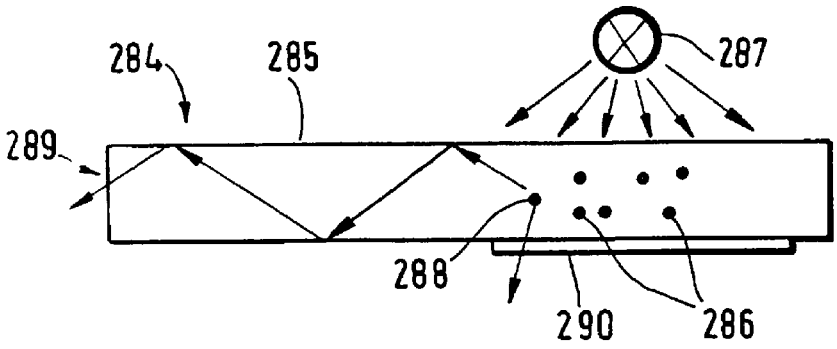
FIG.25
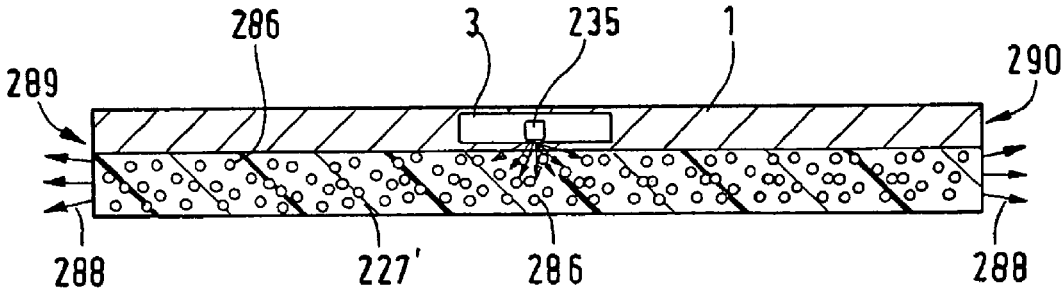
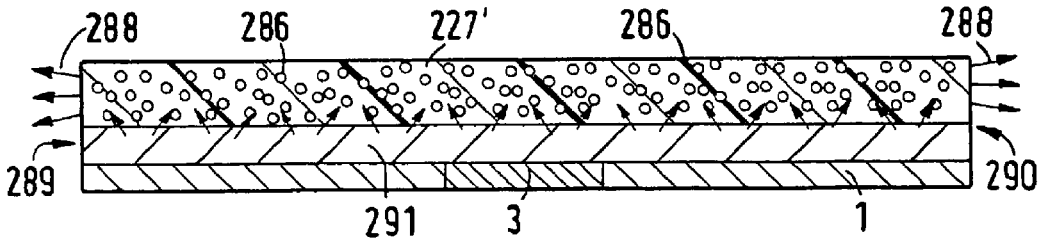
FIG.26

FIG.27
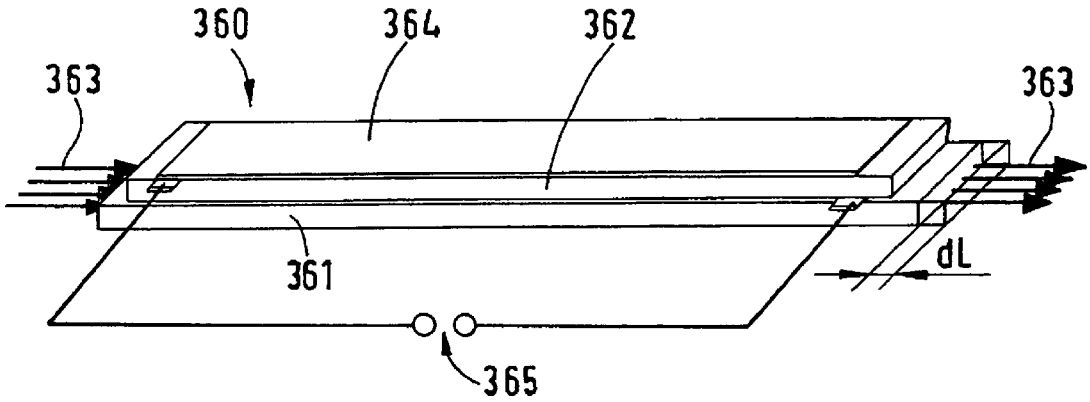
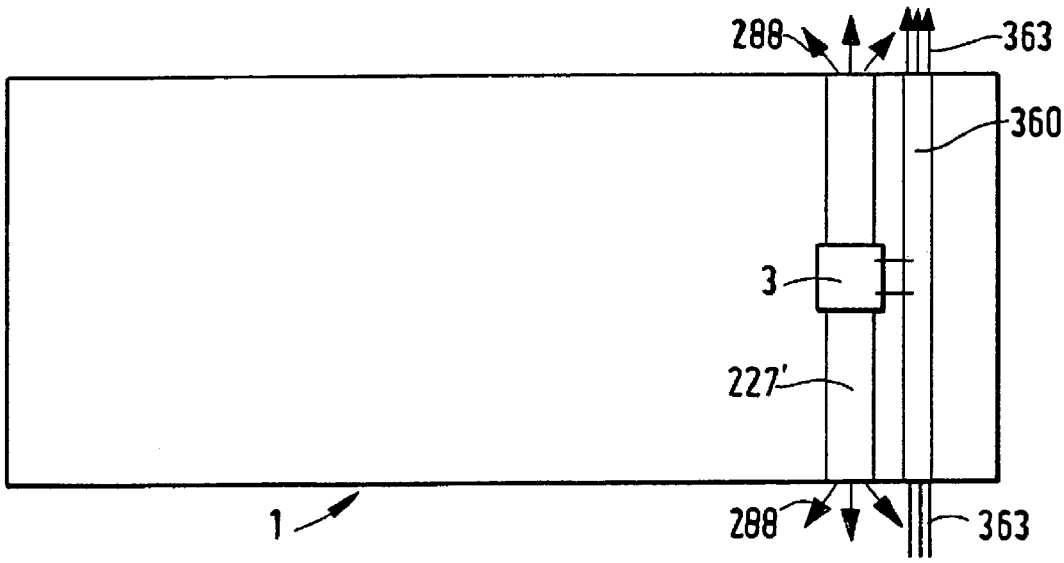
FIG.28

FIG.30
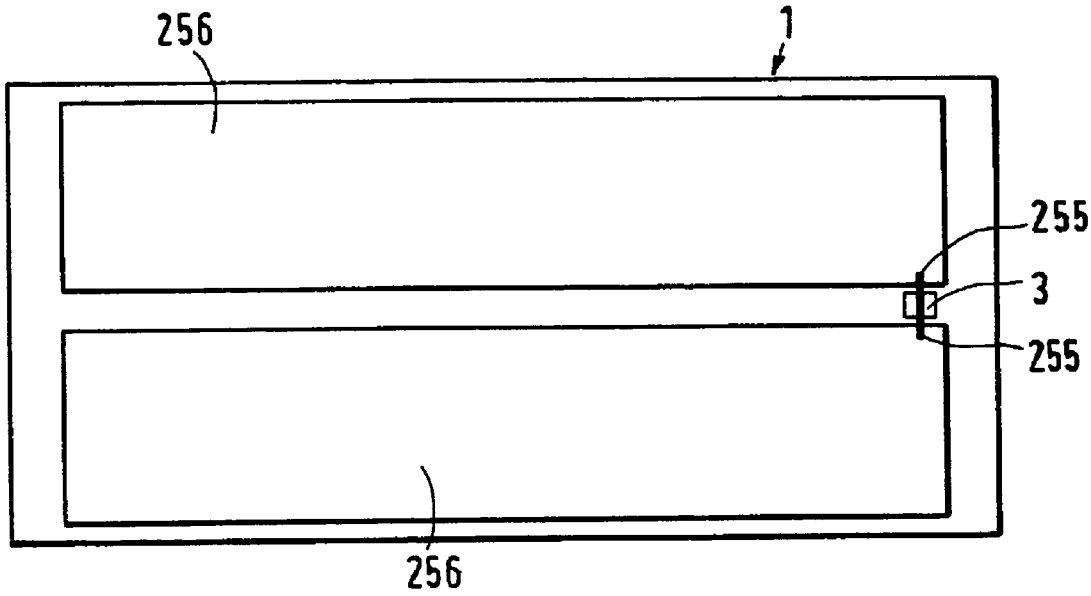
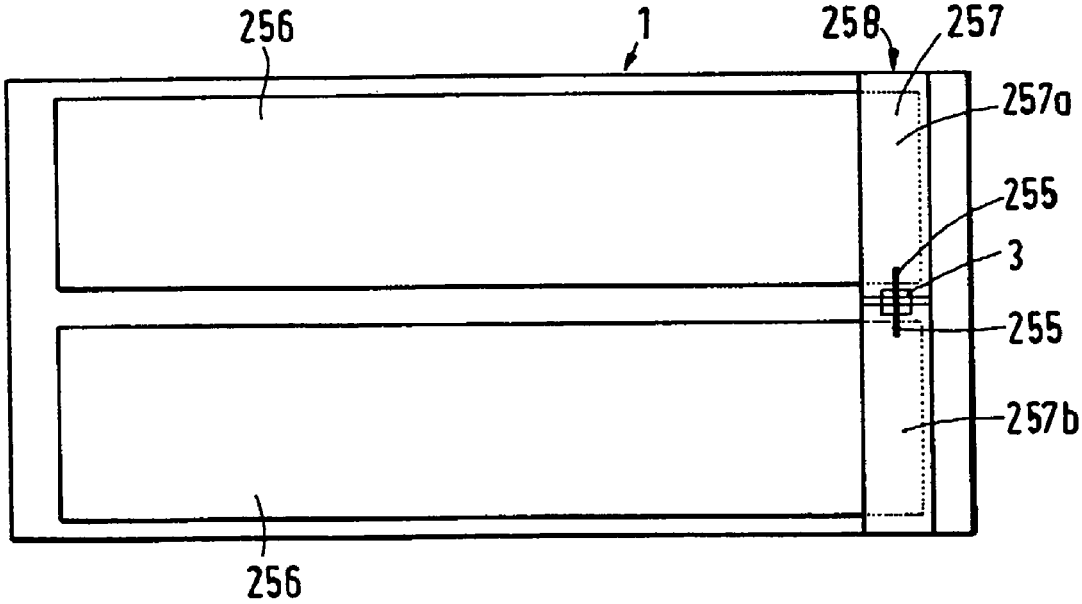
FIG.31

FIG.36
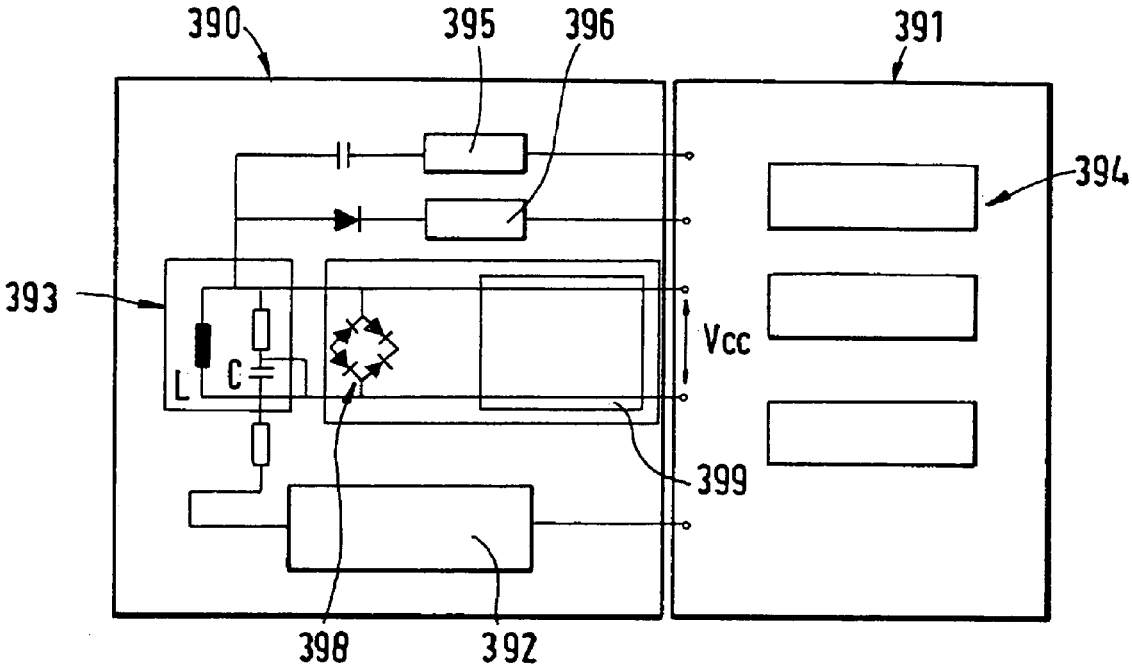
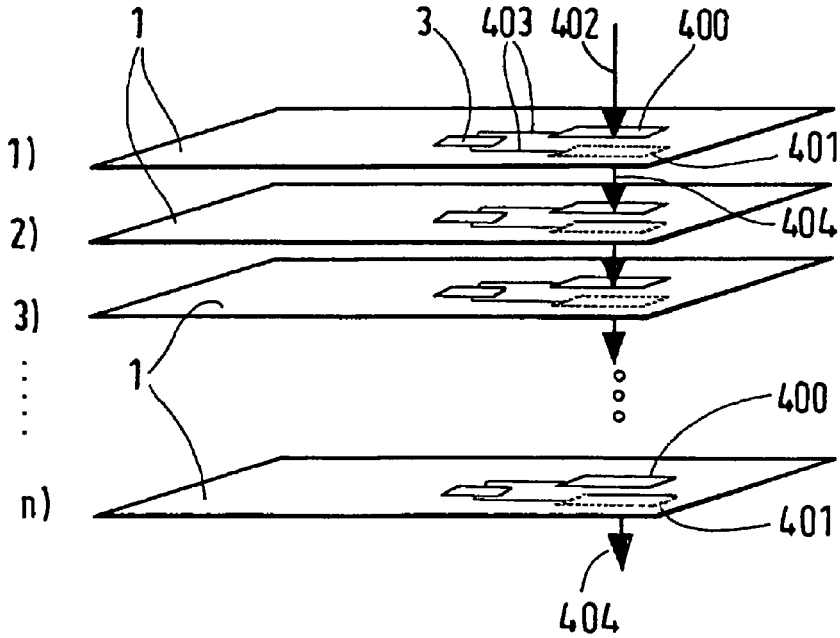
FIG. 37

FIG.48
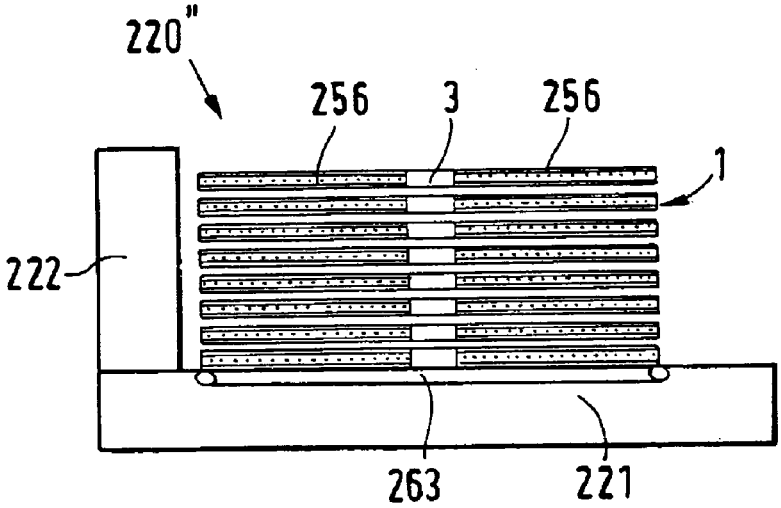
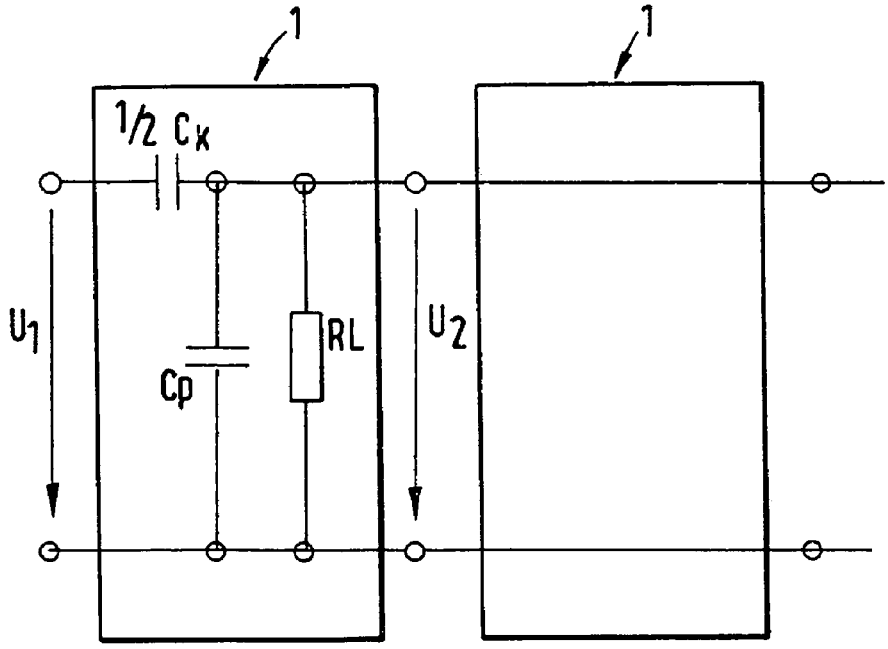
FIG.49

FIG.52a
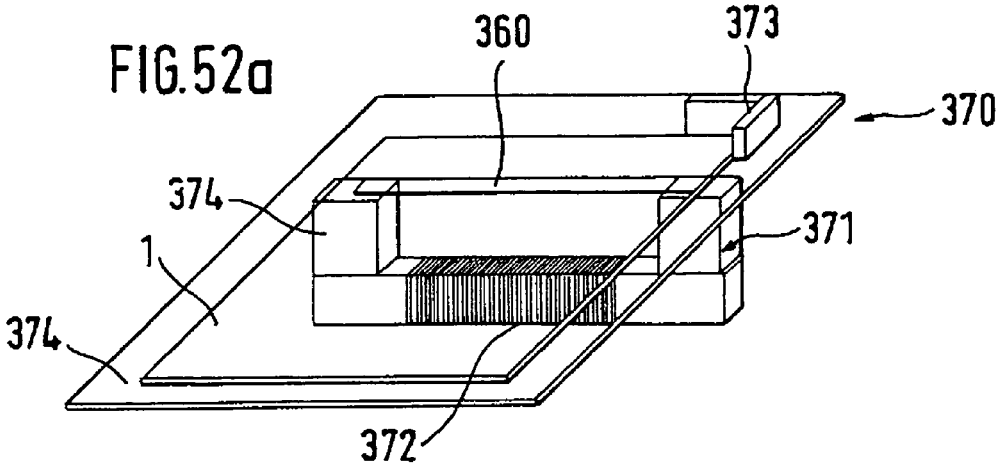
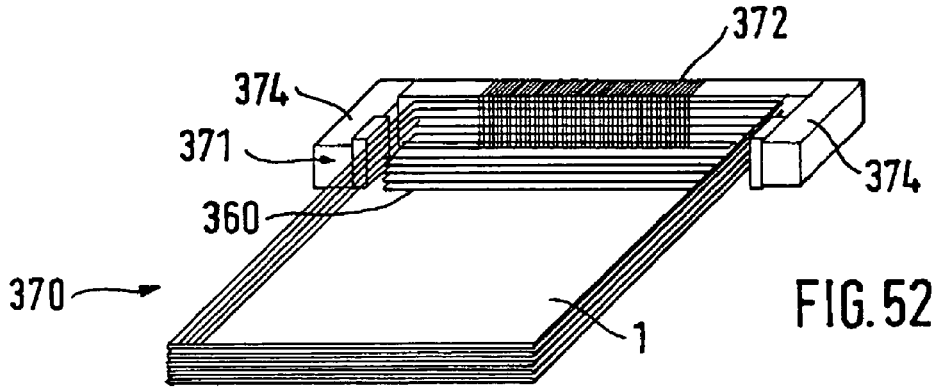
FIG.52b
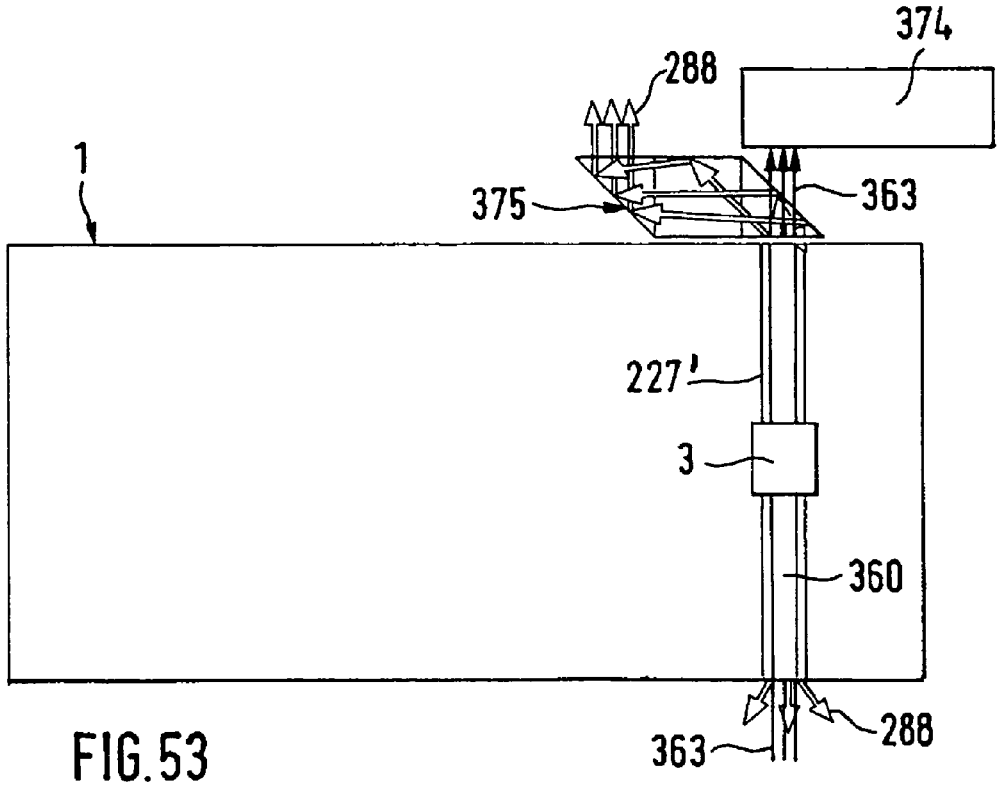
FIG.53

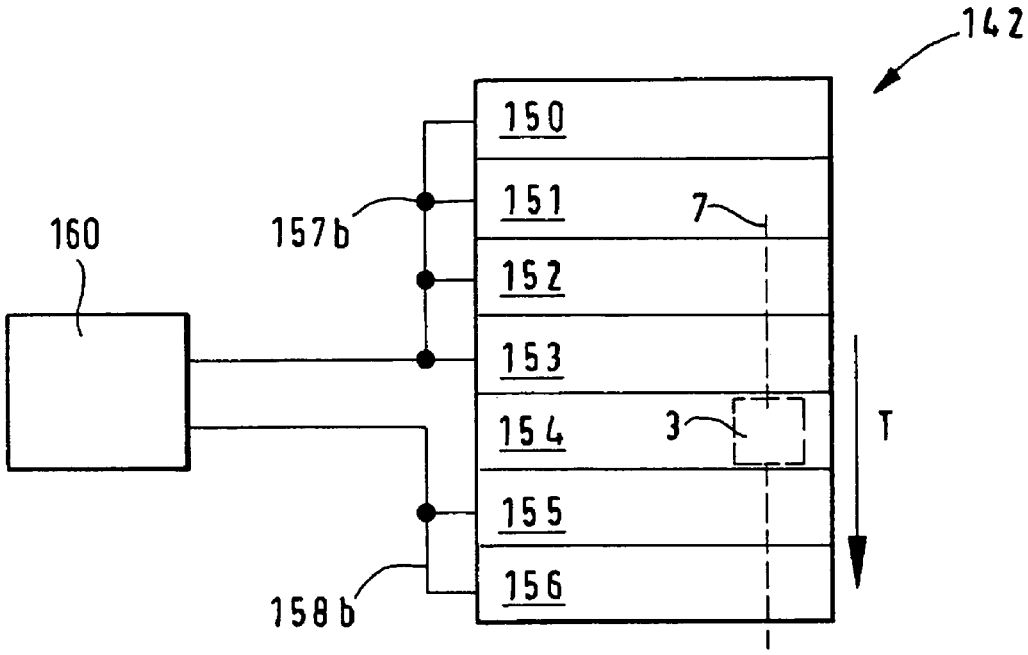
FIG.59b
FIG.59c
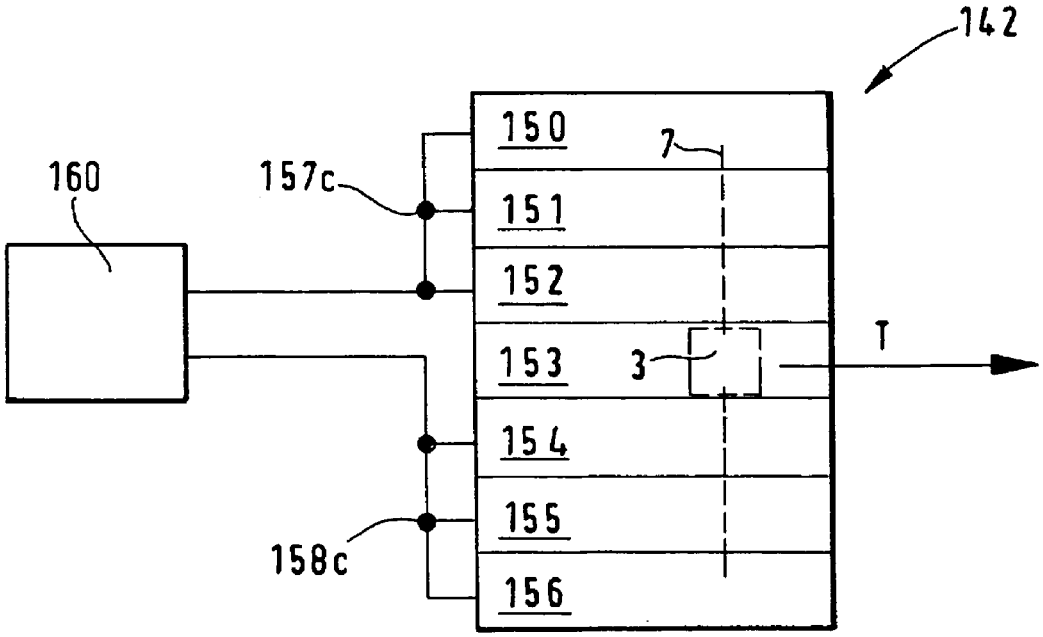

DEVICES AND METHOD FOR THE PRODUCTION OF SHEET MATERIAL

The invention relates to sheet material with an electrical circuit and apparatuses and methods for producing and processing such sheet material.

Elaborate processing using sensory means is required when processing, such as counting and/or sorting prior art sheet material such as banknotes.

It is thus the object of the present invention to specify sheet material with an electrical circuit and apparatuses and methods for producing or processing, as the case may be, same that reduce the expenses and time required to produce or process, as the case may be, the sheet material and/or facilitate and/or improve such production or processing, as the case may be, and/or render same more reliable.

This object is solved by the features of the independent claims. The dependent claims describe preferred embodiments.

Among other things, the object is thus solved by an apparatus and a method for processing sheet material with at least one electrical circuit, where energy and/or data are transmitted from the apparatus to the electrical circuit and/or from the electrical circuit to the apparatus and at least part of the transmitted energy or data, as the case may be, is used for the processing.

A checking device is used for this purpose. Such checking device, hereinafter also referred to as a testing, reading, transmission device or unit, as the case may be, can be designed not only for the transmission of energy and/or data, but rather for the analysis of such data as well. The checking device within the meaning of the present invention can thus be used both for receiving energy and/or data and/or emitting energy and/or data and/or for testing in dependence on the energies or data, as the case may be, that are emitted or received, as the case may be.

According to the general definition, the term "data" can refer both to information that, in particular, is transmitted unilaterally or bilaterally between the sheet material circuit and the processing apparatus, i.e. including information e.g. in the form of processing commands or control commands, as the case may be, that specify what is supposed to happen to the other transmitting information. Here, the "energy" serves in particular to enable such data transmission by having the processing apparatus supply the sheet material circuit with energy for example. In this context, the term "electrical circuit" can refer to the circuit itself, i.e., for example, a chip as an integrated circuit, as well as its coupling elements such as its contact surfaces, coupling antennas or coupling photodiodes, etc.

Special embodiments of the invention relate to sheet material with a circuit and one or more transmission devices for transmitting energy for the supplying of voltage into the circuit and/or one or more transmission devices for transmitting data into the circuit and/or one or more transmission devices for transmitting data out of the circuit. Here, it is possible to base each of these transmission units on diverse physical modes of action. For example, galvanic coupling via contacts, coupling by an electric field, coupling by a magnetic field, optical coupling by electromagnetic waves such as coupling by light, coupling by deformation, coupling by electromechanical elements, coupling by sound and coupling by heat can take place alone or in combination. Within the meaning of the present application, light refers to all kinds of electromagnetic radiation, although it preferably refers to visible light, but also refers to UV light, infrared light, radio waves or microwaves.

Other methods such as data transmission by means of changing coefficients of optical transmission, reflection and/or absorption such as with so-called electronic paper and/or transmission of the information by load modulation of the energy that is transmitted into the circuit via a transmission device can also be used to transmit data from within the circuit.

An embodiment of the invention relates to apparatuses and methods where sheet material with an electrical circuit is made available as a stack and where one or more properties of the sheet material is determined and/or captured by communication between the electrical circuit of the sheet material and the apparatus and/or where information and/or data are transmitted to the electrical circuit by the communication and stored in a memory of a banknote chip, for example. There are the two categories of measurement in stack measurement in particular with one being with a stationary stack and the other one with a moving stack.

Here, a "stationary" stack or a "moving" stack, as the case may be, can be understood to refer to the cases where both the stack as a whole is stationary or moving, as the case may be, and/or individual sheets or all of the sheets of the stack are stationary or moving, as the case may be, with reference to one another.

Another embodiment of the invention relates to apparatuses and methods for processing, preferably in the stationary state, sheet material having at least one electrical circuit, where an informational exchange between the electrical circuit and the apparatus of the particular sheet material to be separated next occurs prior to separation of such sheet material. The problem of jumbled talk/crosstalk can be solved e.g. by optical enabling. Additional authenticity sensors in the singler make it possible to build banknote processing machines without a measurement path.

Moreover, the object is solved by sheet material having an electrical circuit and a transmission device for the transmission of energy and/or data to or from the electrical circuit, as well as apparatuses and methods for this informational exchange. It must also be emphasized that, with reference to banknotes, the sheet material according to the invention refers to both unprinted banknote paper and banknote paper that has already been printed.

In another embodiment of the invention, the electrical circuit of the sheet material has at least one memory with a plurality of separate memory areas that are writable and/or readable while the sheet material is in circulation. Furthermore, the invention can provide for particular usage data to be recorded in a memory and/or read from same.

Another embodiment of the invention relates to sheet material with an electrical circuit with a memory as well as apparatuses and methods for the exchange of information with the electrical circuit where PKI (Public Key Infrastructure) methods are used to secure the exchange of information and authenticate certain properties (e.g. the nominal value of a banknote). This makes simple realization of the apparatus possible since no security electronics are required.

Another preferred embodiment of the invention relates to apparatuses for the exchange of information with an electrical circuit of the sheet material, with the sheet material being transported past the apparatus in order to exchange information and the exchange of information being independent of the transport and the orientation of the sheet material.

According to the other main claims, the object is also achieved by containers such as a safe or a cassette or a band for the storage and/or transport of sheet material, an intermediate product, such as a transfer element for use in the production of a sheet material, a method for the production of sheet material or an intermediate product for use in the production of sheet material and by an apparatus for use in the production of sheet material or an intermediate product for use in the production of sheet material.

It must be emphasized in particular that the individual features of the dependent claims and the embodiments cited in the description may be used advantageously in combination or also completely or at least partially independently of one another and of the subject matter of the main claims.

Figure 2B:
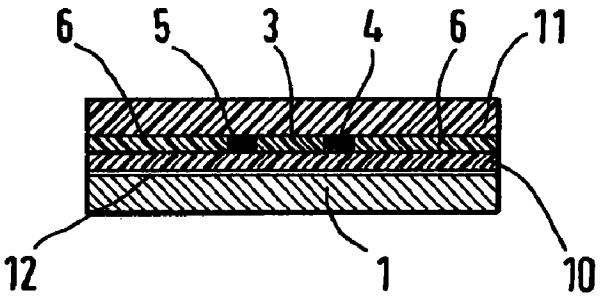
Figure 2A:
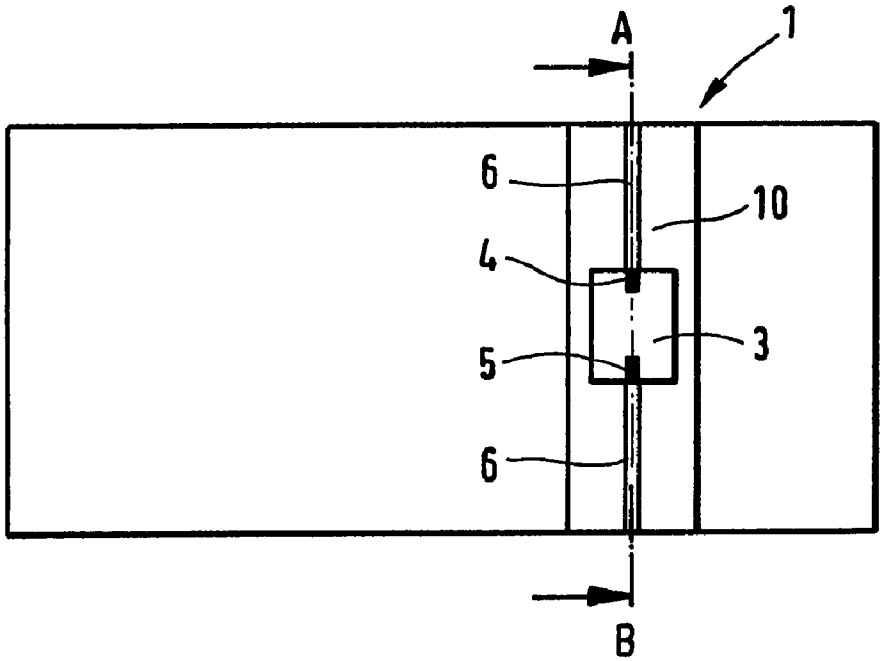
Figure 3:
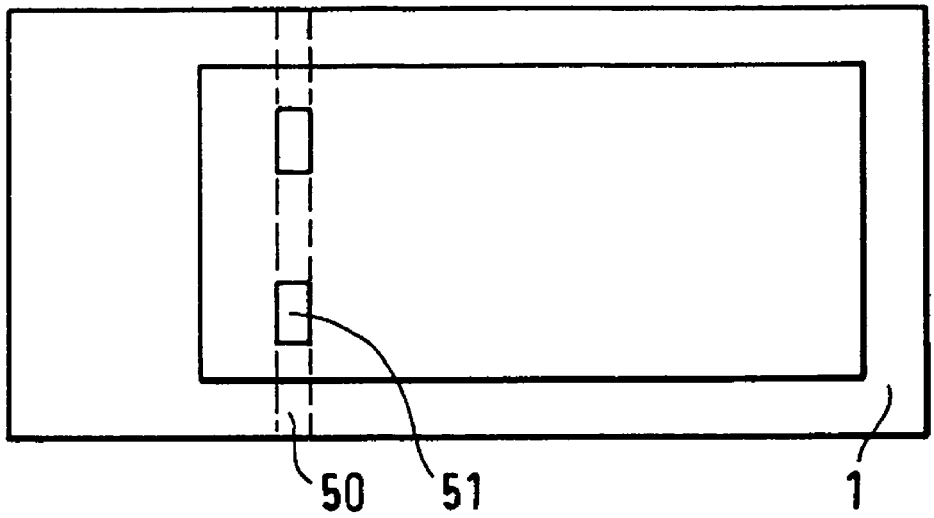
Figure 4:
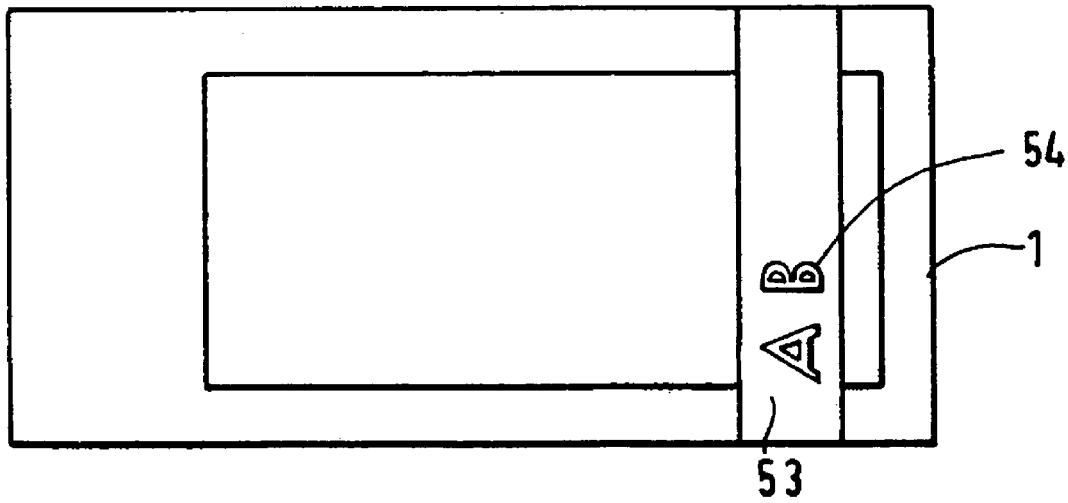
Figure 5:
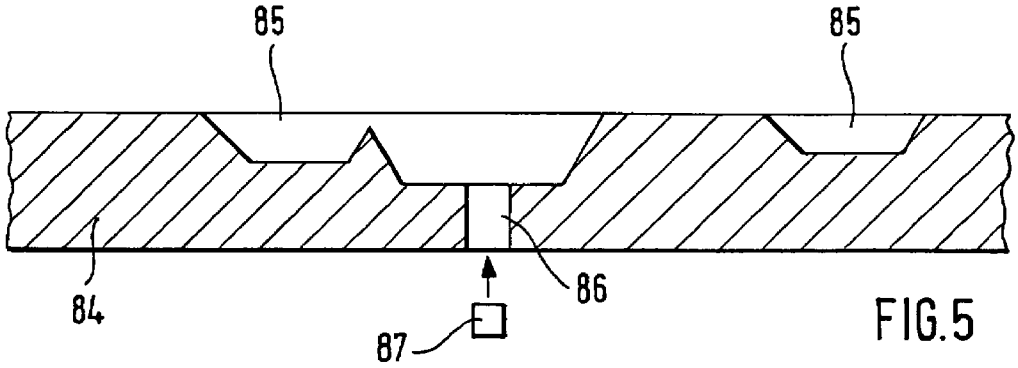
Figure 6:
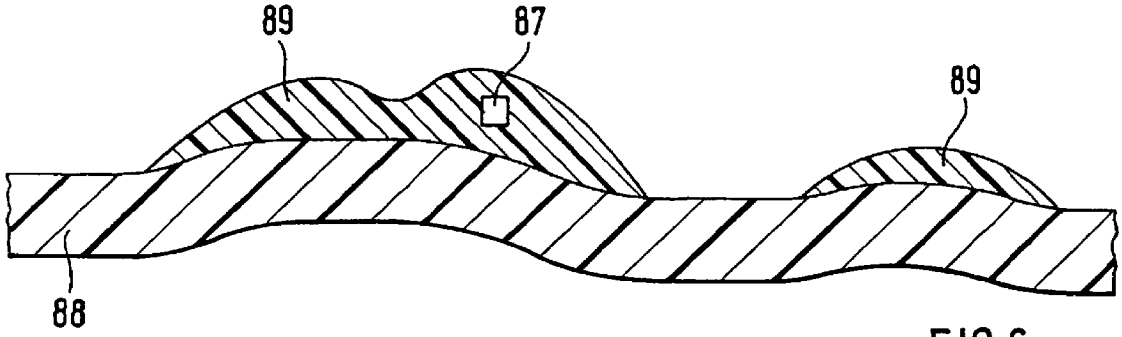
Figure 7:
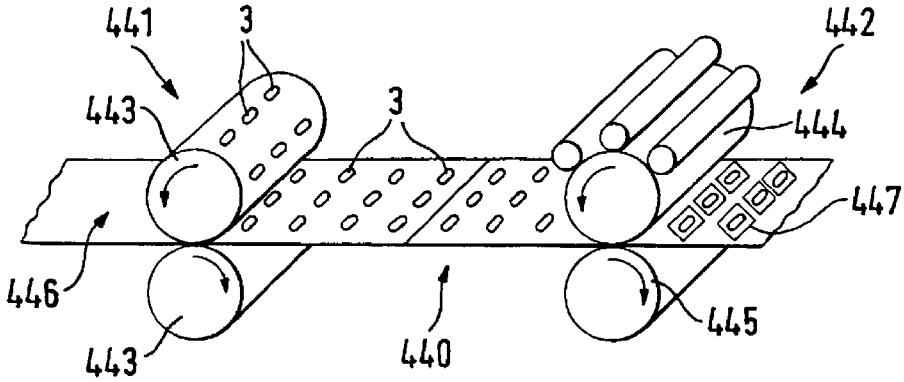
Figure 8:
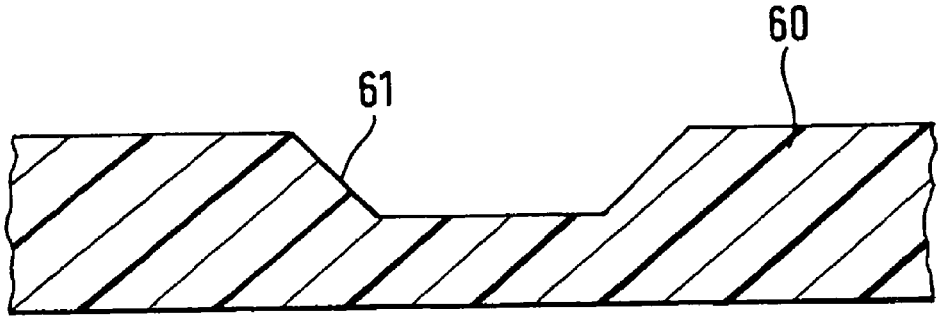
Figure 9:
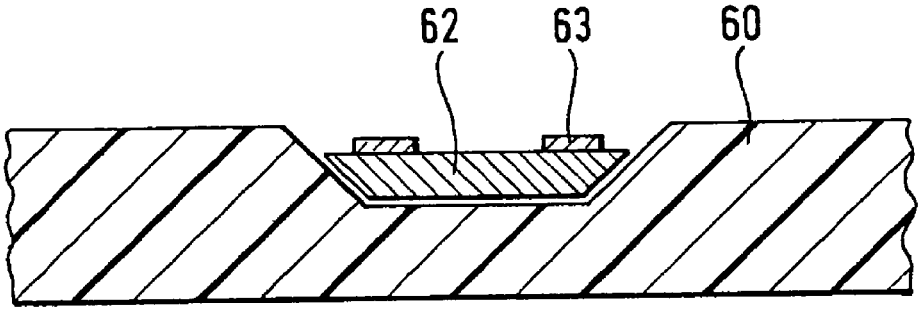
Figure 10:
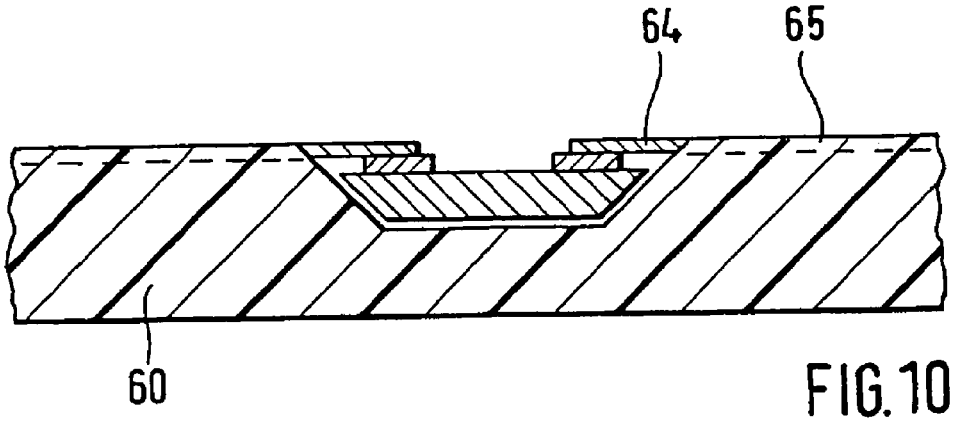
Figure 11:
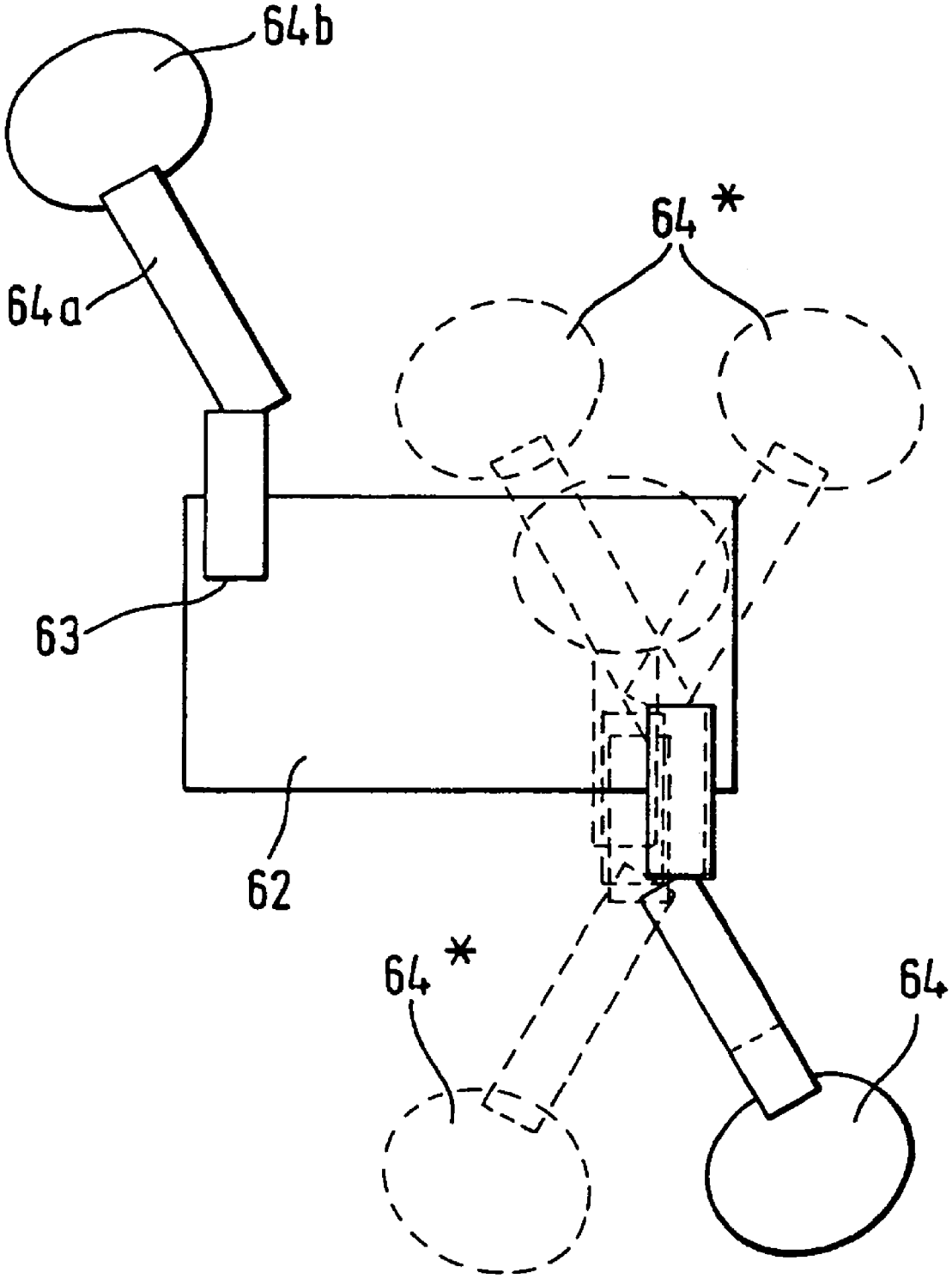
Figure 12A:
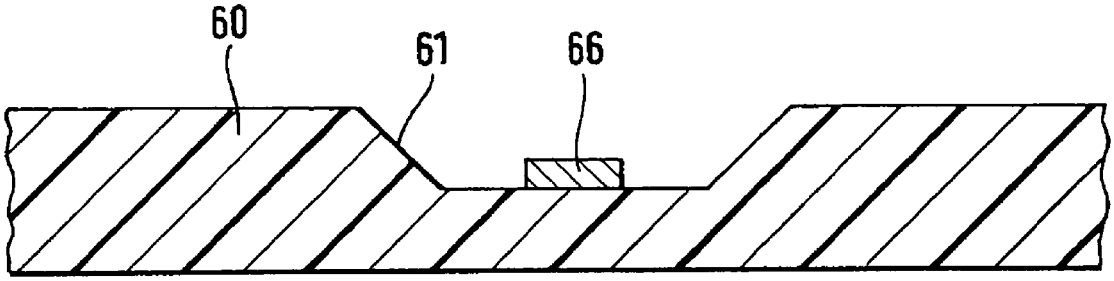
Figure 13:
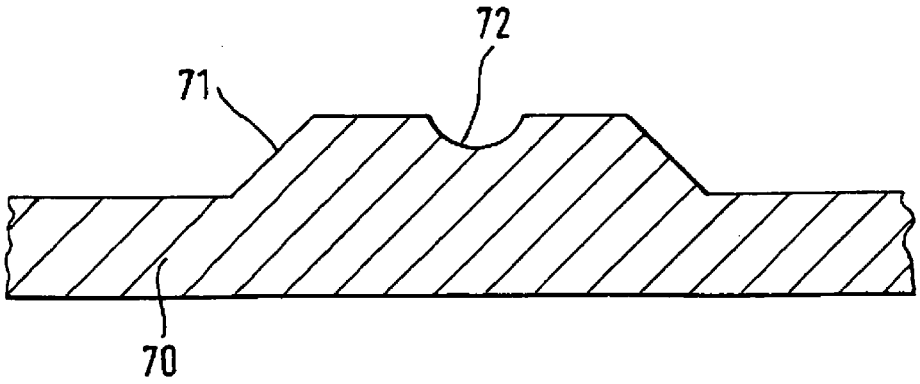

The invention is described on the basis of exemplary embodiments in the following, which show:

FIG. 1 A simplified, schematicized representation of the circulation of money;

FIG. 2 An embodiment of the security paper in the form of a banknote according to the invention;

FIG. 3 A top view of a further embodiment of the security paper in the form of a banknote according to the invention;

FIG. 4 A top view of a further embodiment of the security paper in the form of a banknote according to the invention;

FIG. 5 An intaglio printing plate for the incorporation of electrical circuits according to the invention in cross-section;

FIG. 6 A cross-section of a document that was printed with a printing plate according to FIG. 5;

FIG. 7 A schematic view of a rotary press apparatus with pre-stage and print stage;

FIG. 8 An embossed foil for the self-alignment method in cross-section;

FIG. 9 A cross-section of an embossed foil according to FIG. 8 with a chip stored in it;

FIG. 10 A further embodiment of an embossed foil for the self-alignment method in cross-section;

FIG. 11 A schematic top view of the position and location of the contact surfaces of a chip of a banknote;

FIG. 12 A further embodiment of the self-alignment method;

FIG. 13 A cross-section of an embossing and printing form for the method according to FIG. 12*a;*

Figure 14:
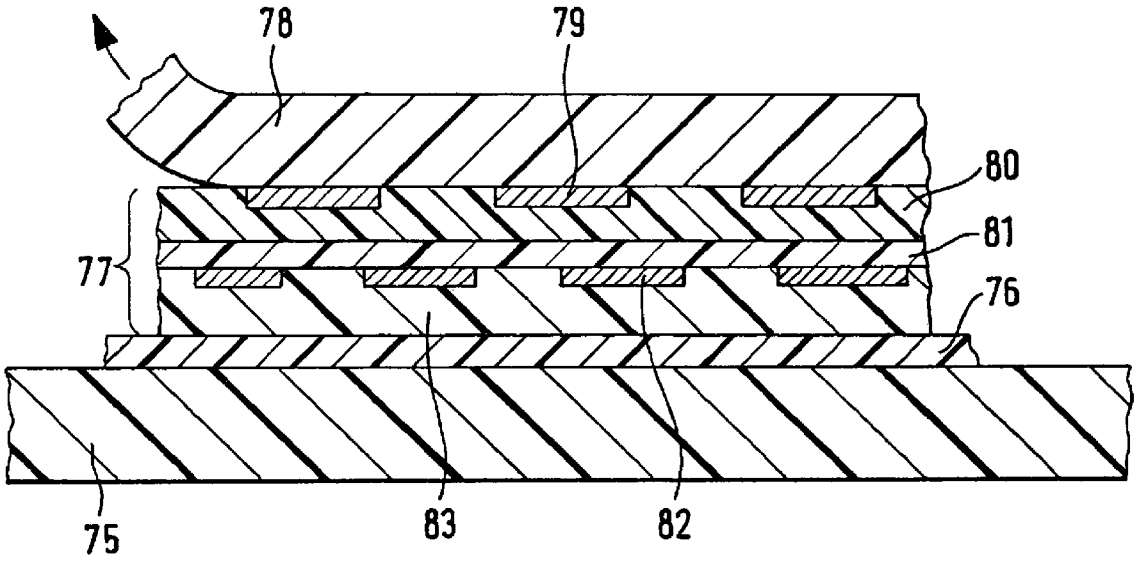
Figure 15:
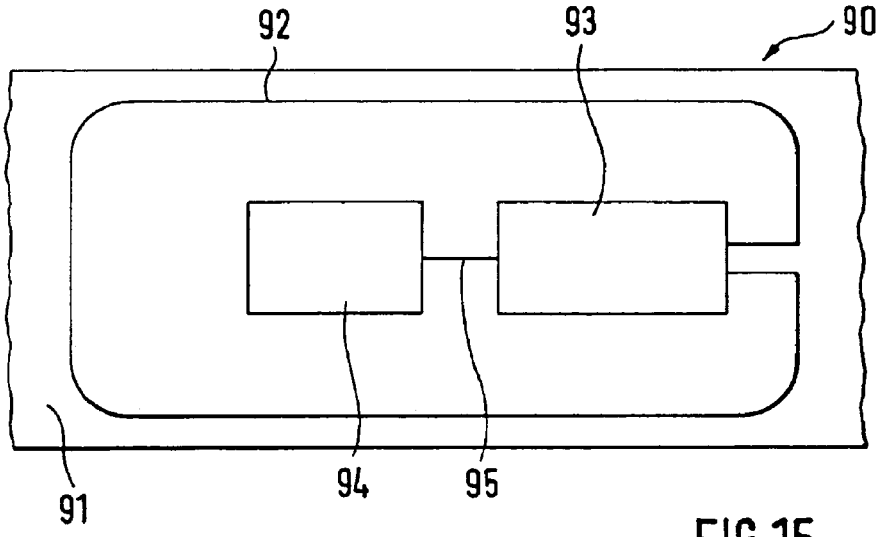
Figure 16:
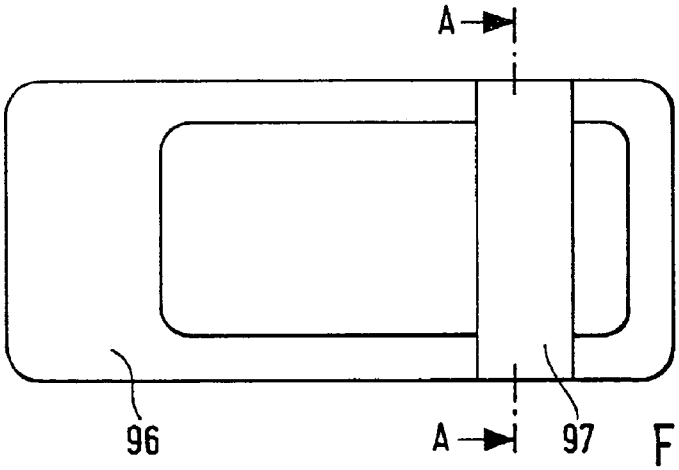
Figure 17:
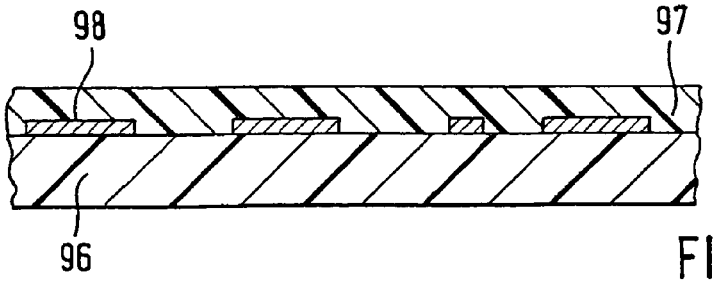
Figure 18:
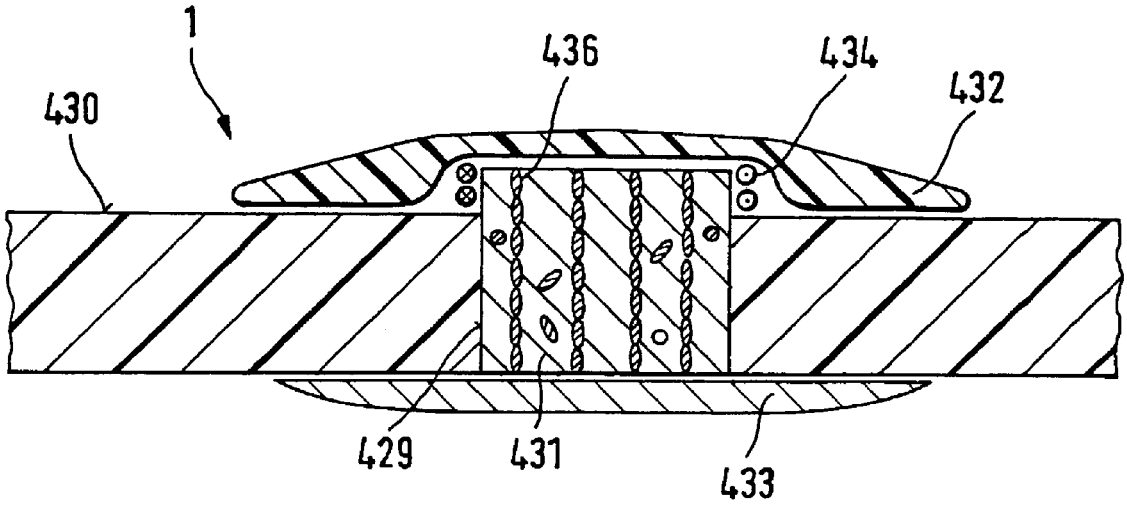
Figure 19:
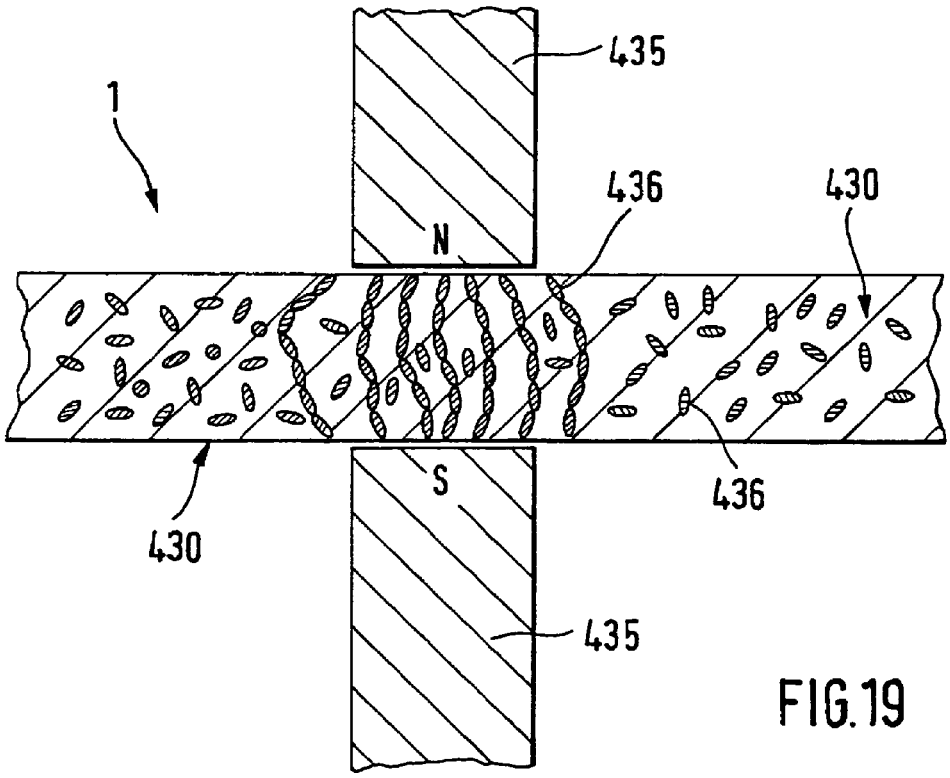
Figure 20:
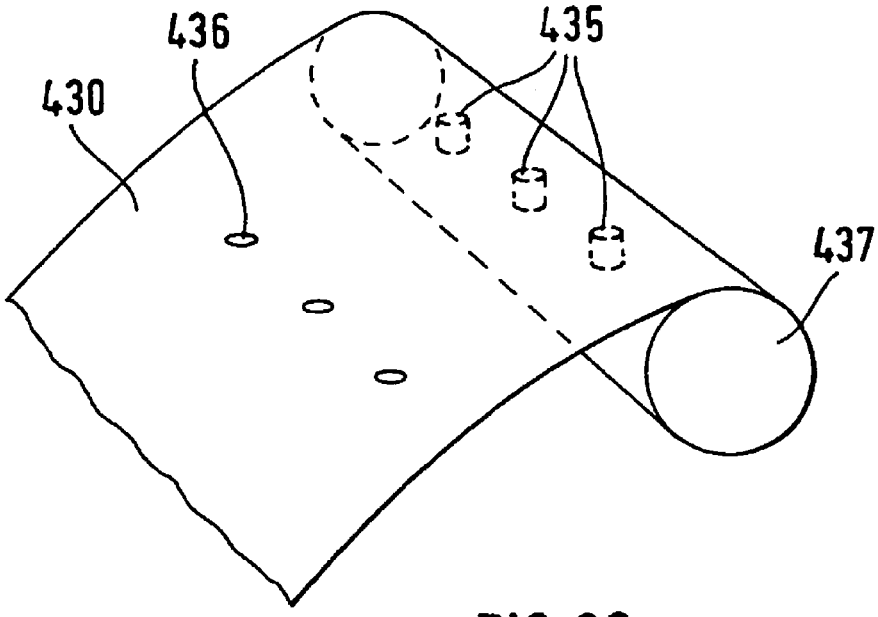
Figure 21:
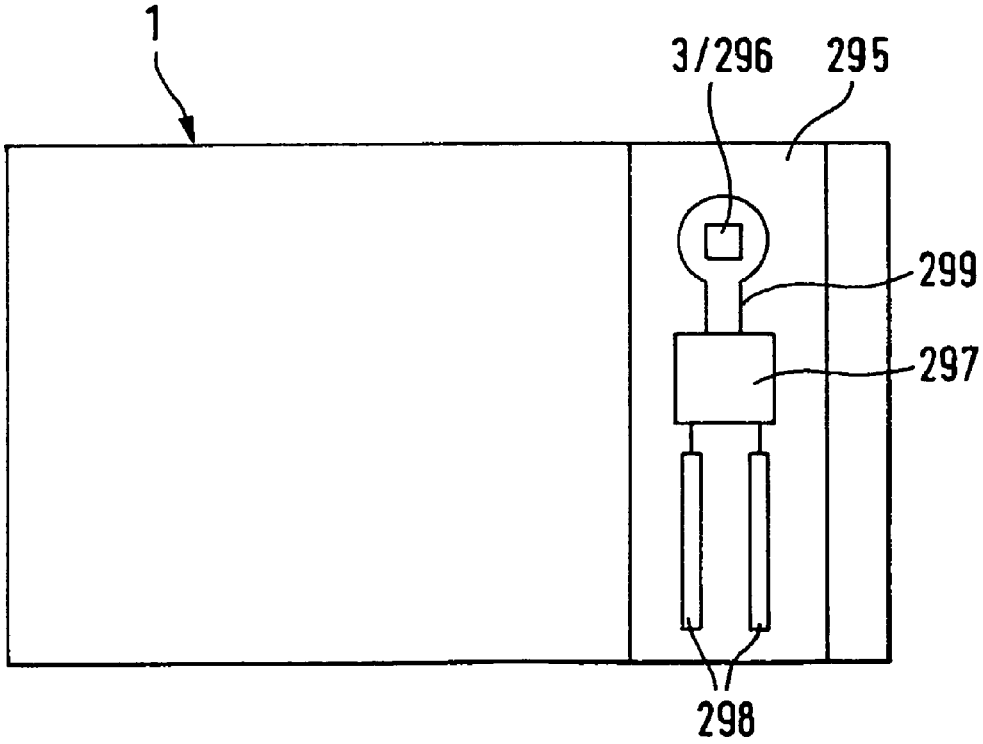
Figure 29:
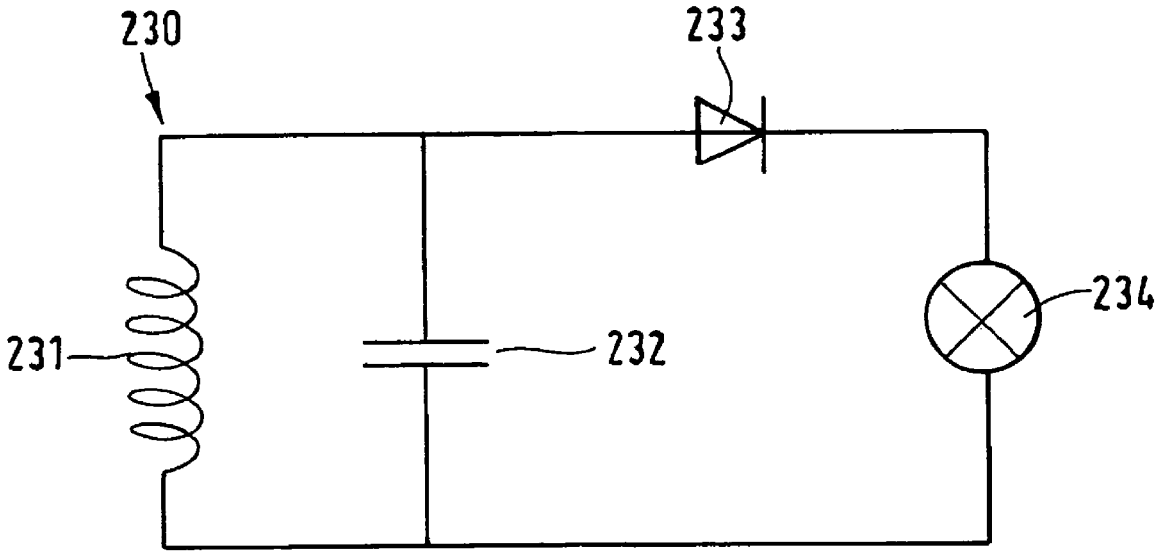
Figure 32:
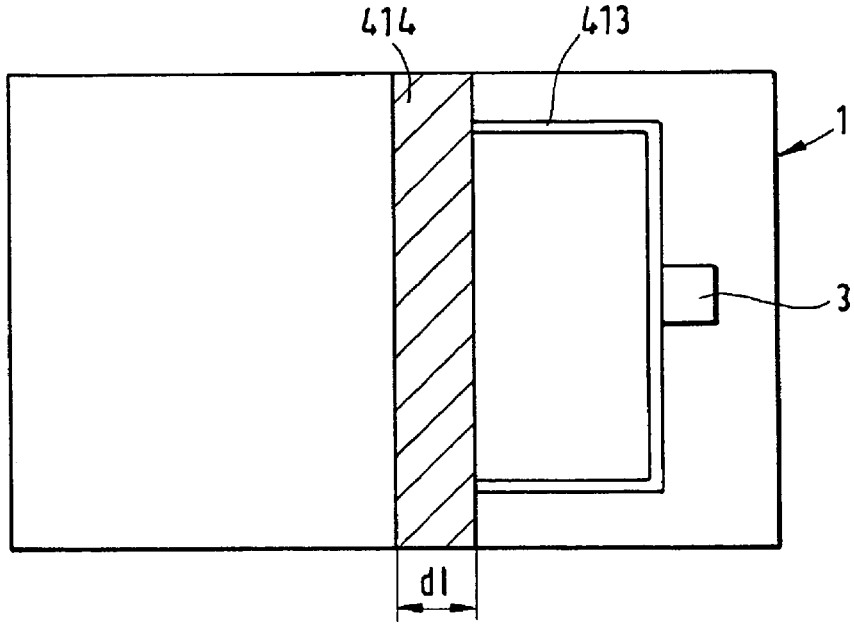
Figure 33:
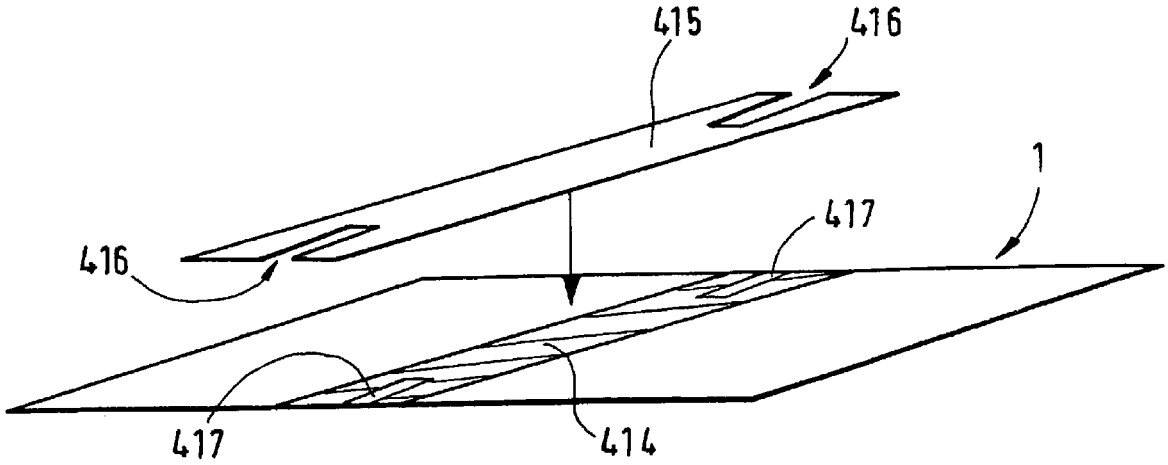
Figure 34:
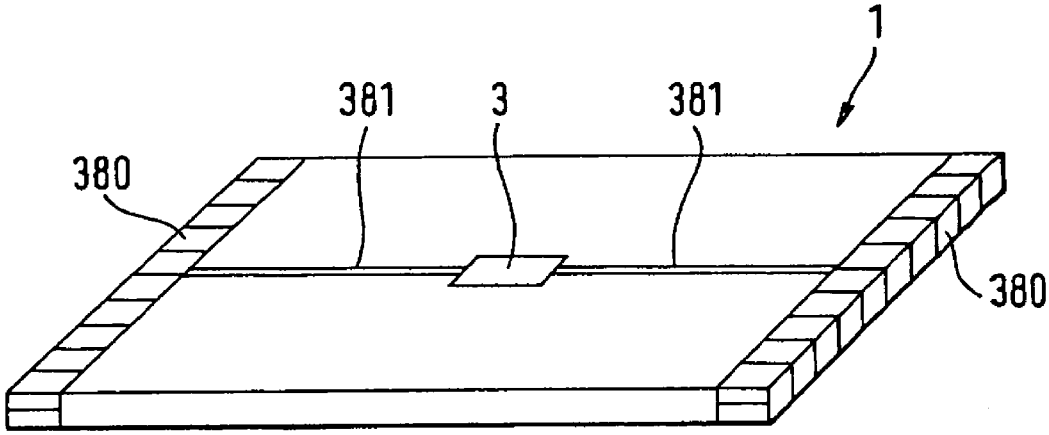
Figure 35:
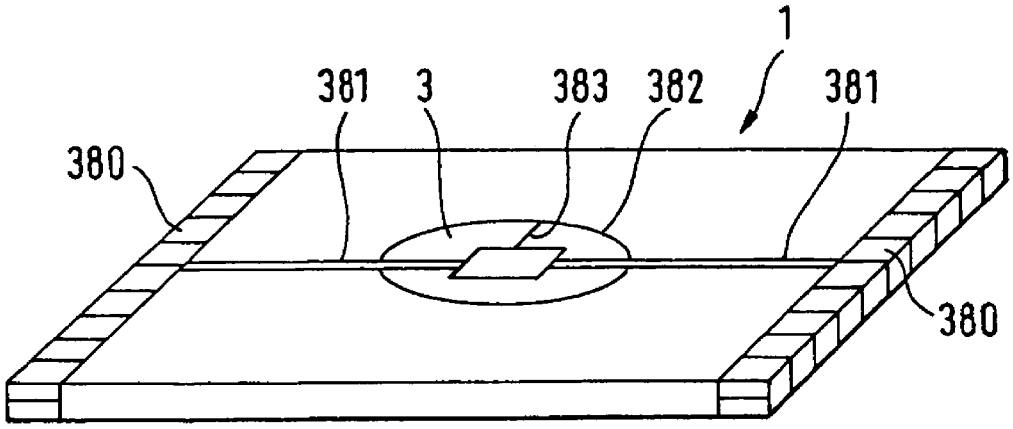
Figure 38:
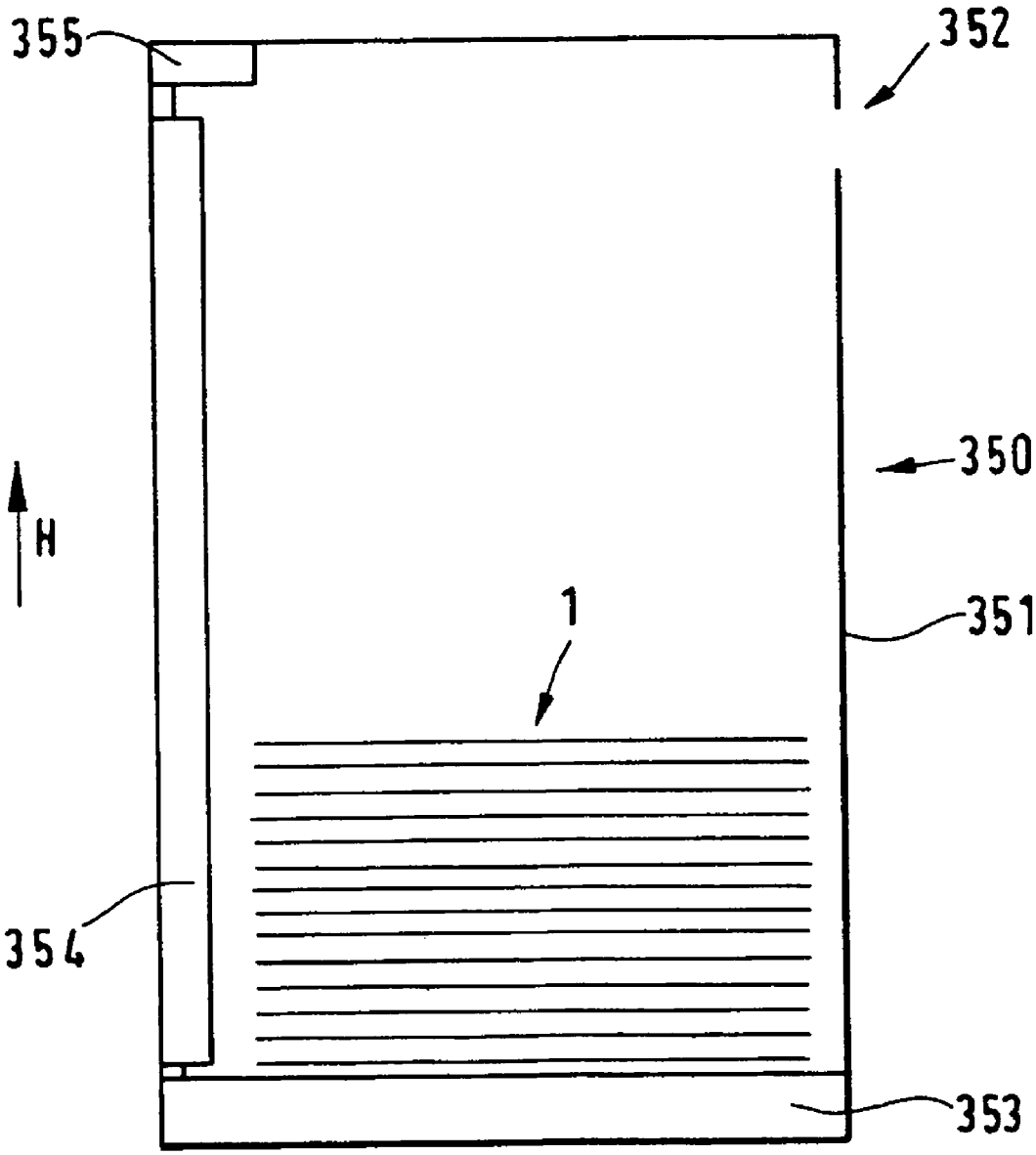
Figure 41:
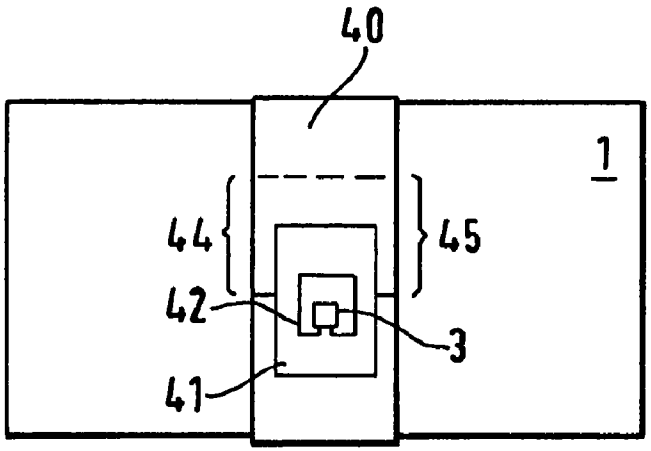
Figure 39:
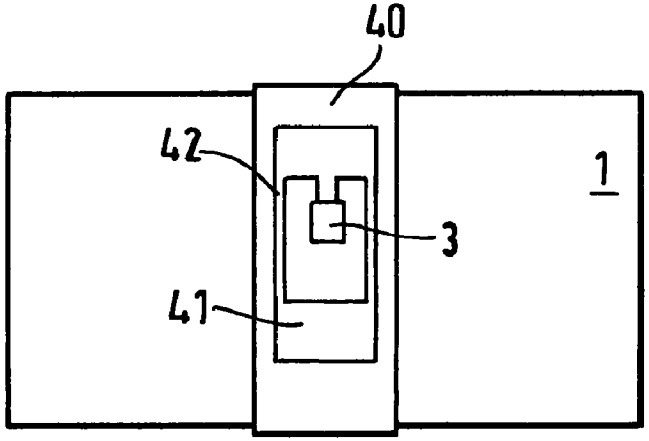
Figure 40:
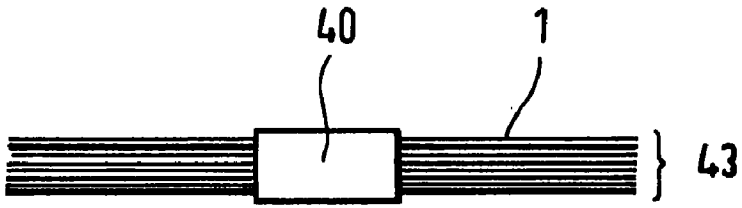
Figure 42:
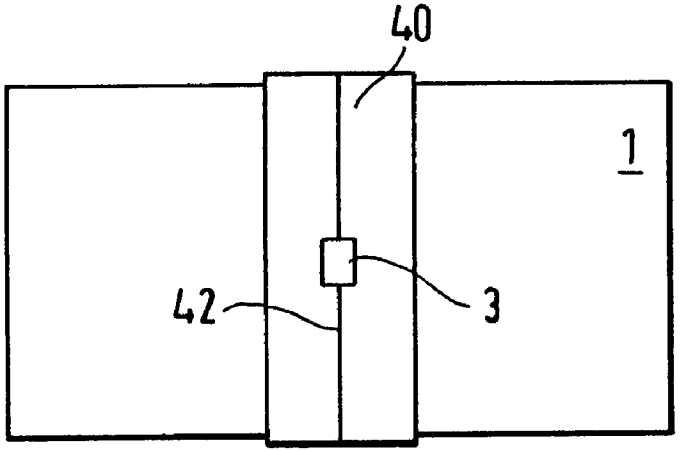
Figure 43:
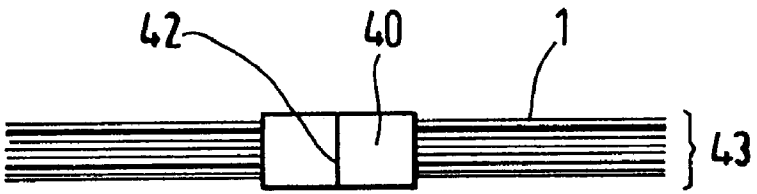
Figure 44:
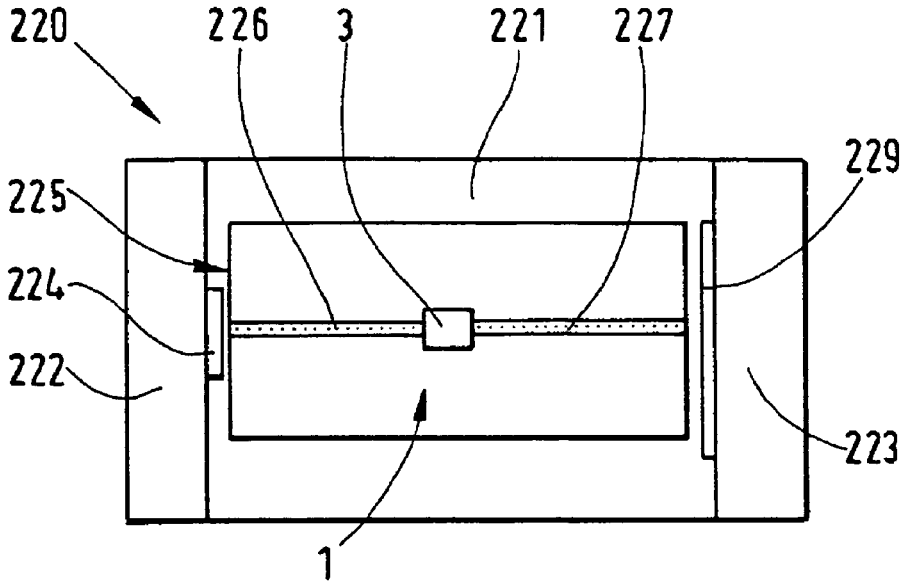
Figure 45:
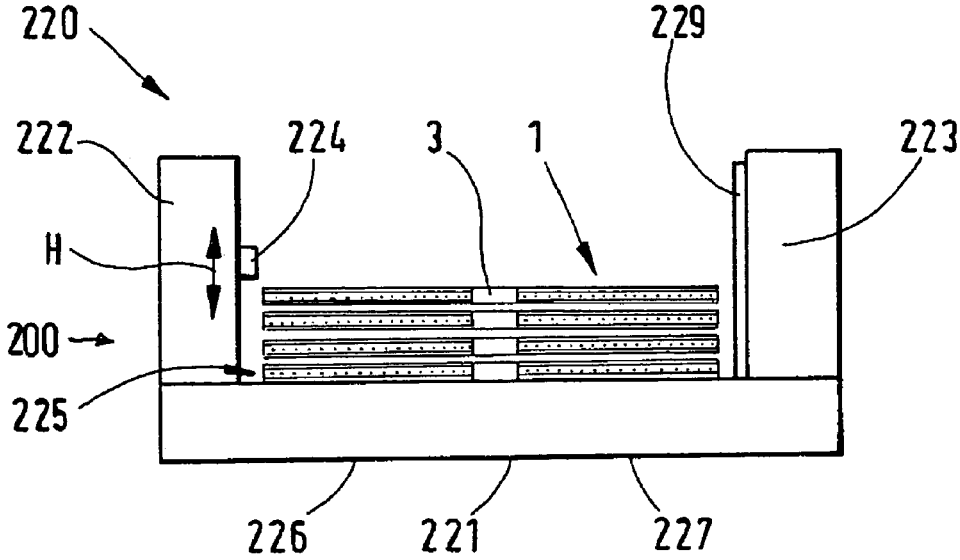
Figure 46:
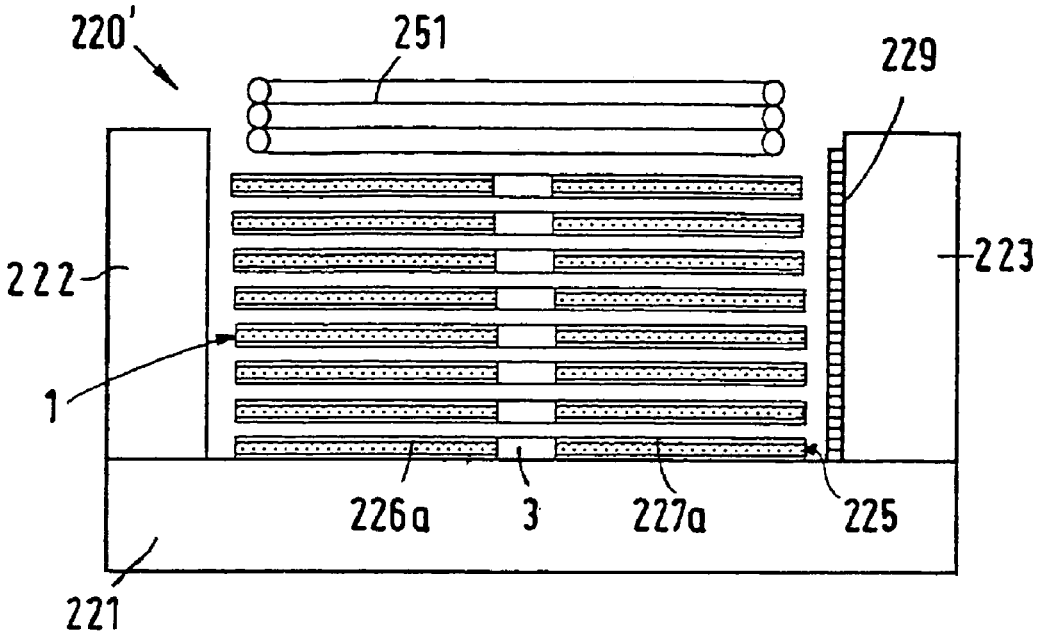
Figure 47:
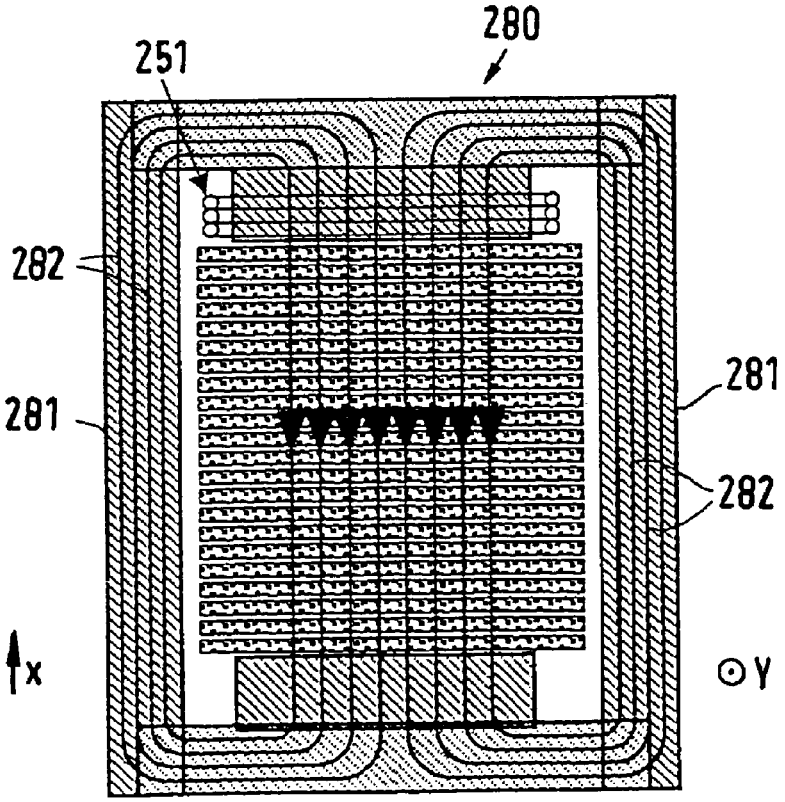
Figure 50:
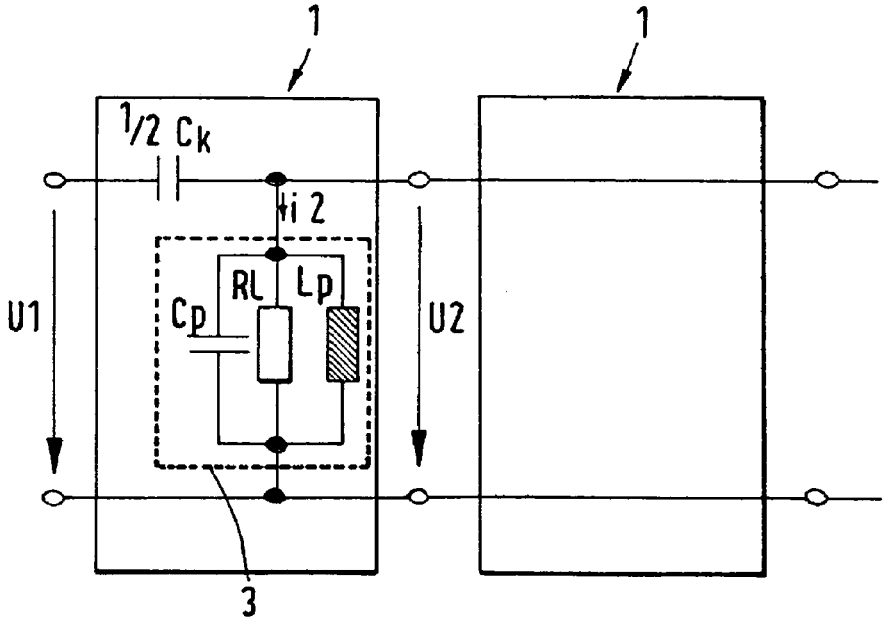
Figure 51:
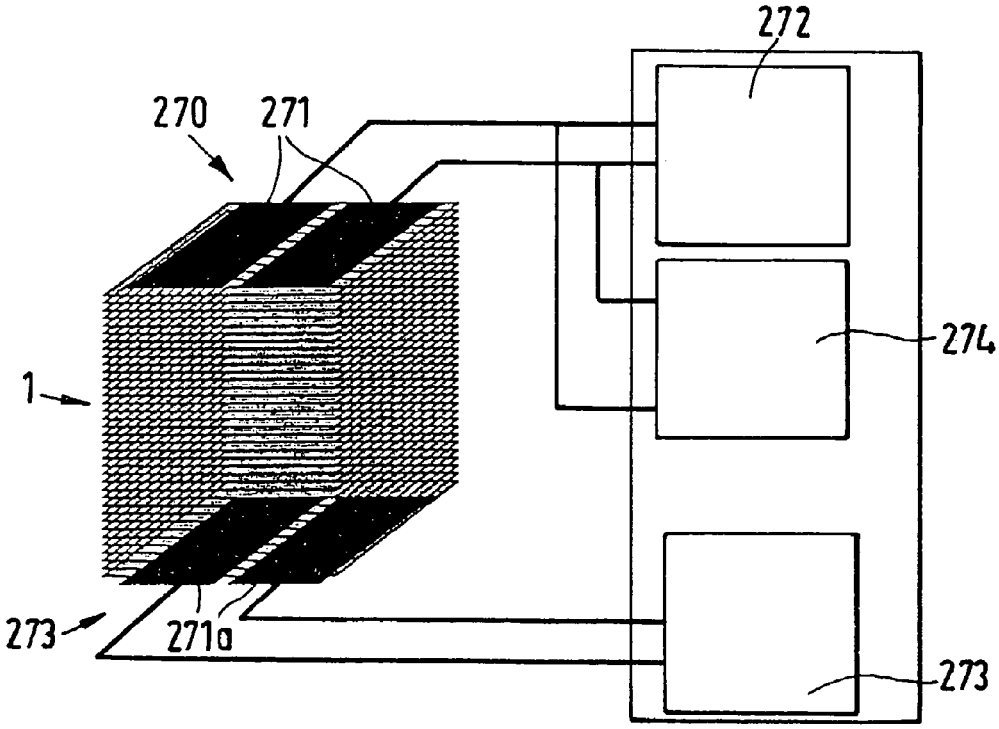
Figure 54:
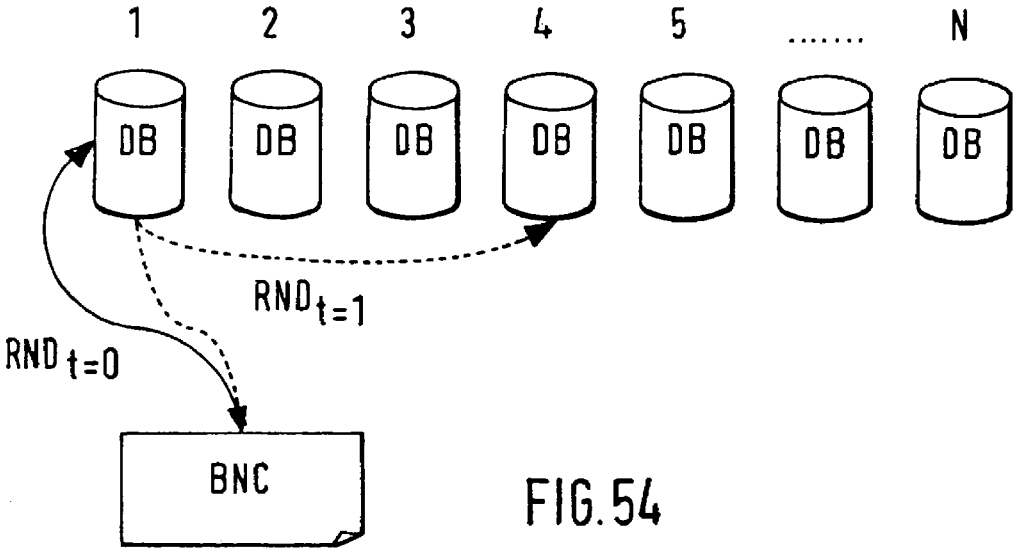
Figure 55:
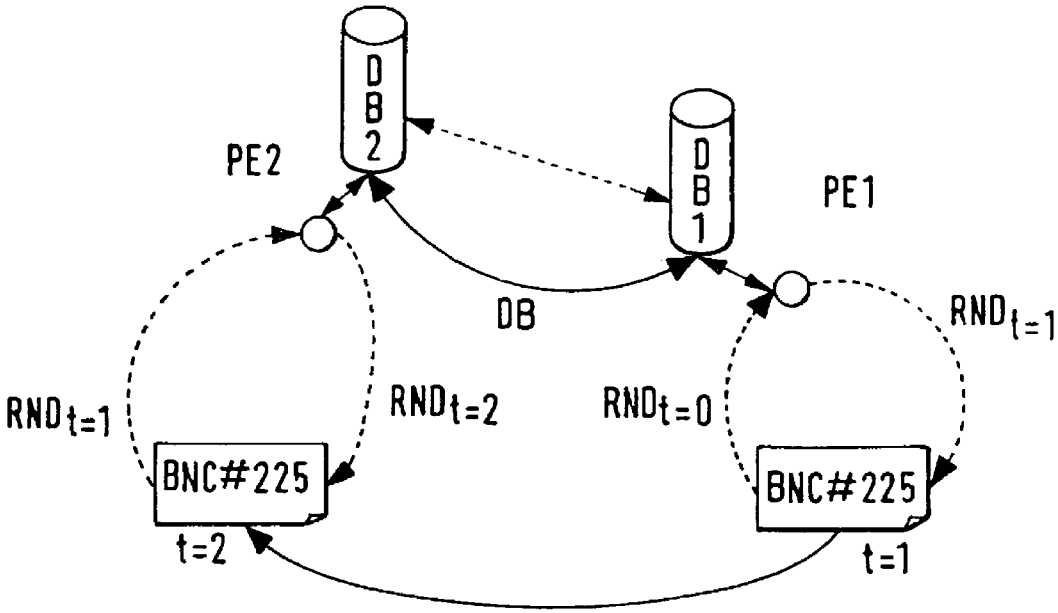
Figure 56:
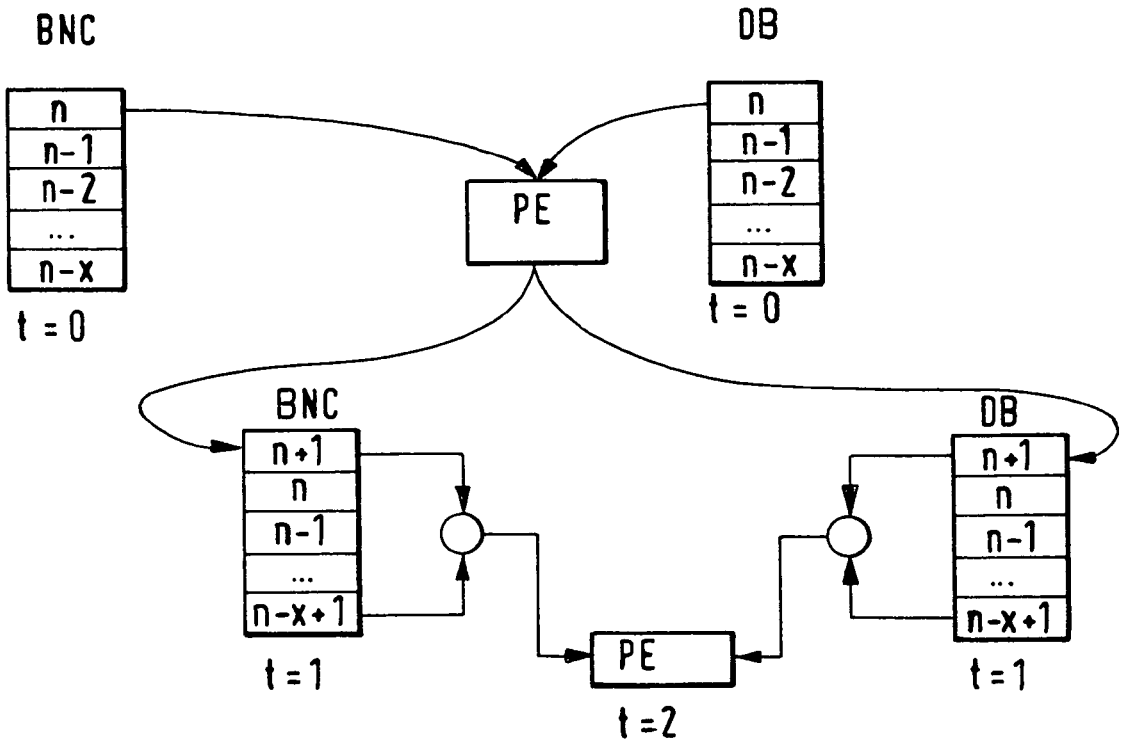
Figure 57:
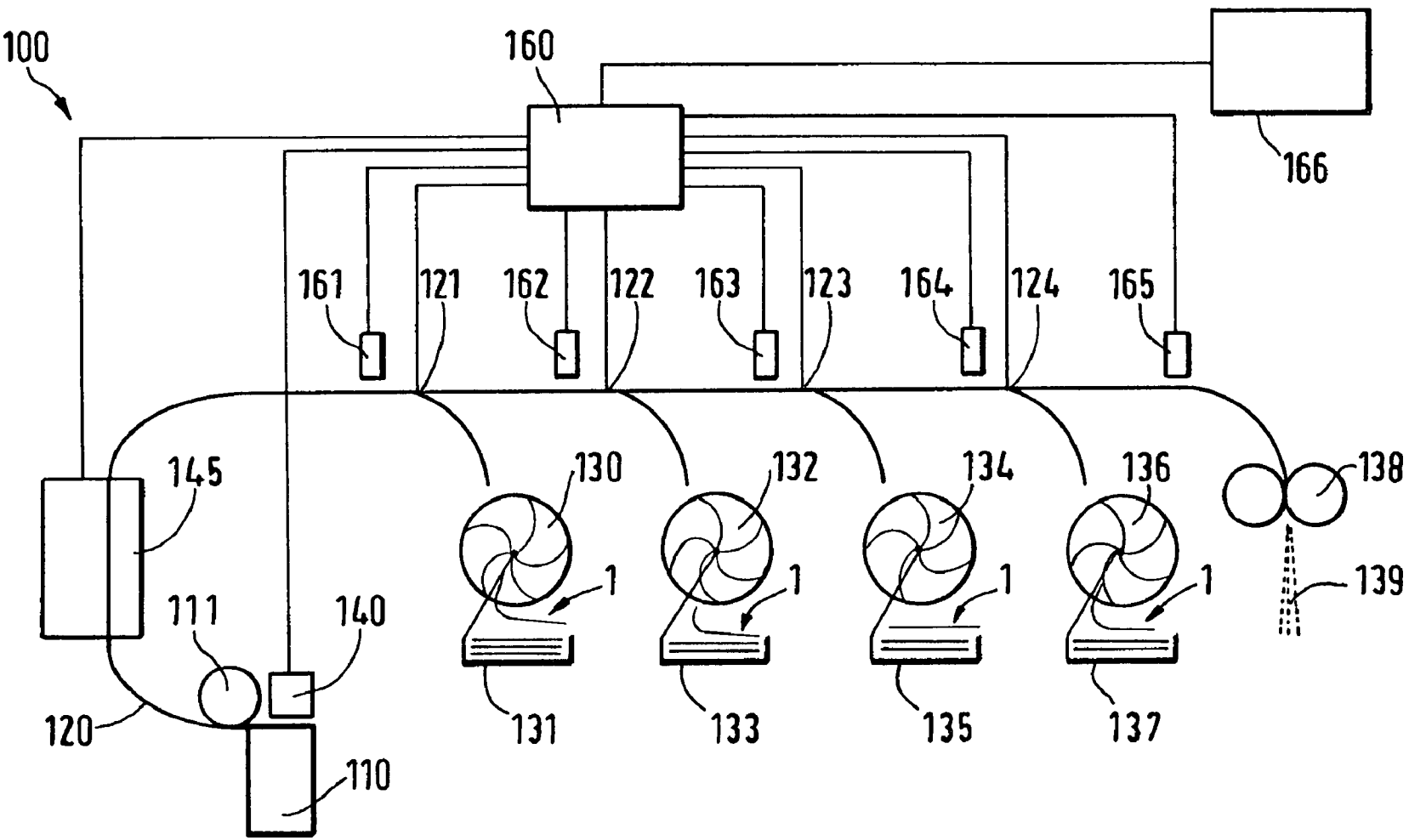
Figure 60:
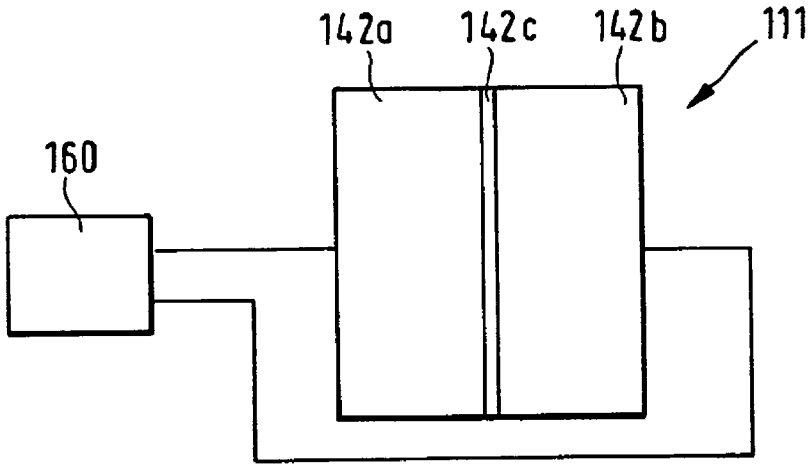
Figure 61:
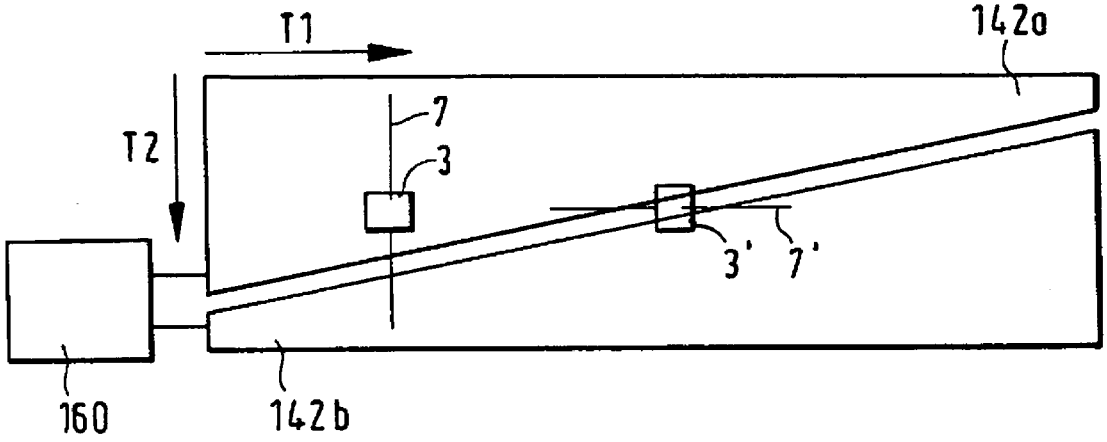
Figure 62:
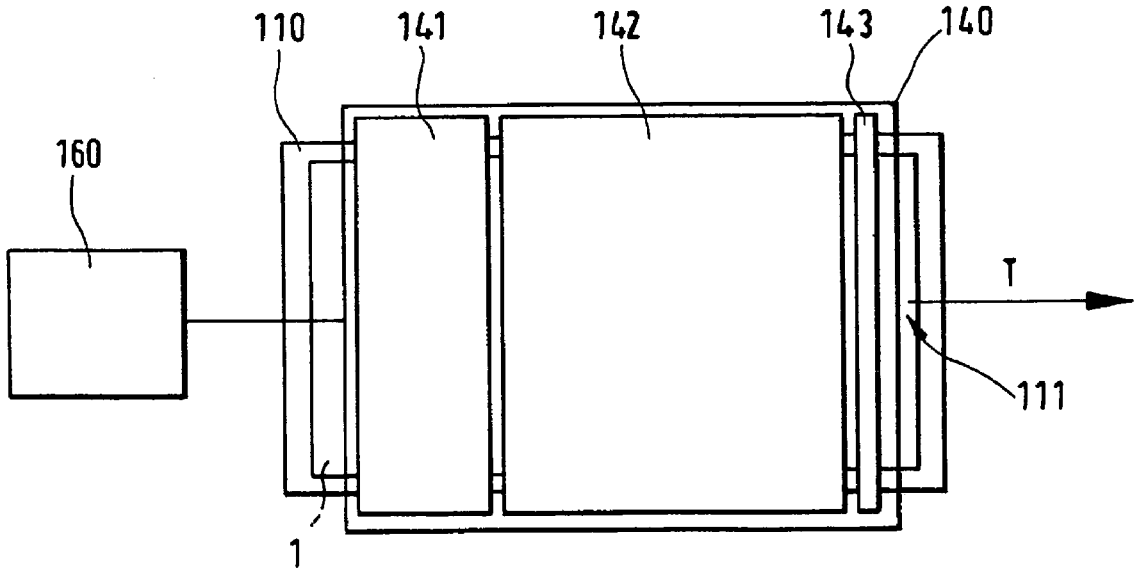
Figure 63:
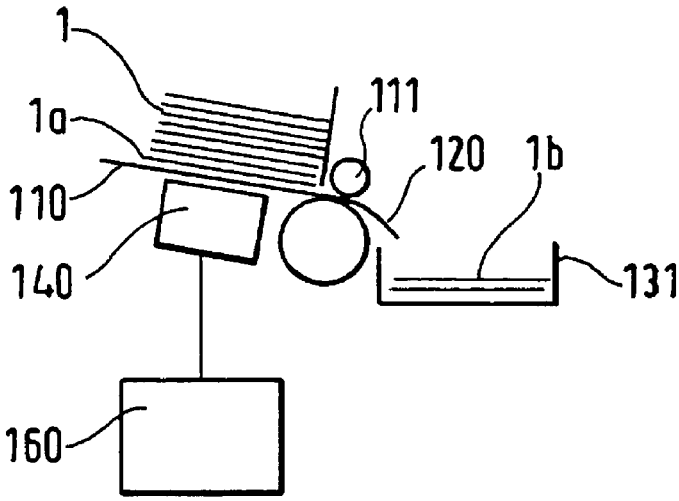
Figure 64:
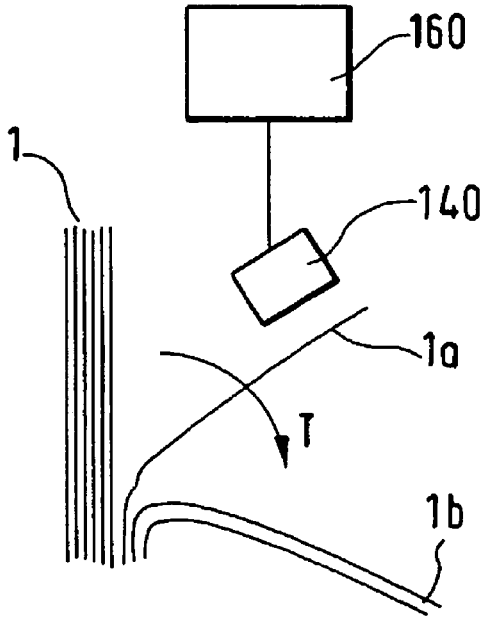
Figure 65:
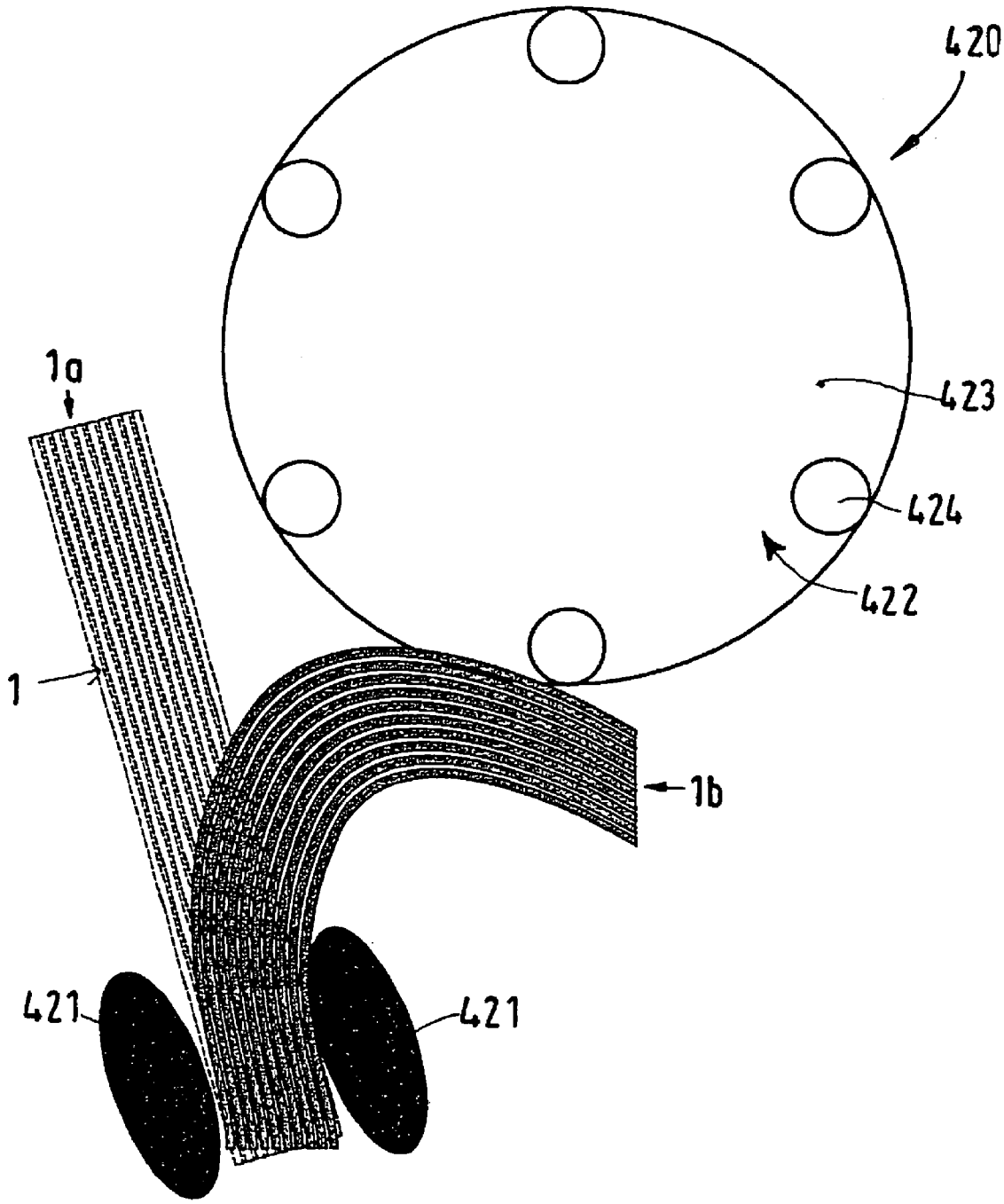
Figure 66:
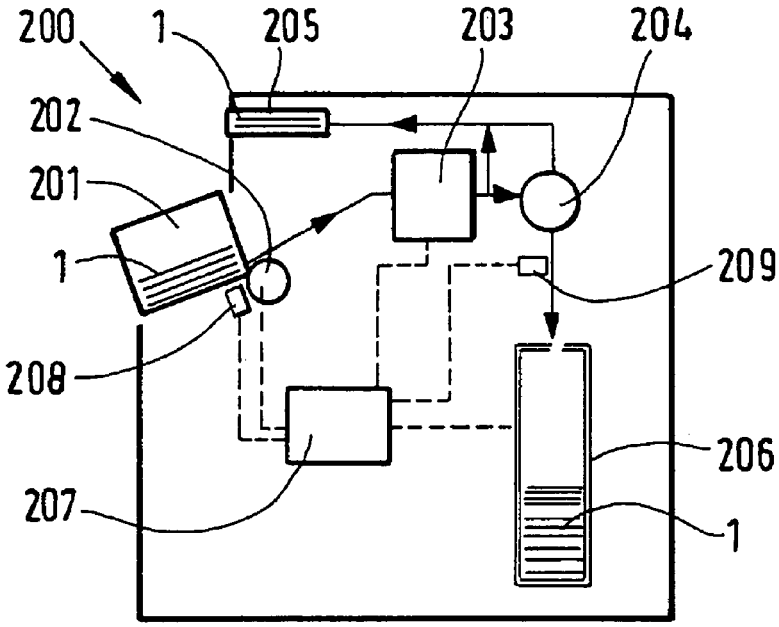

FIG. 14 Transfer of a multilayered printed circuit onto a substrate;

FIG. 15 A top view of a further embodiment of the security paper according to the invention in the form of a banknote;

FIG. 16 A top view of a further embodiment of the security paper according to the invention in the form of a banknote;

FIG. 17 A section of a banknote according to FIG. 16 along A-A;

FIG. 18 A schematic cross-section through a banknote with a ferromagnetic core;

FIG. 19 A schematic cross-section through an apparatus for the creation of locally-defined ferromagnetic areas in a paper web;

FIG. 20 A schematic view of a sieve for the creation of locally-defined ferromagnetic areas in a paper web;

FIG. 21 A schematic representation of a banknote with a chip and two antennas;

FIG. 22 A top view of a further embodiment of the security paper according to the invention in the form of a banknote with coil-on-chip technology;

FIG. 23 An embodiment of a banknote with inductive coupling elements and optical coupling elements;

FIG. 24 A schematic representation of the functional principle of a photodiode with fluorescent dyes (LISA);

FIG. 25 A schematic representation of a banknote with a LISA photodiode;

FIG. 26 A schematic representation of a further banknote with a LISA photodiode;

FIG. 27 A magnetostrictive-piezoelectric compound material;

FIG. 28 A banknote with such a magnetostrictive-piezoelectric compound material;

FIG. 29 An equivalent circuit diagram of an electrical oscillating circuit permanently integrated in the banknote paper as an electronic security element;

FIG. 30 An initial embodiment of a banknote with a capacitative coupling element;

FIG. 31 A second embodiment of a banknote with a capacitative coupling element;

FIG. 32 A top view of a further embodiment of the security paper in the form of a banknote according to the invention;

FIG. 33 A schematic perspective representation of a portion of the production method of the banknote according to FIG. 22;

FIG. 34 An embodiment of a banknote with galvanic contacts;

FIG. 35 A further embodiment of a banknote with galvanic contacts;

FIG. 36 A block circuit diagram of an inductively coupled transponder consisting of logic portion and HF interface;

FIG. 37 A schematic representation of a stack of banknotes with optical energy supply;

FIG. 38 A schematic representation of a cassette with a reading device for banknotes with a chip;

FIG. 39 An example of a small packet of banknotes enclosed by a band;

FIG. 40 A side view of the example depicted in FIG. 39;

FIG. 41 A further example of a small packet of banknotes enclosed by a band;

FIG. 42 An embodiment of the band holding the small packet of banknotes together;

FIG. 43 A side view of the example depicted in FIG. 42;

FIG. 44 An example of a stack measuring device with optical communication in top view;

FIG. 45 An example of a stack measuring device with optical communication in side view;

FIG. 46 An example of a stack measuring device with optical communication and inductive communication in side view;

FIG. 47 In schematic view, a reading device for reading out inductively coupled banknotes with magnetic paper in a stack;

FIG. 48 An example of a stack measuring device with capacitive communication in side view;

FIG. 49 An equivalent circuit diagram of a stack of banknotes according to FIG. 30;

FIG. 50 An equivalent circuit diagram of a stack of banknotes modified in comparison with FIG. 30;

FIG. 51 A further example of a stack measuring device with capacitive communication in schematic, perspective view;

FIG. 52 Two reading devices for banknotes according to FIG. 28;

FIG. 53 An alternative to the banknote according to FIG. 27 with part of an associated reading device;

FIG. 54 A schematic representation of an example of a check for duplicates with several databases;

FIG. 55 A schematic representation of a further example of a check for duplicates with several databases;

FIG. 56 A schematic representation of yet another example of a check for duplicates with several databases;

FIG. 57 An initial embodiment of a banknote processing machine, for sorting banknotes in particular;

FIG. 58 Embodiments of banknotes with an electrical circuit and antenna;

FIG. 59 An initial embodiment of a data exchange device for a banknote processing machine according to the invention, for processing banknotes with an electrical circuit;

FIG. 60 A second embodiment of a data exchange device for a banknote processing machine according to the invention, for processing banknotes with an electrical circuit;

FIG. 61 A third embodiment of a data exchange device for a banknote processing machine according to the invention, for processing banknotes with an electrical circuit;

FIG. 62 An embodiment of an input unit for banknotes used with a banknote processing machine according to the invention;

FIG. 63 A second embodiment of a banknote processing machine, for counting and/or evaluating banknotes in particular;

FIG. 64 A third embodiment of a banknote processing machine, for counting and/or evaluating banknotes in particular;

FIG. 65 A schematic representation of an example of a spindle counter for banknotes;

FIG. 66 An example of a money-deposit machine; and

Figure 67:
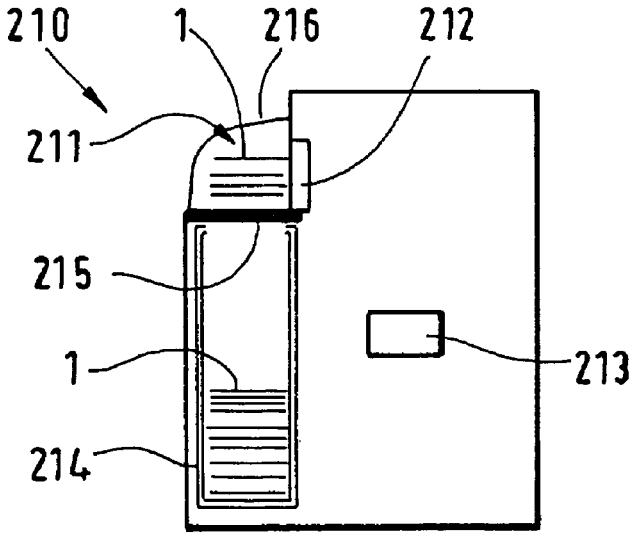

FIG. 67 A further example of a money depositing machine.

Although the present invention relates to sheet material of any kind and can also be used e.g. for sheet-shaped documents of value, such as checks or tickets, it is particularly advantageous for banknotes. That is why the special problems associated with banknotes and the processing of such banknotes are dealt with in particular in the following.

The idea according to the invention, as it can be realized in the embodiments referred to in the above and further described in the following, permits substantial improvement and reorganization of procedures in the entire money cycle as well as the banknote processing apparatuses used therein.

Therefore, the various embodiments of the invention can best be explained and understood with reference to their particular significance in the money cycle as shown by means of its fundamental characteristics in FIG. 1.

The Money Cycle

When paper is produced in a paper mill 20, security paper that is suitable for banknotes is produced and provided with security features such as watermarks and/or security threads. The security paper is printed with security ink during subsequent banknote printing at the banknote printing works 21 and provided with additional security features if necessary.

After banknote printing 22 and other potential production steps, the banknotes are subjected to quality assurance 23, during which their quality is checked. Faulty banknotes or banknotes that do not meet certain quality standards or only do so partially are generally destroyed immediately by being fed into a destruction device 24, a shredder in particular.

The completed and checked banknotes are brought into circulation by a central bank 25, with the bank delivering them to individual commercial banks where the banknotes are either passed on to customers 34 directly at a cash counter 35 at the bank or via a money dispensing machine 27.

In shops 30, the individual customers' 34 banknotes presented during payment are placed in a portable cash register 33, or they can be placed into an automatic money input device 32 that checks the banknotes that are deposited, recognizes their particular denominations and totals them if necessary. At least part of the cash obtained is then returned to the commercial banks 26, where it is credited to the particular shop's account 30. The banknotes can be deposited directly at the counter 35 or they can be deposited into a cash deposit machine 28. Combined money depositing and money dispensing machines 29, so-called recyclers, which commercial bank customers can use both for depositing and dispensing cash, are intended for smaller amounts in particular.

The banknotes deposited at a commercial bank 26 are generally returned to the central bank 25 where automatic banknote processing machines 31 are used to check them for authenticity and further fitness for circulation in particular, which depends on the banknotes' degree of wear and soiling. Unfit banknotes that are no longer fit for circulation are fed into a destruction device 24, in particular a shredder, whereas banknotes rated authentic and still fit for circulation can be distributed to the commercial banks 26 again and recirculated.

In the following, a number of examples are described in more detail, and the diverse aspects of the present invention are illustrated at different stages of the money cycle by way of example.

The production and design of a banknote with an electrical circuit

When paper is produced at the paper mill 20 or when banknotes are produced at the banknote printing works 21, the security paper is provided with an electrical circuit e.g. an integrated circuit.

When paper is produced at the paper mill 20, the integrated circuit can already be embedded in the security paper or applied to same. At the banknote printing works, the circuit is not applied to the banknote or incorporated into same, as the case may be, until the security paper is processed further. This can preferentially be effected by mixing it in with the printing ink during the printing operation and transferring it onto the document with same. Alternatively, the circuit is prepared on or in a carrier layer that is applied to the banknote or incorporated into same, as the case may be. Likewise, several electrical circuits can be produced both at the paper mill 20 and at the banknote printing works 21, or the production of one or more electrical circuits can be divided up between the paper mill 20 and the banknote printing works 21.

Advantageously, the electrical circuit is produced by printing technology on the base layer, i.e. on the security paper or carrier layer, as the case may be, with two of the production steps that are normally performed separately, namely production of the circuit and subsequent application of same onto a base layer, being combined in a single step. Altogether, this procedure significantly reduces production costs. Moreover, the electrical circuit printed on the security paper or the carrier layer, as the case may be, can only be removed from the finished banknote with great difficulty, or potentially only self-destructively, so that any further use for purposes of manipulation is made significantly more difficult or impossible, as the case may be.

Advantageously, the position of the electrical circuit varies slightly in every document at least, in banknotes in particular, so that the electrical circuits do not end up lying directly above one other when the documents are stacked, thereby preventing both a thickening of the stack in the region of the electrical circuits, as well as a reciprocal high-frequency-based disturbance of the individual circuits in the stack.

The sheet material as security paper according to the invention preferentially consists of paper in the narrower sense, i.e. out of cotton or cellulose fibers. However, it can principally also be produced from any other kind of material containing natural fibers and/or synthetic fibers. Furthermore, the security paper can be comprised of one or more plastic foils that can optionally form a bond with a layer of the security paper consisting of fibers.

Here, the electrical circuit within the meaning of the invention can comprise only a single electrical module in the simplest case or a complex electrical circuit, in particular, an integrated circuit, that comprises a few or many electrical modules. All known passive modules such as resistors, capacitors and semiconductor diodes, or active modules such as transistors and thyristors, as well as transducers, such as photodiodes and light-emitting diodes, are principally suitable as electrical modules.

Preferentially used integrated circuits, so-called chips, have typical dimensions of less than 1 millimeter×1 millimeter at thicknesses of between 20 and 100 microns and exhibit at least one memory for storing data among other things. However, smaller chips with an edge length of 0.3 millimeters and a thickness of less than 20 microns, for example, can also be used. The memories that are typically used can be RAM, ROM, PROM, FRAM, MRAM, EPROM, EEPROM or FIFO memories. Additionally, the circuit can be provided with a processing unit, a microprocessor in particular, for processing data.

For certain applications, it is advantageous for the memories in the integrated circuit to be designed as nonvolatile and writable memories, PROM, EPROM and/or EEPROM in particular, with several separate memory areas that are writable during circulation of the banknote. The individual memory areas can be provided with different access privileges for writing and/or reading operations so that certain actions may only be allowed for certain people or devices.

At least one memory area can also be configured such that several different groups of persons or entities such as commercial banks 26, money dispensing machines 27, money depositing machines 28, combined input and output machines 29, automatic money input devices 32, cash center and/or individual customers 34, have access to the memory area. Here, the memory in the circuit is segmented such that the individual memory areas remain reserved for the particular groups of persons, even if no data has yet been written to it.

The memory of the circuit preferentially comprises an authentication system that contains data on different access authorizations for reading and/or modifying the contents of the memory.

Preferentially, information is registered in the memory indicating by whom, when, where or by means of which apparatus or device, as the case may be, data were written into and/or read from the memory.

If there is a relatively high risk of the chips being damaged and not functioning as a result during one of the possible incorporation procedures, several chips may also be incorporated. Following completion of the document, the chips may be checked for operability, and surplus chips may be removed or deactivated, as the case may be. If the chips are introduced into the document in an uncontrolled fashion, e.g. if they are added to the paper pulp and each document is equipped with a statistically fluctuating number of chips, the number of chips actually present in the document can be determined and potentially verifiably documented.

Finally, stored data and/or the result of the processing of data may be used when the particular security paper's authenticity, life history or intended use is being checked, for example. In this context, the life history may comprise data on production, such as individual production steps, and/or the circulation of the sheet material, data on a prior processing operation, such as prior test results and/or data on a subsequent processing operation, such as on the issuance of the sheet material from the processing apparatus and/or the transport of the sheet material.

As the chips used according to the invention are very small, there is a risk of a chip being removed from an authentic document, e.g. by being punched out, and then being inserted into a forged document as an authentic chip. In order to avoid this, it can be expedient to remove individual functions from the chip and to place them on or in the remaining surface of the document in the form of electric components distributed over a large surface. In this case, the total unit, i.e. the circuit plus additional components, preferentially takes up a surface of 5 to 95% of the document, with 50 to 90% or 70 to 90% being particularly preferred. This information can refer to the entire surface of the circuits and/or also e.g. to the size of the region of the banknote surface that is enclosed by the unit such as its coil. Distribution over a large surface has the big advantage that it prevents forged documents made by cutting banknotes up and putting them together again in a slightly shorter form, by e.g. putting 20 original banknotes back together as 21 slightly smaller banknotes.

In this context, circuit distribution over a large surface may in principle constitute an operable circuit that can be addressed inductively, capacitively or also by direct contacting.

The production of large-surface circuits is facilitated by the fact that, in terms of printing technology, components like transistors, diodes, etc. can also be produced by means of conducting polymers or conductive polymers, as the case may be, or on the basis of thin amorphous or polycrystalline silicon layers ($\alpha$-Si, p-Si).

In principle, it is also conceivable to represent the entire circuit with the aid of conductive polymers. Since the polymers are usually imprinted, it may be necessary to smooth out the rough subsurface of the security paper when the security paper is printed on directly or, as the case may be, when a separately prepared printed circuit is transferred. This can occur by means of calendering, painting or by applying a primer coat on the corresponding surface. However, measures of that kind can also be used advantageously with other embodiments of the document according to the invention.

In order to be able to also produce circuits with very fine structures, such as transistor gates, by means of typographical methods, it may be advantageous to suitably engrave the region of the circuits by means of typographical methods such as steel gravure printing. This can either be performed prior to application of the organic polymer components of the circuit (pre-processing) or subsequent to the application (post-processing). With this method, one attains less stringent demands on the precision of the printing process and is thus less dependent on tolerances of the application technology.

Likewise, the densely packed circuits of the silicon technology can be divided into functional units and then connected to one another via suitable lines, possibly by including simple logical elements, such as amplifiers, signal shapers or antennas. Here, both the lines and the additional elements may be produced with the aid of polymer technology. Therefore, when using this solution, a fully integrated circuit is no longer designed, but rather functional units with different tasks. Accordingly, a RAM memory element, a CPU element, a ROM memory, driver elements for the peripheral devices, sensory elements for the input of parameters, etc. might each be realized on an individual piece of silicon, for example, and the elements subsequently connected to one another. This method makes it possible to produce standard units that can be combined with another, thereby obviating the costly constant development of new chips.

For certain applications, it is advantageous to provide transmission devices such as optical transmission devices, via which data and/or energy can be exchanged with the circuit. Among others, this solution achieves the advantage that an additional or alternative form of transmission besides the typically used transmission of data and energy via high-frequency fields can be created. For example, energy can be supplied via high-frequency fields, while the actual communication, i.e. the exchange of data or information, as the case may be, takes place via the circuit, e.g. by optical means.

Concrete examples of the layer structure and the production of documents according to the invention are described in the following. The measures described in individual examples for reasons of clarity can be combined with one another at will. The examples only serve to illustrate particular individual aspects of the invention.

EXAMPLE 01

FIG. 2 shows an embodiment of the security paper according to the invention. Parts a) and b) of the figure show sectional views parallel to the plane of the security paper or perpendicular to it, as the case may be, along the A-B line.

The security paper, here a banknote 1, is provided with a circuit 3 applied to a carrier layer 10. Circuit 3—only shown schematically in the form of a square—may be a circuit consisting of discrete modules or an integrated circuit, for example. In both cases provision is made that circuit 3 is addressable from the outside, i.e. information can be transmitted to circuit 3 from the outside or circuit 3 can transmit information to the outside, such as, for example, to a corresponding reader.

Transmission devices are provided for such information exchange. In some preferred embodiments, the transmission devices are in the form of antennas, e.g. coils or dipolar antennas, via which energy and/or data may be transmitted.

In the example shown, the transmission devices allow optical data transmission. Circuit 3 is equipped with an optical transmitter 4, in particular a light-emitting diode, such as a thin-film light-emitting diode (OLED or the like), and an optical receiver 5, in particular a photodiode, for this purpose. A photodiode element 6 is coupled to optical transmitter 4 or receiver 5, as the case may be, in each case. Photodiode elements 6 direct the light produced by optical transmitter 4 to the edge of banknote 1 or, as the case may be, guide the light irradiated into the area of the edge of banknote 1 to optical receiver 5.

The exchange of information e.g. takes place such that the spectral composition of the light that is emitted or received, as the case may be, depends on the data to be transmitted. Preferentially, the time course, in particular pulse duration, pulse magnitude, pulse separation and/or pulse sequence of the light signals emitted or received, as the case may be, may also depend on the data to be transmitted.

In the simplest case, transmission devices 4, 5 and 6 only act as an "optical switch" which, upon reception of an external light signal, switches the circuit on or enables it and/or emits a certain light signal for a certain operational state of the circuit. Further details on the possible transmission methods are described in more detail in the following.

Suitable glass fibers or plastic fibers that are applied to carrier layer 10 may be used as photodiode elements 6. Alternatively, photodiode elements 6 may also be produced on carrier layer 10 by printing technology in analogy to circuit 3, for example, by applying a suitable transparent plastic by means of a printing method such as screen printing.

Optical transmitter 4 or optical receiver 5, as the case may be, may also be produced by printing technology, in particular by using semiconductive and/or light-emitting organic compounds, e.g. corresponding polymers, or by applying thin amorphous or polycrystalline silicon layers ($\alpha$-Si, p-Si).

As may be seen in FIG. 2*b*, circuit 3 including transmission devices 4, 5 and 6 is applied to carrier layer 10. Application of carrier layer 10 to banknote 1 is preferentially effected by bonding, for which purpose adhesive layer 12 is provided between carrier layer 10 on the one side and banknote 1 on the other side.

It is also possible to produce circuit 3 including transmission devices 4, 5 and 6, which are also referred to as coupling devices or coupling elements, as the case may be, directly on a banknote 1 by printing technology or to place same in the banknote 1 between two partial layers (not shown).

A cover layer 11 that, in particular, protects circuit 3 against manipulation, moisture and/or soiling may be provided additionally in the area of circuit 3 and/or transmission devices 4, 5 and 6. Cover layer 11 and/or carrier layer 10 are preferentially designed as security elements that produce a desired optical effect. Here, carrier layer 10 or cover layer 11 itself, as the case may be, may even be constructed with several individual layers that, for example, also produce a holographic effect. Photodiode element 6 may also be formed directly by cover layer 11.

Alternatively or in addition to the foregoing, carrier layer 10 and/or cover layer 11 contain special pigments that produce an optically variable effect. Liquid crystal pigments or other pigments that, for example, make use of interference effects may preferentially be used for this purpose. In this fashion, additional security features are applied to banknote 1 in addition to the electrical circuit, thereby further improving its resistance to forgery and tampering.

As already explained above, an exchange of optical data and/or energy with circuit 3 may be combined with an exchange of data and/or energy via a high-frequency field. In this case, corresponding transmission devices, in particular dipolar antennas or coil-like antennas (not shown) are provided in addition to optical transmission devices 4 to 6.

It is also possible to supply circuit 3 with energy by means of photovoltaic devices, in particular one or more solar cells, or paper batteries or piezoelectric elements in or on the banknote paper, which e.g. induce electrical voltage when compressing that may be used to supply energy. This may already be used to operate the circuit through the presence of natural light or artificial light, as the case may be, such that further and potentially expensive apparatuses for supplying energy may be eliminated.

EXAMPLE 02

According to a further embodiment, a small, thin chip having an edge, length of approx. 0.3 millimeters and a thickness of less than 80 microns, particularly less than 20 microns, may be arranged on a security thread. Such security thread is, at least partially, completely embedded in the security paper. FIG. 3 shows an embodiment of a banknote wherein the security thread 50 is more or less woven into the security paper and comes directly to the surface of banknote 1 in certain areas called "windows" 51. The parts of the security thread that are completely surrounded by security paper are shown by dashed lines in FIG. 3. Here, security thread 50 may have an electroconductive coating that is designed as a dipole and serves in the chip's transmission of energy and/or data. As a security thread of this kind is practically impossible to separate from the security paper without destroying same, the chip is well protected from abusive removal in this embodiment.

A further protective effect may be achieved via the information that is stored in the chip. It is therefore advantageous to store a so-called "unique feature" of the particular banknote in the chip's memory area as an identification criterion. In this context, the information is individual and characteristic of the particular banknote. For example, it may constitute the serial number or a parameter derived from same, or it may also constitute the x, y coordinate of the chip in the banknote. As the thread is never embedded at the same place relative to the banknote, the x, y coordinate is a good assignment criterion. Measurement is effected on the finished banknote by means of thread geometry and is stored on the chip in one of the final processing steps. The relation between the chip and the banknote may be structured even more clearly by storing further data such as the serial number in the chip in addition to the x, y coordinate.

Additional protection against manipulation or removal of the thread, as the case may be, is provided by measurement and storage of the chip's resonance frequency. Namely, should someone succeed in fully pulling the thread out of the paper, this would lead to a stretching of the thread in any case and thus to an alteration of the resonance frequency.

EXAMPLE 03

The chip or the electrical circuit, as the case may be, may also be transferred onto banknote 1 or the security paper, as the case may be, with the help of the transfer method. This type of embodiment is shown in FIG. 4. Here, the transfer element is in the shape of a strip 53 that runs parallel to the short edge of the banknote 1. In top view, one recognizes a metallic surface with recesses 54 in the shape of marks in the example shown. The integrated circuit is contained in the layer structure of this transfer element 53. Special embodiments relating to the foregoing are described in WO 02/02350, to which express reference is hereby made.

Here, transfer element 53 must be anchored so well on banknote 1 that security element 53 cannot be torn off across the whole surface. This may, for example, be achieved by having transfer element 53 so thin that mechanical stability is not sufficient to tear it off completely. Further, it must be ensured that penetration of the adhesive into the paper and durability of the adhesive are so good that no mechanical and/or chemical removal is possible. Cross-linking adhesive systems may be used for this purpose, for example. The background may be smoothed by applying a primer to the paper in the area of transfer element 53. In this case, the adhesive to be used for the transfer of transfer element 53 may be selected such that it reacts with the primer, so that chemical protection is effected by the cross-linking.

Additionally, the transfer element may be partially provided with intaglio printing, which results in strong local anchoring and deformation of transfer element 53. If an attempt is made to remove transfer element 53 mechanically, rated breakage will result in the area of the intaglio printing.

As also shown in the prior example, additional protection may be effected via measurement of the resonance frequency and storage of same in the chip. A resetting by punching out and contacting to a counterfeit coupling surface may thus be demonstrated.

Attention is drawn to the fact that transfer elements may refer to both elements such as transfer element 53 according to FIG. 4 described in the above, which serves as a security foil that is permanently affixed to the banknote paper in production, and other elements such as carrier foils 78 according to FIG. 14 that are described in more detail in the following and which are pulled off of the banknote paper after the circuits have been connected with the paper.

EXAMPLE 04

FIG. 5 shows a schematic representation of another possibility for incorporating a chip into a document.

In this example, the chip is transferred onto the banknote during the printing operation. This may occur both in the prepress stage, i.e. when the paper sheets are on the way to the press cylinder, during the printing operation or also when the printing sheets are being transported away after the printing operation. The basic idea of this procedure is to provide all of the individual copies of a printing sheet with the chips either one after the other or in a complete step. Diverse embodiments that may be used in both sheet feed printing and continuous printing are described in the following.

FIG. 5 shows an intaglio printing plate 84 with the usual depressions 85 that the printing ink is filled into in exemplary fashion. One or more of these depressions 85 is formed such that chips 87 may be incorporated into the depression. In the example shown, one of the depressions has an opening 86, through which a chip may be supplied by means of compressed air from the back of the printing plate. This may be effected before or after the depressions 85 are filled with printing ink. Preferentially, the chips are incorporated after the depressions have been filled with printing ink so that the chip comes to lie in the volume of the printing ink and is protected by it. The document material, preferentially paper, is pressed into the depressions 85 during the printing operation and the ink is transferred onto the document as a raised application of ink.

The printed document 88 is shown in FIG. 6. Chip 87 may be recognized in ink application 89, which is completely surrounded by printing ink 89.

The portrayal in FIG. 5 is only intended to illustrate the basic principle. Additional measures such as the closure of opening 86 during the printing operation, the provision of measures ensuring that precisely one chip is separated in the ink cell of the printing plate each time, cleansing of the printing plate, including the area where the chips are fed, etc. are needed when it is translated into practice. As all of the copies of a printing sheet are to be equipped with chips during the printing process, the feed device is preferentially provided in multiple form, i.e. at least once per individual copy. Chip elements 87 are preferentially provided as transponder chips, i.e. they are equipped with an antenna and all of the functional elements and are fully operable on their own with no additional measures. Prior art transponder chips, for example, already exhibit an edge length of just 0.3 millimeters at a thickness of approx. 50 microns.

When the transponders are transferred onto the banknote during the printing operation as described, this process step may be incorporated into the production process very well and, in addition, the chip is optimally camouflaged in the ink and well protected from chemical influences.

EXAMPLE 05

With the procedure cited, the possibility to readily arrange the chips in different locations per individual copy in the printing sheet presents itself. If a printing sheet has e.g. 54 individual copies, one obtains a variational potential of 54 different sites for embedding. An additional variational potential results from each additional printing line or additional printing works, as the case may be.

This proves to be especially advantageous for currencies that are issued in high piece counts and that are produced on a large number of printing lines and, potentially, at several printing works. For these currencies, the positions where chips 87 are incorporated may be varied so greatly that the likelihood of finding chips 87 arranged directly above one other in a packet of used banknotes is relatively small. Since reciprocal interference of the chips is extremely reduced, banknote packets of this type are distinctly easier to check with respect to individual banknotes 1.

EXAMPLE 06

Should the unit price of transponder chips 87 permit, one may also consider embedding more than one chip 87 in a banknote. Then, the particular positions of these chips with reference to one another may also be varied by means of printing plate arrangement, thereby making it possible to switch to the other chips in case two chips should come to lie directly on top of one another or too close to one another. That means that the chips that have the least interference or are arranged most favorably, as the case may be, may always be addressed.

EXAMPLE 07

The printing sheets or the particular individual copies of the printing sheets, as the case may be, may now be equipped with chips 87 in highly diverse ways.

As described with regard to FIG. 5, one idea consists of incorporating the chips into the printing plate through boreholes. However, this procedure is not just limited to flat printing plates. For example, when using rotary printing, the boreholes may also originate from the interior space of the cylinder, e.g. of the press cylinder, so that the chips may be transferred from the inside of the cylinder to the corresponding depressions.

EXAMPLE 08

Furthermore, it is possible to deviate from the procedure already described and already send the individual printing sheets through an insertion apparatus consisting e.g. of two cylinders that already help to affix the chips on the unprinted sheets prior to the actual printing process. FIG. 7 shows an associated rotary printing apparatus 440 from prepress stage 441 and printing stage 442 in exemplary fashion. Insertion cylinders 443 preferentially have the same diameter as press cylinder 444 and counter-pressure cylinder 445. Insertion cylinders 443 have the task of separating chips 3, transferring them to printing sheets 446 and affixing them there by means of an adhesive or the like. Subsequently, printing sheets 446 are transported into the actual printing station 442 and provided with the printed image 447, preferentially with steel gravure printing.

In prepress stage 441, chips 3 are to be arranged on the printing sheets 446 such that they may be subsequently superimposed with elements of the printed image 447. In this context, the details of the printed image are to be rendered large enough to ensure that chips 3 are reliably covered with printing ink and that they are not damaged either. The tolerances occurring during printing are to be taken into account for these measures.

Separation of chips 3 on cylinders 443 of prepress stage 441 and from these onto printed sheets 446 may either be effected through boreholes in at least one of cylinders 443 from the inside of the cylinder, or it may also be effected by additional elements that are used to apply chips 3 to the surface of the cylinder first and then transmit them to printing sheets 446 while printing sheet 446 is moved through rotating cylinders 443. The application may also be effected by means of e.g. a transfer strip with applied chips that is pressed on the surface of the cylinder for transfer of the chips.

EXAMPLE 09

Another possibility results if the press cylinders are supplied with chips from the outside via the insertion cylinder rather than through drilled holes in the press plates from the inside of the press cylinder. In this case, insertion cylinder 443 is arranged at the circumference of press cylinder 444, i.e. in printing step 442 according to FIG. 7, similar to the counter-pressure cylinder or the inking cylinder. It transfers the chips to the areas of the individual copies that are to be equipped with the chips before or after the printing plate has been inked.

The final embodiment cited makes use of several advantages of the two methods described previously. Accordingly, the chips are transferred during the printing operation, thereby achieving very effective integration in the production process of the banknotes. With this method, the chips are also positioned in the ink-containing depressions of the printing plate, preferentially in the vicinity of the surface, so that the chips are arranged in the area of the paper surface, i.e. encased in ink and well protected, following transfer to the printing sheet. As singling of the chips from the inside of the press cylinder may be quite problematic from a technical standpoint, transfer via the insertion cylinder from the outside onto the press plate is a good alternative.

EXAMPLE 10

For communication with the chips arranged in the document, it is necessary to connect them to suitable contact surfaces. This normally takes place by wirebonding, i.e. the connection is produced via thin wires, preferentially made of gold, or through flip-chip technology, with the contact surfaces of the chip being applied to the external contact surfaces in the opposite fashion and connected by means of, for example, conductive adhesive or isoplanar contacting, so-called "wedge bonding". The so-called "fluid self assembly" process, e.g. as described in U.S. Pat. No. 6,417,025 or WO 01/33621, where chips are "swept into" small depressions of a foil with the contacts facing upwards, offers an alternative technology. Contacting is subsequently effected on the upper side of the chip by means of lithographic methods. Within the scope of the invention, this technology may be used very advantageously for the production of security threads or transfer elements, as the case may be, for banknotes. However, any other desired foil elements may be equipped with a chip in this way as well.

The method according to the invention is explained using the example of the production of a security thread with a chip in the following. First, a carrier foil in endless form is provided with depressions having roughly the same size as the chip to be embedded. A carrier foil 60 is shown schematically in FIG. 8. Here, carrier foil 60 is provided with trapezoidal depressions 61 that are produced by embossing, for example. In this context, depressions 61 are distributed throughout the endless foil such that the desired number of chips is contained in the security element when the foil 60 is divided into individual security elements later on.

In the next step, the foil 60 thus prepared is flooded with a liquid containing the chips 62. In this context, the chips 62 are swept into the depressions 61 and self-orient in this way. FIG.

9 shows foil 60 after the chips 62 have been swept in. The chip exhibits contact surfaces 63 that still need to be contacted with the corresponding conductive paths on foil 60 by means of lithographic methods now. However, isoplanar contacting, so-called "wedge bonding", or contacting via ink jet methods is also feasible.

EXAMPLE 11

Instead of the contacting methods normally used for the chip 62 incorporated the way explained above—namely bonding, i.e. soldering/welding of contact wires, and contacting by lithographic methods, another technology can also be used that is likewise based on the principle of self alignment. The method avoids the relatively high demands on exact positioning or the high printing precision, as they are needed in the other methods, since the chips 62 to be used can have edge lengths of down to 1/10 mm. Beyond that, more or less continuous processing of the banknotes that are to be contacted is made possible.

For this purpose, foil 60 is provided not only with depressions 61 for chips 62, but additionally with depressions 65 that are indicated by dashed lines in FIG. 10. After that, as already explained, chips 62 are washed in first, and then contact surfaces 64. These contact surfaces 64 preferentially consist of thin metal foils. They guide the small contact surfaces 63 on washed-in chips 62 further outward and act as distinctly larger contact surfaces, the contacting by means of lithographic methods of which does not pose any problems. An especially expedient embodiment of contact surfaces 64 is shown in FIG. 11. They have a relatively thin contact wire 64A, which has a contacting surface 64*b* on one end, the surface of which is larger compared to contact surfaces 63. Large-surface contacting surface 64*b* permits low contact resistance to the conductive paths applied by printing, in spite of the relatively poorer conductivity of the conductive printing inks used.

In this context, production of the additional depressions does not lead to increased efforts for positioning, since the same tool can be used for the simultaneous production of both the depressions for chips 62 and the depressions for the contact surfaces. To ensure reliable contacting of chips 62 with the contact surfaces 64, contact surfaces 64 can be welded to chip 62 at its contact surfaces 63 with the aid of a laser, or adhesives that become conductive in the direction of the compression only after having been compressed can be used.

During preparation of contact surfaces 64, care must be taken that they are formed in such a way that they can, on the one hand, be washed in at every necessary location, but that, on the other hand, no faulty contacting can occur that is caused by contact surfaces 64 washed in wrong orientation. In FIG. 11, possible wrong positions of contact surfaces are indicated by contours 64*.

It is expressly noted that this method is not only restricted to the production of foil elements with chips for banknotes, or, as the case may be, to the banknotes having chips themselves, but rather that it can be used with any other desired process wherein chips that are fixed to a substrate must be contacted. This method especially lends itself to all electronic components incorporated into a carrier material by means of self alignment.

EXAMPLE 12

As an alternative to or in addition to the method of self alignment by washing in chips and/or contact surfaces, a self alignment method based on vibration can also be used. This means e.g. that foil 60 and/or a storage reservoir of chips 62 and/or contact surfaces 64, where foil 60 is moved past, are vibrated in order to facilitate incorporation into the depressions 61 or 65. This method can also be executed without liquid-based washing in.

EXAMPLE 13

In accordance with another variation, before the chips are washed in, a carrier foil used as a transmission element is already provided with a metallization upon which the chips are subsequently applied in a positioned fashion. This method will be explained in more detail with reference to FIG. 12A to 12*d*.

Figure 12B:
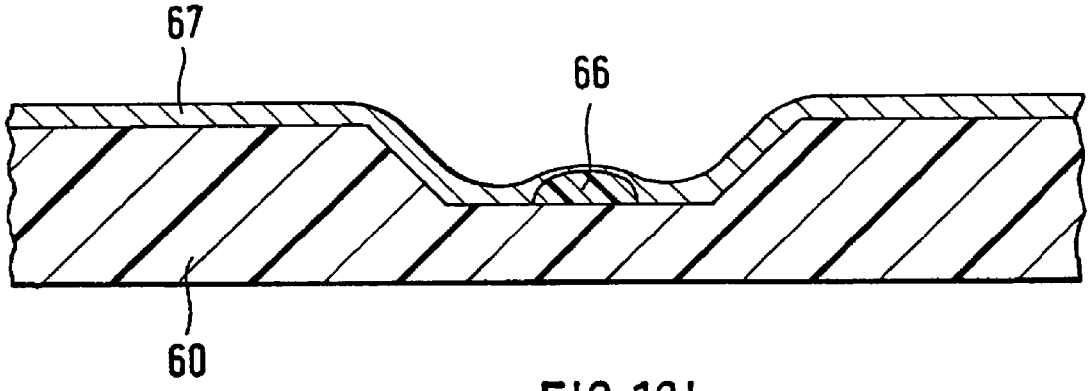
Figure 12C:
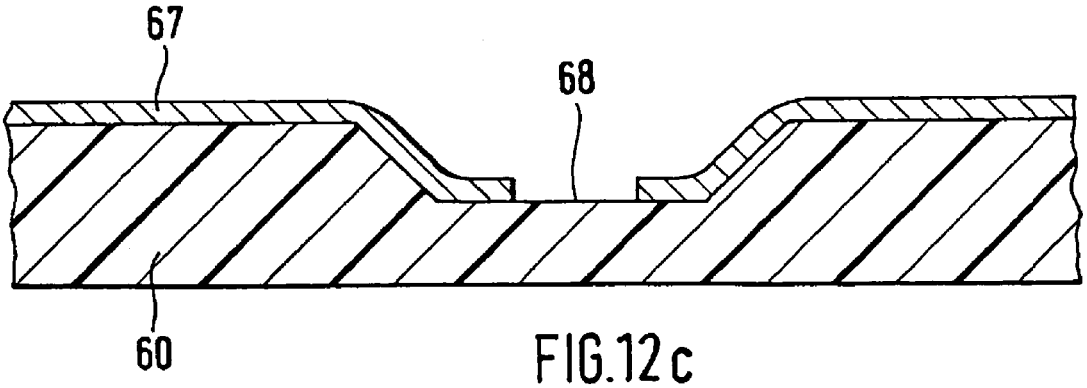

In FIG. 12A, foil 60 with depressions 61 is shown, where a printing ink 66 that is removable by washing has been printed register-containing into depressions 61. Subsequently the entire foil is metallized preferentially by means of the vacuum vapor deposition method. FIG. 12*b* shows the foil 60 metallized over its entire surface, with metal layer 67 covering both foil 60 and the soluble printing ink 66. Subsequently, the foil is treated for printing ink 66 with a solvent, preferentially water. Thereby, printing ink 66 is dissolved and removed together with the metal layer 67 lying on top of it. In this fashion, a recess 68 is created in metal layer 67, as shown in FIG. 12*c*. Subsequently, the chips 62 are washed in. In this case, the chips must be designed such that contact surfaces 63 are disposed on the surface of chip 62 that faces metallization 67. Here, the connection between metal layer 67 and the contact surfaces of chip 62 is effected, for example, by means of anisotropically conductive adhesives or so called ACF foils.

Here, the dimensioning of printing ink 66 must be selected in such a way that no short circuits between the metallized areas are possible. At the same time, the overlapping surface with the contacts of the chip must be sufficiently large.

Figure 12D:
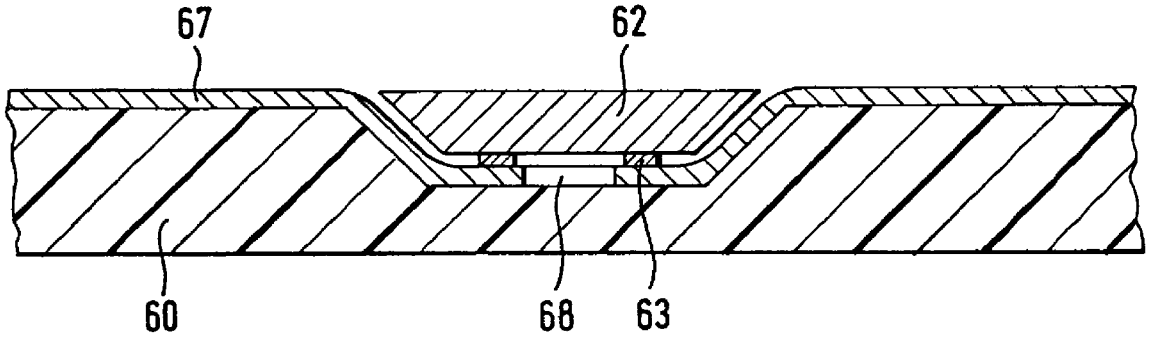

Apart from the recesses 68 shown in FIG. 12*d*, further demetallized areas in metal layer 67 can be produced in the same way. These demetallized and therefore transparent areas can, for example, serve as planes of sections and separation of the metallization of the individual threads during further processing. Recesses in the form of signs or any other pattern that serve as an additional visual authenticity feature in connection with the subsequent security element can likewise be produced in this way. Furthermore, metal layer 67 can be structured such that it serves as an antenna for the contactless transmission of data. Likewise, it is possible to connect the ends of metal layer 67 to an antenna structure already existing elsewhere.

A special embossing die, with which both the depression 61 and the printing ink 66 are transmitted in one processing step, can be used for the production of depressions 61 and application of soluble printing ink 66. Such an embossing die 70 is shown schematically in FIG. 13. This embossing die 70 has a prominence 71 in the form of depression 61. In the plateau area of this prominence 71, a depression 72 is provided, into which printing ink 66 for the printing and embossing process is brought in. In the example shown, embossing die 70 is shown in the form of an embossing plate. The embossing die can of course also be designed in the form of a cylinder with several embossing dies designed in that way, in order to ensure continuous embossing and printing of foil 60.

This embodiment has the advantage that the printing ink can be disposed in the area of depression 61 in a positioned fashion without much effort.

EXAMPLE 14

Regardless of whether using the method described above or any other methods for applying the chip, contacting of the small chips used according to the invention poses a considerable problem. One solution to this problem according to the invention is based on the finding that different metals or also oxidic surfaces have different affinities for printing inks. Therefore, contacting occurs by means of fluid, electrically conductive printing inks that wet the contact surfaces, but do not wet noncontacting surfaces and withdraw from them. I.e. if the contacts of the chip, for example, are made from copper, while the remaining surface of the chip, for example, consists of silicon dioxide or aluminum, a suitable printing ink will only wet the copper surfaces, while it does not wet the silicon oxide or the aluminum and will therefore withdraw from this portion of the surface. Numerous possible materials and corresponding printing inks are known from the field of offset-printing, which can also be used with great benefit in the solution according to the invention.

Thus, it is achieved that during printing of the conductive paths, there is no need to take account of the register accuracy of the printing with the interruption between the contacts. One can simply print one continuous trace over both contacts. As long as the printing ink is still liquid, it will withdraw from the interruption between the printing inks and produce two paths not connected with each other.

This method therefore allows for the contacting of chips without being hindered by the low tolerance for the contacting of the contact surfaces. The necessary register accuracy thus corresponds only to roughly the size of the circuit and therefore only has to be in the order of magnitude of 150 μm or larger.

This method can also be applied to chips that have already been fixed on a carrier material. It can, however, also be applied to a semifinished product, the components of which are subsequently transferred to a banknote by a processing step. In this case, by suitable design of the contacts and corresponding selection of the foils and their surface quality, one can even achieve that the printed contacts or, as the case may be, conductive paths are transferred together with the circuits.

EXAMPLE 15

In FIG. 14 an embodiment of a document of value according to the invention is shown, wherein the rough surface of the document of value or security paper is smoothed by additional measures. In the example shown, the circuit element 77 is prepared on a separate carrier foil 78. For this purpose, a network of organic conductive material 79, that represents the source and drain electrodes of field effect transistors, is printed onto carrier foil 78 that can have a thickness of 23 μm for example and consists of PET for example. Electrodes 79 are printed on in such a way that they are spaced 20 μm apart. The electrodes can be executed in the form of an interlocked comb-like structure for example. In a second printing operation, a layer of a semiconductive organic material is applied over electrodes 79. It extends over both the electrodes and the intermediate areas as well. An extremely thin continuous insulator layer 81 is applied onto this layer. It has a thickness of 100 nanometers for example and is advantageously produced by means of a curtain coater or by any other suitable method. Finally, a network of gate electrodes 82 which is also produced by printing an organic conductive substance is produced on top of insulator layer 81.

This final layer can also be manufactured by vapor deposition of conductive metal layers (e.g. aluminum, copper or similar); the layer can then be structured by means of etching, washing methods or other lithographic methods. The carrier foil 78 thus prepared has a series of field effect transistors that can further be connected to each other by means of suitable conductive paths. Finally, an adhesive layer 83 is applied onto this layer. Here, the adhesive can be comprised of ionomere PE dispersions which should have about 15 grams per square meter in their dry state.

In the area of the circuit element 77 to be applied, security paper 75 has a primer coating 76, the extension of which is larger than the circuit element 77 to be transferred. Carrier foil 78 with circuit element layer structure 77 is laid upon this primer coating 76 over adhesive layer 83. Adhesive 83 binds with primer layer 76 by the action of heat. Subsequently, carrier foil 78 is stripped off, as also shown in FIG. 14. The circuit is now fully operable on the paper.

When designing the printing cycles, one must consider which side the electrodes should be contacted from. In the method shown, the source and drain are always free on the surface, while the gate electrode lies beneath the circuit. If contacting should be performed from the surface, the semiconductive and insulating layers must be interrupted at the locations of the gate electrode in order to permit contacting.

In the case that the circuit element is prepared on the smooth surface of carrier foil 78, it is potentially possible to dispense with primer layer 76 as well, since adhesive layer 83 sufficiently compensates for the surface roughness of the document of value or security paper 75.

According to another embodiment, carrier foil 78 can additionally be provided with a separation layer to permit good separation of circuit element 77 from carrier layer 78. This can be comprised of a polyvinyl acetate layer having a thickness of approx. 5 μm for example.

Alternatively it is also possible to produce electrodes 79 with the aid of metal layers that can be structured with any suitable methods. This can comprise etching methods, laser ablation methods, washing methods or similar. For example, a printing ink or a brushing paint normally used in paper finishing can be used as primer coating. Inks with high solids content that lead to good filling of the paper pores are suitable. For example, cross-linkable acryl dispersions can be used. After coating, security paper 75 is brought to a roughness of less than 150 milliliter/min (according to the Bendtsen measuring method) on the primer side by means of calendering.

According to another embodiment, carrier foil 78 can also be embossed in a first step by means of a suitable embossing die, in order to achieve a sequence of depressions. An embossing die as shown in FIG. 13 can be used for that purpose. Chips with the desired structure are then inserted into these depressions. Subsequently, element layer structure 77 already shown in FIG. 14 is applied onto thus prepared carrier foil 78. Here, the microchips are contacted and connected to the printed circuit.

EXAMPLE 16

In FIG. 15, a security element 90 is shown that consists of a plurality of cooperating electrical components. It has a chip 94 that is connected to a diode 93 via a conductive path 95. This in turn is connected with an antenna 92. A high-frequency alternating electric field, which is converted into DC voltage for the energy supply of the chip 94 by means of the diode 93, is fed in via antenna 92. Here, diode 93 can be produced by printing by using a combination of organic semiconductive compounds. In addition, it preferentially has a surface area of approx. 1 to 15 square centimeters, such as 3 centimeters×4 centimeters. Further, a thin-film diode based on α-Si or p-Si is conceivable.

A security element 90 of this kind can either be transferred onto the document to be secured via the transfer method or embedded as a foil element between two further document layer materials, for example paper layers.

Such a security element has the advantage that it covers a large part of the surface of the document of value and thus cannot be removed without destroying the entire document.

According to an alternative embodiment, chip 94 can consist of a plurality of components. In the simplest case, electrical circuit 94 consists of a chip that comprises only a working memory and a CPU, while the second component comprises the ROM memory. The individual components are of course connected with each other via printed conductive paths. This variation has the advantage that standard components can be put together according to the particular application without having to develop a new chip.

EXAMPLE 17

Instead of chip 94 shown in FIG. 15, an oscillating circuit consisting e.g. of a large surface transistor, a resistance and a capacitance can also be imprinted.

Since the entire security element is produced by printing technology in this case, it can of course also be produced directly on the document.

EXAMPLE 18

According to another alternative embodiment, foil 91 shown in FIG. 15 can be a pigmented white foil upon which only a memory is printed by means of semiconductive organic polymers. An information is now applied in customary fashion on top of this memory, possibly after an opaque white or colored intermediate layer. This information can be a portrait, any printed image, logos, signs or for example individualizing numbering.

If one tries to alter these data by mechanical or chemical means, the effect of falsifying means will not only change the written content but will also destroy the function of the circuit hidden below.

EXAMPLE 19

According to another variation, a circuit is used that receives the energy for the production of the supply voltage for the system and/or information fed in from a transmission device and/or delivers information to the transmission device. For each of these transmissions, the couplings described above can be used, such as coupling by electrical, magnetic, electromagnetic fields or coupling by deformation or, as the case may be, sound. This circuit is executed over a large surface and preferentially consists of organic materials that are e.g. printed on or embedded in the banknote material. The voltage and/or information produced by this circuit can be led directly onto a chip and can be used for the operation of same. The chip itself preferentially does not have any device to produce the supply voltage and/or for direct communication with the transmission device. If the large-surface circuit is damaged by deceitful manipulation, the entire circuit is damaged, to the effect that no supply voltage or information can be fed into the conventional chip or, as the case may be, removed from same, so that the chip is thus no longer able to function.

EXAMPLE 20

The electrical circuit shown in FIG. 15 can be designed in such a way that it outputs a signal in response to an external frequency, which signal represents individualizing information of the document. The individualizing information can be recorded in a file on a host computer together with any other data. In this way, when the document is checked, it is possible to fetch not only the individualizing information stored on the document but rather also the information stored in the file of the host computer.

EXAMPLE 21

Another embodiment of the document according to the invention is shown in FIGS. 16 and 17. In FIG. 16, a banknote 96 that carries a strip-shaped, optically variable element 97 is shown in a top view. In FIG. 17, this document is shown in cross-section along the line A-A. Here, it becomes clear that a printed electronic circuit 98 is disposed under the optically variable element 97.

Optically variable element 97 can be any optically variable element, such as an imprint, a transmission element or also a label. Preferentially, an optical diffraction structure is used. In this case, the optically variable element 97 does not comprise only a single layer, but rather has several layers.

In an attempt to remove the optically variable element, for example, in order to reuse it in a deceitful manner, printed circuit 98 is also damaged. Since same is used for machine recognition of authenticity, there is a direct connection between optical recognition and machine recognition of authenticity. Thus it is no longer possible to use optically variable element 97 to pretend authenticity, whereas the remaining document without the optically variable element could still pass the automatic authenticity check in a machine. It goes without saying that this effect can be further reinforced by interrupting the printed circuit at some locations, which are then connected by parts of the metallized hologram. Even if the circuit is not damaged during removal of the hologram, the connection between its parts would, however, be damaged.

EXAMPLE 22

A circuit, which outputs a key (signature, serial number or similar) in response to an external field, is printed onto the banknote on 90% of its surface. However, the circuit is executed such that it consists of several parts that are connected by thin conductive connections. If such banknote/document is led through a machine suited for checking, it checks the number emitted by the document. Its agreement with a setpoint decides on the admission of the owner. At the same time, however, one or more of the weak conductive connections are destroyed, e.g. by punching or by an electric shock of sufficient power. With that, the banknote is canceled.

It is also possible to store the state of a banknote by providing a plurality of connections to be canceled, which, together with fixed connections (which represent the key), form a partially writeable circuit. This circuit can receive different status values by the connections that can be canceled being changed. This e.g. is also advantageous for tickets that are valid for an event that lasts several days and that can be successively invalidated on a day-by-day basis.

EXAMPLE 23

An additional embodiment that is expedient in the production of such a banknote consists in manufacturing and checking the chip and the banknote paper independently of one another and only combining them with one another in a later production step.

Thus, the chip or, as the case may be, the chips is/are mounted e.g. on a transfer foil and/or security film of the banknote and can thus already be tested for their functionality before the chips are permanently mounted on the banknote paper, e.g. with the security film. The paper will also have been produced and tested already before connection with the chip. Thus, the print on the banknote will preferentially be applied to the paper before the chips are applied. If the transmitting and/or receiving antennas for the optical and/or inductive and/or capacitive coupling of the chip are also applied to the banknote paper itself, this step can also be executed e.g. before application of the chip. This modular manufacturing method makes it possible not to have to discard the banknote paper e.g. when a chip is defective. This reduces scrap.

EXAMPLE 24

It is also possible to apply the chip with suitable electrodes of larger surfaces on a transfer foil, to test the chip there if necessary and subsequently, to connect it conductively on suitably prepared areas of the banknote. This can e.g. occur by means of a conductive adhesive that has been applied to corresponding locations of the banknote or the transfer foil beforehand. The conductive connection is also [made] possible by exerting pressure during subsequent printing processes.

EXAMPLE 25

According to another idea of the present invention provision can be made, in particular in the case of an inductive coupling, as will be described in more detail in the following, to equip the paper intended for the production of banknotes 1 having a chip 3 with a magnetic permeability that is significantly greater than the relative permeability of paper. In this way, inductance of the imprinted coil can be significantly increased. For this purpose, soft magnetic materials are preferentially admixed to the banknote paper. According to the invention, this is preferentially effected by adding soft magnetic powder, so-called magnetic powder, to the fiber suspension used in paper production. In this context, the soft magnetic powder can consist of or comprise ferrite powder, amorphous or nanocrystalline metal powder, carbonyl iron powder, or any other powdered magnetic material, which should have highly permeable properties.

Another possibility also consists in printing magnetic material onto the surface of the banknote as magnetic ink.

Still another possibility consists in impregnating the cotton fibers in a solution that contains magnetic powder with an especially small grain size, so that the soft magnetic material is taken up, i.e. soaked up, by the cotton fibers themselves. Compared to imprinting, this variation has the advantage that a larger share of volume of the magnetic material in the banknote stack can be achieved. Furthermore, the magnetic material, which is normally dark, is advantageously less visible through the differently colored or lighter colored envelope.

The magnetic material is preferentially applied to the banknote paper or incorporated in same homogenously and/or over a large surface, in particular over the whole surface. Since, in this case, the incorporated magnetic material does not necessarily serve as a separate security element, but only serves to achieve improved inductive coupling, e.g. a different denomination-specific application is not necessary either.

EXAMPLE 26

If the banknote with a chip is to be coupled to the energy supply and/or if the banknote with a chip is to communicate with the reading device via an inductive coupling to an alternating magnetic field, it can be expedient to provide the banknote with a coil having an iron core. As a result, the necessary number of coil turns on the banknote having a chip can be reduced on the one hand and the currents on the exciter side of the transformer for the energy supply are not as high on the other hand, since the relative permeability $\mu r$ and thus the flux in the magnetic field increases.

Possibilities shall now be described for altering the magnetic properties of plastic foils or paper in general and those of banknote paper in particular in such a way that they exhibit behavior similar to that of an iron core.

A fundamental problem in the use of iron cores for coils applied to paper that generate or, as the case may be, receive a flow perpendicular to the paper plane consists in the fact that the thickness of the paper is normally small in relation to the coil area.

In actual practice, an iron core used in this way will tend to reduce the flow flowing through the coil rather than increase it, since it corresponds to a lying dipole that can easily be magnetized in its longitudinal direction, but is relatively hard to magnetize in a direction perpendicular to the paper plane.

One embodiment of the magnetic banknote paper can be achieved by incorporating unordered braids of ferromagnetic materials with long fibers into the paper. In this unordered braid, a large number of fibers will always connect the upper side and the lower side of the banknote paper with one another and thereby achieve a magnetic "short circuit", i.e. increase the permeability $\mu r$ to the desired extent. Here, fibers lying crosswise in the plane of the banknote paper do not block the magnetic flow.

Accordingly, an especially favorable embodiment of the magnetic banknote paper according to the invention is achieved if the material used as an iron core exhibits magnetic behavior that is dependent on direction. A paper designed in that way can also be used as an independent authenticity feature, besides its expedient use in connection with banknotes having a chip.

An associated checking device can e.g. let two magnetic fields that are perpendicular to one other act successively on the paper and measure the magnetic flow flowing through the paper in these two situations.

Whereas, for an application of that kind, it appears expedient to place the preferred direction, in which the material can be magnetized more readily, in the paper plane, in the case of application as an iron core for coils mounted on the paper plane, it is also expedient to dispose the preferred direction perpendicular to the coil plane. In the following, the preferred direction is assumed to be perpendicular to the coil plane, if not explicitly stated otherwise.

A magnetic paper with directional magnetic behavior can e.g. be produced by embedding ferromagnetic fibers into the paper. If the preferred direction is to lie in the paper plane, the incorporation can be achieved well conventionally by e.g. coating the individual fibers with nonmagnetic materials and then applying them to the screen in paper production.

If, however, the preferred direction is to lie perpendicular to the paper plane, it is preferential to incorporate ferromagnetic fibers having a length lying in the order of magnitude of the paper thickness, the diameter of which, however, is significantly less. Individual fibers are then formed, which can readily be magnetized in the direction perpendicular to the paper plane, but which are relatively hard to magnetize in a direction lying in the paper plane.

EXAMPLE 27

The incorporation of such fibers in an ordered manner is not conceivable in the conventional manner, since the individual fibers are very thin, to the effect that they are very hard to handle, although, on the other hand, their numbers are extremely high.

One possibility for incorporating the fibers consists in performing a machining metal-processing process over the screen in the paper production that produces suitably short shavings that are slung in a defined direction at a very high speed. The removal of iron by means of a grinding tool would be an example. If these shavings are additionally shot onto the paper pulp at suitable locations by means of suitable templates, this results in the possibility of incorporating the special magnetic properties into the paper at the selected locations only.

Another possibility for producing paper with the desired magnetic properties consists in producing a suitable semifinished product beforehand, which is then either applied to the screen during paper production or is applied to same or inserted into a hole or into a depression in the banknote only after production of the banknote.

EXAMPLE 28

In order to impede forgery, it is especially expedient to apply a so-called patch to the banknote on one or both sides, which protects the desired semifinished product for one and bears additional security features, such as, for example, a hologram, for the other.

In connection with the banknote having a chip, this patch can, at the same time, be used to protect the coil, the antenna and the chip applied to the banknote against aggressive environmental influences.

FIG. 18 shows in cross-section a banknote 1 having a magnetic core 431 made of ferromagnetic material 436 that has been inserted into a hole 429 of the banknote paper web 430 and is protectedly placed between two patches 432, 433 together with a coil 434. As shown in FIG. 18, it can be advantageous to design the core as thick as the combined thickness of the banknote paper and the applied coil 434. When several of such banknotes are stacked, core 431 effects a significant increase in the magnetic flux through the individual banknotes.

The semifinished product described above, which can e.g. comprise core 431 and optionally coil 434 and patch 432, can now be produced in different ways.

One possibility, for example, consists in joining longer ferromagnetic fibers in the form of a rope and filling this up and holding it together with a material having properties similar to that of paper pulp, i.e., in particular, it is permeable to water. This rope is then cut, e.g. with a laser, into slices that are somewhat thinner than the banknote.

An alternative possibility for the production of such slices consists in the use of several layers of ferromagnetic braids, which are welded one on top of the other in a first processing step and cut into slices in the desired manner in a second processing step.

These slices can now either be inserted-into holes 429 in banknote 1, as shown in FIG. 18, or already applied to the screen during paper production. Then, paper pulp will also accumulate on the individual-slices, i.e. the slices are embedded in the paper and can no longer be readily removed from same.

EXAMPLE 29

An especially advantageous possibility for the production of paper with the above-described directional magnetic properties consists in using the method of self-organization. For this purpose, use is made of prior art knowledge that individual small ferromagnetic particles align themselves along the magnetic field lines when a sufficiently strong magnetic field is set up. In the same way, the ferromagnetic shavings incorporated into the paper pulp align themselves in a magnetic field acting on the paper pulp as long as the paper pulp is still sufficiently wet and the shavings are still mobile within the paper pulp. In the finished dry state of the banknote paper, the shavings are no longer mobile, so that the desired direction-dependent magnetic properties of the paper have been "learned".

FIG. 19 shows a schematic representation of the expected locally structured alignment of ferromagnetic particles 436 that appears when, by means of a magnet 435, a sufficiently strong magnetic field acts on paper web 430 lying between same. Here it can be especially advantageous if the shavings 436 incorporated into the paper pulp already have a rod-like form and can themselves readily act as magnetic dipoles. Then, a translatory movement of the shavings 436 does not have to occur in the paper pulp in all cases, but rather, it is sufficient for the shavings 436 present in paper 430 to rotate in the suitable direction.

The effect occurring here within paper 430 is comparable to that occurring when the Weiss domains reverse in ferromagnetic material: The more shavings 436 have already aligned in a correct, i.e. energetically favorable direction, the greater the magnetic forces acting on the remaining shavings, which force them to align as well, will become.

A particular advantage of the method described here for impressing the desired magnetic properties consists in the fact that it is relatively simple to perform this process locally, in which process the property is not only simultaneously applied to the paper, but rather can simultaneously be present in the entire paper layer at the desired location. Thus, it is not possible to readily transfer this property from one piece of paper to another.

EXAMPLE 30

Two methods seem to be especially advantageous for application in the production of banknotes, application at the screen itself or after the paper web has left the screen. Potentially, a combination of both methods can also lead to even better embossing.

In the application on paper web 430 that is still moist, strong magnets 435, which provide for the magnetization and thus the orientation of particles 436, are mounted above and below paper web 430. Paper web 430 thus only exhibits the desired magnetic properties at locations where magnets 435 are situated. Here, the use of solenoids is especially advantageous, since they can be switched on and off in clocked cycles, thereby permitting zones to be created, which have the desired magnetic properties in an order of magnitude defined in the desired directions.

FIG. 20 shows an alternative arrangement, wherein a screen 437 is dipped into a non-depicted container out of paper pulp with sprinkled-in ferrite shavings 436. Magnets 435 are mounted on the inner face of the cylinder wall for the production of locally defined ferromagnetic areas 436 in a paper web 430. For the purpose of simplicity, strong permanent magnets 435 are preferentially used. Application on screen 437 is especially advantageous for several reasons.

For one, the ferromagnetic particles 436 sprinkled into the paper preferentially settle at the places in screen 437 where magnets 435 are located, and for the other, shavings 436 are aligned evenly with the deposition. The frequent feeding of energy during paper production in the form of stirring, blowing in of air or similar promotes the efficiency of the settling and aligning process, since it further increases the mobility of the ferromagnetic shavings 436.

The paper with the directional magnetic properties produced in this way can also be used to produce the semifinished product described above that is incorporated into the paper pulp or applied to the screen.

EXAMPLE 31

The method of self organization can also be used very advantageously for the production of plastics, more specifically for foils with the desired direction-dependent magnetic properties, wherein the plastic goes through the learning process while it is still in a liquid state and is then stimulated to undergo polymerization while the magnetic field is still set up. In the polymerized state, the ferromagnetic shavings are no longer mobile, and the desired property has been remembered.

EXAMPLE 32

A further idea for the present invention consists in the coupling frequency for inductive and/or capacitive coupling of an antenna of the banknote, which is coupled to the banknote chip having a value that is different from the banknote chip's own transponder frequency. This is particularly advantageous when each banknote has two different antennas with different resonance behaviors, with one antenna being coupled directly with the chip and the other antenna serving as an external coupling and being able to interact with the chip antenna.

FIG. 21 shows an example of an associated banknote 1. In this example, chip 3 is on a security strip, such as a metallized foil strip 295 of banknote 1. Chip 3 is executed as a transponder chip and has a coupling element 296, via which e.g. communication at the frequency of f1=2.45 GHz can take place. Basically, the coupling element could also be realized externally, although the illustrated variant of a transponder with "coil-on-chip" is used particularly preferentially, wherein coupling element 296 is mounted on or, as the case may be, in the chip housing. The metallized foil strip 295 has a circuit unit 297, which is connected with two further coupling elements 298, 299. The transponder chip 3 is disposed in coupling element 299 such that it can communicate with circuit unit 297 via coupling elements 296/299. Furthermore, circuit unit 297 is in a position to communicate with an external apparatus, such as a banknote checker at a frequency of f2=13.56 MHz, via coupling elements 298. The unit consisting of transponder chip 3, circuit unit 297 and foil strip 295 is now structured such that communication is possible between a banknote checker (not shown) and chip 3 via coupling elements 298 and circuit unit 297 as well as coupling elements 299 and 296 at the frequency of f2=13.45 MHz, whereas chip 3 communicates with circuit unit 297 at the frequency of f1=2.45 GHz.

Transponder chip 3 with communication frequency f1 is supplied by the chip manufacturer. Foil strip 295 is configured by the system operator or, as the case may be, by the banknote manufacturer. As coupling element 298 defines the communication frequency between the banknote and the checking device, fraudulent use of transponder chip 3 understandably will not be successful, because the checking device does not respond to its frequency. Chips 3 that have been removed from valid banknotes or stolen on the way from the chip manufacturer to the banknote manufacturer can thus not be utilized without elaborate additional measures. If foil 295 is mounted on the banknote surface such that removal without damage is excluded, a valid foil cannot be transferred operatively to other substrates.

Further functionalities that are not readily accessible to an outsider, but that can be mandatory for the check, are contained in circuit unit 297, which e.g. can be produced in polymer semiconductor technology. Imitation of a foil element according to the invention or transfer of same to another substrate can thus largely be excluded.

Further improvement in forgery-proofness can be achieved if metallized foil 295, on which the coil turn, antenna elements, connecting lines, etc. are "exposed" by etching technology or other means, is additionally equipped with diffractive structures or other feature materials that are not available on the market, but which likewise permit unique identification.

By providing two different communication frequencies f1 and f2, the frequency predetermined by the chip manufacturer can thus be redefined. In principle, different frequencies can thus be allocated to different currencies or different denominations of a currency, on the basis of which, of course, automatic differentiation is also possible. If the geometry of coupling element 298 is frequency-dependent, this means that the resonance frequency of the elements can be defined sharply only to a limited extent by simple, printing technology measures. Thus, a deviation within a certain bandwidth must be tolerated in these cases.

If, on the other hand, the resonance frequency as well is to be used as an authenticity criterion, it is possible to trim the geometry of coupling elements 298, which for example can be formed as antenna dipoles, to such an extent that the security width is dimensioned extremely narrowly. Trimming procedures of that type are known and are carried out by means of laser technology, for example.

As mentioned, the foil element shown in FIG. 21 offers the possibility of addressing a transponder chip 3 that is set to frequency f1, via frequency f2. In case communication by machine with a banknote via frequency f2 is not possible for a banknote, different case scenarios are conceivable in principle, e.g.

the transponder chip is defective, there is a defect in one of functional elements 297, 298, 299, the chip or the foil element is completely missing.

In order to be able to further limit these possibilities for the checking device, it is conceivable for a second check with a switch to frequency f1 to be connected in series following an initial unsuccessful check of the banknote using frequency f2. If the result of the check is now positive, at least it has been proven that an authentic transponder chip is present. In case the security concept used links the transponder chip to the associated banknote through specific data stored in the chip, in which individual information provided on or in the banknote is stored in the chip (e.g. by additional storage of the serial number printed on same), the authenticity of the banknote can be established by machine nevertheless in case of a positive check of this connection.

The first-described banknote check via frequency f2 is certainly that used in more simple checking devices. In case this check produces no result, the authenticity check is normally performed visually, by inspecting the authenticity features intended for the number check, such as intaglio printing, guilloche printing, watermarks, windowed security threads, holograms, etc.

The second check via frequency f2 will certainly only take place in more elaborate checking devices, wherein further authenticity features as well are recorded or, as the case may be, checked by machine anyways. This is the case in every case in automatic banknote sorting or banknote deposit apparatuses.

If, as a result of this second check, it becomes possible to query the transponder and if, as a result of the assignment of the memory contents to the banknote serial number (or other individual data), the authenticity is confirmed, the banknote can be destroyed as authentic, but no longer fit for circulation, without manual access.

EXAMPLE 33

Provided that the banknote has different coupling frequencies, e.g. by several different antennae being present, as was described above, according to a further variant, these can also be checked by an associated checking device, as described in even more detail by way of example in the following. Thus, for example, it may be that a checking device addresses banknotes 1 on frequencies f1 and/or f2 for purposes of reading and/or writing, in order to, for example, to check the authenticity of the banknote. This can also be used if chip 3 itself of a banknote 1 is directly coupled to two different antennas and if, consequently, the chip can be addressed directly on two different frequencies.

EXAMPLE 34

In the above-described banknotes 1 with several antennas, as depicted by way of example in FIG. 21, the following idea is also particularly advantageous. As was mentioned, antenna 296 of chip 3, referred to as internal antenna 296 for short, and antenna 298 can also be coupled contactlessly, such as capacitively and/or inductively, for external coupling, referred to a external antenna 298 for short. In this case in particular, several external antennas 298 of that type can also be present on the banknote paper of each individual banknote 1 and preferentially be disposed spaced-apart on the paper. This variant has the advantage, that even when part of the external antennas 298 of a banknote 1 fail, chip 3 can still be addressed from externally.

Moreover, in stacking measurements, as they are described in even more detail in the following, the particular advantage results, that if antennas of individual banknotes fail, functioning external antennas of adjacent banknotes can take over the task of the antennas that have failed, since communication with chip 3, i.e. with its internal antenna 296, takes place contactlessly here. This is also advantageous, should only one antenna be present on the banknote for contactless coupling to chip 3.

EXAMPLE 35

In the following, an example is described for a banknote, the chip of which can be coupled contactlessly. As has already been mentioned, a transponder circuit of a banknote can have a transponder chip and a coupling coil, which acts as an antenna and via which the electrical energy from the field of a reading device can be coupled into the chip of the banknote or, as the case may be, data can be transmitted bidirectionally or unidirectionally. The term contactless connection is understood to mean that the chip of the banknote can be coupled contactlessly to the antenna of the banknote that is responsible for energy and/or data transmission to an external (reading) device.

Now, it proves to be very advantageous, within the scope of the present invention, to use so called transponders with coil-on-chip, where e.g. galvanically deposited antenna coils are applied to the chip itself. A particularly preferred example of this has already been described in detail in connection with FIG. 21. The coil-on-chip coil will preferentially communicate contactlessly with the coupling coil of the banknote. This significantly reduces the requirements for register accuracy of the incorporation or, as the case may be, application of the coupling coil on or, as the case may be, in the banknote. In addition, the production throughput can e.g. be significantly increased compared to contact-type contactings, such as wire bonding, wedge bonding or flip-chip bonding.

FIG. 22 shows a further example of such a banknote 1. This [banknote] shows a coupling coil 410 that is disposed as dipole antenna 410, by way of example, although, of course, other forms of antennas as well are conceivable. This dipole antenna 410 can withdraw electrical energy from the field of an external nondepicted reading device through inductive coupling. Through this, voltage is produced in dipole antenna 410, which in turn irradiates an electromagnetic field itself. As an example, a further transmitter 411 can also be mounted on or, as the case may be, in dipole antenna 410, the energy supply of which is ensured by dipole antenna 410. As already mentioned in another example above, transmitter 411 can e.g. also irradiate at another frequency f2 in this case. However, this is not mandatory, since, for example, time scaling, which permits sequential radiation, can also be introduced.

Furthermore, on banknote 1 is located a chip 3, on which a further coupling antenna 412 is mounted, by way of example, in the form of coil 412 as a coil-on-coil chip. This chip 3 then communicates advantageously with coupling antenna 410, which itself in turn then exchanges data and/or energy with the external reading device. It hereby becomes possible to achieve that data transmission and the Chip 3's supplying of voltage do not take place by means of galvanic contacts.

EXAMPLE 36

As already mentioned, the electrical circuits need not necessarily have a rewritable memory. Provided that it is desired to provide an "anonymous" banknote, wherein no data can be stored, which provides information about the current or previous owners of the banknote, the banknote's chip will not be made rewritable.

This occurs by providing possibilities in the chip that prevent data from being written into the memory area as of a point in time in the banknote's life history.

A suitable point in time can be completion of the banknote at the manufacturer's. The time of issue at the state central banks' e.g. is equally conceivable.

To serve this purpose, it is important that no personal data of the end user be able to be stored in the chip's memory during circulation of the banknote.

Technically, this task can be solved in different ways, e.g. by providing data lines in the chip, which can be interrupted deliberately at the selected time, so that, although the memory contents can still be read, it will no longer be possible to "write" into the memory cells (hardware inhibit). The same result can be achieved by placing an inhibit bit in the chip operating unit that prevents write access as of this point in time (software inhibit).

It is plausible, that a memory inhibited by a hardware inhibit or software inhibit can be supplemented by another memory that can be furnished with data during circulation of the banknote.

It is important that such a memory can both be read and deleted or overwritten by the end user. The memory areas associated with "transparent banknotes" can by definition only be used by authorized positions, i.e. these write/read operations can not be used by the end user. The write locks mentioned at the onset are provided to avoid the problems resulting therefrom.

In case doubts arise that a banknote with a chip, wherein the official memory exhibits a write disable during circulation of the banknote, is even expedient, these can be countered by pointing out that the data pertaining to the manufacturing process, i.e. the banknote's serial number as well as information on currency, denomination, date of manufacture, manufacturer, etc. are already very valuable for general statistical inquiries for the system operators, in particular the national banks. Personal data going beyond that are not necessary for system support.

The "anonymity" of a banknote, though, can not just be disturbed by the recording of personal data. The possibility, as well, of being able to determine the possession of such banknotes without the consent of the particular holder of the banknote can already massively disturb the end user's interests.

Imagine that the existence of a banknote can be detected at a greater distance via "direction-finding transmitters". This would not only give pickpockets an excellent "working aid".

Thus, if one wishes to also prevent bearings to be determined for banknotes from a larger distance, one must make sure that the range of the transponder's transmitting unit is selected through skilled selection of the system parameters such that it is smaller than would be necessary for purposes of determining bearing.

In passive radio frequency transponders (RFID), which gain their transmitting energy from the energy received, the transponder's transmitting power, and thus the transponder's range as well, can thus be increased via an increase in the transmitting power of the checking device. In order to not exceed the desired range of the transponder chip, measures can be provided in the transponder, through which the transponder's transmitting power is deliberately limited.

It is also possible to alternatively or additionally adjust the range as desired through skillful selection of the transmitting frequency (gigahertz range) or, also, through specific designing of the coupling elements. In this spirit, it can also be necessary to provide capacitive coupling elements or other coupling elements, which only allow communication upon direct contact, instead of dipole antennas or oscillating circuit coils.

If a banknote with a chip must be such that its bearings can not be determined, a maximum range of a few cm, preferentially of a few mm, of the Chip's RFID transmitter appears expedient.

For certain applications, it can also be advantageous to provide transmission apparatuses, via which data and/or energy can be exchanged with the circuit, with the transmission occurring by optical means. Through this, one can achieve, among others, the advantage that an additional or alternative type of transmission is created besides the transmission of data and energy that typically takes place via high-frequency fields. For example, the supply of energy can then be effected via high-frequency fields, while the actual communication, i.e. the exchange of data or, as the case may be, information, with the circuit, takes place by optical means.

Understandably, a communication performed by this means is extremely dependent on optimal boundary conditions. A determination of bearings or, as the case may be, unintentional monitoring must be fully excluded in this context.

EXAMPLE 37

A further example for producing a banknote 1 with optical coupling is shown in FIG. 23. Such a banknote 1 can transmit data from its chip 3 to an external reading device via optical photodiodes 226*a*, 227*a*. In this context, photodiodes 226*a*, 227*a* can have e.g. exhibit a transparent light-conducting plastic, such as polycarbonate (PC) or polymethylmethacrylate (PMMA), or consist of same. To improve coupling in and relaying of an optical signal produced by chip 3, according to the invention, a product can be used that contains fluorescent dyes. Such materials are based e.g. on cumarin compounds or perylene compounds and are known as LISA (light collecting) plastics and are described e.g. in DE 40 29 167 A1.

Within the meaning of the present invention, a dyed light-collecting and light-conducting polycarbonate-based foil, for example, is a LISA plastic of the kind referred to. The foil contains fluorescent dyes, which convert the light falling in into light of a longer wavelength. Although attention is especially given to the preferred variant with fluorescent dyes, phosphorescent dyes are also conceivable as an alternative. The major part of the light is reflected within the foil in accordance with the laws of reflection (total reflection) and exits again only through the edges. That is why foils made of LISA distinguish themselves by clearly visible lightness of edges.

FIG. 24 shows the functional principle of this kind of photodiode made of LISA plastic. Photodiode 284, which is available in the form of a LISA foil 284 by way of example, has dye molecules 286 inside, which can be present in all or just a part of its volume. Irradiation of light from a light source 287 causes the dye molecules 286 to be stimulated to emit fluorescent radiation 288, a large share of which exits from photodiode 284 at lateral edge 289 after total reflection on the photodiode wall 285. Total reflection always occurs at the transition of LISA to air, when the sine of the angle of incidence is greater than the quotient 1/n, with n being the refractive index of the LISA plastic and nair being equal to 1.

The total reflection can be unfavorable when the surface of the light conducting element is scratched or moistened with liquids. In the first case, part of the light present in LISA foil 284 will exit at many scratched places, thereby reducing the efficiency of the radiation at the desired edges of the foil.

Therefore, if necessary, it can be advantageous to produce LISA foil 284 from several, particularly preferentially from at least three or precisely three partial layers having different refractive indexes. In this context, materials with high refractive indexes are used inside, and these are covered on top and below by a foil having a low refractive index Due to the different refractive indexes, part of the total reflection already occurs in the spacer between the two optical media inside the foil. Only the share that is not reflected by the inner layer transition reaches the outer layer transition and can likewise be reflected there, if the critical angle is exceeded. In this context, the critical angle calculated back to the inner layer transition is as large at the transition of the outer foil layer as the direct critical angle at the transition of the denser medium to the ambient air.

The advantage of this variant has an effect when a surface is scratched and roughened. These significantly worsen the share of total reflection. However, since only a small share of maximum approx. 25% of the light rays produced in LISA foil 284 are reflected at the outer boundary surface, the foil's efficiency rises on the whole.

The whole foil e.g. can first be manufactured with a greater thickness and brought to the desired thickness through stretching if direct manufacture becomes problematic.

Further, it can be advantageous, if the LISA foil 284 is provided with a reflecting coating 290 on one side or both sides. In the second-cited case, the LISA foil 284 will, however, preferentially have a recess in the area of the LED to allow the irradiation of the stimulating light to enter. To increase efficiency, depicted photodiode 284 thus specifically has e.g. reflecting backside metallization 290 in the area of irradiation as a minimum.

The use of several layers with different refractive indexes also offers advantages with reference to LISA foils that are metallized for the purpose of improved light utilization on the outer side. For one, the total reflection is better in terms of efficiency than the reflection on a metallized surface, for the other, scratches on metal surface 290 only affect the efficiency of LISA foil 284 to a slight degree for the same reasons as those described above.

Technically, foils 284 of this type can be produced through extrusion methods or calendering methods, with the LISA dye being added at the e required concentration. In order to ensure that banknote 1 can also still communicate via photodiode 226*a*, 227, the plastics should be correspondingly provided with additives. For example, the plasticizer content of the foil can be increased such that the foil becomes less sensitive to banknote 1 being crumpled up by the user.

An additional reflective layer can be created by incorporating and/or applying metallic layers, e.g. metallic foils. If this layer or other layers are e.g. so-called shape memory alloys, then, as a result of the memory effect, the possibility of freeing the plastic foil from deformations caused by use by means of short-term temperature increases to e.g. approx. 80° C. shall continue to exist. Polymers exhibiting the so-called shape memory effect can also be used for this purpose. It is particularly advantageous when foils that exhibit this effect are additionally provided with LISA dye. The surface of the foils should be sufficiently smooth so as to minimize scattering loss. Further, the thickness of the foil is to be adjusted to the manufacture and thickness of banknote 1. Normally, foil thicknesses of less than 50 μm are used.

The LISA pigment can not just be integrated in the banknote in the form of a dyed foil, but rather, it is also possible to coat and/or print on undyed foils, such as PET foils, with LISA lacquers. It is particularly advantageous, when the security thread present in the banknote and/or another foil to be incorporated in or applied to the banknote is printed on with LISA lacquer. Application of the lacquer to the foil can also occur by using knife-coating or spin coating on individual parts of the foil.

EXAMPLE 38

As shown in FIG. 25, according to one embodiment, a LISA photodiode 227' of this type is irradiated in a banknote, analogously to photodiode 284 according to FIG. 24, by a light source present on Chip 3, such as a light-emitting diode (LED) 235. In this context, the wavelength produced by light-emitting diode 235 of the light is preferentially selected such that it corresponds to the absorption maximums of the plastic used, i.e. to the fluorescent dyes contained therein.

In this context, in accordance with the representation of FIG. 25, the light exit opening of light-emitting diode 235 can be mounted on the upper side or, as the case may be, on the underside of Chip 3, but also on the narrow side of Chip 3. In order to achieve optimal light coupling, photodiode 227' is led past light diode 235. Thus, there is a significant difference between the photodiode variant according to FIG. 25 compared to those of FIGS. 44, 45 and 23, 46, consisting in that there is not a plurality of individual photodiodes or, as the case may be, photodiode sections 226, 227, 226*a*, 227*a*, but rather, that there is only a single photodiode 227', which preferentially extends from an edge 289 to an opposing edge 290 of banknote 1. As a result, a large tolerance window with reference to the positioning accuracy of Chip 3 results from this arrangement according to FIG. 25, since light-emitting diode 235 merely has to be positioned within the width of the photodiode 227' that is used.

Moreover, an essential advantage of using LISA foils compared to conventional photodiodes consists in that no in-phase coupling of the light from light-emitting diode 235 into photodiode 227' is necessary, since this is a process wherein the irradiated light is merely frequency-shifted with reference to the emitted light through the absorption by the LISA molecules.

It is possible for the LISA pigments to be distributed homogeneously in the photodiode. In the variants indicated, in order to achieve the highest possible efficiency, it is will be advantageous if LED 235 is mounted over an area of photodiode 227', which contains a higher concentration of LISA pigments. This can e.g. be translated into practice through layers of varying thickness of the LISA foil or, as the case may of the LISA lacquer or through generation of a concentration gradient of the LISA pigments within the LISA foil or, as the case may be, of the LISA lacquer.

Another possibility consists in the use of a laser diode as light source 235, with e.g. an organic thin-film laser diode being particularly advantageous. In this context, a higher intensity of light is achieved, than is possible when using a conventional LED. Likewise, the use of two-dimensional LEDs is preferred, which e.g. are produced by means of thin-film technology, such as vacuum deposition, etc. To this end, e.g. LEDs with a perpendicular aperture or, as the case may be, with a square aperture can be used. This can lead to better luminous efficiency compared to point-shaped emitting LEDs.

EXAMPLE 39

Another even more efficient possibility for generating light is shown in FIG. 26. In this context, a luminous surface 291 is used to generate a primary optical signal. This luminous surface 291 can e.g. be a coating. In this context, it is e.g. an organic LED (=OLED), which preferentially can be printed on, or have electroluminescent inorganic substances such as doped transition metal chalconides (sulfides such as ZnS, CdS, etc.). By applying photodiode 227' to luminous surface 291. the optical signal, which is primarily being irradiated perpendicular to the surface of luminous surface 291, can be directed at edges 289, 290 of banknote 1 for radiation.

The emission wave length of luminous surface 291 and the absorption wave length of fluorescent dye molecules 286 is adapted to an absorption maximum of the dye molecules, so that the fluorescent luminous intensity preferentially corresponds to a maximum of the dye molecules.

EXAMPLE 40

In a further development that offers particular advantages in the processing of stacked banknotes, as will be described in the following, a piezoelectrical element, which is likewise a component of the banknote, is provided for the supply of an electrical circuit of a banknote. In this context, it can be a piezoelectric monocrystal (e.g. BaTiO3, PbTiO3), a piezoelectric foil (e.g. polyvinylidene fluoride—PVDF) or any other piezoelectric material (e.g. copolymer transducer of trifluoroethylene).

If, for example, the piezoelectric element is present as a foil of piezoelectric material, it can e.g. be constructed as a security thread, OVD foil (optically variable element), etc. However, it can also be a component of a compound material consisting of a foil and paper or of several foils. The two sides of the foil are at least partially vacuum metallized for the formation of electrodes. If one applies voltage to the two metallic electrodes, the thread bends itself in the rhythm of the electrical voltage. As described in greater detail in the following, for decoupling of the energy supply and response of the piezo foil, an integrated circuit in the vicinity of the foil or preferentially on the foil itself can be used, which [circuit] is conductively connected to the electrodes of the piezo foil.

In one advantageous embodiment of a banknote, provision is made to mount the circuits between two uninterrupted, vacuum metallized piezo foils such that the two piezo foils are brought into association with the contacts of the electrical circuit. This can occur through a particular design of the metal layers, e.g. through use of the so-called "clear text" method. When a conductive laminated adhesive is used, it is possible to bring the contacts, which as a rule lie on one side of the electrical circuit, into contact with the two metallized piezo foils. Other similar embodiments are conceivable. In case, for example, there is an electrical circuit is available, which exhibits contacts on different sides. Through corresponding structuring of the metal layers, electrical circuits with more than two contacts can also be used.

EXAMPLE 41

The electrical circuit can be operated by means of irradiated energy in the form of ultrasound, with electrical voltage being generated that is also used—potentially after temporary storage—to operate the piezo foil and optionally to communicate with a reading device. However, the circuit can also be supplied with energy by means of a photo cell and irradiated light, with electrical voltage being generated, which—potentially after intermediate storage—is also used to operate the electric circuit and the piezo foil and optionally to communication with a reading device.

The electrical circuit can also be operated through the introduction of deformational work on the banknote, i.e. e.g. of elements with a piezoelectrical effect. The energy brought in can then be used—potentially after temporary storage—to operate the chip situated on the banknote and potentially to operate communication with the reading device.

Precisely in conjunction with a display or an optical outcoupling of information out of the banknotes in the range of visible light, the use of deformational energy results in the advantage that even the normal user of the banknote sees a security feature in the chip of the banknote that he can discern. Slight crimping of the banknote then e.g. leads to light effects on the LISA strip[,] the blinking of LEDs or a display on the display of the banknote.

EXAMPLE 42

One further idea of the present invention consists in using the magnetostrictive effect in place of the effect of magnetic induction. As is known, when a ferromagnetic crystal is magnetized a change in shape of the magnetic crystal then appears as field strength increases. This phenomenon is known as the magnetostrictive effect. The Joule effect is the most important component of magnetostriction. It is based on the fact that the so-called Weiss regions rotate in the direction of magnetization and displace their boundaries. Through this, a change in shape of the ferromagnetic core occurs, with its volume remaining constant.

The magnetostrictive effect, which causes expansions in the range of 10 to 30 μm/m in the case of alloys with the components of iron, nickel or cobalt, achieves values of up to 2000 μm/m in highly magnetostrictive materials of rare-earth metal-iron alloys. Thus, the compound Tb0,3Dy0,7Fe2, which is also known as Terfenol-D©, has an energy density that is many times higher than piezoelectrical materials.

Aside from metals and their alloys, molecular magnets also possess magnetostrictive properties. Molecular magnets are understood to mean larger molecules or clusters, the magnetic properties of which are determined by the coupling of metal ions usually, which [coupling] is anti-ferromagnetic as a rule. The best known representative of the magnetic clusters, which demonstrate macroscopic quanta tunneling in magnetization, is [Mn12O12(CH3COO)16(H2O)4] .2CH3COOH.4H2O (abbreviated as Mn12-acetate or simply Mn12), which is of mixed valence.

As described above, a magnetostrictive material experiences a longitudinal change in length upon application of a magnetic field, i.e. the direction of field and the direction of expansion run parallel. A similar effect is also known for piezoelectrical materials. When an electrical field is applied, it effects a longitudinal or also transversal change in the spatial expansion of the lattice structure. In particular, it is also known that the piezoelectric effect can be reversed, i.e. in the case of the reciprocal piezoelectric effect, an electrical voltage that can be captured can be generated on the surface through expansion or bending of a piezoelectric material. In this context, the amounts of energy that can be generated by means of a piezoelectric material can be sufficient for the operation of a chip.

EXAMPLE 43

Although not limited to this, FIG. 27 shows an exemplary embodiment where a piezoelectric material is used, too, in addition to a magnetostrictive material. The materials are integrated into a composite 360 for the generation of an electrical supply voltage from a magnetic field. Here, a layer of magnetostrictive material 361 is coated with a layer of piezoelectrical material 362, which e.g. is applied in the form of a strip onto a banknote paper. An alternating magnetic field 363 flowing through the magnetostrictive material 361 causes a periodic change in length dL of the composite material 360, with the frequency of the change in length dL corresponds to the frequency of the alternating magnetic field.

Preferentially, for the construction of the composite material 360, a magnetostrictive material 361 with longitudinal sensitivity is preferred, in the case of which there is a change in length parallel to the applied magnetic field, which [change], in particular, is greater than the one in the direction perpendicular to it should be. In addition, a piezoelectrical material with a lateral sensitivity is preferred, in the case of which the tapped voltage at right angles to the change in length is particularly preferentially greater than that in the direction perpendicular thereto.

The electrical voltage evoked through the periodic change in length of composite 360 in piezoelectrical material 362 can be tapped at electrodes 364 at the surface of the material, which are mounted on the material. Although a separate electrode layer is also conceivable as a counterelectrode, the magnetostrictive material 361 will preferentially be used as the counterelectrode, provided this [material] exhibits sufficient electrical conductivity, like e.g. that associated with nanocrystalline metal or, as the case may be, amorphous metal. The voltage captured by means of electrodes 364 or, as the case may be, 361 can then be tapped at connections 365. In the case of use in a banknote, connections 365 will consequently be electrically connected with chip 3 of a banknote 1.

The construction of the material composite according to the invention thus serves to generate an electrical alternating current, proportional to an externally applied alternating magnetic field, under avoidance of electrical conduction by means of a coil.

EXAMPLE 44

FIG. 28 shows a further example where a magnetostrictive-piezoelectrical compound material 360, corresponding e.g. to that of FIG. 27, is in turn integrated in a banknote 1 and connected, in this context, with chip 3 of banknote 1 via lines 366. Here, a preferred variation is depicted, where a strip of a LISA foil 227' can likewise be present besides magnetostrictive-piezoelectrical strip 360, as will be explained in detail within the scope of this invention. In a particularly preferred manner, there can be a single strip that comprises both LISA foil 227 as well as compound material 360 and e.g. is applied onto the banknote paper as a prefabricated unit.

EXAMPLE 45

In this context, it can also already be expedient to provide an electronic security feature without the use of a chip or any other storage element for the storage of data. By dispensing with such storage elements, an associated banknote can be manufactured particularly simply and inexpensively.

A further possible variation consists in the design of an electrical oscillating circuit in or, as the case may be, on the banknote paper.

FIG. 29 shows an equivalent circuit diagram of such a simply-constructed electronic security feature in idealized form, where an optional optical display is also present additionally. In this context, oscillating circuit 230 specifically exhibits an inductance 231 and a capacitance 232 and is preferentially connected with a rectifying element 233 and an electrooptical reproduction device, such as an emitting diode LED or OLED 234. In principle, the equivalent circuit diagram can also exhibit still further components.

A banknote with such an equivalent circuit diagram can be manufactured as was described previously in the section "Banknote with an electrical circuit". Preferentially, the electronic components are applied to the banknote paper as a substrate typographically, such as through screen printing, ink jet printing or engraved printing by means of silver conductive paste, graphite paints or conductive polymers. Alternatively, vacuum metallized foil elements can also be used. The inductance 231 e.g. is applied onto the paper in the form of a conductor loop and the capacitance 232 is applied in the form of an electrically-conducting surface. The capacitance 232 can thus be adjusted to a predetermined value during fabrication such that a conductive surface is likewise imprinted onto the other side of the banknote paper or a metallic layer, e.g. in the form of a strip or a label form, is applied to it.

Rectifying element 233 and LED 234 are likewise preferentially realized on the banknote paper typographically, in particular on the basis of semi-conductive polymers. Alternatively, Si- and/or III/V-semiconductor-thin-layer technology can also be used for the generation of the components. A different display can also be realized in place of an LED.

If a banknote equipped with an integrated oscillating circuit in this manner is brought into an electronic alternating field, preferentially in the radio frequency range, such as particularly preferentially e.g. 125 KHz or 13.56 MHz, emitting diode 234 is stimulated to illuminate in the visible spectral range by the energy absorbed in the oscillating circuit. This represents an authenticity feature with a very high rate of tamperproofness. The transmitter for the radio frequency field can be realized simply and inexpensively and e.g. integrated into a manual device or tabletop device, such as a register, for the testing of bank notes. Preferentially, the performance of the transmitter is dimensioned such that it can still stimulate banknotes to illuminate within a coverage range of some 10 to 30 cm.

EXAMPLE 46

FIG. 23 shows a further example of a banknote 1 according to the invention. It is distinguished in that it exhibits both an optical as well as an inductive coupling device.

Specifically, chip 3, or a separate region of the banknote 1 connected to it, exhibits a device for sending out an optical signal, such as an LED 235. The optical signal can be led via one or more photodiode sections 226*a* and 227*a*, to the outside edge of banknote 1 and out-coupled there. Further, banknote 1 also has an inductive coupling device 250 in the form of a coil 250. Coil 250 is connected with chip 3, and in this context, the banknote is designed as a noncontacting RFID Transponder. Alternatively, banknote 1 can also exhibit a capacitive coupling device in place of or in addition to the inductive one, as will be described in the following by way of example.

In that an inductive and/or capacitive coupling is also possible in addition to the optical coupling in the case of an individual banknote 1, measurements in a stack can be conducted significantly more reliably, as is described in more detail in the section "Stack measurement".

In addition to the inductively coupled transponders, as were described by way of example with reference to FIG. 23 in connection with an optical coupling, banknotes with a capacitively coupled transponders are also conceivable.

EXAMPLE 47

The preferential construction of such a banknote 1 is depicted in FIG. 30. Here, chip 3 is conductively connected with two large-surfaced, conductive capacitive coupling surfaces 256 as electrodes 256 via two lines 255.

The surface of capacitive coupling surfaces 256 is an important factor for the functional capability of capacitively coupled transponders in a stack. Coupling surfaces 256 can in fact also be integrated in the paper during paper manufacture, but they are preferentially applied onto the banknote paper. One manufacturing option, which is also of particular advantage in the manufacture of banknotes, consists in the printing technology application of such conductive surfaces 256. In this context, they can be applied over the entire surface of the carrier medium, in this case the banknote paper. They will at least take up at least 50% share of surface, preferentially at least 70% share of surface of a banknote side. As will be described more precisely, this has the advantage that the individual surfaces always overlap to form a capacitance arrangement, even in the case of a stack of banknotes with different dimensions, e.g. correspondingly different denominations.

E.g. conductive lacquers, which are advantageously largely invisible visually, can be used as printing ink. Coupling surfaces 256 of graphite materials, which can likewise be applied typographically, are also conceivable as an alternative to this—at least in the case of small shares of surface.

EXAMPLE 48

FIG. 31 shows a second example of a banknote 1 with a capacitively coupled transponder. In analogy to FIG. 46, it has two conductive layers 256 as capacitive coupling surfaces 256. By way of example, the banknote exhibits a hologram strip 258 with a metallic reflecting layer 257. The reflecting layer exhibits two areas 257*a*, 257*b* that are spaced-apart and galvanically decoupled from one another. Transponder chip 3, which is electrically connected with the two areas 257*a*, 257*b* via electrical lines 255, is affixed in the space between them.

In certain cases in the manufacture of banknotes, metallic layers 257, such as the exemplary hologram strip 258 with metallic reflecting layer 257 in the present case, can be applied onto the banknote paper through a transfer method. It is now possible to conductively connect chip 3 with metallic layer 257 of such a hologram strip 258 in a separate working step prior to application onto the banknote paper. Here, areas 257*a*, 257*b* of metallic layer 257 are connected with chip 3 via electrical lines 255.

Coupling surfaces 256 are now imprinted onto the banknote paper first. Hologram strip 258 is then applied such that an electrical connection is produced between coupling surfaces 256 printed on previously and metal coating 257 of the hologram strip 258.

An alternative consists in first applying hologram strip 258 with chip 3 onto the banknote paper, in order to then print coupling surfaces 256 over hologram strip 258.

These variations solve the problem that conductive dyes can not be contacted with a chip 3 by simple means using conventional procedures, such as bonding, soldering, flip-chip. It is to be emphasized that, in the above, the capacitive coupling surfaces were in fact only applied onto one side, but that they can, in principle, also be applied onto both sides of the banknote paper, which, in particular in the case of banknote stacks that have not been sorted according to their position, leads to more defined coupling relationships.

EXAMPLE 49

To prevent the destruction or detachment of optically, inductively or capacitively coupling structures that are not embedded in but rather applied onto the paper, as they were described by way of example in the above, the banknotes can be provided with an uppermost cover layer to protect these structures.

EXAMPLE 50

As was mentioned, a further idea consists in that a banknote exhibits a passive electrical, magnetic and/or electromagnetic structure, such as a passive oscillating circuit, which was described with reference to FIG. 29 by way of example. This passive oscillating circuit can have e.g. characteristic data, such as a resonance frequency, which is specific for the individual group of banknotes or at least for a certain group of banknotes. Thus, these oscillating circuit data can be specific e.g. for the country issuing the banknotes and/or for the denomination of banknote 1. These data can be used as an authenticity feature, in that e.g. the named resonance frequency is measured in an associated test device and compared with the expected values. In this context, provision can be made e.g. that the measured resonance frequency can only deviate very minimally, i.e. by a certain amount (e.g. +/−10 Hz), from the ideally expected resonance frequency in order to be recognized as authentic. This makes falsification of the oscillating circuit more difficult.

If the banknote also exhibits a chip in addition to the passive structure, an authenticity check can take place e.g. through a comparison of the measured resonance frequency with the ideally expected value, which is stored in the chip.

EXAMPLE 51

Particularly in the aforementioned example as well, it is essential to be able to adjust the properties of the oscillating circuit in a targeted and selective fashion. Several methods are presented by way of example, which permit scalable detuning both during paper manufacture as well as during printing/processing of the sheet material. This can e.g. take place in that, for different banknotes, there is an oscillating circuit, which is actually manufactured uniformly in principle, the resonance frequency of which is detuned in defined fashion such that different banknotes have different resonance frequencies.

As is commonly known, the resonance frequency of an oscillating circuit is directly dependent upon the total capacitance and the total inductance of same. Approximated, the resonance frequency fres of a transponder circuit can be represented through Thomson's oscillation equation for an ohmicly attenuated oscillating circuit:

$$f_{res} = \frac{1}{2\pi} \cdot \sqrt{\frac{1}{LC} - \frac{R^2}{4L^2}}$$

Here, L is the inductance, C is the capacitance and R is the ohmic resistance of the oscillating circuit. In the HF range, the frequency dependency of the inductive and capacitive resistance per se is actually no longer negligible, but Thompson's equation for an ohmicly attenuated parallel resonant circuit as here portrayed represents an acceptable approximation for illustration of the applied principles. One recognizes from the equation that the resonance frequency fres is directly dependent on the square root of inductance L, capacitance C and also ohmic load resistance R of the oscillating circuit, all of which, except R, are frequency-dependent. Thus, if one succeeds in influencing these variables in a targeted fashion, one then has a direct influence on the resonance frequency of the transponder.

As depicted by way of example in FIG. 32, a banknote 1 exhibits an integrated circuit, specifically a chip 3, which can consist of a(n) Si-chip, a polymer electronic circuit, a polycrystalline chip circuit (a-Si, p-Si) and/or also of combinations. Chip 3 is connected with a region on banknote 1, wherein the targeted detuning of the resonance frequency takes place, by means of electrically conductive connection pieces 413.

In this context, the region exhibits a layer 414 of thickness d1. This layer 414 can be embedded in the paper, but it can also be subsequently applied by means of transfer methods and can thus e.g. consist of a metallized foil strip 414 as well as out of a layer 414 of particularly conductive printing ink. Layer 414 must also not necessarily have the form of a strip. The following examples of application are now conceivable:

EXAMPLE 52

Detuning of the resonance frequency of foil strip 414 can take place through the incorporation into the paper suspension of a defined quantity of electrically conductive substances, such as electrically conductive fibers, preferentially corresponding cellulose filaments. They can e.g. be treated with conductive carbon black and can potentially be spun fibers. Alternatively or additionally, magnetic substances can also be incorporated into the paper mass. E.g. particles such as iron shavings, but also ferrite powder, are conceivable as magnetic substances.

The electrically conductive substances or, as the case may be, magnetic substances are incorporated in the paper web in a targeted fashion. This can e.g. take place through spraying onto the still-wet paper web being transported past, as a result of which corresponding strips 414 in paper 1 are formed. Here, a variation in the geometric dimensions, e.g. the width d1 of the strip 414 for the case named, can be used to vary the specific resistance (electrically conductive substances) or, as the case may be, the inductance (magnetic substances) and thus achieve targeted detuning of the resonance frequency. Thus, corresponding, scalable detuning can be produced e.g. through adjustment of the width d1 in dependence on the denomination of banknote 1.

Since sheet material, e.g. security paper is generally smoothed and/or calendared during manufacture, it is conceivable that a galvanic contact does not automatically always exist between detuning strips 414 and contact lines 413. It is therefore conceivable to "lasers away" the non-conductive layer on detuning strip 414 with a laser, e.g. an excimer laser, so that the connection stretches 413 to be printed then restore the galvanic contact.

EXAMPLE 53

A further example provides that the detuning is elicited through a correspondingly prepared strip 414. This is to be a thin sheet 414, which can be metallized, e.g. with aluminum; also copper or similar metals with a high vapor pressure are realizable. If this strip 414 is now applied onto the banknote paper by means of a transfer method, this thus takes place e.g. by means of a hot-seal adhesive. These lacquers and adhesives are non-conductive as a rule, which results in a galvanic interruption of the oscillating circuit. According to one variation of the invention it is therefore contemplated to first apply connection stretches 413 e.g. by imprinting with conductive printing ink and applying the strips afterwards, thus e.g. metallized foil strip 414, in a transfer method. That way, a galvanic connection is produced between connection stretches 413 and detuning strip 414.

As an alternative to the hot-seal adhesives mentioned, conductive adhesives can also be used, also conductive anisotropic adhesives in particular.

EXAMPLE 54

FIG. 33 shows yet a further variation, where a conductive ink or a metal are imprinted as a strip 414. This strip 414 can in turn also have e.g. a width d1 that is dependent on the denomination. If a non-conductive transfer strip 415 is now glued on, by way of example, provision can be made to provide two or more recesses 416 in transfer strip 415, which come to lie on the banknote paper in exact register after application over corresponding surfaces 417 in the printing surface, i.e. strip 414. Subsequently, e.g. a contact over recesses 416 with recesses 417 lying below can be established by imprinting with conductive ink in order to establish the galvanic contact to circuit 3, which is not depicted in FIG. 33. In this context, scaling of the specific longitudinal resistance is made possible through suitable selection of form, specifically of the width d1 of printing surface 414 and also of recesses 416. This leads to the desired detuning.

EXAMPLE 55

In the following an example for a banknote with a chip is explained that can not be addressed inductively or capacitively, but rather through a galvanic, i.e. direct electrical contact. In this context, the galvanic contacting will serve the current supply of the chip 3 in particular. Above all, such banknotes are suited to stack measurement, as is further explained in the associated section.

FIG. 34 shows such a banknote 1 with chip 3 that exhibits an electrically conductive layer 380 (shaded in the illustration) as a contact surface along each of its short sides. The layers 380 are thus electrically connected with the chip 3 over lines 381 that are in or on the banknote paper. The layer 380 is formed such that a conductivity of the banknote 1 across its cross section is ensured. That means that at least two contact surfaces 380 are incorporated on the upper and lower side of the banknote paper to supply the chips 3 with energy, which [surfaces] are conductively connected throughout the cross section of the banknotes and which can be connected with the voltage source through external contact clamps.

To this end, the layer 380 can, by way of example be designed as a conductive track 380 that is applied on the banknote paper around the side edges such that a direct electrical contact exists between the upper and the lower side of the banknote 1. Alternatively, the layer also can not only be applied and/or incorporated on the surface of the banknote, but rather e.g. take up the entire volume of the side edge. Here, such banknotes 1 can be manufactured e.g. through the scattering in of conductive fibers, e.g. in the form of steel strips along the edges of the banknotes 1. It is likewise possible, e.g. to apply electrically conductive polymers or, as the case may be, to imprint them as conductive printing inks such that they penetrate the cross section of the paper and thus establish the desired galvanic contact.

The track 380 is preferentially realized on □two opposite sides of the banknote 1, e.g. in the form of a track that surrounds the entire edge of the note 1 on the two short sides, as depicted in FIG. 34. The galvanically conductive layers 380 need not encompass the entire edge of the banknote 1. Even the execution of the contacts in the form of relatively small layers 380 already suffices if it is only ensured that these layers 380 can come in contact conductively across the entire stack. Likewise, the two layers 380 as contacts of the galvanic circuit, can also be executed on only one side of the banknote 1 in this embodiment.

EXAMPLE 56

FIG. 35 shows an alternative embodiment of FIG. 34, where, in addition to the conductive contact layers 380 for energy supply, the banknotes 1 are provided with at least a third contact 382 that is only active in the surface of the banknote paper and was created e.g. through imprinting. It is augmented by a fourth contact 382 on the back side of the banknote, where the third and fourth contact 382 are not galvanically connected with one another. These contacts 382 are again connected with chip 3 via electrical conductors 383 and serve to permit chips 3 in a stack to be able to also individually reciprocally activate or, as the case may be, address themselves, as explained more closely in the section "Stack measurement". To this end, contacts 382, just like contact layers 380, are positioned such that they lie above one another during appropriate stacking and thus establish the galvanic contact between every two bank notes that lie above one another. This can also be reinforced through ordered stacking.

By way of example, the geometry of the third and fourth contacts 382 can be executed such that each surface for itself lies roughly in the middle of the element and is executed e.g. in the form of a ring or a circle. The contacts 382 can, however, also be executed as polygons or in another form. To the extent that the contacts 382 overlap with the conductors 381, an intermediately placed electrical insulation is necessary.

EXAMPLE 57

In addition, it is also conceivable that one or more chips per banknote are incorporated or applied without any contacting. The chips then do not necessarily have the functionality for data transmission, thus potentially do not even need to function. The presence and/or the form and/or a surface structure, e.g. a surface pattern, and/or the position and/or the distribution of several such chips in or, as the case may be, on the banknote paper alone can serve as an authenticity feature. These chips can be very small i.e. e.g. invisible to the naked eye and optical or electrical test methods can, for example, be employed for testing.

Semiconductor Technology with Polymer Electronics

A further idea of the present invention consists of manufacturing transponder circuits based on a combination of procedures from semiconductor technology and polymer electronics. These ideas can be advantageously applied to all types of transponder substrates, be they rigid chip cards or also flexible substrates made of paper, polymers or metal films, etc. such as the sheet-shaped documents of value according to the invention.

In this context, semiconductor technology is understood to mean all processes belonging to silicon technology or the like, which work via elementary semiconductors or compound semiconductors. Thin layer technologies in particular find application in this context. In current semiconductor circuitry technology, nearly exclusive use is made of integrated circuits of elementary semiconductors (silicon, germanium), which have been superior in the points of production technology and price thus far. Nearly all components available on the market consist of monocrystalline, doped elementary semiconductors (essentially silicon), that have been sawn out of wafers. In that context, the doping (n- or p-) is needed to maintain the electronic carrier surpluses, upon which electrical conduction in semiconductors is based. Aside from the conventional element semiconductors, there also exist so-called compound semiconductors, which are composed of elements from different main groups within the periodic system. Examples of these are GaAs, InP, InSb and others. The mobilities of these "composite semiconductors" are, in part, clearly greater than for Si or Ge.

If these semiconductors are applied by means of thin-layer technology, a required bending resistance for flexible substrates can also be achieved, as is necessary for use in banknotes, etc.

Passive and active components produced from these materials distinguish themselves by stability with reference to carrier frequencies up into the high GHz range.

However, the disadvantage of known semiconductor technology in this context is the thickness of the monocrystals (wafer), which continue to exhibit a thickness of multiple 10 μm even after thinning, e.g. by abrading the non-active side with diamond paste, thus hampering use on/in substrates/carriers of comparable thickness, such as, e.g. paper. Moreover, the high piece counts that are required for applications in the area of security papers/smart labels are difficult to realize during application and bonding of the chips (e.g. by means of the flip-chip process).

As a rule, transponder systems consist of a coil, which is applied to the substrate in several turns either typographically or by etching, for example. In the current state of the art, the transponder chips are still too thick (even after thinning) to be applied to thin substrates with thicknesses in the μm range, as is usually necessary for use in the documents of value according to the invention.

In contrast, the manufacture of electronic circuits produced via polymer technology, so-called IPCs (integrated plastic circuits) of conductive polymers, proves to be advantageous in the present invention. Here, the polymers can be conductive (polyaniline) or also semiconductive (poly-3-alkylthiophene). The possibility of being able to apply the circuits required for this purpose typographically, even at minimal thicknesses in the μm range, is advantageous versus classic semiconductor technology. The big advantage of IPC lies furthermore in the possibility of applying the necessary structures to a carrier material typographically. The carrier material can be a plastic film or also a particularly smooth-surfaced paper instead.

As already mentioned in another location of the present invention, all semiconductor components known from semiconductor technology, such as, e.g. diodes, transistors, etc., can also be produced from conductive polymers via polymer electronics. It then also becomes possible to produce more complicated logic circuits such as AND gates, OR gates, NAND gates or similar with these polymer electronic (polytronic for short) base elements. The critical aspect, however, is that maximum limit frequencies reach only some 100 kHz on account of the rather limited electronic carrier mobility achieved in polymer semiconductors to date.

However, such frequency behavior is unsuitable for current RFID transponders according to ISO-14443 or, as the case may be, ISO-15693, which are triggered by external reading devices with frequencies of 13.56 MHz.

Normally, the interface between the analog, high-frequency transmission channel of a reading device to a transponder and its digital components is realized via a high-frequency interface, also known as an HF interface, which corresponds to the classical modulator-demodulator system of a modem and is described in greater detail in the "RFID- Handbuch", Finkenzeller, Klaus, 2nd Ed., pp. 242 ff., Hanser-Verlag, Munich, 1999. The HF-interface can serve to facilitate communication of the transponder with the reading device and the energy supply of the transponder via the high-frequency, or HF-signal for short, of the reading device, and in particular when the transponders are passive, it can do so with no energy supply of its own.

In the above, the reading device's modulated HF-signal of e.g. 13.56 MHz is demodulated in the HF-interface. At the same time, the system clock of the data carrier is derived from the carrier frequency of the HF-field. As a rule, the interface disposes of a load regulator for sending the data back to the reading device. The critical aspect in this regard is that the carrier frequencies lie in the range of MHz and above. In other words, the associated circuits must then also be able to work with these frequencies.

EXAMPLE 58

FIG. 36 shows a block circuit diagram of an inductively-coupled transponder 3 consisting of a logic portion 391 and HF interface 391 with a load modulator 392. In this context, the HF interface 391 is essentially formed by the analog input oscillating circuit 393 with transponder coil L and trimming capacitor C. Connected to this in series, is a rectifier 398, consisting, e.g. of a Graetz bridge 398 and a voltage stabilizer 399, preferentially a Zener diode 399. Parallel to the transponder oscillating circuit 393, a circuit 395 supplies the system clock for the data carrier. This circuit portion supplies the stabilized, equidirectional voltage Vcc, which provides the logic portion 391 with energy. Furthermore, a demodulation circuit 396 supplies a serial data stream to the logic portion 391 for further processing, as well as e.g. a load modulator 393, which sends back data to the external reading device. In this context, the logic portion 391 exhibits digital circuits 394 e.g. for control of the transponder, storage or encryption of data.

According to the invention, semiconductor elements from semiconductor technology are now utilized for the high-frequency range, and polytronic elements are now utilized for the digital, low frequency range of the transponder circuit. This makes it possible to work with sufficiently high frequencies at the necessary circuit locations when using thin and flexible substrates, thereby enabling the use of transponders in banknotes and the like in a more simple manner. As a result of this, transponder circuits can be realized for RFID systems in which limitation of the clock rate to the kHz range in the polymer electronic is circumvented by the additional incorporation of conventional semiconductor circuits which have no frequency limitation, such that these transponders can also be used in the HF range (mHz and higher).

Specifically, the high-frequency components of the HF interface are preferentially applied as element semiconductors or compound semiconductors, e.g. by printing, precipitation, vapor deposit or similar methods, whereas the low frequency components, such as the digital circuits of the logic portion 391, are produced by means of polymer electronics.

By way of example, oscillating circuit L and C, as well as rectifier 398, and, optionally, all further components of HF interface 390 as well, are thus operated at high-frequency, i.e. e.g. at 13.56 mHz or higher. In particular, however, stabilizer 399 can also be a component of logic portion 391 and then likewise be manufactured polymer electronically and only work at frequencies in the kHz range like its remaining components 394.

Likewise conceivable are designs in which both the high-frequency portion and the low frequency portion of the transponder circuit 3 are a combination of polymer electronic and conventional components. By way of example, thin-layer diodes can thus be integrated into the IPCs of load modulator 392 as well, just as polymer components can be integrated into rectifier and stabilizer circuits 398, 399.

Optical and/or Acoustic Playback Devices

As was described by way of the example above, a further essential embodiment of banknotes with electrical circuits can consist in the provision of one or more electrooptical and/or acoustic playback devices firmly integrated into the paper of the banknote. Aside from authenticity recognition, such devices can also serve further purposes, which are described in particular below and in even greater detail in the sections "Stack Processing" and "Commerce". By way of example, the playback devices can have the following properties.

An electrooptical display can exhibit individually or in combination e.g. a self-luminous optical display that radiates in the visible, infrared and/or UV spectral range and/or a non-self-luminous optical display and/or a display made of electronic paper and/or an LCD and/or an LED. In this context, the electrooptical display can exhibit a two-dimensional display surface, e.g. in the form of an LCD or also an approximately punctiform light source, such as a single LED.

In this context, electronic paper can, be understood to mean in known fashion, for example, a flexible substrate with rotationally or slidably controllable microcapsules embedded between electrodes. The manufacture from electronic paper has the advantage that the flexibility of the banknotes, which are mostly made of paper, is not impaired. Moreover, electronic paper exists for which the display remains intact even without external energy supply. This is particularly suitable for many applications involving banknotes. In order to recognize an external manipulation of the displayed text in this case, it is advantageous for additional information concerning the intactness of the information, e.g. in the form of a check sum or similar to be displayed or, as the case may be, for a digital signature or the like to be stored in the chip of the banknote in addition to the text to be displayed.

The display will preferentially be produced typographically in particular, e.g. by printing on the banknote with electronic ink, i.e. e.g. with printing ink that exhibits microencapsulated pearls. This provides a high degree of compatibility with the already known printing method for banknote production.

Alternatively, an acoustic playback device such as an electrooptical sonic transmitter and/or a reciprocal piezoelectrical sonic transmitter and/or a magnetostrictive sonic transmitter can also be used in place of the electrooptical display.

An advantage of such electrooptical and/or acoustical playback devices is that they constitute an authenticity feature readily verifiable by humans, which in addition can also not be deceptively imitated with copying technology. Moreover, these playback devices can also preferentially be incorporated as machine-readable security, i.e. authenticity features.

Thus e.g. an associated banknote processing machine can comprise a sensor device that captures, potentially in response to stimulus of the playback device by the machine, the optical or acoustical signals emitted by the banknote, as the case may be, and compares them with those measurement signals expected for authentic banknotes.

Associated banknotes will then be able to be recognized in particularly secure fashion, either automatically or by humans without the utilization of further aids, if the playback status of the playback device changes temporally.

EXAMPLE 59

In the simplest case, this can consist in playback that occurs only periodically. This can occur by having the playback device supplied with current, particularly by an energy source, for example by means of a photocell, a thin-layer battery e.g. paper-based or by an inductive coupling, and having it only light up or, as the case may be, send out sonic signals when supplied with energy. The variation is particularly preferred in which playback only occurs when energy is supplied from the outside, i.e. no energy sources or energy stores are present in or on the banknote itself.

In contrast to this termination of playback upon interruption of external energy supply, the case can also be advantageous in which the playback device exhibits an interface for the playback device's signal triggering, in particular along optical and/or electronic paths, which is particularly preferentially connected or connectable via a signal line to a control device integrated in the document of value or at least partially or completely external to it, which alters or can alter the playback status of the playback device in a temporally-predetermined manner.

In this case, the playback status can also be changed in a predetermined manner independent of energy supply. In this context, the time until a change can e.g. be set randomly or at one or more specific points in time or set to occur at defined time intervals.

EXAMPLE 60

A particularly simple example of this is a flashing display, e.g. a flashing, punctiform LED that lights up at predetermined intervals. In this context, the associated control data are preferentially stored in a memory of the control device.

In addition, not only can the playback status be changed by altering the brightness or volume, as the case may be, of the playback device for example, but the information content played back can itself be changed temporally.

EXAMPLE 61

In addition, a banknote can be designed such that it exhibits a photocell for energy supply on at least one side and a light-emitting element on at least the other side, each of which is connected to a chip in the banknote.

In this context, as FIG. 37 shows, the banknotes 1 according to one variation can have a thin-layer photocell 400 on the one side, which is connected with the banknote's 1 chip 3 for energy supply of the chip 3. This [chip] in turn is connected to a light-emitting diode located on the other side of the banknote, such as a laser diode 401. The connections are preferentially made by way of typographically applied contact lines 403.

This variation has the advantage that energy can be transmitted between adjacent banknotes in the stack, as subsequently described in detail with regard to FIG. 37 in the section "Stack Processing".

EXAMPLE 62

This can e.g. mean that the sonic transmitter plays through different playback frequencies or frequency sequences, or that different display patterns, such as signs or symbols, are played back in the case of a two-dimensional display surface. In order to facilitate the optical or acoustical differentiation of banknotes of different denominations, provision can be made for the playback statuses for different denominations to differ, e.g. through different tones, sonic frequencies or light signals.

EXAMPLE 63

An alternative possibility for transmitting information out of the banknote into its surroundings consists in the use of thermal radiation generated in the banknote.

To this end, in accordance with the information predetermined by the banknote's electrical circuit and slated for transmission, current is directed in the banknote through a number of electrical elements that act as resistors, which are embedded in or applied onto the banknote material, preferentially the banknote paper. It is hereby noted that this can also involve active electronic components such as transistors. Since they act as resistors for the physical principle of action, they will be designated using the term "resistors" in the following, if no explicit reference to electronic components is made.

The resistors heat up through the electrical power brought into them. The temperature change evoked can then occur either directly, e.g. through the use of a thermal image camera in an optical sensor, or instead indirectly through an indicator reaction. The latter usually creates the potential for optical demonstration of the heat brought in. Even though other indicator reactions, such as alteration of the conductivity of conductive elements that are likewise incorporated in or upon the banknote paper, are supposed to be explicitly possible in the region of the demonstration according to the invention of incorporated heat according to the invention, "displays" will be spoken of in the following for the sake of simplicity.

In contrast to the method described there, the display according to the invention does not, however, consist of simple LCR oscillating circuits like those according to DE 100 46 710 A1, for instance, which are caused to resonate by electromagnetic waves, but rather of active elements that represent an alterable condition of the banknote's oscillating circuit. In particular, display of the information available in the potentially present non-volatile memory of the electric circuit is provided for here as well. The current to be transmitted can also explicitly be an equidirectional current that is sent through the resistors.

As stated, the voltage supply of the banknote is also explicitly not limited to the reception of electromagnetic radiation. Very interesting applications result from the use of electromagnetic transducers in particular that convert deformational energy into the electrical energy needed for the voltage supply of the banknote; these will be described in detail in the following.

The resistors, through which current to heat the banknote is directed, can be arranged in various ways to display the information. Thus it is possible to arrange the resistors in simple barcode-like structures, bar-code-structures are realizable, segmental displays can be realized by way of the resistors, or it is even possible to realize pixel-based displays. The methods commonly used to trigger and realize the display of LCD notebook displays are to be used preferentially for pixel-based displays of this type.

In contrast to known methods, however, for the displays described here it is also possible to produce the entire display not from conventional wafer-based electronic components, but rather from components made of other materials, such as amorphous silicon or multicrystalline silicon.

Such pixel-based displays are however preferentially manufactured through the use of printable semiconductors such as organic polymers. In a printing process, a display of this type with the control lines and the transistors, as well as any potentially necessary additional resistors, which are, however, preferentially formed by the transistors themselves, can be printed and any printing ink to be potentially used, which contains the indicator material, can be applied over it subsequently. It is expedient for an indicator dye used in this way to simultaneously constitute a protective layer for the electronic components lying below it.

A banknote designed in this manner can also exhibit the feature that a portion of the electrical circuit on the banknote necessary for the overall functionality stretches across a large areal portion of the banknote. As a result, manipulations on the banknote quickly lead to a circuit on the banknote that is no longer capable of functioning.

Particular advantages then result for the displays on the banknote described above if the indicator substance contains features visible to the human eye, the information is rendered on the banknote in readable form, and the energy supply takes place by way of an energy carrier that is readily available to the general population, such as the deformational energy mentioned above, radio wave energy in the frequency range of mobile telephones or, however, solar energy. In this case, important information, such as the validity of a banknote or the like, can be portrayed in generally readable form on the banknote.

Quality Control during the Manufacture of Paper and Banknotes

An interesting area of application for the security papers or banknotes provided with a circuit lies in quality assurance 23 in the manufacture of paper or banknotes.

According to the invention, provision is made to follow the path and/or the particularly occurring processing steps of the security paper or banknotes within the paper factory 20 or banknote printing works 21 in simple fashion by reading data from or writing data to the circuit at arbitrary locations or production stages without contact, particularly by means of high-frequency electromagnetic fields or optically.

The data stored in the circuit preferentially consist of data identifying the particular sheet of paper or the particular banknote, such as serial number, denomination, issuing country, currency and/or production dates. By reading out these data, the particular sheet of paper or banknote can then be identified.

Among other things, this plays an important role in controlling the destruction of paper sheets or individual banknotes that have not been manufactured properly and which are routed to a destruction device 24, particularly a shredder, subsequent to quality inspection. The individual sheets or banknotes slated for destruction can be identified by simple, noncontacting readout of data from the circuit right up to before the cutting tools of the shredder and can thus be traced in essentially uninterrupted fashion. In this manner, a nonauthorized removal of the security papers or banknotes slated for destruction can be particularly reliably monitored. Alternatively or in addition, the banknotes intended for destruction can be cancelled during the inspection or just before the shredder by writing the corresponding information into the memory of the banknote as already explained above. Alternatively, the entire contents of the memory can be deleted, e.g. by irradiating light from a UV flashlamp.

In addition, data relating to the processing or finishing steps that are being performed or will be performed on the security paper or on the banknote can be stored in the circuit. In this case, particularly in the context of the quality assurance 23, one can, by reading out the stored data, check whether the paper or the banknote has completed all required finishing steps and whether they were executed in an orderly manner or a faulty manner.

During production, it can be particularly advantageous to use larger or, as the case may be, more or all of the memory portions of the chip, even if, for a later application, only portions of the memory can be used and these portions, in turn, can only be used by different user groups or for different application purposes. In this case, the limited access privileges for the memory regions are not able to be permanently introduced until after the chip has been successfully produced, by the corresponding memory regions, for example, being permanently, e.g. by severing fuses through burning, and appropriately designed such that they are protected against writing.

The invention can also be utilized to advantageous effect in the banknote processing machines provided for quality assurance 23. In these machines, the finished banknotes are provided in stacks, drawn in individually, transported along a transport path and inspected for various properties and security features. Undesirable malfunctions in which several banknotes are pulled in simultaneously and transported further and/or a jam of banknotes arises, can occur repeatedly during transport through a machine such as this, however. In these cases, it is advantageous if data, particularly the serial numbers, of the bank notes being drawn in each case are read out and stored in the machine control during their separation. These [data] can then be queried again upon correction of the malfunction and renewed set-up of the banknotes, which have been multiply drawn off or jammed, for renewed inspection, so that any unauthorized removal of banknotes during the correction of the malfunction can be readily demonstrated.

Transport of Banknotes

A further important area of application for the invention lies in the area of banknote transport.

By noncontacting readout of the circuit located on the particular banknote using the apparatuses and methods described in greater detail below, banknotes can be identified simply and rapidly at arbitrary stages in their circulation. Data on the identity of the banknotes are registered in a central monitoring device as applicable. These data allow the path taken by a banknote during its circulation to be reconstructed.

The identification and, if need be, registration of the banknotes can already take place during their manufacture, i.e. in the paper factory 20 of FIG. 1 and/or in the banknote printing works 21, or not until their circulation in the area of a central bank 25, a commercial bank 26, and/or a business 30 in various apparatuses, such as processing machines 31, money dispensing machines 27, money depositing machines 28, combined money depositing and money dispensing machines 29 or automatic money input devices 32. In general, it is also possible to install corresponding scanning apparatuses in transport vehicles, which apparatuses register the incoming and outgoing lots of banknotes.

As will be explained in detail in the section, "Disabling and Enabling of Banknotes", a further advantage of the invention is achieved in that the circuit located on the paper or, as the case may be, on the banknotes can be switched or written to in such a manner that the paper or the banknotes can be temporarily blocked from any use in machines, particularly from payment at machines. Release of the banknotes for further use in machines can first be undertaken by a central bank 25 or commercial bank 26, preferentially by entering a secret password or by triggering a particular operation in the circuit, shortly before the banknotes are once again put into circulation.

Thefts or holdups in the area of paper and banknote manufacture or, as the case may be, during the transport of finished banknotes from the banknote printing works 21 to a central bank 25, and, as applicable, from it to a commercial bank 26, are thereby rendered unattractive, since disabled banknotes will be recognized as such at registers or machines equipped with the corresponding reading devices, such that a payment or deposit will be refused. Should these banknotes again be put into circulation again at another location, i.e. at locations at which no communication with the circuit is possible, at least it will be possible at a later time to recognize that the money was stolen, thus potentially allowing valuable conclusions to be drawn.

The disabling of the banknotes described above is of particular advantage for the automatic dispensing machines 27, automatic deposit machines 28, combined automatic deposit and dispensing machines 29 and containers described in greater detail below, and/or also for the banknotes stored in transport vehicles, since any banknotes withdrawn illegally by break-in or sabotage and thus disabled will be readily recognized with the corresponding scanning apparatuses upon an attempt to place them in circulation.

Altogether, this variation of the invention is utilizable in various applications and case scenarios.

EXAMPLE 64

By way of a temporary cancellation and/or marking, it is thus also possible for the money stored in the particular devices to be acknowledged as non-interest-bearing property of the central bank 25, the so-called minimum reserve. Moreover, the registration of banknotes allows money flows of black money, stolen money or extorted money to be monitored in simple fashion. For this purpose, e.g. when money is being disbursed, the identity of the banknotes disbursed, in particular their serial numbers, together with data on the recipient, can be stored. Other applications are described more closely in the section "Disabling and Enabling of Banknotes".

Containers for the Transport of Banknotes

In order to be able to utilize the invention in particularly advantageous manner during the transport of banknotes, special containers for the transport of banknotes are provided. In this context, containers in the broader sense of the word are understood to mean all devices in which banknotes can be brought together and transported. This includes in particular safes, cassettes made of metal, plastic or cardboard, paper packagings, small sacks or bags made of paper or plastic, as well as bands. These containers are usually characterized in that they can be closed in such a manner so as to render impossible an unrecognized external access without manipulation to the container.

The containers, particularly cassettes, can, for example, be provided with an antenna and/or a reading, writing and/or checking unit, which is particularly able to read, alter and/or check the stored contents of the circuits of the banknotes located in the container.

The necessary apparatuses and methods, explained in exemplary detail in conjunction with the testing of banknotes in stacks further below, can also be employed in such containers.

In this way, data which identify the banknotes, such as the serial number, can first be read in the container, such that—depending on the particular application case—an identification of the banknotes slated for transport by means of an external inspection device can be omitted. The contents of the container are preferentially registered by the container itself and, as necessary, checked so that monitoring of the contents, in particular during transport, upon storage, upon handing over or upon transmission of the banknotes can be recognized by the container itself without the need of having to open it for this purpose. This also applies particularly to automatic tellers, where banknotes can be dispensed from cassettes and/or fed into these cassettes or other cassettes.

As a result of the fact that the contents of the cassettes can always be determined completely, correct taking of inventory can even be effected during a jam or a temporary error or, as applicable, failure of checking and/or evaluation devices of the machine, without the need for the cassettes to be opened.

EXAMPLE 65

Moreover, provision can be made that data, for example relating to the course of transport, are written into the memories of the circuits by the container's writing unit. In this manner, the transport route can be recorded in the banknotes.

In particular, the container can exhibit walls, e.g. of electrically-insulating material such as plastic, which, at least in part, do not screen out electromagnetic fields, so that the circuits of the banknotes located in the container can also be read from, written to and/or checked from the outside by means of high-frequency alternating fields.

Altogether, containers of this type allow the value, i.e. in particular the total value and/or the denomination of all the individual banknotes located in the container, to be determined at any time. During transmissions, uncertainty over the contents being handed over or time-consuming recounting is eliminated. In this way, money transfers, the handling of money and the control of money flow are made fundamentally simpler, faster and, above all, more secure. In this way, the entire monetary cycle can be monitored in an effective fashion.

EXAMPLE 66

It is principally possible for the container itself, by means of its writing device, to input this information, the data referring to the value and other data concerning the banknotes, such as transactional and/or transport data, into some or all of the banknotes contained in the container. However, additional or alternative provision can also be made for the container itself to likewise store e.g. the total value of the banknotes stored in the container in a nonvolatile memory. If both possibilities are realized, a check for manipulation of the container contents can also be conducted e.g. by a comparison of the indications of total value that are stored in the banknotes with those that are stored in the container.

EXAMPLE 67

For instance, in the case where the memory of the chip in the banknotes exhibits a write-only memory area that cannot be read out again directly, an examination of security against manipulation can consequently occur such that the total value present in the memory of the container is sent to the banknote for examination. If this value is the same as the value recorded in the banknote, it will be assumed that the contents of the container were not manipulated.

EXAMPLE 68

Security against undetected manipulation of the container contents can be increased by using an asymmetrical PKI encryption method. For this purpose, the banknote processing machine, by which the container is filled, can, for example, write the total value of the container contents into the banknotes and/or into the container. In the above, the total value prior to input is encrypted with a private key from the filling location and can be decrypted with the public key of the banknote processing machine performing the filling after receipt of the container and, as applicable, any legally-occurring removal of the banknotes contained therein. If the total value is written into both the banknote and the container, it even becomes expedient to utilize two different private keys for the encryption of the two numbers for the total value.

For instance, in the case where the chip exhibits a write-only memory area that cannot be read out again directly, but instead only responds to a query as to whether a second transmitted value is identical to a value written in initially, a check for manipulation can occur in that the potentially unencrypted total value present in the memory of the container is sent to the banknote for examination. If this value is the same as the potentially unencrypted value written into the banknote, the banknote will report this fact to the emptying banknote processing machine and the assumption will be that the contents of the container was not manipulated.

This method already constitutes a certain security against undetected manipulations, since, for an undetected removal, the data for the falsified total value are written into both the container and to one or more, preferentially all, of the banknotes. Nonetheless, security can be raised even further through the use of encryption. To accomplish this, the total value of the container is written into the banknotes in a) encrypted or b) unencrypted form, and to the containers in encrypted form. On the one hand, the recipient can now decrypt the total value contained in the container with the public key from the filling location and thus determine the total value of the container at the time of filling. On the other hand, he can determine manipulations of the number written into the container by comparison of the a) decrypted or b) still-encrypted number with the contents of the banknotes.

An attacker of the contents of the banknote transport containers will not succeed by combinatorial means in removing a number of banknotes and determining values for the numbers in the banknotes and the container which produce a positive comparative result subsequent to encryption. The only means with a promise of success for a thief would be to read out the encrypted numbers for the total value of a container of known contents and to empty another container with a higher total value such that its contents corresponded to that of the first one and to write the corresponding data into all the banknotes as well as into the memory of the container.

EXAMPLE 69

Therefore, security here can be raised even further yet, by storing additional information in the container and/or the banknotes, which information also differs for two filled containers that have contents of like value, and by likewise encrypting this information in the way described above. For example, a combination of a portion or all of the serial numbers of the banknotes contained in the container can be used for such information.

EXAMPLE 70

A further form of container for the transport of banknotes then results when a non-volatile memory of the container contains the data for a portion or all of the banknotes contained therein. For this purpose, for example, the data of all of the banknotes that are slated to be transmitted to the container are sent to the container before, during or after filling, either from the device filling the container or from the banknotes themselves.

Upon inquiry by the device processing it, the container can now supply the data of the banknotes which it contains and/or data written into the banknotes which it contains. The container can, however, also be formed such that it accepts the data intended for writing into the banknotes, holds them in its memory and that the intermediately-stored data are not written into the corresponding banknotes until removal of the banknotes contained in the container.

The communication with the container can take place via a transmission method that is different from the communication with the banknote; in this context, e.g. considerably higher transmission speeds can be achieved than by direct communication with the banknote.

Additionally or alternatively, the container can also exhibit an identical transmission method, such as communication with the banknote; however provision can then preferentially be made to reliably prevent direct communication with the banknotes located in the container in order to unequivocally clarify responsibility for the sending and receiving of information. In this case, a reading device can communicate with a banknote, a stack of banknotes or a container in the same way.

For two reasons, this makes possible communication with a significantly larger number of banknotes than is possible in unpacked form. On the one hand, because the capabilities and the reliability of anti-collision methods limit the number of banknotes that are reliably addressable without collision in a given time period.

However, the container, which knows the relevant data of the banknotes it contains, can transmit these data to a readout device in a suitable form precluding all forms of collision. On the other hand, because the transport of energy for generating the supply voltage in very large quantities of banknotes is significantly more difficult to manage than the transport of energy for operating the container.

EXAMPLE 71

FIG. 38 shows an example of a container 350 according to the invention. Specifically, cassette 350 has a housing 351 of known type with an optional lockable opening 352 for the insertion of banknotes 1. In this context, the banknotes can be placed upon a base plate 353. It can e.g. be designed to be adjustable in height within the cassette. According to the invention, cassette 350 contains at least one test unit 354 for optical and/or inductive and/or capacitive reading and/or writing of data from or to the electrical circuits of the banknotes 1.

In this context, this checking unit 350 can be designed as indicated in the aforementioned examples and in the chapter on stack processing. It can exhibit a row of inductive coupling antennas in the direction of height H, for example, that can read data from or write it into the banknote chips. Alternatively or additionally, the floor of the cassette housing 351 or the base plate 353 can also exhibit a further test unit, for example.

Band with an Electrical Circuit

The properties of the containers for transport of banknotes according to the invention can also be applied in particular to the disposable containers, so-called safe bags, used in the transport of valuables. Explicit reference is also made to the meaningful application of the aforementioned properties to containers as separating agents, i.e. the use as separator cards, such as header cards during the processing of deposits.

As an alternative to the variations described above, e.g. the band are also preferentially provided with an integrated electrical circuit, i.e. a chip.

EXAMPLE 72

An exemplary embodiment of such a band is shown in top view in FIG. 39 and in side view in FIG. 40. Individual banknotes 1 are enclosed by the band 40 and thus held together as a small packet 43. Band 40 is designed as a strip made of flexible material, e.g. made of paper or a plastic foil, which adapts to the shape of small packet 43 and surrounds it. Band 40 is provided with a circuit 3, preferentially a chip. Beyond that, a transmission device 42 for energy transmission and/or exchange of information with circuit 3 is incorporated on band 40.

Circuit 3 can already be integrated into or applied to band 40 during manufacture. Alternatively, circuit 3 can also first be applied during the banding process, during which a small prepared packet 43 is provided with the band 40, or else applied to band 40 subsequently. In this variation of the invention, circuit 3 is preferentially applied onto a backing film 41, which is applied, preferentially glued, to band 40. The band can also exhibit another arbitrary form, e.g. at least represent an envelopment of the small packet that is so full that no banknotes can be removed from the banded small packet.

Transmitting unit 42, in this case an antenna coil, can likewise be applied onto backing film 41 and applied onto band 40 along with circuit 3. Preferentially, backing films that exhibit no stability of their own are used, so that they are inevitably destroyed upon removal. In this case, unauthorized removal of backing film 42 provided with circuit 3 or, as the case may be, transmitting unit 42, leads to their destruction, such that very good protection against manipulations is provided.

As already mentioned, circuit 3 and/or transmitting unit 42 can be directly printed onto the band 40 in an alternative embodiment. Very good protection against manipulations is also given in this variation, since circuit 3 or the transmitting unit 42 can practically only be removed from band 40 with self destruction.

EXAMPLE 73

A further embodiment of the invention is depicted in FIG. 41. In this example, the two terminal regions 44 and 45 of band 40 are glued together with a backing film 41, upon which circuit 3 and transmission unit 42 are located. Unauthorized opening of band 40 by removal of backing film 41 would have as a consequence the destruction of same, including circuit 3 and transmitting unit 42. Any manipulations are therefore readily visible and can, in addition, be easily demonstrated by checking the functionality of the circuit.

EXAMPLE 74

FIGS. 42 and 43 show a further embodiment of the band 40 according to the invention in top view or side view, as the case may be. Circuit 3, situated on band 40, is provided with a transmitting unit 42, which runs along band 40 and extends over several sides of the banded small packet 43. In the example shown, transmitting unit 42, designed as a closed coil antenna, extends across four sides of the small packet, in that it surrounds said packet like a closed loop.

In principle, provision can be made for chip 3 on the band 40 to exchange data with banknotes 1 in small packet 43, which likewise exhibit a chip. The resultant advantages correspond to those which were already described above in connection with containers for the transport of banknotes.

Analogous to the integrated circuits in or on banknotes, chip 3 on band 40 is designed for the storage and/or processing of data. In particular, information about small packet 43 and/or individual banknotes 1 in small packet 43 are stored in chip 3 of band 40. In particular, this information concerns the transport course of a small packet, e.g. the time at which small packet 43 was at a particular location. A reconstruction of the transport can be performed from the data stored in chip 3.

The data for the banknotes assigned to the band can also be contained in chip 3 of band 40. As long as the small packet is enclosed by the band, the data exchange can also preferentially only occur via chip 3 of band 40, which has great simplification and an increased read-security as a consequence, since now, each individual chip on the banknotes in the small packet no longer needs to be queried separately. The data of the individual banknotes are preferentially made available in a storage device, if necessary, after each individual banknote has been separated and checked. In this process, banknotes with a defective chip can also be captured and taken into account in the band's information.

A band with an electrical circuit can be particularly advantageously employed if the data storage and transmission described in the section on containers for the transport of banknotes are incorporated into said band and communication takes place exclusively via the band's chip. In banded small packets of e.g. 100 banknotes, the number of banknotes addressable in one process step could be increased by a factor of up to 100, without generating additional time, effort and costs for more sophisticated anti-collision algorithms.

In a further variation of application, the serial number of chip 3 situated on the band is brought in as a unique feature for establishing or checking the identity of the band.

Before going into the preferred embodiments of processing apparatuses, etc., a plurality of concepts according to the invention shall now be described, which can be applied to great advantage in said apparatuses, but also in the other apparatuses described in this application.

Stack Processing

As already mentioned repeatedly in the above, a particular advantage of using banknotes with a chip or an electrical circuit is that stack processing is made possible. In this context, stack processing is understood to mean that a stack of banknotes is processed. However, stack processing also makes it possible to process a "stack" consisting of just one individual banknote as well. This means that one or more banknotes are made available in a stack and e.g. one or more properties of the banknotes are preferentially measured and/or determined in a stack. In particular, such properties also concern the total number of banknotes, the value of the individual banknotes and/or the total value of all banknotes and/or their serial numbers or other individual data that are specific and unique to the particular banknote. This method thus makes possible particularly simple determination of total value in the stack, even for banknotes of differing denominations.

In comparison to the known methods, in which e.g. to determine the value of a stack of banknotes, the banknotes must first be separated and subsequently individually assessed with respect to their denomination, the method according to the invention brings enormous simplification and time-savings to stack measurements.

In particular, stack processing is understood to mean the case that, in order to measure and/or then consequently determine the properties of the banknotes, measurement signals are obtained, and, as applicable, subsequently evaluated via communication with the banknotes in the stack. In this context, communication is understood to mean a signal transmission from the banknote, in particular the banknote's chip, to an external measurement or evaluation device, as the case may be and/or a signal transmission from the measurement or evaluation device, as the case may be, to the banknote, in particular the banknote's chip. Therefore, aside from the determination of banknote properties, the case can also be meant where signals are transmitted to the banknotes in the stack in order e.g. to write data to the storage area of the chips of the individual banknotes.

In this context, the communication will preferentially be noncontacting. This can e.g. be achieved by inductive and/or capacitive and/or optical and/or acoustical and/or microwave coupling. By way of example, the photodiodes named above can be used in the banknote for an optical coupling. As already portrayed above, transponders, such as a coil coupled to the chip, capacitive surfaces or antenna arrangements for inductive coupling or capacitive coupling, as the case may be, in banknote paper are incorporated in and/or applied to the banknote for inductive or capacitive coupling, as the case may be. By way of example, banknotes with a capacitively coupled transponder chip can thus exhibit conductive regions on the front and/or back side, such as in the form of hologram strips containing metallic layers. The stacking of several such banknotes leads to a serial connection of capacitors, which, by way of example, can also be used for simultaneous energy supply to the individual banknotes during measurement. If e.g. each banknote exhibits an electrically conductive region, the distance between the conductive regions of two adjacent banknotes will thus be largely independent of the position in which the banknotes find themselves. This makes possible particularly readily reproducible coupling in the stack.

For inductive, capacitive or optical coupling, as the case may be, the sender and/or receiver are preferentially arranged in the same region of the banknote relative to a corner and/or edge, independently of the banknote's denomination. As a result, by orientating a stack of banknotes in relation to this corner or edge, effective coupling of the individual banknotes becomes possible even for stacks with banknotes of different denominations.

Furthermore, the properties of the individual banknotes are preferentially measured one after another or, as the case may be, the banknote chips are written onto one after another. For one, that can mean that, although several or all of the stacked banknotes emit a measurement signal, only the measurement signal of an individual banknote will be picked up and evaluated in an associated evaluation device at any given time. It can also mean, though, that the banknotes are only activated individually one after another to emit a measurement signal. As mentioned above, the activation of the banknotes and the subsequent emission of a measurement signal to an external evaluation device preferentially occurs according to an inductive, capacitive, optical, acoustical and/or microwave coupling method, whereby either the same or different coupling methods are used for activation and signal emission.

Another method for activating banknotes in a stack individually can consist of individually activating the banknotes individually by means of pointwise illumination of a photodiode integrated into the banknote, as has been described in greater detail in the above. For this purpose, the photodiode is preferentially arranged on an edge of the banknote and the light coming from one side is irradiated onto the stack of banknotes and, one after another, onto the photodiodes of the individual banknotes. Via an optical interface, the irradiated light will cause the banknote's chip to emit, by means of a transmitter that is connected to the chip by a signal line, a response signal in response to the optical stimulus. The response signal can e.g. likewise occur through activation of a light-emitting element, such as an LED, whereby the light emitted from said element, e.g. via the photodiode through which the excitational light is irradiated into, or though a further photodiode integrated in the banknote paper, is sent outwards to an evaluation device. Alternatively, a controllable see-through window with e.g. alternating transmission or polarization is also possible as an output medium. Alternatively or additionally, the response signal can also be emitted by means of inductive and/or capacitive coupling.

EXAMPLE 75

FIGS. 44 and 45 show an example of an associated measuring device, i.e. reading device 220 with optical coupling in a view from above (FIG. 44) and from the side (FIG. 45). In this context, for example, the banknotes exhibit two photodiodes 226, 227 incorporated in the banknote paper, both of which are connected to a roughly centrally-incorporated chip 3 by means of a non-depicted optical interface. In this context, chip 228 can be activated by irradiation from both photodiodes 226 and 227 and sends the response light into the other particular photodiode by means of a non-depicted optical transmitter, such as an LED. In this case it is preferable that one LED apiece be present for each of photodiodes 226, 227, which can be selectively stimulated to emit light by chip 3. In order to avoid the necessity of a targeted deflection of the emitted light beam to either the one or the other photodiode, the response light can also be sent out to both photodiodes 226, 227, in particular by a single LED. As an alternative to the two photodiodes 226, 227, it is also possible to use a continuous photodiode, upon which the chip is applied, e.g. glued or hot-pressed, so that in-coupling and out-coupling of the data does indeed take place on the common photodiode, but input and output are performed separately at the two ends. A separation of the signals can be accomplished in known fashion by data systems technology or with optical filters.

The device 220 comprises a base surface 221 and two side walls 222, 223. Banknotes 1 are laid down on the base surface 221 in flush stacks and oriented in relation to left side wall 222. A light source, such as a laser 224, adjustable in height H, is arranged in or on left side wall 222. For this purpose, e.g. laser diodes 224 are used that generate a focal point in the area of left [bank]note edge 225 in a magnitude corresponding to the diameter of the left photodiode 226 of e.g. 0.03-0.08 mm.

For measuring the banknote properties, laser 224 is moved by automatic drive from below to height H, so that the light beam emitted by it successively passes over the output region 225 of photodiode 226 of all banknotes 1 in the stack once. In this way, the LEDs of banknotes 1 are successively activated by means of chip 3 and in each case emit light through the other photodiode 227, which light is captured by a detector 229 that is integrated in or on the inner side of the right side wall 223 allocating the stack of banknotes. In this context, detector 229 exhibits e.g. a CCD surface, the dimensions of which extend over roughly the entire height H of the potential stack region.

Whereas in the above, the case was described where laser 224 is moved to height H, the successively-occurring focusing of the laser beams on the individual photodiodes 226 can also be realized with a stationary laser by means of correspondingly-adjustable imaging optics and/or in that several laser diodes are distributively arranged in side wall 222 at height H, which diodes can be selectively activated successively to emit light.

Moreover, it is also not imperative to work with a punctiform focal point. Since banknotes 1 are usually not in exactly flush orientation in the stack, photodiode 226, which is roughly punctiform in cross section, of an individual banknote 1 would then be struck better if the light beam were focused in the shape of a strip, in other words, if the light beam extended in a direction roughly perpendicular to stack direction H and to the illuminated sides of the banknotes 225. In this case, the stimulus light can be reliably focused on the individual photodiodes 226 without the effort of additional post-adjustment for individual banknotes 1, even in case of positional shifts of the individual banknotes 1 in the stack relative to one another and/or in case of stacks with mixed denominations, where the photodiodes 226 lie in different positions on the side of the illuminated banknotes 225.

In these and also in all other cases where an optical response signal is generated for measurement, the denomination of the emitting banknotes 1 can be determined in simple fashion by frequency analysis, specifically via recognition of the specific wavelength and/or modulation pattern of the optical response signal captured e.g. in detector 229, provided the light frequencies emitted by the banknotes are designed to be nominal-value-specific.

EXAMPLE 76

FIG. 46 shows an example of a modified version of measuring device 220 from FIGS. 44 and 45 in a view from the side. Measuring device 220' serves to examine banknotes by the stack, with both optical, as well as inductive and/or capacitive coupling elements, as described by way of example by means of FIG. 23. Coupling of the banknotes by inductive means or capacitive means, as the case may be, requires a lesser adjustment effort than optical coupling, e.g. as per FIGS. 44, 45, since the inductive coupling or capacitive coupling, as the case may be, is less dependent upon the exact placement of the banknotes in the stack. By having readout of the banknotes take place by optical means, however, this process, on account of the negligible interaction of the out-coupling signals of the individual banknotes in the stack, is more readily possible than e.g. with the help of the anti-collision method described below for inductive coupling. Although analogous action is therefore also advantageous for a capacitive coupling, the following will deal specifically with an inductive coupling.

The measuring device 220' of FIG. 46 distinguishes itself from those of FIGS. 44 and 45 in that it exhibits a device 251 for generating an inductive alternating field, such as a coil 251 as coupling antenna, instead of a light source 224. In this context, coil 251 preferentially extends essentially parallel to the stack area 221 for banknotes 1 and is so designed that the magnetic field lines generated run essentially perpendicular to the surface of coil 251. Although a variation is indeed depicted in which coil 251 is mounted above the stack of banknotes, but said coil would preferentially be present on or in the base surface 221, upon which the banknotes 1 to be checked are stacked.

In order to supply the stacked banknotes 1, which can be manufactured in accordance with FIG. 23, in the measuring device 220' with energy, an alternating magnetic field is generated through coil 251 at a frequency preferred for the RFID system 3, 250 of the banknotes 1 for an effective coupling of 13.56 mHz. The field strength of this magnetic field will be multiple times greater than that which would be necessary for the energy supply of an individual banknote 1.

In addition, it is possible to send data to chips 3 in the banknotes 1 by modulating the alternating magnetic field. In this context, all banknotes can be addressed simultaneously, i.e. be coupled.

The high field strength required, as well as the strong inductive interaction between the individual banknotes in the stack, hamper the sending back of data from chips 3 to the reading device 220'. A variation to the solution of this problem consists in a load modulation of the chip. Preferred, however, is the depicted variation with optical signal out-coupling, by which the signal generated by the LED of the banknotes is directed through photodiodes 226*a*, 227*a* to the edge of the banknotes. One advantage of sending the signal to two opposite edges via photodiodes 226*a*, 227*a* is that the orientation of the banknotes in the stack is inconsequential to the measurement. That means e.g. that device 220' can also check a stack in which banknotes 1 with the front side pointing up and down are present simultaneously.

The out-coupled optical signals are received by a sensor 229, which is preferentially a CCD sensor 229 with a rectilinear resolution, so that a plurality of optical signals can be simultaneously received and evaluated in parallel.

The transmission of data by the emission of optical signals can be initiated via control data that are sent to the chips via the inductive coupling. The separate, parallel evaluation of the signals sent from the individual banknotes 1 in the stack via the photodiodes 227*a* makes possible the simultaneous readout, processing and storage of the data from all banknotes 1 in a stack.

EXAMPLE 77

The following is a variation for reading devices with inductive coupling. Although the coupling antenna 251 is preferentially arranged above or, as the case may be, below the stack of banknotes in the embodiment according to FIG. 46, provision can also be made for it to be situated on the side of a stack of banknotes 1 to be examined. In analogy to the variation according to FIG. 45, provision can e.g. also be made for such a coupling antenna to be height-adjustable in direction H lateral to the stack of banknotes, exactly like light source 224, which functions as an optical coupling antenna. Alternatively, provision can also again be made for several coupling antennas arranged in rows that extend in direction H, i.e. roughly perpendicular to the stack area 221.

In this case, according to the height of the banknote stack to be checked, the stack measurement can be performed by moving the coupling antenna up in height or, as the case may be, by successive activation of the coupling antennas arranged in rows, such that only a limited number of banknotes of the stack are supplied with sufficient energy and addressed in each case. In this context, to the extent that the field strength of the coupling antennas is selected to be sufficiently small, it can, in the ideal case, be achieved that only one individual banknote, i.e. the banknote closest to the coupling antenna, is addressed at a time. Otherwise, it can at least be achieved that only a limited number of banknotes in a stack are addressed simultaneously, as a result of which any potentially necessary anti-collision measures are simpler and faster to execute on account of the lower number of transponders coupled in. In other words, agents are thus introduced to "displace" the external checking unit spatially, specifically translationally, in order to be able to address other transponders in the stack in temporal succession.

Moreover, in comparison to optical coupling, this variation of inductive coupling provides the advantage of lesser adjustment effort and places fewer demands on exact orientation and positioning of the banknotes in the stack.

EXAMPLE 78

As an alternative or to supplement the preceding examples, provision can also be made that the banknotes 1 are additionally provided with a device for inductive out-coupling. Thus, chips 3 can e.g. exhibit a device for the generation of a load modulation. This makes possible the readout of chip data from individual, non-stacked banknotes 1 by means of inductive coupling over a stack measuring device, i.e. stack reading device, even beyond those described by way of example in the above. This is e.g. an advantage for mobile reading devices or also in [cash] registers, as will be more closely described in the following sections.

If signal coupling is possible using both inductive as well as optical means, various methods of selection or, as the case may be, switching between the optical coupling and the inductive coupling are conceivable. For one, it is conceivable that both methods are simultaneously activated or will become activated, upon stimulation of the banknotes, e.g. through inductive coupling by means of coil 251. In this case, both types of reading devices, i.e. with inductive sensors or, as the case may be, optical sensors, can be employed without the need for a switching procedure or the like. However, this variation has the disadvantage that the parallel operation of both coupling methods increases the energy requirement for chips 3.

Therefore, only one of the two inherently possible methods is preferentially selected. Within this meaning, e.g. a selection or switching between inductive coupling, i.e. load modulation, and optical coupling can take place by way of a specific control signal, which is sent to chip 3. In addition, it is possible to define one of the two methods as preferential, which method is always active initially, as soon as chip 3 is supplied with energy. In this case, when the method not defined as preferential is used, switching by means of a control signal sent to the chip 3 would likewise take place. Such a control signal would preferentially be cryptographically encrypted to only allow readout in reading devices 220' intended for this purpose.

A further variation for activation or, as the case may be, switching consists in using specific switch-on sequences or codes which are not contained in normal data transmission from the measuring device to the chip. These can, for example, be realized in that, for a bit encrypting, specific codes that are not contained in the transmission of "1-", "0-", "Start-" and "Stop-" signals are reserved and can therefore come into exclusive use for switching the transmission method.

In this case, but also particularly in the case where, aside from optical and inductive coupling, capacitive signal transmission from the chip to the reading device is possible, the chips will be prompted by specific control signals to use a coupling method specific to the particular signal.

Alternatively, it is also conceivable that many different transmission methods are available to the reading devices 220', and that the selection of one of the transmission methods occurs in dependency upon a control signal that is transmitted to reading devices 220' from chip 3.

EXAMPLE 79

Moreover, it is possible that a unique banknote identifier, such as the serial number, is initially read out, preferentially in parallel, from all or a partial quantity of several banknotes during a stack measurement in order to then, in a further step, be able to address individual banknotes via their serial numbers in a targeted manner. However, this approach is also principally applicable to the testing of individual banknotes.

EXAMPLE 80

Banknotes with photodiodes, e.g. of LISA plastic, as was previously described in relation to the FIGS. 23, 25, and 26, by way of example, are particularly suited to stack measurement.

In this context, for both the use of an LED 235 as well as for the luminous surface 291, the emitted light intensity is altered, i.e. modulated, in order to transmit data from banknote 1 to an external reading device 229. In that context, the simplest type of modulation is preferentially employed, that is, the turning-on and turning-off of a light signal, such as so-called "on-off keying" for a 100% ASK modulation (amplitude keying), as it is e.g. described in Finkenzeller's book: "RFID-Handbuch", pp. 156 to 164, 2000, Carl Hanser Verlag Munich Vienna, ISBN 3-446-21278-7.

However, multi-step modulation, e.g. corresponding to bit encrypting via gray shades, is also possible for both the (large-surface) LED 235, as well as for the luminous surface 291.

The readout of the optically modulated data can occur e.g. via a sensor 229, as it was described with reference to FIGS. 44, 45 or, as the case may be, 46. Sensor 229 can be both a CCD field (a charge-coupled device), as well as a line sensor (e.g. a photodiode array).

Photodiode 226, 227, 226*a*, 227*a*, 227' is consequently primarily used for the transmission of data, in the form of modulated light signals, to a reading device 220'.

A particular property of luminescent materials consists in that an attenuation of the emitted radiation with a defined time constant is observed upon turning off the absorbed radiation. This effect also appears during the modulation of the absorbed radiation for the purpose of data transmission.

A further idea therefore consists in capturing and analyzing the attenuation behavior of the radiation emitted from the fluorescent dyes 286 by a reading device, such as sensors 229. When using other materials or illuminants for the purpose of forging a banknote 1, a different attenuation behavior at the pulse edges is to be expected. This makes it is possible to recognize forgeries of this type and to handle the banknote 1 accordingly.

A banknote 1 according to the invention, as was described in the above by way of example, is addressed in the stack e.g. inductively or capacitively and responds through the photodiode. Particularly in the singled condition, provision can be made to likewise address same inductively or capacitively, but also responds in this way. Therefore, this variation represents a banknote 1 with two interface possibilities/response possibilities.

EXAMPLE 81

As was explained, according to the invention, it is also possible that banknotes are read out in the stack by means of inductive coupling. In this context, it has been shown that the resonance frequency of transponders in the stack follows the following function:

$$f_{total} = \frac{f_{indiv.}}{\sqrt{N}}$$

Here, N is the number of transponders, i.e. banknotes 1 with chip 3 in the stack, findiv. is the resonance frequency of an individual transponder and ftotal is the resulting resonance frequency. Optimal energy coupling in the banknote stack can then be achieved if the measuring device transmits on the resulting resonance frequency ftotal.

However, in the case of large stacks, the resulting resonance frequency ftotal assumes very low values. At a resonance frequency of 21 MHz of an individual transponder, for example, 2.1 MHz result for a stack of 100 banknotes 1 and but 0.66 MHz result for a stack of 1000 banknotes 1 with chip 3.

In order to keep the processing speed in a stack low, it is, however, desirable to select the working frequency of the measuring device as high as possible, preferentially e.g. at 13.56 MHz. The maximum achievable resonance frequency of an individual transponder 3 with a coil consisting of at least one turn, as a rule, however, is not higher than 30 MHz. Higher resonance frequencies can not be realized in a simple manner due to the inductance values that are predetermined by the design as well as the additionally present parasitic capacitances.

An increase in the resulting resonance frequency by increasing the resonance frequencies of the individual transponders in the stack is thus possible in principle, although it is not practicable in all cases.

In order to be able to nonetheless address a stack of transponders 3 outside the resulting resonance frequency ftotal, high magnetic field strengths prove to be expedient. Beyond that, it is advantageous to adjust the diameter of the transmitting antenna, such as transmitting antenna 251 in FIG. 46, to the diameter of the antenna in the banknote, such as of coil 250 in the banknote 1 according to FIG. 23, so as to optimize the magnetic coupling between transmitting antenna 252 and transponders 3.

The course of the field strength in a coil in the X direction can e.g. be calculated according to Finkenzeller's book: "RFID-Handbook", pp. 61 ff., 2000, Carl Hanser Verlag Munich Vienna, ISBN 3-446-21278-7. Here, it can be recognized that at a distance x, that is larger than the radius of the coil, the magnetic field becomes strongly inhomogeneous and rapidly loses intensity. By contrast, with very large stacks of e.g. 1000 banknotes, the height of the stack is already greater than the coil radius. A homogenous magnetic field can thus no longer be readily generated by means of a simple arrangement of coils.

An improvement can be achieved if the volume taken up by the banknote stack exhibits higher magnetic permeability than the surrounding space, i.e. normally the air. To accomplish this, the banknotes are equipped with a magnetic permeability, as was already described previously.

EXAMPLE 82

A reading device 280 for the readout of inductively coupled banknotes 1 with magnetic paper in the stack is depicted in FIG. 47. The manufacture and properties of such a magnetic paper have already been dealt with in detail in the above. For readout of the banknotes in the stack, a homogenous field is generated that penetrates through the stack. By way of example, the stack is therefore brought into a ferrite core 281. In principle, soft magnetic materials are also possible, but the ferrite core 281 is preferentially formed of a hard magnetic material, in particular ferrite or amorphous or, as the case may be, nanocrystalline metal. Here, materials with greater permeability are preferentially employed.

A coil 251 generates a strong, high-frequency magnetic field 282. The magnetic field lines 282 are directed through the magnetic paper of banknotes 1 and subsequently through ferrite core 281, so that the field lines run completely through the ferrite core and, in that context, at least in the region of the stacked banknotes 1, a homogenous magnetic field is developed, which preferentially traverses the stack vertically in direction X.

In this context, ferrite core 281 is preferentially led along either the narrow sides or the longitudinal sides of banknotes 1 so that it forms a ring that is open in the Y direction, i.e. in a direction Y perpendicular to the plane of the sheet in FIG. 47. In this way, reading device 280 can very easily be filled with a stack of banknotes 1 in the Y direction and also be emptied again so that machine processing is possible with no trouble.

A preferable, successively-occurring activation of the individual banknotes in a stack can also be realized in advantageous manner in that the banknotes reciprocally activate themselves one after another. In this case, after the activation cascade has been launched through activation of an initial banknote of the stack, all others can consequently reciprocally activate themselves without further intervention from the outside. In this context, it is advantageous to conduct the activation by means of light, as described in the following more precisely, and to feed the energy necessary for this into the stack of the banknotes by means of electromagnetic waves. Naturally, the banknotes require corresponding receiving elements to be able to take up the energy made available by means of the electromagnetic waves.

EXAMPLE 83

A particularly preferential example for such an internal activation is that the first-activated, e.g. lowermost banknote of the stack sends out light that is captured by the second-lowermost banknote, which, after this activation, in turn sends out light that is received by the third-lowermost banknote, etc. In particular, the banknote will, in preferential manner, thus exhibit an optical transmitter and an optical receiver in such a case as well. In this context, the activated banknotes preferentially each send out a coded light signal, which e.g. contains information about the own value, or as the case may be, the total value of all hitherto activated banknotes. Consequently, only the light signal sent out by the last-activated banknote in the stack still needs to be measured to obtain information, for example, about the total value of the stack.

Therefore, e.g. only the underside of the lowermost banknote is irradiated with light from the outside to activate this lowermost banknote and the light signal sent out by the last-activated banknote, i.e. the light exiting from the upper side of the uppermost banknote of the stack, is captured as a measurement signal. In this context, the transmitter and the receiver of the banknotes are preferentially mounted on opposite sides of the banknote paper. In the case of measurement in the aforementioned manner, they should be stacked in like orientation and location. If, on the other hand, a banknote can be activated through illumination from both the underside as well as from the upper side, and particularly also in the case that it sends out light both upwardly as well as downwardly, the aforementioned method can thus also be carried out independent of the location and orientation of the individual banknotes in the stack. In this context, the energy supply of the individual banknotes advantageously takes place through an electrical or magnetic field, with corresponding receiving devices in the banknotes.

Through optical feedback to respective preceding (operable) banknotes, it is possible here, in the absence of such a reply, to presume defective banknotes. This can also be demonstrated particularly simply in that, for an interruption of the activation cascade, no outgoing light signal of the last banknote that is measurable as such is generated, and thus can [not] be measured.

This variation offers the possibility to be able to simply recognize whether defective banknotes are present in a stack. In this case, the signal chain is interrupted and thus, at the other end, no outgoing signal appears or, as the case may be, not the expected outgoing signal as for an uninterrupted chain.

EXAMPLE 84

With reference to FIG. 37, a measurement method for banknotes is now described, in which energy can be transmitted between adjacent banknotes in the stack by optical means.

Specifically, an electromagnetic wave 402, that can be visible light, but also IR radiation and UV radiation, is irradiated onto photocell 400 of the uppermost banknote 1 in the stack. A current is generated in this [banknote] through the external photoelectric effect. With this current, chip 3 is then be supplied with energy via contact circuit 403, in which case typical voltages in chip 3 lie in the range of up to 5 V. After chip 3 of the uppermost banknote 1 has been supplied with energy, it will send out light by means of laser diode 401 on the underside, which in turn will be received by photocell 400 situated on the upper side of the banknote 1 lying directly thereunder, to in turn supply its chip with energy. This [chip] will then, in analogous fashion, transmit energy to the banknote lying thereunder, etc.

In this context, the light source for illuminating a photocell 400 of one of the outermost banknotes 1 in the stack can, by way of example, be integrated in a deposit surface of a reading device, upon which the banknotes are deposited in a stack, as is e.g. described in analogous fashion for capacitive coupling in relation to FIG. 48.

To achieve positional independence, photocell 400 and laser diode 401 are preferentially arranged in the center of the banknote surface and/or particularly mounted on the two sides of individual banknotes 1.

In this context, data transmission to an external reading device can take place by all of the methods described within the scope of the present invention. However, the data are preferentially out-coupled in another way, such as by electromagnetic means. Alternatively however, the chip can also transmit data to the outside by means of piezoelectrical coupling or also surface waves.

Moreover, the laser diode 401 can not only be used for the energy supply of an adjacent banknote 1, but also for data transmission to this [banknote], if it sends out a modulated e.g. pulsed light signal 404 that, aside from energy, also transmits data.

Furthermore, provision can be made that chip 3 first transmits its information to the outside to the reading device before it, by means of light-emitting diode 6, supplies energy to and activates chip 3 of banknote 1 situated thereunder. Consequently, chips 3 of banknote 1 can be operated sequentially. As a result of this, e.g. anticollision problems are able to be avoided in a simple way even in the case of inductive out-coupling.

Although in the above, in particular, the case was described that the properties of individual banknotes are measured one after another, it is also conceivable to simultaneously measure the properties of several, in particular of all banknotes of the stack or, as the case may be, to simultaneously write to the chips of several banknotes. In this context, the coupling methods can be designed as analog inductive, capacitive and or optical.

EXAMPLE 85

In the case of an optical coupling for the use of banknotes with photodiodes that e.g. lead into a side edge of the banknote paper, it is e.g. possible, through illumination of the entire surface of the banknotes from the side, to illuminate the photodiodes of several, in particular of all banknotes, and to consequently activate these almost simultaneously. Through the stimulation, they are stimulated to send out light, and the light sent out from the banknotes analyzed as an optical response signal. In the case of the device according to FIGS. 44 and 45, this could for example be realized in that, in the presence of several laser diodes, which are distributively arranged in the sidewall 222 at height H, these are not successively, but rather simultaneously activated to send out light.

In addition, illumination of the entire surface of the banknote stack in the region of side edges 225 can continue to already suffice here, without the need to focus the illuminating light on the individual photodiodes in each case. This simplifies the arrangement. In this context, during evaluation of the measurement signals of detector 229, the signals that are not generated through the response light exiting out of photodiodes 227, but instead through the illuminating light of light source 224 that is not in-coupled into photodiodes 226, are, by means of reference measurement, considered disturbing signals. In a particularly simple case, this can occur in that the response signals of individual banknotes 1 each send out light at a different wavelength than the illumination light.

A particular advantage of the use described in more detail in the preceding examples by way of example of an optical coupling between the evaluation device and the banknote consists in that undesired influencing of the individual signals does not occur. This means e.g. that the light signals, which are sent out from the individual banknotes, are not altered by the presence of the light signals of the other banknotes. For example, if upon activation of all banknotes of the stack to send out light simultaneously, the light sent out from all banknotes is measured summed-up by means of a detector, particularly at the same point in time or in the same time period, the properties of the banknote stack can thus be determined through evaluation of the total signal.

If the light radiation sent out e.g. for all banknotes, regardless of denomination, has the same intensity and/or if the light radiation sent out for different denominations has a different frequency or, as the case may be, a different frequency spectrum, conclusions on the number of banknotes can be drawn through evaluation of the measured total intensity or, as the case may be, on the basis of frequency analysis of the measured intensity, conclusions can also be drawn on the number of banknotes per denomination and thus on the total value of the banknote stack.

In addition, it is to be particularly emphasized that the preceding embodiments of the optical communications by means of photodiodes for stack measurement can also be advantageously employed for banknotes without a chip.

EXAMPLE 86

Thus, e.g. in place of an LED controlled through the banknote chip, e.g. a color filter can also be used that only lets through and/or reflects a portion of the irradiated wavelengths. If e.g. as in FIGS. 44 and 45, the photodiode goes through the banknote paper, a corresponding color filter can e.g. be incorporated in the photodiode, which, upon irradiation with white light, e.g. only allows a red wavelength range through. In particular, the individual denominations will exhibit filters with different transmission properties.

In the case of an optical coupling with and without a chip, visible and/or ultraviolet and/or infrared wavelengths can be used in this context.

While, it was moreover explained in the above, to radiate the optical response signal at the [bank]note edge, it can then also be out-coupled perpendicularly through such a transparent window if the banknote paper exhibits transparent windows. To this end, e.g. a reflective and/or a dispersive element is incorporated in a foil of which the transparent window consists. This reflective or, as the case may be, dispersive element will out-couple light, which, for example, is irradiated into the plane of the paper by means of a photodiode, perpendicular to the plane of the paper through the transparent window.

EXAMPLE 87

If the coupling does not take place optically, but rather inductively or capacitively, a reciprocal disturbance can arise during simultaneous data transmission from several transmitters to one receiver if no suitable countermeasures are taken. That means e.g. that in the case when the chips of several banknotes stimulate their inductive or, as the case may be, capacitive elements to send out signals simultaneously, the individual signals can no longer be clearly differentiated by a reading device of the evaluation device.

However, this problem can be solved by the use of anticollision methods, as known in the realm of RFID (Radio Frequency Identification) systems and described e.g. in Finkenzeller's book: "RFID-Handbuch", pp. 170-192, 2000, Carl Hanser Verlag Munich Vienna, ISBN 3-446-21278-7. In the customary manner, an "anticollision method" is thus understood to mean a method, which enables the troublefree handling of a case of multiple access to several transponders. It has become evident in that context, that for the stack measurement of sheet material with a chip according to the invention, depending on the case of application, various of the known anticollision methods can be applied particularly advantageously.

Time Division Multiple Access [TDMA] method is especially suited for counting and value determination in the stack, in which [method] the entire available transmission channel capacity is temporally divided among the participants, i.e. all banknote transponders situated within range. The dynamic S-ALOHA method or, as the case may be, the dynamic binary search method are particularly preferred in this context.

EXAMPLE 88

In the event, though, that the transponders of the banknotes of different denominations are adjusted to different transmission frequencies, the Time Division Multiple Access method is also preferentially used to determine if counterfeit banknotes or banknotes of an undesired denomination are contained in the stack. Through a frequency analysis of the summed-up total signal, one may, even in the case of simultaneous reception of signals from several banknotes, draw conclusions about which and, optionally, how many banknotes-denominations are situated in the stack.

A general advantage of the variation where there are banknotes of different coupling frequencies, is that, by way of example, there is less overlap of the individual signals for an inductive coupling, and e.g. a temporal separation of the signals through different response-times and/or response-time-periods can also be possible in dependence on the frequency. Consequently, this advantage results for a stack measurement even if there are different delays in the reaction times in response to the signals received from the outside for different banknotes, e.g. even for the same coupling frequencies.

Likewise, a lesser signal overlap can e.g. be realized in that the antenna position and/or antenna orientation on the banknote paper varies from banknote to banknote. Thus, provision can be made that the position of e.g. dipole antennas varies through rotation by certain angular amounts for different banknotes. This variation can e.g. also be denomination-specific.

Usually, banknotes in the stack can initially only be addressed simultaneously via an inductive or, as the case may be, capacitive coupling. Through a control signal designed for that purpose, the banknotes can be induced to transmit their serial number or another signal that uniquely identifies the banknotes to the reading device. As soon as e.g. the serial number of the individual banknotes in the stack is known, it is also possible to address the individual banknotes in targeted fashion through appropriate control signals, in that they are individually selected and addressed e.g. through the transmission of the serial number as a parameter for the control signal. All other banknotes that do not correspond to this parameter of the control signal, will then usually not react or at least react differently, i.e. send out other response signals.

It is also possible that the serial numbers of all, or at least a portion, of the banknotes of a stack were already determined by other means prior to the stack measurement. This can e.g. then be the case if, in a banknote processing apparatus, through the readout of chip data or also by other means as well, e.g. by scanning of the print image, the serial numbers of the individual banknotes are known, which are subsequently stacked as a stack and e.g. placed in cassettes. The banknotes can then be addressed in targeted fashion and individually by appropriate reading devices, such as in the banknote processing apparatus or the cassette, in a simple way that avoid anticollision problems.

In the case of operation of a stack of capacitively coupled banknotes corresponding to the equivalent circuit diagram of FIG. 49, increasing distance from the beginning of the stack, i.e. from the place where energy is fed in, leads to a rapid decline in the available supply voltage. In the case of stacks with a few tens or hundreds of banknotes, a difference of one or more powers of ten can arise between the voltage fed in at the beginning of the stack and the available voltage (voltage transmission) at the last banknote in the stack. However, the voltage transmission is strongly dependent on the current uptake of the individual chips in the banknotes, as well as upon the input capacitance of the chips. Thus, the voltage transmission differs by one or more powers of ten, depending on whether all chips in the stack are switched on or switched off.

EXAMPLE 89

Therefore, a further idea of the present invention consists in, that transponder chips 3, which were already able to be read out, are switched to a currentless, so-called "power-saving" or "sleep" mode. These are initially predominantly banknotes 1 at the beginning of the chain, i.e. at the shortest distance to the stimulating energy source, since there is always sufficient energy for operation of the transponder chip 3 available here. By switching off the transponder chips 3 that have been read, banknotes 1 at the end of the stack can subsequently also obtain sufficient energy for operation.

In this context, the voltage to be supplied at the entrance of the stack should preferentially be selected higher, by the factor of the voltage transmission, than the minimum supply voltage of an individual transponder chip 3. For the previously-named example, a voltage of at least some 200 V would thus have to be fed in at the entrance of the stack to still be able to supply the last transponder of the stack with 1.8 V.

To ensure the operation of all transponders, independent of their random position in the stack, chips 3 are preferentially equipped with a voltage control, such as a serial control unit, which can cover this voltage range.

In the case of higher working frequencies, the difference in the voltage transmission between switched-on and switched-off transponder chips becomes increasingly less on account of the high pass properties of such a banknote stack. In the case of sufficiently high operating frequency, it is therefore no longer necessary to switch off the transponder chips. It is, however, to be noted that, in the case of higher frequencies, increasingly higher currents also occur at the entrance of the stack, which, on the other hand, would lead to a larger dimensioning of the reading devices.

If the full operational voltage, i.e. a sufficiently high voltage, is applied at the entrance of the banknote stack in order to supply the last transponder in the stack with energy as well, all transponders in the stack are thereby thus placed in a ready-to-operate state. The attempt to communicate with the transponders in the stack initially leads to a multiple access of the transponders to the reading device. To be able to address the transponders individually, these [transponders] must initially be "singled" by the reading device by means of an anticollision algorithm.

In this context, for a large number of transponders, correspondingly many iterations of the anticollision algorithm used must be run through. Even if it is assumed in this context that a transponder, once selected and read, is deactivated and no longer takes part in the following iteration loops, a considerable number of iterations still arise for a large number of simultaneously active transponders, e.g. over 600 iterations in the case of approx. 100 transponders, i.e. banknotes in the stack. This leads to a high expenditure of time to select a single transponder.

To optimally shorten the time necessary for readout of the transponders in a stack, a further idea of the present invention consists in placing only a few transponders of a stack in an active condition at the beginning of the scanning process, and to activate further transponders only at a later point in time. This is preferentially achieved in that the supply voltage applied to the stack is gradually increased during the measurement process.

EXAMPLE 90

Preferentially, therefore, a stack of banknotes 3 is initially fed with a voltage Umin that corresponds to the response sensitivity of the individual transponders in the stack, such as 1.8 V. In this way, only some few transponders at the beginning of the stack are supplied with sufficient energy for operation. The selection of individual transponders by means of an anticollision algorithm can then be carried out with very few iteration loops. The transponders that have already been read out are then deactivated and no longer take part in any further communications, e.g. further iterations. Thus, each transponder that has emitted its feedback can be separated from the energy supply through an electronic circuit on the chip or in a second circuit on banknote 1 connected with such chip. Therefore, it is preferentially not only switched "mute" for a certain time, but taken out of operation completely instead. In this way it is achieved that the inductance and/or capacitance and the ohmic load of chip 3 is taken out of the chain for a certain time, or preferentially, until the energy supply of the stack is switched off, e.g. by disabling a transistor. As a result, its influence on the energy supply of the bordering transponders also diminishes, i.e. these are now better supplied with energy. After each completed interaction with a transponder in the stack, the voltage at the entrance to the stack is increased by a value of ΔU, for which preferentially applies:

$$\Delta U = \frac{U_{max} - U_{min}}{N}.$$

Here, Umax is the maximum input voltage on the stack which is necessary to still address the last transponder in the stack. Umax is the minimum supply voltage of an individual transponder chip and N is the number of transponders in the stack.

By successively increasing the voltage at the entrance to the stack, it is ensured that, little by little, even the transponder chips lying further below in the stack are supplied with sufficient energy until all transponder chips have finally been read.

Provided the voltage can be balanced finely enough, it is thus even possible to manage without any anticollision, i.e. it is always only one individual chip in the stack that responds in each case. The described method of the gradual increase of the energy sent thus allows circuits in chip 3 to be provided without energy regulation in the entrance, which leads to a simplification of the integrated circuits in comparison to the previously described variation with voltage regulation in chip 3. The method of the separation of the energy supply according to the invention is more simply realizable than a control of the input voltage in chip 3.

EXAMPLE 91

FIG. 48 shows, in schematic fashion, an example of a reading device 220" for the capacitive coupling of banknotes 1 with chip 3 which exhibit capacitive coupling surfaces 256, as were described by way of example in relation to FIGS. 30, 31. Reading device 220" exhibits a deposit surface 221, upon which a stack of banknotes 1 are automatically or manually deposited. An electrode 263 is permanently integrated in the base surface. Electrode 263 can preferentially exhibit two coupling surfaces, the dimensions of which essentially correspond to coupling surfaces 256 of banknote 1. In this context, deposit surface 221 can be executed with at least a lateral boundaries 222, to thus simplify the positioning of banknotes 1 with respect to electrode 263 of reading device 220". In this context, this apparatus can also serve to test individual, non-stacked banknotes 1, which must be placed on deposit surface 221 for readout. An arrangement of this type in particular allows the readout of smaller stacks of e.g. 1 to 30 banknotes.

A constant supply voltage can in fact be applied, but a supply voltage, which e.g. continuously or intermittently increases during the ongoing measurement process in the aforementioned way, will be preferentially applied to the two electrodes. Through the self-increasing supply voltage, an increasingly larger number of banknotes in the stack can be addressed.

An advantage of a capacitive coupling in comparison to an inductive coupling consists in that it leads to fewer cases of mutual influencing of the individual banknote transponders in a stack among themselves and thus to an analytic more accurately predictable effect. Among other things, this variation is also of advantage for a stack measurement in automatic tellers in particular, specifically in their input pocket and in cassettes.

EXAMPLE 92

A further idea for capacitive coupling consists of inserting, in a stack of banknotes 1 with capacitive coupling surfaces 256, at least one electrode into the stack, in order to have to address fewer banknotes simultaneously. Thus, e.g. in the case of device 220" according to FIG. 48, there can be one or more retractable and extensible electrodes, which are sufficiently thin—in particular at their front region as well, which is intended to be extended into a banknote stack to be tested—in order to not fold or jam the banknotes. These can e.g. be incorporated at predetermined heights [with respect] to base surface 221, in order to move such an electrode into the stack for measurement when stacking a large number of banknotes e.g. all 100 banknotes.

EXAMPLE 93

FIG. 49 shows, by way of example, the electrical equivalent circuit diagram of a stack with two capacitively coupled banknotes 1 stacked on top of one another, where the circuit depicted in the first, left banknote 1 in FIG. 49, is also present for the merely schematically indicated, second banknote 1. The circuit diagram of the stack can naturally also be expanded in the form of a series connection of quadripoles (No. 1 in FIG. 49) for a larger number of banknotes 1 in the stack. If two banknotes are stacked on top of one another, a capacitance Ck thus arises between any two electrodes presently lying on top of one another, i.e. coupling surfaces 256. By mounting two electrodes 256 on one banknote side, two coupling capacitors are thus available to each banknote 1. For chip 3, however, the two coupling capacitances appear as a serial connection of the individual capacitances, for which reason only ½ Ck is effective in the equivalent circuit diagram. The capacitance Cp represents the sum of the input capacitance of transponder chip 3 and all parasitic capacitances and RL [represents] the input resistance of chip 3.

This system of the stacking of banknotes according to FIG. 30 is principally operable. However, it exhibits the disadvantage that the available supply voltage decreases very quickly toward the end of the chain, i.e. banknotes 1 in the stack. As a result, very high voltages must be fed in at the entrance of the stack in order to make sufficient energy available for the operation of a chip 3 at the end of the stack as well.

EXAMPLE 94

According to a further idea, an inductance Lp of defined value is connected in parallel to parasitic capacitance Cp in order to improve energy transmission in the stack.

A valid equivalent circuit diagram for this purpose, illustrated in analogy to FIG. 49, is depicted in FIG. 50. The dashed line with the reference character "3" identifies the region of the influencing variables of chip 3. In this context, the value of inductance Lp is preferentially selected such that the phase angle of the i2 current generated through parasitic capacitance Cp is compensated within the stack through inductance Lp. A typical value for Lp amounts to roughly 0.3 μH. In this context, when dimensioning, care must be taken that the individual elements in the stack are capacitively coupled among one another and reciprocally influence each other in respect of their effect. The common resonance frequency fres of the banknote, determined by the elements Cp and Lp (parallel oscillating circuit), therefore does not correspond to the operating frequency fb of the stack, but rather lies about one or more powers of ten higher.

The selected circuit configuration yields a bandpass filter of the Nth order for a stack of N banknotes 1. A stack of 100 banknotes 1 corresponds to a bandpass filter of the 100th order; a stack of 1000 banknotes 1 to a bandpass filter of the 1000th order. As simulated calculations show, by switching in the inductance Lp, significantly better properties with respect to energy transmission result than for the arrangement according to FIG. 49. The improved arrangement is depicted in FIG. 50.

EXAMPLE 95

If a banknote outside of the stack is read by means of capacitive coupling, Cp and Lp together with coupling capacitance Ck form an oscillating circuit. Since the resultant resonant frequency of this oscillating circuit lies some powers of ten above the usually employed working frequency for capacitively coupled systems, the readout of banknote 1 outside of the stack is usually impaired by the additional inductance Lp.

Therefore provision is made to design the inductance Lp such that it can be switched on or switched off, e.g. by chip 3, according to the operating state of the banknote 1. The inductance Lp is preferentially in a switched off state in the initial state of the chip, so that it is designed for the examination of one individual [bank]note in particular. If banknote 1 is read out in a stack, the inductance Lp will thus connected to it additionally by chip 3. Alternatively, the opposite embodiment, i.e. that inductance Lp is not switched off until there is a pending examination of an individual note, is naturally possible as well. It is also conceivable that the inductance is switched on or switched off prior to a stack measurement or an individual note measurement in each case and again switched back to the original state after the measurement. Various methods of switching are conceivable in this context.

It is also possible to have repeated sending-out of a special command, i.e. control signal, in order to successively induce chips 1 in a stack to switch on inductance Lp. Energy transmission is successively increased, e.g. corresponding to the previously described method, to reach all the banknotes starting at the beginning of the stack.

The use of different frequency ranges to read out chips 3 in the stack or outside of the stack is an alternative or addition to this. Thus e.g. a frequency of 50 MHz to read out one individual banknote 1 over a certain distance, and another frequency of e.g. 13.56 MHz to read out in the stack, can be used. Here, chips 3 have a unit to recognize the frequency of the signal being applied. If an operating frequency is detected, which is used for the reading in the stack, the inductance Lp is thus automatically connected to it additionally in order to optimize energy transmission in the stack. In this way, energy transmission in the stack is successively built up from the beginning of the stack after application of a reading signal.

A further alternative or supplement consists in the evaluation of other physical parameters in chip 3. By way of example, it is thus conceivable, for instance, to equip chip 3 with optical sensors which must be addressed additionally for reading outside of the stack to prevent an inductance Lp from being connected additionally. Thus, provision can be made e.g. that reading in the stack is usually conducted in a darkened environment, i.e. a largely lighttight, closed housing in order to permit inductance Lp to be switched on. In this way, energy transmission in the stack is once again successively built from the beginning of the stack after application of a reading signal.

E.g. the following two methods are possible for realizing the necessary inductance Lp.

EXAMPLE 96

The inductance Lp can either be applied to the chip 3 through galvanic deposition ("coil-on-chip") or integrated on the chip itself ("on-silicon") or realized externally on the banknote. Alternatively, inductance Lp is simulated by an electronic circuit in chip 3. Circuits which allow a rotation of the phase angle of i2 current are suited for this purpose. The so-called "gyrator circuit" is suited for this purpose.

One arrangement for communication with chip 3 in the stack fundamentally comprises an energy source as the sending unit, i.e. specifically, a voltage source and an associated modulator that permits data to be transferred to chips 3 of the banknotes, as well as a receiving unit to be able to receive the data sent back from chips 3.

In the case of associated reading devices, the sending unit and the receiving unit can use the same coupling unit, i.e. antenna that serves both for transmission of data and for reception of data. This can, however, make expensive circuits necessary in order to decouple the various signals from one another.

EXAMPLE 97

A further idea of the present invention, which serves for the optimization of the arrangements for the reception of the transmitted data, therefore consists in separating the sending unit, specifically the voltage source provided for it, and the receiving unit from one another and equipping each of them with their own coupling units as antennas.

An example for a possible embodiment is depicted in FIG. 51. Here, energy and data are coupled in on one side, in FIG. 51, for example, the upper side in the stack of banknotes 1. In this context, for in-coupling, device 270 comprises an in-coupling electrode 271 in the form of a pair of capacitive coupling surfaces 271, which preferentially correspond in form to the dimensions of coupling surfaces 256 of the banknotes 1, as depicted in FIGS. 30 and 31. The coupling surfaces 271 are connected with a unit 272 with a voltage source and a modulator.

The readout of data sent from banknotes 1, such as their serial number, takes place through coupling on the opposite side of the stack. Receiving unit 273 likewise exhibits two capacitive coupling surfaces 271*a*, which are connected to an evaluation unit 273. Optionally, a further receiving unit 274 can also be incorporated parallel to the voltage source 272, as depicted in FIG. 51.

EXAMPLE 98

Based on the technical method of the preceding chapters, an anticollision method can be realized which permits the readout of data that is uniquely associated with a specific chip 3, such as the serial number of the chip, for instance, within only one iteration loop. The method is based on bit-wise arbitration of the serial data stream.

To this end, chips 3 preferentially have a receiving unit, by means of which data, e.g. from the reading device 270 with a voltage source and a modulator according to FIG. 51, can be detected and evaluated. Further, chips 3 can preferentially have a circuit for load modulation. In this context, both ohmic load modulation as well as capacitive load modulation can be used. In addition, chips 3 have a unique serial number or the like, which is only used by one individual banknote in each case.

According to the invention, a bit coding with the properties RZ (return to zero), such as a so-called Manchester code or modified Miller code, for instance, is preferentially used for the data transfer from chips 3 to the receiving device. The anticollision method described in the following can in fact also be conducted with NRZ (non return to zero) encrypting, but RZ codings are preferred on account of easier detectability of a collision that has occurred. Details on the modulation method and coding method can, by way of example, be taken from Finkenzeller's book [manual]: "RFID-Handbuch", 2002, Carl Hanser Verlag Munich Vienna, ISBN 3-446-22071-2, pp. 189-198.

In addition, the chips 3 can have a detection apparatus, which permits individual chip 3, to recognize whether, during the transmission of a logical "0" or "1" to reading device 270, a signal that is logically inverse in each case—i.e. "1" or "0"—is simultaneously transmitted through a further chip 3 in the banknote stack. To this end, the input voltage of chip 3 is evaluated preferentially, since it is influenced within the entire stack by the load modulation of an arbitrary chip 3 in the stack, such that the load modulation of each individual chip 3 in the stack can be detected by both a reading device 270 as well as by all other chips 3 in a banknote stack.

According to a further idea, the banknotes 1 in the stack are initially all called upon, through a specific signal or command of reading device 270, e.g. through modulation of the energy fed into the stack, to begin with the synchronous transmission of their unique serial numbers to reading device 270. During the transmission of the own data, chips 3 continually detect the input voltage upon signals of other chips 3 in the stack. If, during the transmission of a "1" or "0" bit, a collision is determined through detection of the signal at the entrance to chip 3, a portion of chips 3 then immediately breaks off the transmission of their own serial numbers. The type of coding, as well as the definition of the algorithm to be applied can be used to define which bit value is considered dominant in each case. In case, by way of example, the bit value "1" is defined as dominant, then all chips with a "0" in the corresponding location will immediately break off further transmission of their own serial number in the case of a collision. This method is preferentially executed for each bit to be transferred, so that, ultimately, only a single chip 3 in the stack can transmit a complete serial number.

To be able to successively read out the serial numbers of all chips 3 in a stack, the following two methods can be employed, for example:

As soon as a chip has successfully transmitted its own serial number, it switches to an operating state, in which it no longer reacts to a further signal or command to transmit the serial number, so that it will no longer take part in subsequent iterations.

For very large stacks of e.g. 100 to 1000 banknotes 1, it is conceivable that a load modulation signal generated by the last banknotes in the stack can no longer be detected by banknotes 1 at the beginning of the stack, i.e. near voltage source 271. Then, it will potentially no longer be readily possible for chips 3 to switch off automatically.

For this case, a command is therefore preferentially provided, by means of which a chip 3, by sending out its serial number, as a rule the serial number which was recognized in the preceding iteration step, is switched, by reading device 270, into an operating state in which it no longer reacts to a further signal or command to transmit the serial number.

EXAMPLE 99

Numerous variations are conceivable in relation to the aforementioned embodiments.

One possibility consists of mounting an additional receiving device parallel to the voltage source at the beginning of the stack, as was described in relation to FIG. 51. Through comparison of the, potentially different, sum signals that appear at the entrance and the exit of the stack in the case of load modulation, problems in the reciprocal detection of the banknote—e.g. through signals that are too weak on account of spacing that is too large in the stack—can be recognized and countermeasures initiated.

EXAMPLE 100

Aside from the preferential variation according to the invention of feeding the stack with energy from only one side through a voltage source, the possibility also exists to supply the stack with energy from both sides via the capacitive coupling.

The procedure described results in that, through the readout and (self-) switching-off of chip 3, the number of the simultaneously "sending" chips 3 is successively reduced during the processing of the stack. In the initial phase, on account of the large number of chips 3 that remain active, the influence of the load modulation can cause the supply voltage of chips 3 at the end of the stack to "break down" during the data transmission of the chips 3. According to the invention, chips 3 should therefore immediately break off the data transmission in the current iteration and wait for the next signal or command to transfer their serial number if they fall below a minimum voltage, such as through detection of the input level or, in the extreme case, the appearance of a "power-on-reset". However, in case e.g. at a later point in time of the processing of the stack, there are still correspondingly few chips 3 participating in the data transmission, chips 3 at the end of the stack can also completely transmit their serial number without a breakdown of the supply voltage.

EXAMPLE 101

The method described is based on the participating chips 3 themselves working through the anticollision. However, methods are known according to which a reading device carry outs recognition of an anticollision and works through a corresponding algorithm. One such method, by way of example, is the binary search tree, the so-called "binary search", as explained, for example, in Finkenzeller's book: "RFID-Handbuch", 2002, Carl Hanser Verlag Munich Vienna, ISBN 3-446-22071-2, pp. 189-198.

A very advantageous variation according to a further idea of the present invention can consist in combining both methods, i.e. the previously described arbitration method e.g. with such a binary search tree. This is then particularly expedient if, on the basis of the high number of the chips in the stack of e.g. 100 to 1000 banknotes, it can no longer be assumed that all participating chips can still detect each other. In this context, the advantage of the combination with an external reading device for anticollision detection is that it can be constructed of technically more elaborate circuitry in order to also recognize weaker signals.

According to a variation, provision can therefore be made to use a suitable code for reliable anticollision detection by a reading device, such as a Manchester code. Furthermore, according to the invention, provision can be made to combine both methods such that a pre-selection is already made through the autonomous switching-off of the chips, remaining collisions can be resolved through the reading device by means of the method of the binary search tree.

EXAMPLE 102

Particularly in the above-described case of inductive and/or capacitive coupling, it can already suffice if, in a measurement process, not all banknotes are recognized, but rather only a portion of the banknotes of a stack are recognized or, as the case may be, examined in noncontacting fashion. Thus, e.g. recognition of an individual illegal banknotes that are, e.g. stolen money or extorted money, can suffice so that a quantity of banknotes to be examined is recognized as suspicious. An identification of all banknotes is not necessary in this case. This applies likewise for the case where merely the existence of banknotes, which are e.g. hidden in a suitcase or the like, needs to be ascertained. In the case of a customs inspection it can, by way of example, suffice, if the banknotes per se are detected, particularly in a large amount and/or with a higher total value. This likewise does not require each individual note to be identified.

It is to be emphasized that the previously mentioned optical, inductive and/or capacitive coupling methods can also be used to carry out a signal transmission to and/or from individual banknotes. Although the aforementioned coupling methods are thus specially designed for stack processing, they can also be used for the processing of individual, e.g. singled banknotes, for example, in the processing apparatuses described in this application as well, such as the banknote sorting apparatuses and/or counting apparatuses and/or money depositing machines and/or money dispensing machines and/or registers and/or manual testing devices.

EXAMPLE 103

As was already mentioned, the supply of an electrical circuit of a banknote by means of a piezoelectrical element, that likewise is la component of the banknote, offers particular advantages in the processing of stacked banknotes.

In that context, e.g. a transducer generates a continuous high-frequency ultrasonic signal for the voltage supply of the electrical circuit. The equally-frequent alternating voltage that thus occurs on the piezo element is rectified and serves as the supply voltage of the electrical circuit. The frequency of the alternating voltage tapped by the piezo element can simultaneously be used as the reference frequency for generation of the clock frequency on the microchip.

In a further development of the invention, at least a portion of the energy is directed to an input capacitor, as a result of which it is charged. After a time that is sufficient to completely charge the input capacitor in the microchip, the ultrasonic signal of the sensor is switched off. This switching-off is recognized by the microchip, whereupon it now generates an ultrasonic signal itself to thereby transmit data to the sensor. Here, the same piezoelectrical coupling element can be used as was previously employed for reception of the signal from the interrogation device.

For data transmission from the sensor to the electrical circuit it is also possible to alter, i.e. to modulate, the physical parameters of the ultrasonic wave, i.e. amplitude, frequency or phase position to the tact of the data to be transmitted. In this context, known methods, such as ASK (amplitude shift keying), FSK (frequency shift keying) and PSK (phase shift keying) can be used, as described e.g. in Finkenzeller's book: "RFID-Handbuch", pp. 156-164, 2000, Carl Hanser Verlag Munich Vienna, ISBN 3-446-21278-7. To design the circuit technology for modulation of the signals in the electrical circuit of the banknote as simply as possible, amplitude shift keying (ASK) is particularly suited.

If an ultrasonic wave encounters a piezoelectrical element, a portion of the ultrasonic wave passes through the piezoelectrical element unhindered (transmission). A small portion of the acoustic wave is absorbed by the elements and converted into electrical energy. Another small portion of the acoustic wave is reflected from the element and thus returns to the ultrasonic transmitter (sensor).

From the known reversibility of the piezoelectrical effect, results a repercussion of the electrical properties of the electrical circuit connected to the piezoelectrical element on the reflection properties of the piezoelectrical element. Thus, through alteration of the input impedance of the connected electrical circuit, the ultrasonic wave reflected from the piezoelectrical element can be altered in magnitude and phase position. Through the alteration of the input impedance of the electrical circuit in the tact of the data to be transmitted, a reflection modulation (backscatter modulation) can be generated that can be interpreted through the sensor, i.e. demodulated.

The reflected signal is now received at the sensor, parallel to the generation of a continuous ultrasonic signal. Through the modulation of the reflected signal with data, a frequency spectrum arises that is likewise received through the sensor. After filtering out of the frequency of the continuous ultrasonic signal, the received frequency spectrum can be easily demodulated and from it, the sent data recovered.

A second possibility consists in sending out a very high-frequency interrogation pulse alongside the continuous ultrasonic signal. Differences in the amplitude and the phase position of the received reflections of two successive interrogation impulses allow conclusions to be drawn on the alterations, which are due to modulation, of the reflection properties of the electrical circuits. Starting from a "reference reflection" in the unmodulated state of the electrical circuit, alterations of the amplitude and phase of the reflected interrogation impulse can be interpreted as logical "0" and "1" sequences. Expediently, the frequency of the interrogation impulse is selected such that it represents a multiple of the bit rate of the data transmission.

The method according to the invention is further developed in such fashion that the electrical circuit sends data back to the sensor on a second ultrasonic frequency via the piezoelectrical element. The use of a second piezoelectrical element is also possible.

EXAMPLE 104

In a further development according to the invention, banknotes are arranged in a stack, with a layering sequence of paper-piezo element-paper arises. If such a layering sequence is scanned with a high-frequency ultrasonic interrogation pulse, the layering sequence can then be reconstructed from the reflections. The attainable resolution is dependent upon the frequency of the interrogation pulse and, in the case of suitable frequency, lies in the order of the banknote thickness:

| Ultrasonic Frequency | Axial Resolution |
|---|---|
| 10 MHz | 160 μm |
| 20 MHz | 80 μm |
| 50 MHz | 30 μm |
| 75 MHz | 20 μm |

In this way, individual banknotes, whose thickness usually lies in the range of 80 μm, can readily be differentiated.

In a further development of detection in the stack according to the invention, the banknotes are initially stimulated with a continuous low frequency ultrasonic signal in order to ensure the voltage supply of the electrical circuits. The reflection coefficient of the individual layers is determined with a second, high-frequency interrogation pulse. Through the electrical circuits in the banknotes, the reflection factor of the piezoelectrical element is now modulated in the tact of the data to be transmitted (e.g. serial number and denomination of the banknote). As a result of the different delay time of the signals reflected from the individual banknotes in the stack, the assignment of a signal to the spatial position of the banknote in the stack is possible. Through the interpretation of the individual, temporally-altered reflection factors as data stream, it is possible to carry out a data transmission to the sensor of all banknotes simultaneously (in parallel). Through the defined relation of the individual reflections to the actual locational position of the piezo element in the stack, a precise assignment of the received data to the individual banknotes in the stack is possible. The sequence of the received serial numbers thus represents their actual sequence in the stack.

A further possibility consists in the focusing of ultrasonic waves. In this way it is possible to focus an interrogation pulse on a single banknote in a stack, for instance, and to read it out in targeted fashion. Through the focusing of the continuous ultrasonic signal serving the energy supply of the electrical circuits onto an individual banknote, it is further possible to activate individual electrical circuits in targeted fashion. All other electrical circuits in a stack are without voltage supply at this time and thus inactive.

EXAMPLE 105

As an alternative to the previously described method, it is also possible to realize the addressing or the detection in the transmission mode.

EXAMPLE 106

In a further development, provision is made to supply the electrical circuits with energy through a continuous ultrasonic signal. This signal is also used for the transmission of data from the sensor to the electrical circuit.

For data transmission from the electrical circuit to the sensor, an electrical, magnetic or electromagnetic coupling is used. To this end, the electrical circuit generates, by means of an oscillation apparatus, a high-frequency voltage, which is fed into a corresponding coupling element. In this context, this is preferentially a frequency in the microwave range (e.g. 2.45 GHz), the coupling element can already readily be a component of the electrical circuit at these frequencies, in case it is designed as an integrated circuit.

EXAMPLE 107

Good propagation (low damping) of ultrasonic waves is only present in solid materials or fluids. In gases (air), one must reckon with poor dispersal (high damping). Therefore, in the case of a further development, a design is provided, wherein the ultrasonic transmitter (sensor) is followed by an adaptation layer, upon which the banknote or banknotes slated to be assessed follow. These, in turn, are followed by an adaptation layer, and finally an acoustical absorber.

In this context, the banknotes are pressed between the two adaptation layers in a mechanical apparatus with as great a force as possible in order to achieve the best acoustic coupling possible between the individual layers. The acoustic absorber, which is likewise connected to the banknote stack via an adaptation layer, is located on the side opposite the ultrasonic transmitter (sensor). The object of this absorber is to completely absorb the acoustic wave going through the banknote stack in order to suppress interfering reflections.

Particular advantages result in the described use of ultrasound for the evaluation of electrical circuits of banknotes, in particular in the case of application in metallic housings, such as in the described transportation containers or in vaults.

As described above, the piezoelectrical element can be present as a foil of piezoelectrical material. If both sides of the sheet are at least partially attenuated metallically for the formation of the electrodes, then the filament can bend in the rhythm of the electrical voltage through application of voltage to the two metallic electrodes. In this context, it sends out sonic waves.

In this context, however, the fact that, when high-frequency ultrasonic signals are used, the oscillations of the foil no longer lie in the range of audibility, so that reproduction of an audible signal through the foil is not possible, is problematic in certain cases.

To avoid this, the energy supply and the response of the piezo foil are decoupled so that the irradiation of the necessary energy for the operation of the piezo foil does not disturb the response of the piezo foil. As already described, this takes place e.g. such that an integrated circuit is used additionally, which [integrated circuit] is conductively connected with the electrode of the piezo foil, is integrated in the vicinity of the sheet or preferentially on the sheet itself. To this end, the irradiated frequency can lie above the band of audibility and even in the range of up to a few gigahertz. The irradiated energy is directed to the circuit and there elicits a response at a different frequency.

Alternatively, the energy is stored for a short time and subsequently used for the generation of a time-shifted response. The advantage of this embodiment lies in the fact that irradiation of the energy and reception of the response do not interfere with one another and that, thus, better and more reliable operation of the circuit becomes possible.

In another embodiment, the energy can also be irradiated as ultrasound. The sonic waves would then have to be picked up and rectified by a portion of the piezo foil acting as microphone, after which the resulting voltage could be used for operation of a circuit. This would then elicit the response of the piezo foil. A corresponding mode of operation would also be possible through the irradiation of light onto a photoelectric cell instead of ultrasound.

By way of example, the response of the electrical circuit is now directed onto the electrodes on the one side of the foil on the one hand, and onto the metal layer on the other side of the foil on the other hand. This makes it possible to make the response of the circuit audible or, as the case may be, demonstrable through vibrations of the sheet in the audible range or in the ultrasonic range.

EXAMPLE 108

In an exemplary embodiment, a sequence of data is stored in the electrical circuit, the transmission of which [data] onto the piezo element or, as the case may be, the piezo foil, generates a tone or a sound. This can comprise a simple sinus tone, but also speech, sounds, etc. By way of example, a rustling sound, which copies the crackling of a real banknote and is reproduced sufficiently loudly, can be generated. Likewise, comprehensible messages can be generated, e.g. the denomination of the banknote: 10 €, etc. The sonic oscillations emitted by the piezo element can comprise audible tones and/or represent sonic waves that can be demonstrated by the use of measurement technology. By way of example, an ultrasonic signal can be generated that is picked up by a microphone and tested via a control circuit.

In a simplified embodiment, provision is made for a high-frequency electromagnetic signal to be received by means of an antenna. The energy obtained in this context is used for the operation of a frequency generator, the output of which is connected with the piezo element, which e.g. emits a tone that corresponds to the high-frequency electromagnetic signal or, as the case may be, is derived from same. Provision can also be made that the electrical circuit contains stored information which determines frequency and/or intensity of the signals, which are emitted by the piezo element or, as the case may be, by the piezo foil.

Through irradiation from sonic waves, the piezo element or, as the case may be, by the piezo foil is stimulated to give off electrical voltages. The corresponding electrical charge is used to supply the integrated circuit and induces it, in accordance with the stored data, to send out a message, work off a program, etc. and to modulate a signal on the piezo foil. In this context, the irradiated energy can also be stored briefly and then serves in the temporally-displaced delivery of a response via the circuit and the piezo foil, while the irradiated frequency can, in the meantime, be switched off.

EXAMPLE 109

As already shown in the above, a particular problem consists in feeding a stack of banknotes with sufficient energy for the operation of all of the chips contained therein. A further solution is therefore presented in the following, in the context of which, by means of electromagnetic fields, particularly in the low frequency range of less than 100 KHz, energy for the operation of the transponder chips in a stack of banknotes can be effectively transmitted.

For one, this can occur in that an electrical alternating voltage is generated from an external magnetic field by means of induction in a coil of a banknote, which [voltage] supplies the chip with energy and/or data, as has already been described. However, this requires the realization of a coil with several turns on a banknote. Alternatively, the frequency of the magnetic field can also be selected sufficiently high to be able to use a coil with only a few turns. Effective energy transmission through magnetic induction requires working frequencies in the range >10 MHz which e.g. can only be realized by elaborate means through polymer electronics.

EXAMPLE 110

One idea of the present invention therefore consists in using the magnetostrictive effect in place of the effect of magnetic induction. As a result, no large-surface coils are needed on the banknotes and working frequencies in ranges of a few 10 KHz can be selected. In this way, for one, the necessary circuits in the banknote with a chip can also be realized by means of polymer electronics, and for the other, the electronics for generating the necessary fields can also be realized more simply.

If e.g. the compound materials according to FIG. 27 or, as the case may be, FIG. 28 are used, generation of a sufficiently high electrical alternating voltage, which is proportional to an alternating magnetic field 363 applied from the outside, is thus possible while at the same time avoiding electrical induction.

Strong alternating magnetic fields, which flow through the volume of a stack in the vertical direction at high-frequency ranges of e.g. more than 10 MHz, are needed when coils are used for the energy supply of the banknotes, particularly in the case of readout in the stack.

In the case of the solution with magnetostrictive materials, it is already sufficient, compared to the foregoing, to generate a locally strong alternating magnetic field, which particularly or exclusively flows through magnetostrictive metal strips 360, as depicted in FIG. 28 by way of example. Since magnetostrictive metal strips 360 exhibit significantly higher magnetic permeability than the carrier material, i.e. the paper of banknote 1, it is by contrast easier to direct a large portion of the generated magnetic flux through the active magnet strips.

The requirement of having to generate a sufficiently strong magnetic field in a small portion of volume in comparison to the total volume of the banknote stack simplifies the development of a suitable reading device. Moreover, the field does not have to flow through the stack in a vertical stack direction, but rather only in a horizontal direction, which can simplify integration in a banknote processing apparatus.

The method according to the invention preferentially works in frequency ranges of less than 100 KHz, typically of a few 10 KHz, thus also permitting the use of chips on the basis of polymer electronics. This further permits the development of simple reading electronics, since even "NF" amplifiers can be used for the generation of the necessary electrical power.

EXAMPLE 111

Two possible built-on accessories of suitable reading devices 370 for such banknotes are depicted in FIG. 52. In this context, for the generation of a sufficiently strong magnetic field, a magnetic field generation unit 371, e.g. in the form of a horseshoe 371, i.e. a U-shaped component 371 made of highly permeable material, upon which an exciter coil 372 is wound, is used in each case. This in turn is fed with an alternating current by the output amplifiers of reading device 370. In this context, the magnetic field should be generated to be so wide that it can also act on the strips 363 of banknotes that are not stacked flush or, as the case may be, banknotes of varying formats.

Upper FIG. 52*a* shows a reading device 370 for a single banknote or a small number of banknotes, such as can occur at a register. A mechanical apparatus 373 in the form of e.g. a right-angled stop on a depositing surface 374 ensures that a banknote 1 lying on the deposit is held in the right position. In this context, the magnetic field generation unit 371 is preferentially situated underneath the depositing surface 374.

FIG. 52*b* shows a reading device 370 for use in a banknote processing machine, i.e. in particular an apparatus for automatic counting and/or sorting of banknotes. The fundamental design corresponds to reading device 370 according to FIG. 52*a*, but the limbs of magnetic field generation unit 371 are arranged such that its magnetic field 363 can simultaneously penetrate strips 360 of the stacked banknotes in this region. Here, stacked banknotes 1 are depicted as semi-transparent for better clarity. It is e.g. also conceivable that such a reading device is integrated in an input pocket of a sorting and/or counting apparatus or, as the case may be, an automatic teller, with the banknotes, which are stacked, being slid in between the limbs, i.e. the magnetic pole 374 of the magnetic field generation unit 371, or transported there.

If the strip 360 to be tested is not integrated centrally on the banknote paper, reading devices 370 according to FIG. 52 can then exhibit a second magnetic field generation unit 371 which is positioned at the alternative possible position of strip 360. A positional invariance of the banknote 1 during testing is thus obtained. In this case, e.g. in the case of the arrangement according to FIG. 18*b*) in the case of integration in an input pocket of a processing apparatus, the banknotes are placed in the hollow formed by units 371 or transported into same.

Since the effect described according to the invention is also reversible, strip 360 can, upon appropriate control by chip 3, also be used additionally or alternatively in this arrangement in order to send data from banknote 1 back to the reading devices 370 according to FIG. 52. For this purpose e.g. load modulation or a signal at half of the working frequency can be used.

The reading devices described have the advantage that banknotes 1 can no longer be read out over a greater distance. As a result, the anonymity of an owner can be ensured particularly simply and reliably, in particular, pocket reading devices are used.

EXAMPLE 112

As was already described in relation to FIG. 28, the method with photodiodes, preferentially LISA photodiodes, as described at another location of this invention, can also be used for readout of banknotes 1.

A suitable readout device to this end for reading in the stack is depicted in FIG. 53. By way of example, in the case that LISA photodiode 227' and compound strip 360 are arranged such that they overlap or are at least lie very close together, a deviating prism 375 is used to ensure a separation of magnetic field lines 363 from light beams 288. Among other things, this also permits the sensitive electronics for the detection of the LISA emissions such as, e.g. a CCD camera, to be effectively shielded against the magnetic fields of magnetic field generation unit 371. The deviation prism is preferentially mounted between magnetic pole 374 and banknotes 1 to be tested.

One possibility for increasing the efficiency e.g. of this arrangement consists in setting the frequency of alternating magnetic field 363 equal to the mechanical resonance frequency of compound material 360. Upon stimulation by an alternating magnetic field 363, a magnetostrictive metal strip 361 exhibits pronounced acoustic resonance frequencies, which exhibit particularly large amplitudes of mechanical vibration. This effect is also to be expected in compound material 360. Through the coating with additional materials, such as strips 362, 364, a damping occurs, however, as a result of which the resonance effects manifest themselves less strongly.

EXAMPLE 113

As an alternative to the above-described variations, provision can also be made that the voltage supply and/or communication of the banknote with the reading device takes place through a contact-type electrical connection. In this context, the voltage supply and communication from the reading device into the banknote can occur via the contact surfaces, while communication from the banknote to the reading device takes place in another form, such as optically or inductively. The individual banknotes will preferentially exhibit contact surfaces on both sides, among other things, for the purpose of simultaneous contacting of more than one banknote. In this context, the contact surfaces of the two sides will be electrically connected to one another for galvanic coupling. To this end, the stack to be measured will preferentially be pressed together in order to achieve better contact between adjacent banknotes. If the contact surfaces are all arranged centrally, and if they are thus at least located at the center, i.e. the intersection of the lateral diagonals of the banknote, or are at least symmetrically arranged in relation to this center, contacting of banknotes is possible in all four positions, for which e.g. their front side and back side and left side and right side are exchanged any way whatsoever.

Here e.g. banknotes 1 can be utilized, which are depicted in FIG. 34 or, as the case may be, 35. To contact a stack of such banknotes 1, the stack must be pressed together such that layers 380 of all banknotes 1 in the stack are electronically conductively connected. The two outermost, i.e. the uppermost and the lowermost contact layers 380 are then each contacted from the outside by an electrical contact clamp. An energy supply of this type permits the number of direct contacts 380 (galvanic contacts) to be reduced to just two in the simplest case. Naturally, solutions with more than two contacts 380 are also possible, if this offers advantages. Preferentially, contacting of a processing device to a banknote 1 will take place via contacts 380, which are significantly larger than chip 3 and preferentially at least 1 cm2 in size. This makes it possible to galvanically address a stack of banknotes 1 of any thickness whatsoever simultaneously. This galvanic coupling preferentially serves in the energy supply of the chip 3. Driving of the chip and data transmission can then optionally also take place via another method, e.g. a noncontacting inductive or optical coupling. Consequently, control and/or data transmission can take place independently of the energy supply. This has the advantage of being able to keep the intensity of the electromagnetic fields low, since no power supply of the chips must take place by this means.

In the case that the elements of the stack must be stacked without regard to their orientation, the polarity of the applied energy supply must be observed. This can e.g. be compensated for, in that an alternating current is applied to galvanic contacts 380 and that the chip or, as the case may be, line 381 exhibits an associated rectifier. Alternatively, a DC voltage can also be applied.

In addition, it is preferred that the contacted banknotes situated in a stack can communicate with one another directly, as has already been described in relation to an optical coupling by way of example. To this end, e.g. banknotes 1 according to FIG. 35 can also be used. These can be contacted such that chips 3 are successively addressed, i.e. e.g. activated. Here, by way of example, the entire banknote stack can initially be supplied with energy by connecting voltage to the outermost conductive contact strips 380. In this context, if all chips 3 are deactivated first, then, by additional contacting e.g. of the upper third contact 382 of the uppermost banknote 1 in the stack, a transistor or another suitable switch element of chip 3 of this banknote 1 is supplied with a control signal, which enables the switch element and thereby activates chip 3 of uppermost banknote 1. Subsequently, banknote 1 lying thereunder is activated a control signal of chip 3 of the uppermost banknote 1 being sent out via the fourth contact 382 located on the underside of uppermost banknote 1. The precondition in this context consists in that contacts 382 of individual banknotes 1 in the stack are positioned such that the third contact or, as the case may be, the fourth contact 383 lie one over another in the case of suitable stacking and thus establish the galvanic contact between two banknotes each lying one over another. In this context, the third and fourth contacts 383 are particularly preferentially designed the same and/or can fulfill the same function, in order to be independent of the position of individual banknotes 1 in the stack.

By way of example, this method thereby allows the energy supply to be applied galvanically to the entire banknote stack simultaneously, while banknotes 1 can be activated successively in the manner mentioned. Here as well, preferentially e.g. only one of banknote chips 3 at a time can be simultaneously active.

Disabling and Enabling of Banknotes

As was already briefly mentioned above, a further essential idea of the present invention consists of writing about the validity of a note into a memory of the banknote chip, e.g. of an EEPROM or a PROM.

EXAMPLE 114

It is in principle conceivable, for example, that a code be written by banks authorized to do so to the memory of the banknote, which marks the banknote, so that this condition will be recognized for such banknote chips by the associated reading devices, and so that the banknotes can then be classified as marked or invalid. Disabling and enabling is thus effected by changing at least one dedicated bit in the memory of the banknote chip. In order to also be able to recognize this marking or status setting, as the case may be, without a reading device, the state of validity can be additionally displayed on an optical or acoustic display device integrated into the banknote paper, such as an LED or LCD display. In the simplest case, a suitable bistable display such as an LED in the banknote, which is switched on or off in the case of an invalid note, will suffice. Said display device can have properties as described in a following chapter entitled "Commerce."

The superordinate idealistic value of a banknote is, however, to be seen in its anonymity and its neutrality. If the authenticity of the paper's features is to already suffice within this meaning in order to be able to use the banknote unreservedly as a means of exchange in any given transaction, the "temporary" invalidation of banknotes as relevant for the end consumer is to a large extent prohibited. Despite the theoretical possibility of an occasional "disabling" in an authentic banknote, this possibility is thus prohibited, at least as regards the end consumer.

Nevertheless, this technical possibility offers entirely new security concepts.

If one is to actually utilize the technically "invisible" information of the banknote chip memory, that the note is "disabled," the central offices within the banknote circulation can in fact receive valuable information from this. Since it is possible for a machine to read out the chip data, data can be collected during the normal processing of the banknotes in banknote sorting machines, e.g. of the central banks, and the "switches" can then be reset.

EXAMPLE 115

If, for example, banknotes are deactivated prior to transport from one location to another, then banknotes which were stolen during an armed robbery of such a transport can be easily identified. This can be effected e.g. during the transport of banknotes from the banknote printing works to an issuing central bank and/or from the central bank to a commercial bank.

EXAMPLE 116

It is furthermore also conceivable that the banknotes not be enabled until immediately prior to their being dispensed to a customer in a bank or from an automatic teller. This can preferentially also be done online by an organization authorized to do so, such as a central bank, via a remote data link between the banknote chip and a central bank computer as described in greater detail in the present application.

EXAMPLE 117

Moreover, in the case of e.g. extortion money, such data as will lead to time-delayed disabling, and e.g. deactivation of an associated display can be written into the memory of a banknote chip, so that same only becomes marked as invalid and can be recognized after a time delay after the money has been transferred to a blackmailer. The delayed disabling can be achieved e.g. by means of a counter contained in an integrated circuit of the banknote, which marks the notes as invalid only after e.g. ten days. Alternatively, it can also be provided that an expiration date as of which the banknote loses its validity is written into the memory of the banknote chip. This validity date can then be checked by the associated reading devices.

This disabling and enabling of banknotes by writing data to a memory of the chip will preferentially be effected in the stack here as described above. The validity status of a banknote will be further indicated, e.g. following a lapse of the expiration date, by an optical and/or acoustic display device permanently integrated in the banknote paper as described in detail in a following chapter entitled "Commerce."

EXAMPLE 118

It is furthermore conceivable that when payments are made with such banknotes marked by the chip data as being special, e.g. invalid, such as when deposits are made in a bank or when payments are made at a business such as a gas station, this state is recognized by the associated checking devices reading out the chip data, and thus a camera coupled with the register terminal is activated in order to be able to record the suspicious payment operation, i.e. in particular the person making the deposit.

EXAMPLE 119

Apart from the writing of data which provides information on the validity of the banknote into the banknote chip, data on other administrative states can also be stored. Here, it is possible to have e.g. data on states such as "in storage," "in transport," or "stolen".

EXAMPLE 120

Also, especially in conjunction hereto, provision can be made that chip 3 of a banknote 1 has several logical switches, memory cells in general, which preferentially also hold sufficient data available in the "switched" state to induce the "switching operation;" i.e., concerning, for example, by whom or, as applicable, by which device, when, where and/or why the switching operation was carried out.

This means e.g. that chip 3 not only has a single switch or chip data characterizing same, as the case may be, which serve to fully disable the banknote, but that several switches are provided for different users in each case in accordance with the associated chip data, in order to disable chip 3 of banknote 1, for example, for certain groups of people or actions. Users can e.g. be central banks, securities transport firms, commercial banks or customers. For this purpose, different memory areas can in turn be provided in the chip for different users. In addition, the switch does not necessarily have to be assigned only a binary signal that e.g. can only assume the "valid" or "invalid" state, as the case may be. One can additionally realize the storing of additional data for information. This can, for example, be data concerning by whom and/or when and/or where the switch of the particular banknote was used.

Further, identifying data can be stored in the memory upon changes to the contents of the memory data, e.g. relating to changes in the display condition of the optical and/or acoustical display, which indicate by whom and/or with which device and/or when and/or where the associated data was entered into the memory, in order to be able to clearly follow and control the changes made when the memory contents are read out, even at a later point in time. In the case of activation or, as the case may be, deactivation of banknotes, the writing devices e.g. will be available solely at the system operators' that is responsible for same, such as the central banks, securities transport firms or other cash handling service undertakings, so that memory data on the current validity of the banknote can only be changed by persons authorized to do so.

This can be achieved by having the data stored in the chip such that it is encrypted and/or marked, or password-protected, as the case may be, and such that it can only be changed given knowledge of the password or, as the case may be, of the encryption algorithm or, as the case may be, only with special writing devices adjusted to writing the associated chip data to the particular banknote. The PKI system described above, for example, can be utilized for this purpose.

It is additionally possible for the digital signature or the key for access to the encrypted data, as the case may be, to be saved in a separate chip, which is not a component of a banknote. The separate chip can e.g. serve to check the access authorization for certain users or certain actions, as the case may be, as specified in the following. This chip can e.g. be a component of an external chip card, which must be inserted into a checking device having read functions and/or write functions for banknote chips or connected to same, as the case may be, in order to check the required access authorization. This has the advantage that, upon a conceivably necessary code change, only chip cards, of which there is but a limited number, and not all the banknotes will need to be replaced.

EXAMPLE 121

Circuits having the properties cited in the above are suited to several applications within the overall circulation of money.

In a case of extortion, the chip memory "switch" reserved for state central banks can be provided with the information, "04.17.2002, Extortion, Case: Code word", in a state central bank. Only state central banks (SCB) can write, read and delete this information in the banknote chips.

Banknote sorting machines at the state central banks check all banknotes flowing back into the monetary circulation for authenticity and their fitness for circulation, i.e. state of preservation. Should the SCB switch of each banknote now also be checked within the context of this routine, the banknotes assigned to the above-cited extortion case can be filtered out.

Such data is not perceptible to the ordinary consumer; it is also irrelevant to the consumer, since the banknotes are still authentic and thus valid.

EXAMPLE 122

Further, the memory can e.g. encompass an authentication system which contains data on different access authorizations for reading and/or reading or writing chip data and/or for changing the data contents of the memory. It can e.g. be necessary to input into the associated reading and/or writing device a code necessary for a certain group of users or testing devices, as the case may be, and/or for the performing of a specific action. The entered code is preferentially compared for a match with the reference data stored in the chip itself in order to enable access authorization.

The reference data is preferentially saved in a memory area, which cannot be read from the outside without special authorization. In order to legitimize itself for the actions, the corresponding processing device, must enter the code, optionally upon prompting by the banknote chip.

Also of preferable advantage in such a case is use of a maloperation counter. The chip of banknote 1 can specifically contain at least one non-volatile error counter which cannot be written to from the outside. Upon each unsuccessful attempt to transmit the code, it counts ahead by one, although it preferentially resets upon successful entering of a suitable code. An exception is made in the case of the error counter reaching or exceeding, as the case may be, a fixed value. In this case, the banknote is marked by a status which documents the attempted manipulations and which cannot be reset. This can e.g. lead to occasional or permanent, i.e. irreversible, deactivation i.e. prevent certain chip actions. According to one variant, after the error counter's fixed maximum number has been exceeded, the chip e.g. irreversibly no longer allows any more chip functions to be executed except for querying the status of the chip.

Provision can be made that the cited codes be different for each banknote and/or that they are stored or will be stored, as the case may be, in a central database. The associated reference data are preferentially stored in a ROM memory area during production of the banknote. It can further be provided that the code is randomly regenerated after every action or at least after a given number of actions, which require the use of the code, and stored in the chip and e.g. transferred to the central database. In this case, it can also be provided that, for example, the chip of the banknote needs to be legitimized at a reading device, in that the code which is stored therein is transferred to said reading device, which in turn transfers the code it reads to the central database, which e.g. only returns a Yes/No statement as to whether the code for the corresponding banknote which can be, for example, additionally uniquely marked by an unalterable serial number, is correct. A connection to the central database can e.g. be established via cell phone or a GSM connection.

In many cases, it is expedient for the transponders of the banknotes to respond and communicate one after the other. This is especially necessary when querying and processing the individual data of the individual banknotes.

In other cases wherein a defined number of banknotes are to be furnished with standard data e.g. prior to a securities transport with the data, "Securities transport from location A to B, date, time, transport company, transport number, transport truck, unit of quantity, etc.,", it is of great advantage to provide a majority or all of the banknotes with the data in parallel i.e., at the push of a button all at the same time. After the transport has been concluded, the data can likewise be simultaneously deleted again for all banknotes "at the push of a button" or, as the case may be, all the "switches" can be reset.

For parallel writing/deleting of information, it can be necessary for the banknote transponders to have a further interface which is particularly optimized to this mode of operation. This applies in particular for banknotes having an optical interface for serial processing, e.g. photodiodes.

EXAMPLE 123

Given a case where there are different access authorizations for different users in order to perform different actions and/or for different memory areas, it can also be provided that at least one memory area is rewritable and in essence freely accessible to all. This can e.g. be utilized to the end that anyone, thus also any private person, is able to write, read and change data, which is then sent off in a form similar to a "message in a bottle." It is likewise conceivable to store advertising information, gift promises ("Use this banknote at XY department store and you will receive a 3% discount"), games, etc. The data can be written into this kind of memory area as text and/or symbols and/or images and/or sounds and/or games. These can then be optically and/or acoustically reproduced, either by means of a display device integrated within the banknote itself or by means of an external device.

Remote Data Transfer

Another idea of the present invention consists of having a remote data connection in order to transfer data between a banknote checking device and an evaluation device at a spatially remote location. The checking device can in particular also be a device described in the present invention for the recognition and/or checking of banknote chips, with the device being able to read data from the chip and/or write data to it. This remote data transfer can be effected via a telephone connection such as a fixed line connection, a mobile link, or via a network connection, e.g. the Internet or an intranet connection. This data transfer can e.g. be either unilateral or bilateral in this context.

EXAMPLE 124

When, for example, a banknote checking device is integrated into a cellular phone or also when stationary terminals, such as money depositing and/or disbursing machines at banks or retail stores, have such a device for remote data transfer, it is conceivable to enable a secure data transfer from and/or to a center, e.g. a central bank or a trust center, e.g. via a GSM connection. For example, direct communication between the chip of the banknote and a computer at the central bank can thereby be established. Authentication between the banknote chip and the central bank computer can ensure that specific, pre-defined actions can only be performed by the organizations authorized to do so, in this case e.g. the central bank.

The following includes possibilities of application in this respect:

EXAMPLE 125

A check of the chip data can be performed online. This means that the evaluation of such data, e.g. for checking the authenticity of banknote chips, is not performed by the on-site checking device, but instead at a remote central bank or the like via the remote data connection, and the only feedback from the central bank to the checking device is the result of the check. This has the advantage that the central bank can keep better secret of the evaluation algorithms and that an unauthorized third party cannot simply conclude the details of the executed checking operations simply by an analysis of the checking devices as such.

EXAMPLE 126

The above-cited data on administrative states, such as the validity of the banknote, which are preferentially stored in its chip, can be additionally or alternatively stored in the central database such that they are assigned to the particular banknote. A variant of this consists in that the data such as the serial numbers of stolen banknotes are collected centrally in the database. If, in this case, banknotes are deactivated for transport, this can then prevent the stolen banknotes from subsequently being "put back into operation" without being noticed.

Recognition of Duplicates

A problem inherent to banknotes is the possibility of their being forged with a corresponding effort. This problem also exists with banknotes having a chip, since it can be assumed in this connection that the chip can also be duplicated given the correspondingly large effort. Particularly when using large-surface circuits made from polymer electronics or polycrystalline silicon, there is the risk of a re-design and, connected with same, the production of one or more copies of the chip for the purpose of bringing forgeries into circulation. In contrast to forged chip cards, a forged banknote is immediately put into circulation and is thereafter no longer in the possession of the counterfeiter. This increases the incentive and, thus, the risk of a forgery.

Therefore, there is a need to be able to recognize duplicates of banknotes.

EXAMPLE 127

A possibility for this purpose consists of having a new code always being written into a memory area of the banknote chip provided for this purpose in each case, during one, preferentially during each online check of banknotes. Online check is hereby understood to mean in particular a checking operation wherein the checking device for banknotes is linked to a remote computer system via an online connection in order to perform a data comparison with a central database, as described in greater detail in the following. Feasible as online connections are network connections such as fixed line or cellular telephone, Internet or intranet connections.

In this context, the code can be a random number representing an arbitrary letter, digit and/or symbol combination. The random number is preferentially generated for the first time at the time of the check. This random number is likewise stored in a central database, e.g. of the central bank, and assigned to the serial number or another unique and constant identification of the particular banknote. Upon each further online check of the banknote, the random number in the banknote chip is compared with the associated entry in the central database. The comparison is preferentially performed in the computer of the central bank in order to be able to more effectively prevent manipulations. If a disparity of the random number is determined for a given serial number, it can then be assumed that there is at least one duplicate of the checked banknote or that the duplicate was tested, as the case may be. If a match is determined for the random numbers, the banknote can then be assessed as being authentic. In this case, a new random number is generated and saved in the banknote chip and in the central database. Thus, forged duplicates of circulating banknotes can be recognized in a reliable manner.

In order to ensure that the memory of a banknote chip can be written to, the newly-generated random number is preferentially first written to the banknote chip and then read out again. If saving of the new value in the banknote was successful, the entry in the central database will then also be updated. Only then, will the banknote be recognized as authentic and a corresponding display be output on the reading device.

An additional possibility consists of registering unsuccessful writing attempts in a maloperation counter. This enables the prompt recognition and sorting out of chips having defective memory cells or also of duplicates having a read-only memory, which would, however, not have been recognized as authentic anyway.

Briefly summarized, the idea thus consists of storing a random number in both the banknote chip as well as in a database. Upon each check of the banknote chip, the random numbers are first compared, specifically e.g. upon each successful check, consequently, a new random number is generated and stored in the banknote chip as well as in the database. If the two random numbers do not match, the banknote is then classified as a suspected forgery and handled accordingly.

EXAMPLE 128

Instead of the random number, the banknote can also be assigned e.g. a transaction number TAN upon each transaction. The TAN is thereby derived from a number of digits, with the number of all possible TANs being larger than the number of all possible serial numbers, i.e. the TAN is a very long and randomly-generated number and thus not easily guessed. The difference from the random number consists of the fact that the TANs were already generated previously and become invalid after use. It is not mandatory to establish a relationship to a serial number, since a TAN alone can also represent a feature of validity.

The following will describe possible problems in the realization of this duplicate recognition and their possible solutions.

EXAMPLE 129

A possibility for illegally ascertaining the random number exists in the so-called "brute force" attack wherein all conceivable possible combinations are queried from the database for as long as necessary until a correct random number is determined. The smaller the available memory in the banknote chip, and thus the length of the random number, the easier this process is.

In order to prevent this, a time stamp is saved in both the banknote chip as well as in the database, i.e. data on the time of the last query. Additionally, the ID number or the IP address, as the case may be, of at least the most recent querying checking unit to the database, preferentially, however, a longer history on the last query, can be stored in the database. In place of the ID number or IP address, as the case may be, all other data can also be used which allows referencing back to the particular checking unit and/or location, i.e. the institution such as the particular business or bank where the checking unit is installed and/or to the last queried database. This additional data will be termed "location stamp" for short.

With each query of the database, a frequency check is now preferentially executed, e.g. by means of a maloperation counter, which will be described in greater detail in the context of these present applications. That means that queries, where combinations of serial number and random number are thus retrieved and compared to the entries in the database, are recorded in a maloperation counter if the random number for a given serial number is invalid. If it appears that a serial number has been repeatedly erroneously queried within a short time by just one checking unit, there is then cause for suspicion that an attempt is being made to determine a valid random number by means of a brute force attack. To prevent this, the checking unit or the associated banknote processing device, as the case may be, can be temporarily taken off the network or the communication between database and checking unit decelerated such that an attack cannot be carried out within an acceptable amount of time.

If, however, it appears that a serial number has been repeatedly erroneously queried by diverse checking units, then the suspicion of an already circulating forgery, possibly in larger quantities, suggests itself.

EXAMPLE 130

A possible problem which can arise when checking banknotes via a central database is a very large number of simultaneous accessing of this database. In order to circumvent this problem, provision can be made for distributing the data among several databases DB. FIG. 54 shows an example of this case. There are N databases DB. When a banknote BNC is checked by a checking unit, the checking unit then sends the serial number and the current random number RNDt=0 of the banknote being checked to one of the databases. The particular database DB to which the test data is sent can, for one, be made dependent on a further identification number as a criterion for selecting one of the databases 1 . . . N, which is stored together with the random number in the chip of the banknote to be checked. The identification number can also be a part of the random number itself; e.g. its last two digits. One database DB will then always be responsible for checking a certain group of identification numbers.

Should a new random number RNDt=1 be generated during a query, it thus thereby becomes certain, with which database the next query will take place upon the next check. In the example shown in FIG. 54, the 1st database DB writes and assigns a random number RNDt=1 to checked banknote BNC, which corresponds to the 4th database DB. Therefore, the associated data record on the checked banknote BNC, e.g. at least data on the serial number and random number, must be transferred via data line from the 1st database DB to the 4th database DB.

In contrast to only one database, there is a resulting decrease in traffic volume, i.e. the number of accesses, by a factor of 2/N, with N representing the number of databases in the overall system.

With this system, each checking unit can access any database within the system. In this context, the databases are preferentially present on separate computers, in particular also at separate locations. It is possible that the checking units can access all possible databases via different databases. For the data comparison, however, it is preferential for one individual checking unit to be connected to a front-end computer, which is assigned to several checking units and which in turn establishes a connection to the individual databases 1 . . . N. The individual checking unit thus only needs to establish a single data link to the front-end computer in each case and not to all the databases at the same time; e.g. upon a deposit transaction.

EXAMPLE 131

A further possibility of reducing accessing of a single database consists of a spatial distribution of the databases, with the distribution possibly being made e.g. by countries, provinces, cities or the like. In this context, each database serves a subset of checking units. Any arbitrary, e.g. cross-border, access is not possible for the checking units, since there is a fixed assignment between checking unit and database.

In this scenario, the banknote chip contains at least one other entry on the database last queried apart from the random number and an optional time stamp. When the banknote is dispensed by a central bank or the like, the valid data record is stored in only one of the databases assigned to the particular central bank.

In addition, it can be provided that all the databases within one system are networked together and, that a comparison can be made among the data records they contain if necessary.

In the following, a concrete example of such a scenario will be explained with reference to FIG. 55. Here, it is assumed that a banknote BNC#255 having the exemplary serial number #255 is stored in database DB1. Upon a check at a terminal PE1 at time t=1, the stored data record is compared with the data record stored in database DB 1. If the check is successful, a new random number RNDt=1 is then generated and stored together with the location stamp and time stamp, i.e. in this case, the time t=1 and database DE1 data, in banknote BNC#255 as well as in database DB1.

If banknote BNC#255 in the example now leaves the "catchment area" of database DB 1 and is found in the catchment area of DB2 at time t=2, then the data record associated with said banknote BNC#255 will initially be missing from said database DB2. However, the location stamp in banknote BNC#255 can serve to establish that a corresponding data record is present in database DB 1. By a comparison of databases DB 1 and DB2, the relevant data record can now be transferred to database DB2. The data record can then subsequently either be deleted from database DB1 or a corresponding reference to the "border crossing" of banknote BNC#255 can be stored in database DB1.

On the basis of the data record now found in database DB2, the authenticity of banknote BNC#255 is checked and a new data record with a new random number RNDt=2 as well as a new location stamp and time stamp is written into database DB2 as well as banknote BNC#255.

In contrast to a single database DB, there is a resulting decrease in traffic volume (i.e., the number of accesses) by a factor of 2/N, with N representing the number of databases in the overall system. In addition, cross-border flows of money can also be detected. Additional security is provided by means of the time stamp and location stamp in the banknote.

EXAMPLE 132

A further scenario for an attack consists of making the chip in the banknote unusable by writing absurd data to it.

As already illustrated elsewhere in the invention, provision can be made for circumventing this problem by signing the data record to be written to the chip e.g. with a public key in a so-called "public key" procedure. The chip only needs knowledge of a public key to check the authenticity of the data record and to reject the data record if necessary.

An additional possibility consists of including the serial number of the banknote chip itself in the marked data record. In this way, the copying of—inherently valid data records—of other banknotes is also prevented.

A further possibility consists of safeguarding reading and/or writing access to the banknote chip by means of a derived PIN number. In the simplest case, the PIN is derived from the serial number of the banknote. A further possibility consists of including the particularly valid random number RND in the PIN computation so that the PIN will also change upon each check of the banknote.

EXAMPLE 133

A further attack scenario consists of copying data from the chip of an authentic banknote, transferring it to a duplicate, and subsequently destroying the authentic chip, which still remains a component of an actual authentic banknote.

According to the invention, it can therefore be provided that the serial number of a banknote is detected at a suitable checking unit in a different way than by reading the chip data, e.g. optically by means of a camera such as a line sensor. Especially in the case of a defective chip, a corresponding notation as to suspected forgery is then stored in the database.

EXAMPLE 134

Another attack scenario which is just as possible consists of manipulating a checking unit in such a way that, a data comparison between the banknote and the database is activated first when a banknote is presented. Given an appropriate manipulation, it is then conceivable that the new data record, i.e. the new random number in particular, is not written back to the banknote chip, but instead, the data records are collected in the checking unit so they can be used to program counterfeit chips at a later point in time.

In order to prevent such a procedure, provision can be made for not only storing the current data record in the banknote chip, but older data records as well, in order to keep a history of testing operations as a life history of the banknotes. Older data records are likewise saved to the particular database in order to produce a history of the banknote.

Moreover, the identification number, such as the IP address, etc. of the querying checking unit, can also be stored in the database. In this context, it is possible, by a statistical evaluation of the data records saved in the database for instance, to discover evidence of possibly manipulated checking units.

A further possibility thus consists of saving historical data records on former testing operations on the banknote as well as in the database. According to another variant, it can also be provided that the historical data records of the banknote are not to be read out or written to directly. This can e.g. be achieved in that the memory of the banknote chip is an FIFO memory ("first-in-first-out"), with the older data records being pushed through the memory each time a data record is updated with a random number and, as applicable, a time stamp and a location stamp.

FIG. 56 shows an example of this variant wherein the current data record "n" of banknote BNC, which was created during the previous check at time t=0, is compared with the corresponding data record "n" in database DB when the check at time t=1 in checking unit PE is performed. Upon successful check, a new data record "n+1" is thus generated and stored with the time data, t=1, both in database DB as well as in the chip of banknote BNC.

In order to check that the new data record was actually written to the banknote chip and not intercepted by the terminal, i.e. checking unit PE, the new "n+1" data record is preferentially linked to at least one data record of the history by an algorithm. Here a function of the last n data records is output for a fixed small n. Ideally, this is a so-called "one way" function or a cryptographic hash function. Alternatively, with limited resources, simpler functions can also be computed. This operation is performed in banknote BNC as well as in database DB and the results subsequently compared. Since checking unit PE disposes of no knowledge of the history, manipulation at this point can effectively be made more difficult.

A further improvement of the writing control can be effected by keeping a history indefinitely. For this purpose, the oldest data record in each case, which in turn contains information about preceding data records, is fed to a random number generator PRG. The result can e.g. be stream encryption, a so-called "stream cipher," where the stream cipher output is used to compare the data from the banknote chip and the database.

Apart from a random number generator PRG, there is also the possibility of computing a checksum such as a so-called "cyclic redundancy checksum" CRC, since, here as well, the entire history, i.e. older data records, enter into the results.

A pseudo random number generator can also be used to compute the random number, which is customarily configured as a counter having a sequential circuit for feedback as is e.g. described in the book by Finkenzeller K., "RFID-Handbuch", ISBN 3-446-22071-2, 3rd Ed., 2002, pages 228 to 231. It can thus be provided that the coding of the sequential circuit—and thus the underlying algorithm—be changed in the chip of banknote BNC if necessary. For this purpose, the sequential circuit can be disposed with a programmable memory, such as an EEPROM.

It is furthermore preferentially provided that the generator polynomial of a possibly utilized checksum CRC also be changed in the manner described above. Changing the sequential circuit or the generator polynomial in a banknote chip can be triggered by an own (write) command, where the new parameters are generated by database DB and transferred to banknote BNC by checking unit PE while said banknote is being checked.

EXAMPLE 135

According to the invention, it can further be provided that the banknote disposes of at least one additional, redundant, identical memory. A writing operation, e.g. to update the data records, will first be performed in one of the identical memories, subsequently, the data is copied e.g. into a primary memory area provided for same. The corresponding status of the writing operation is marked and recorded in the banknote chip by flags, so that at least the original status of the memory can be restored in the banknote in case the writing operation is aborted, e.g. if an interruption in voltage supply to the banknote chip occurs.

EXAMPLE 136

It is further possible to irreversibly alter the properties of the banknote chip. A possibility for this consists of burning through so-called "fuses." In so doing, it is possible to have sufficiently high amperage flow through the fuse. It is, however, also possible to burn through the fuses e.g. with a laser.

A possibility consists of the provision of a quantity, e.g. an array of as many fuses as possible, which are preferentially burned through according to a random pattern, with the number of fuses increasing the number of possible combinations and thus the security as well as the number of possible checking cycles. The status of the arrays in turn is preferentially saved in the central database.

EXAMPLE 137

A further possibility for duplicate recognition without testing the chip data can be achieved by irreversible, local altering of a banknote or a feature of the banknote. It can thus be provided that a marking, e.g. an ink dot, is applied, e.g. imprinted at a random location on the banknote upon each testing operation of a banknote in a suitable checking unit. In contrast to a usual identification of banknotes which are no longer fit for circulation, e.g. banknotes to be destroyed, the alteration according to the invention will thus be effected above all when the note is assessed as further fit for circulation or is classified a priori as further fit for circulation due to the lack of a status check.

The ink used for that purpose shall preferentially be machine readable and not recognizable in the visible spectral range. In addition, the position of all dots of ink already present on the banknote is recorded in a database with an assignment to the particular banknote e.g. in turn via its serial number, and rechecked during a subsequent check.

EXAMPLE 138

Although not mandatory, it can also be provided in the afore-mentioned case that this data in turn, is stored in a chip of the banknote. This enables a check of the clear assignment of banknote paper to banknote chip. This can particularly effectively prevent unallowed removal of the chip from a banknote and insertion of the chip into another banknote paper.

EXAMPLE 139

As an alternative to the afore-mentioned examples, wherein the banknote is selectively altered by application of markings, magnetic, especially hard-magnetic particles, can also be brought into the banknote paper in order to provide same with a locally different magnetization. In this context, it is provided that the magnetization pattern is altered according to the random principle in a reading/testing operation and that the particular current pattern is deposited in the database.

EXAMPLE 140

A further alternative possibility consists of removing from the banknote markings, e.g. imprinted dots of ink, already applied during production of the banknote; in a random or also in a predetermined order. A laser, for example, with which the dots of ink can be removed, can be used for this purpose.

EXAMPLE 141

Still another possibility consists of furnishing the banknote completely or at least in a portion thereof with a changeable, e.g. heat-activatable surface. During each checking operation, a pattern can be written on the banknote, e.g. with a laser beam, which is changed in a random order or also in a predetermined order. It is possible in particular to configure the heat-activatable surface to be very small, with the dots applied with the laser being of a microscopic, non-visible scale.

EXAMPLE 142

Finally, a further possibility involves altering the structure of the banknote paper itself; e.g. with a laser. One can thus provide for burning dots into the paper or burning it away completely in order to produce recesses such as holes in the banknote. These will, again, preferentially be of a microscopic, non-visible scale.

Banknote Processing Machines

Banknote processing machines are machines which perform worksteps fully or partly automatically with a number of banknotes transferred to them. Such worksteps can e.g. consist in counting the banknotes, determining their value, sorting them according to currency and/or value and/or position and/or quality, stacking them, packing them, checking them for authenticity or even destroying the banknotes. Banknote processing machines can also perform a combination of several such worksteps.

Banknote processing machines according to the invention can be divided into three different classes according to their procedure when processing banknotes: into banknote processing machines with individual processing, where the individual banknotes are separated, processed successively and subsequently deposited again, preferentially stacked, into banknote processing machines with stack processing, where entire groups of banknotes are all processed quasi at the same time without them being physically separated completely from one another, and into banknote processing machines with combined individual/stack processing, where processing by the banknote processing machine can be effected via both individual processing as well as stack processing, is possible. In this context, banknote processing machines are conceivable, which alternatively provide both processing possibilities, banknote processing machines that perform both processing possibilities on the banknotes to be processed or banknote processing machines that allow every possible combination of processing possibilities.

That is why, in contrast to the banknote processing machines that are realized at present, stack processing must be designed significantly more efficiently in addition to individual processing. In the following, examples predominantly relating to banknote processing machines with individual processing are described.

EXAMPLE 143

FIG. 57 shows the principle structure of a device 100 for processing sheet material having an electrical circuit or, as the case may be, a banknote processing machine for processing banknotes having an electrical circuit.

Banknote processing machine 100 has an input unit 110 into which the banknotes are inserted in stacks. A singler 111, which takes individual banknotes out of input unit 110 and transfers same to a transport system 120, is connected to input unit 110. Singler 111 can be configured, for example, as a suction singler, i.e. singler 111 separates the banknotes by means of negative pressure, or it can be configured as a friction wheel singler. Singler 111 can be disposed, as depicted, at the upper end of input unit 110 and separate the uppermost banknote of the stack of banknotes in each case. Likewise, an arrangement at the lower end of input unit 110 is possible, such that the particular lowermost note of the banknote stack will always be separated. Transport system 120 transports the individual banknotes through a sensor unit 145, which determines data from the banknotes, which e.g. permits conclusions to be drawn on authenticity, condition, currency, denomination, etc.

The determined data of the banknotes is transferred to a operating unit 160, which evaluates the data, thereby controlling the further flow of the banknotes through banknote processing machine 100. In this context, operating unit 160 acts on switches 121 to 124, which are components of transport system 120 and allow the banknotes to be placed in output units 130 to 138 according to the predetermined criteria.

Output units 130 to 138 can be constructed, for example, as spiral slot stackers, which stack the banknotes, which are to be filed, in stacker 131, 133, 135, 137 by means of rotating units 130, 132, 134, 136, which have spiral slots. A further output unit 138 can be formed by a shredder, which thereby serves to destroy banknotes in poor condition, for example severely soiled banknotes, by means of shredding 139. Banknote processing machine 100 can be controlled by a user via operating unit 166, which can consist of, for example, a display and a keyboard.

Data Exchange Devices

For processing banknotes having electrical circuits, banknote processing machine 100 has special transfer devices in sensor unit 145, also referred to as data exchange devices, which permit a transfer of energy and/or data with the electrical circuit of the banknotes, i.e. e.g. reading and/or writing of data from and/or to the electrical circuit. For communication, the banknote likewise has transfer devices, such as an antenna linked to the electrical circuit.

EXAMPLE 144

Figure 58A:
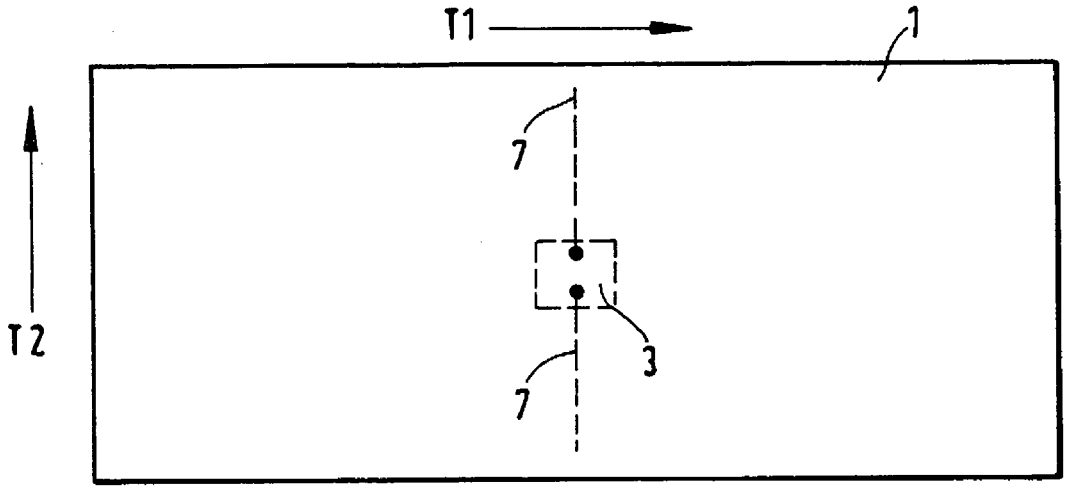
Figure 58B:
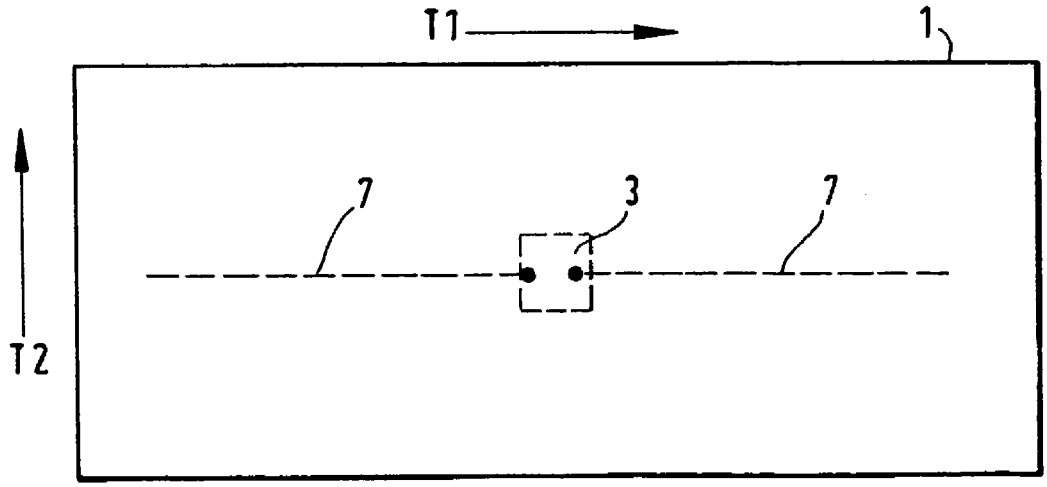

FIG. 58*a* shows, for example, a banknote 1 having an electrical circuit 3 as well as an antenna 7, with antenna 7 and/or electrical circuit 3 being affixed in and/or on banknote 1. Antenna 7 is configured as a dipole antenna and is oriented toward the short side of banknote 1. Contingent upon the orientation of the banknote during transport through transport system 120, in transport direction T1 parallel to the long side of banknote 1 or in transport direction T2 parallel to the short side of banknote 1, different requirements result for the data exchange device in sensor unit 145. Upon affixing antenna 7 to banknote 1 as depicted in FIG. 58*b*, these requirements act conversely.

The data exchange device of sensor unit 145 is therefore constructed in such a manner that, independent of the orientation of antenna 7 of banknote 1 and/or the orientation of the data exchange device of sensor unit 145 and/or the transport direction T1, T2, data exchange between the data exchange device of sensor unit 145 and electrical circuit 3 of banknote 1 is always possible.

A further possibility consists of determining the orientation and/or position of antenna 7 of banknote 1 during transport through transport system 120 and controlling the data exchange device of sensor unit 145 accordingly in order to enable data exchange. Other sensors present in sensor unit 145, sensors which record the optical information of banknote 1, for example, can be used for this purpose, for example.

Another possibility consists of designing the data exchange device of sensor unit 145 and banknote 1 in such a manner that the data exchange device of sensor unit 145 and electrical circuit 3 of banknote 1 are coupled inductively or capacitively for the data exchange. This, for example, can be effected by means of electroconductive coupling surfaces in the data exchange device of sensor unit 145 and banknote 1.

A data exchange device for banknote processing machine 100 is proposed which enables communication with an electrical circuit 3 both in longitudinal as well as also transverse transport, i.e. when transporting along the long side T1 as well as the short side T2 of banknote 1, and independently of the orientation of antenna 7 of electrical circuit 3 of banknote 1.

EXAMPLE 145

Figure 59A:
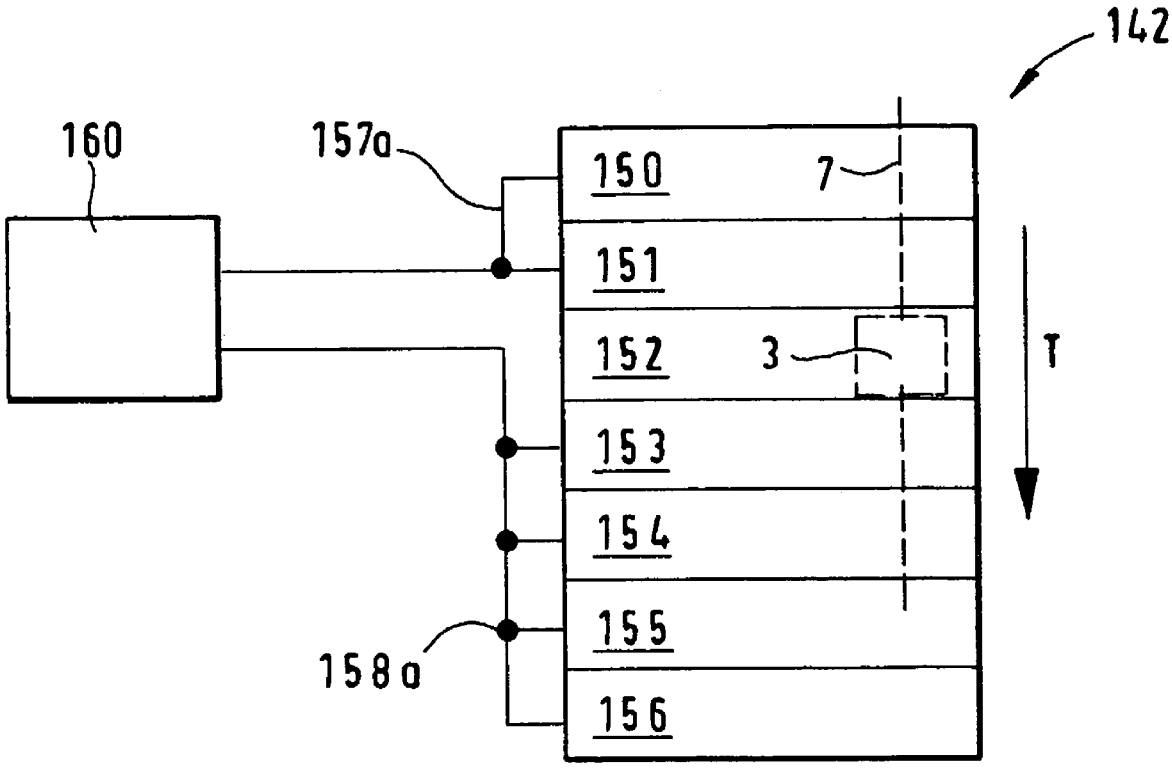

According to FIG. 59, a further embodiment of a data exchange device 142 consists of electroconductive segments 150 to 156, which are disposed to be insulated from one another. FIG. 59*a* depicts data exchange device 142 at that point in time at which electrical circuit 3 of the nondepicted banknote, of which electrical circuit 3 is a component, is at the height of segment 152. One branch of antenna 7 lies in the area of segments 150, 151, the other branch in the area of segments 153 to 156. In order to enable communication of data exchange device 142 with electrical circuit 3, segments 150 and 151 are connected to one another electroconductively 157*a*. Segments 153 to 156 are likewise connected to one another electroconductively 158*a*. In this way, segments 150, 151 and 153 to 156, which are connected to one another electroconductively, serve as an antenna or coupling surface for the data exchange with electrical circuit 3 via its antenna 7. For this purpose, electrical connections 157*a* and 158*a* are connected to operating unit 160.

Since banknote 1 is moved by transport system 120 of banknote processing machine 100, the position of antenna 7 of banknote 1 changes. In the case depicted in FIG. 59*a*, wherein antenna 7 is transported in the direction T perpendicular to segments 150 to 156 of data exchange device 142, the position of antenna 7 relative to the individual segments 150 to 156 changes. FIG. 59*b* depicts data exchange device 142 at a later point in time, at which banknote 1, and thus antenna 7 as well as electrical circuit 3, have been transported further by transport system 120 in comparison to the representation in FIG. 59*a*. At this point in time, electrical circuit 3 is at the height of segment 154. Therefore, segments 150 to 153 are electroconductively connected with one another 157*b* on the one hand. On the other hand, segments 155 and 156 are electroconductively coupled with one another 158*b*. In this way, the electroconductively-connected segments 150 to 153 as well as 155 and 156 serve as an antenna or coupling surfaces for the data exchange with electrical circuit 3 via its antenna 7. Electrical connections 157*a* and 158*a* are additionally connected to operating unit 160.

In order to ensure that the correct segments 150 to 156 are electroconductively connected to one another at all times, the position of banknote 1 being transported by transport system 120 is determined so that the interconnecting of segments 150 to 156 occurs synchronously to the movement of banknote 1, or antenna 7 and circuit 3, as the case may be. The position of banknote 1 can e.g. be derived from the known transport speed of transport system 120 when the location of banknote 1 is precisely determined at a specific point in time; for example, by means of light barriers disposed in the transport path of transport system 120. The operating unit can then control the above-described electrical connection of the individual segments 150 to 156. For this purpose, operating unit 160 can, for example, control electronic switches such as transistors or electromechanical switches such as relays, which are connected to segments 150 to 156 in order to produce connections 157 and 158.

Further, the orientation of banknote 1 or antenna 7, as the case may be, is determined. The orientation of banknote 1 is usually known, since banknote processing machine 100 transports banknotes 1 either along their long side or along their short side. If the type of banknotes to be processed is known, e.g. a certain currency, then the position and orientation of the banknote's antenna 7 is also known. If same is not known, a conductivity sensor of sensor unit 145 can be additionally used, for example, to determine the position and orientation of antenna 7 in order to control the described electrical connection of segments 150 to 156 of data exchange device 142.

Once it has been or, as described, once it is ascertained that antenna 7 is at the height of e.g. segment 153 and transported along direction T, as depicted in FIG. 59*c*, and parallel to segments 150 to 156, segments 150 to 152 will be electroconductively connected to one another 157*c*. Segments 154 to 156 are likewise electroconductively connected to one another 158*c*. Electrical connections 157*c* and 158*c* are—as described above—connected to operating unit 160 in order to enable an evaluation of electrical circuit 3. Further monitoring or changing of electrical connections 157*c* and 158*c* can be omitted in this case, since the position of circuit 3 or antenna 7, as the case may be, does not change relative to the segments of data exchange device 142.

EXAMPLE 146

FIG. 60 shows a still further embodiment of a data exchange device for a banknote processing machine 100 according to the invention for the processing of banknotes 1 having an electrical circuit 3. The data exchange device is formed from singler 111 of banknote processing machine 100, for example from the singling roller. The data exchange device consists of two electroconductive roller bodies 142*a* and 142*b*, which form the singling roller and are connected to an electrical insulation 142*c*. The two roller bodies 142*a* and 142*b* are connected to operating unit 160 for the data exchange. The data exchange between electrical circuit 3 of banknote 1 and data exchange device 142*a,b* occurs upon the separation of banknote 1 from input unit 110 via singler 111 (FIG. 57). When banknote 1 is detected by singler 11, a branch of antenna 7 lies in the area of the one roller body 142*a*, the other branch of antenna 7 lies in the area of the other roller body 142*b*, so that operating unit 160 can exchange data with electrical circuit 3 of banknote 1 via data exchange device 142*a,b*.

EXAMPLE 147

FIG. 61 shows a still further embodiment of a data exchange device for a banknote processing machine 100 according to the invention for the processing of banknotes 1 having an electrical circuit 3. The data exchange device is formed from electroconductive surfaces 142*a,b*, which are disposed along the transport system 120 of banknote processing machine 100. Electroconductive surfaces 142*a,b* of the data exchange device are electrically insulated from one another and have an oblique gradient in transport direction T1, T2. It is thereby ensured that data exchange will occur between electrical circuit 3, 3' of banknote 1 and data exchange device 142*a,b* when banknote 1 is transported past data exchange device 160 by transport system 120, independently of the orientation of antenna 7, 7' of banknote 1 and independently of the direction of transport T1, T2. Thus, operating unit 160 can exchange data with electrical circuit 3, 3' of banknote 1 via data exchange device 142*a,b*.

EXAMPLE 148

In a further variant, data exchange device 142 of banknote processing machine 100 comprises a device which generates a rotating and/or migrating electrical and/or magnetic field. An antenna structure, for example, which functions according to the so-called "phased array" principle, can be used for this purpose. This data exchange device 142 allows data exchange between the banknote's electrical circuit 3, independently of the orientation, position or shape of antenna 7 of banknote 1 and independently of any possible position or transport direction of banknote 1 in transport system 120 of banknote processing machine 100.

EXAMPLE 149

The arrangements and structures described for data exchange device 142 can also be utilized for banknote 1. For example, antenna 7 can be disposed obliquely on and/or in banknote 1 in order to enable data exchange with data exchange device 142 independently of the orientation and transport of banknote 1. In addition, other deviating antenna structures can be provided, e.g. a cross-shaped dipole antenna or a closed (e.g. annular, circular, polygonal, particularly rectangular) or a ridged antenna structure.

The data exchange device 142 described above can also be disposed in the area of singler 111 and/or input unit 110 instead of in the area of transport system 120 or also additionally thereto and e.g. be a component of a second sensor unit 140 (FIG. 57).

EXAMPLE 150

FIG. 62 depicts an input unit 110, into which banknotes 1 are inserted. At location 111, banknotes 1 are detected by singler 111, separated and transferred to transport system 120 in the direction T. Data exchange device 142 for data exchange with electrical circuit 3 of banknote 1 is situated in the area of input unit 110. Data exchange device 142 has a structure and a functionality as described above.

Data exchange can occur in the inactive state with the next banknote 1 to be separated, i.e. with the uppermost or the lowermost banknote, depending upon whether singler 111 separates from above or below.

It is, however, also possible to conduct the data exchange during the separation of the particular banknote 1 to be separated and to e.g. make use of the movement of banknote 1 during separation when same is moved passed data exchange device 142. As described above, the singler, preferentially singling roller 111 itself can also comprise data exchange device 142.

However, an exchange of data can also be effected with several or all banknotes in input unit 110. In that context, the procedures described below must be applied to avoid collisions or crosstalk, as the case may be.

The problem of mixed-up talk/crosstalk can also be solved by always having only one banknote selectively communicate with data exchange device 142. In order to achieve this, provision can be made to always enable only one banknote for data exchange with data exchange device 142. This can be particularly advantageously achieved if the next banknote 1 to be separated is enabled for data exchange with data exchange device 142. To enable, it is particularly expedient to utilize a transfer method deviating from that for the data exchange with data exchange device 142. For example, provision can be made to effect enabling by optical means, e.g. by irradiating with light.

For this purpose, a photocell is provided on transponder chip 3 which, when sufficiently lit with enough brightness, electrically enables the function of the transponder. Should a light source be located in singling unit 110, which illuminates the next banknote to be separated in the area of chip 3, same enables the units necessary for communication, whereby data exchange is enabled. This luminosity of the light source is to be measured in such a way that the light passing through the separated banknote and striking the next banknote is so weak that it can only just not yet be enabled for the next banknote. It is expedient to also provide measures in chips 3, e.g. in the form of threshold values, which optimize the photosensitivity of the photocells to this situation. Care must be taken that the banknotes are disposed in such a way in the singler for this communication that the photoelectric cells of chips 2 are disposed in the direction of the light source.

EXAMPLE 151

Optical activation of the next banknote 1 to be separated is effected by illuminating a portion of or the entire surface of banknote 1 with light, since, at this time (prior to separation), banknote 1 is openly available in input unit 110 due to the fact that it constitutes—as described above, depending upon separation from above or below—the uppermost or the lowermost banknote of the banks notes in input unit 110. As depicted in FIG. 62, a light source 141 can be provided for this purpose, which fully or partially illuminates the surface of the next banknote 1 to be separated. The light strikes an optoelectric component, a photo transistor, for example, which can be a component of electrical circuit 3 of banknote 1, and enables electrical circuit 3 for data exchange with data exchange device 142.

Illumination with light can also occur at selective points if the precise location of the optoelectric component in input unit 110 is known so precisely.

The use of one or more photodiodes in the banknotes represents a further possibility, as described at the outset. In that context, the light of light source 141 is guided to the optoelectric component, for which purpose an end of the photodiode or photodiodes is coupled to said optoelectric component. The other end or ends of the photodiode, for example, can terminate at one or more edges of the banknote. The light from a light source can then be selectively coupled to one of the edges of one or more of the banknotes in order to effect the enabling. The light can be coupled particularly advantageously when the front edge, viewed in transport direction T, of the banknote 1 just being grasped by singler 111 is illuminated in an area outside of input unit 110, since only the edge of this banknote 1 that has just been separated—and thus the photodiode—can be selectively illuminated in this area, with which only electrical circuit 3 of said banknote 1 is activated for the data exchange.

If, the banknotes are to be separated anyway in banknote processing machine 100, however, the solution preferred is the one where no photodiode is needed, since selective communication is then possible with exactly the lowermost or uppermost banknote, as the case may be. In order to ensure in this case that the next, e.g. viewed from singler 111, the second banknote, is not activated in this case, a threshold is to be provided, as previously mentioned, which ensures that the light which has already passed through one banknote is insufficient for activation of the next banknote.

EXAMPLE 152

As further illustrated further in FIG. 62, the second sensor unit 140 can contain further sensors 143. For example, sensor 143 can be an optical sensor that captures the surface of the particular separated banknote 1 and the signals of which are evaluated by operating unit 160. Conclusions as to the condition of banknote 1 can, for example, be drawn from the optical appearance of the surface of banknote 1, e.g. relating to soiling or damages. Further evaluations also allow conclusions e.g. as to the authenticity and/or the currency or, as the case may be, the denomination of banknote 1. Additional sensors can also be provided in the second sensor unit 140 in the area of singler 111 and/or input unit 110 for checking authenticity or other properties of banknote 1.

EXAMPLE 153

The early recognition of banknote 1 or certain features of banknote 1 prior to and/or during separation allows operating unit 160 to make pre-settings for further components of banknote processing machine 100, which can facilitate, accelerate or improve further processing. For example, operating unit 160 can pre-set sensor unit 145 for the check of a certain currency and/or denomination, as a result of which a faster or more precise check is enabled.

The structure or function, as the case may be, of data exchange device 142, light source 141, as well as additional sensors external sensor device 145, described above in connection with the second sensor unit 140, which is disposed in the area of singler 111 and/or input unit 110, is also applicable to the banknotes that have bee deposited and/or are to be deposited in output units 130 to 137.

EXAMPLE 154

The data exchange between the banknote and the checking device can signify reading on the one hand and writing on the other hand. As is known, can be read out in an especially short period of time when EEPROM memories are used. In contrast, however, writing data takes a relatively long time. Depending on whether only reading or also writing is now to be effected, one must check whether same is also readily possible without hindering the checking sequence. In this context, one must take into account that, when a high-performance sorting machine with a processing speed of e.g. 40 banknotes/second is used, the idle time for each banknote exposed next in each case lasts a maximum of 1/40 second. All planned measures are to be coordinated according to the aforementioned, i.e., locations in the sorting machine are to be selected for the individual writing operations, which take these facts into account.

The banknotes stay the longest in spiral slot stackers 130, 132, 143, 136 (FIG. 57). For writing operations, therefore, it appears especially expedient to provide the "writing devices" in the individual slots of the spiral slot stackers.

This enables data exchange with electrical circuit 3 of the banknote to be deposited while same is situated in a spiral slot of rotating units 130, 132, 134, 136. Since usually only one banknote is found at a time in a spiral slot, provision can also be made to optically enable said banknote, or, as the case may be, its electrical circuit, as described above. Further, as likewise described above, further sensors can be provided in rotating units 130, 132, 134, 136. It is moreover possible to shield the individual spiral slots from one another, e.g. by the use of electroconductive surfaces that form a type of Faraday cage.

It is likewise possible to provide data exchange devices in stacker 131, 133, 135, 137. In this case, data exchange can be performed with several banknotes that have been deposited or, as the case may be, with the banknote last deposited in stacker 131, 133, 135, 137 in each case. Since the surface of the particularly last stored banknote in stacker 131, 133, 135, 137 is freely accessible, i.e. not covered by other banknotes, an above-described enabling of data exchange can be effected. Further, as likewise described above, further sensors can be provided in the area of stacker 131, 133, 135, 137.

To improve, e.g. accelerate, the processing of banknotes 1 having an electrical circuit 3 in banknote processing machine 100, provision can be made to distribute the data exchange between banknote 1 and banknote processing machine 100. For this purpose, a separation of reading and writing operations can be effected, for example.

EXAMPLE 155

In this context, for example, data is read from the electrical circuit 110 of banknote 1 by means of the second sensor unit 140 in the area of singler 111 or, as the case may be, input unit 110. Data can then be written to electrical circuit 3 of banknote 1 in the sensor unit 140 mounted in transport system 120 and/or in the data exchange devices of output units 130 to 137. Likewise, a further separation of the reading operation and/or the writing operation is actually possible. For example, only a certain part of the information from electrical circuit 3 of banknote 1, can be read out in second sensor unit 140, e.g. the serial number, while the rest of the data, which is required for processing in banknote processing machine 100, is read out in sensor unit 145. In the same way, arbitrary distributions can be made between reading and writing operations as well as between the data exchange devices mounted at the different locations that have been described.

In other words, the processing device for the receipt of energy and/or data from the sheet material circuit will have a receiving device, which is located in the same or another processing part of the processing device as the transfer device for the transfer of energy and/or data from the processing device to the sheet material circuit, with "processing parts" or also "processing station" preferentially being understood to mean modular components of the device having different processing functions, such as input, singler, transport path, sensor path, stacker and/or deposit means.

Intelligent Light Barriers

In order to be able to better monitor the individual steps of processing of the banknotes in banknote processing machine 100, light barriers 161 to 165 are provided, which capture the transport of the banknotes through banknote processing machine 100 and forward same to operating unit 160 for processing. Further light barriers can be provided at additional locations along transport system 120 if necessary, in particular, sensor units 140 and 145 can also be regarded as light barriers and their signals evaluated accordingly. It is thus possible to determine the particular location of a banknote after separation in the transport system, when the signals of light barriers 161 to 165 are evaluated by operating unit 160.

EXAMPLE 156

A further improvement of monitoring can be achieved if data exchange devices are provided at the positions at which light barriers 161 to 165 are mounted instead of or in addition to the light barriers. Such light barriers 161 to 165 will be referred to as intelligent light barriers 161 to 165 in the following. It thereby becomes possible to read out the unique data of the banknote to be processed, e.g. the serial number, from the electrical circuit of each banknote at the start of processing in banknote processing machine 100. Same can be effected in sensor devices 140 or 145, for example. Along the further course along transport system 120, the unique data is again read out by sensor device 145 and intelligent light barriers 161 to 165 and forwarded to operating unit 160, which logs same for monitoring purposes. Such an intelligent light barrier can in particular also be used to recognize whether there are several banknotes that are overlapping one in the transporter.

Thereby, precise monitoring of the processing of the banknotes in banknote processing machine 100 is possible at every point in time. Particularly in the case of malfunctions, such as jamming of the banknotes, for example, better assignment of the individual banknotes is thus possible. This is especially important when banknotes stemming from different depositors are processed at the same time. In this case, when banknotes from different deposits are mixed, it is possible to assign each banknote to the deposit from which it originated, since the corresponding unique data (serial number) are detected during separation and stored in operating unit 160.

If a malfunction and along with it intermixing of the banknotes occurs, the serial numbers of the individual banknotes serve to restore the original assignment.

Likewise, during preparation of a deposit for processing by the banknote processing machine, the owner or, as the case may be, legal owners (e.g. name and/or account number), can be recorded in the electrical circuits of the banknotes, either by the depositor itself or at the site of the banknote processing machine, or, as the case may be, during transport to said site. Should malfunctions occur in the course of processing, such as jams or a mix-up of the order of the banknotes (so-called crossovers), the assignment of a banknote to a depositor can be restored automatically.

This can be effected by having an operator who reads the serial numbers of the banknotes and compare them to the log, which contains data on the affiliation of the intermixed banknotes to the particular deposits as displayed on operating unit 166. It is, however, also possible to re-feed the intermixed banknotes into input unit 110. They will then be automatically allocated to the particular deposit in accordance with the log of operating unit 160. However, it is also possible to write the information into a "write-only" type memory area in order to maintain the anonymity of the depositor. In cases of uncertainty, the information then be checked for validity and put out only within the chip.

Destruction of Banknotes with Electrical Circuits

Special security is necessary when monitoring the destruction of banknotes by means of shredder 138, as removal of banknotes from transport system 120 by manipulation prior to their destruction must be prevented. For this reason, disposal or, as the case may be, shredding has usually only been performed by central banks to date. By contrast, the procedure according to the invention also allows this to be accomplished by cash centers or other cash handling service undertakings.

EXAMPLE 157

In order to prevent this, provision is made according to a further example to dispose intelligent light barrier 165 in direct proximity to or as part of shredder 138. It thereby becomes possible to recognize that banknotes are removed prior to destruction by shredder 138, since, otherwise, the signal of intelligent light barrier 165 does not report the expected banknote to operating unit 160. If intelligent light barriers 161 to 165 as well as sensor units 140 and 145 capture the serial numbers of the banknotes, as described above, operating unit 160 can generate and save and preferentially transfer to a central database a list of all of the banknotes to be destroyed. If banknotes later surface in the circulation of money later on, the serial numbers of which are on said list, this is then a case of forged banknotes with serial numbers identical to the destroyed banknotes.

It is also possible to delete from the list the serial numbers captured by intelligent light barrier 165 and forwarded to the operating unit, since their destruction is ensured. The latter list can be stored in addition to or in place of the first-cited list for subsequent monitoring.

In order to also make the electrical circuits unfit for later abuse following destruction of banknote 139, shredder 138 can, for example, be formed such that the electrical circuits are also reliably destroyed. For this purpose, provision can also be made to subject the remains 139 of the banknotes to further treatment, e.g. have them burned, in order to ensure destruction of the electrical circuits.

It is likewise possible to configure intelligent light barrier 165 such that it destroys the electrical circuit or marks it as no longer valid by means of an irreversible writing operation. This can be achieved, for example, by a so-called fuse which is irreversibly burned through by means of a suitable current flow in order to rule out further use.

Further, it is therefore also possible to perform a comparison with the cited list or lists, which contain the serial numbers of all of the destroyed banknotes. If one of these serial numbers surfaces at a later point in time, this is a case of manipulation. In order to enable this comparison and the above-cited monitoring of banknotes removed prior to destruction, a central database, which contains all the serial numbers of all the banknotes deemed to be destroyed. This, for example, can be done via a network connection, e.g. the Internet. Serial numbers in the database can be checked as necessary via the network connection. Alternatively, it is also possible to delete the banknotes from databases on all valid banknotes.

Should banknotes surface during processing in banknote processing machine 100, the electrical circuit of which cannot communicate with the data exchange device, e.g. because the banknote's electrical circuit or antenna is defective, these banknotes can be transported, guided by control device 160, from transport system 120 to shredder 138 for destruction, since they are no longer usable due to the damage. In order to prevent abuse, however, by having other features of these banknotes checked by evaluating the signals of sensor unit 145 by operating unit 160, it is ensured that the banknotes are not counterfeit banknotes or banknotes where the above-cited irreversible writing operation for marking of the destruction has been performed.

However, provision can also be made for banknotes having electrical circuits that cannot be evaluated to be sent to a special deposit means, e.g. stacker 131, wherein all suspicious banknotes or non-processable banknotes are deposited for a manual examination. The analysis thereby enabled can, for example, allow conclusions to be drawn in the case of frequent occurrence of defective or absent electrical circuits.

Utilization of Data of the Electrical Circuit

A variety of further data can also be read and written apart from the reading and/or writing operations described to this point in the context of the data exchange between the banknote's electrical circuit and the data exchange device of the banknote processing machine. For example, data can be exchanged in order to determine the presence of a banknote. Further, the currency and/or the denomination of the banknote, i.e. the denomination can be contained in the data.

EXAMPLE 158

The data described can additionally be utilized for the counting, sorting and accounting of the processed banknotes. By means of the evaluation of the data contained in the electrical circuit of the banknote alone or in addition to the information obtained by operating unit 160 from the signals of sensor unit 145 and/or 140, processing security is increased and can be additionally safeguarded by means of the thorough monitoring by means of intelligent light barriers 161 to 165 as described above. Missing or non-assignable, i.e. recognizable, banknotes thus barely occur anymore.

EXAMPLE 159

Further, the data of the electrical circuit can be used for processing for in order to determine the state of the banknotes. For this purpose, test data can also be written into the electrical circuit. For example, data about the production date of the particular banknote, the date the banknote entered circulation or the date of its last determination of condition can be written into the electrical circuit. Further data such as information about production-relevant parameters, e.g. color deviations, etc., previous checking procedures of the banknote, i.e. signals of the sensors of sensor unit 145 or their evaluation by operating unit 160, are written into and stored in one or more dedicated memory areas of the electrical circuit.

EXAMPLE 160

The stored data can be utilized for a later examination and e.g. determination of condition. For example, conclusions regarding the note's likely condition can be drawn from the date of manufacture and/or the date of entry into circulation and/or the date of the last determination of condition or check, since statistical connections between circulation time and banknote condition have been well researched and known. Of course, the result of the last condition check can also be stored and used for these conclusions. In this case, elaborate optical sensors for examining the state of the banknote could be done without in this case, since the condition can merely be estimated on the basis of the stored data. Alternatively, every more elaborate check can also be applied merely to the subset of the dubious, expired or specially-marked banknotes.

EXAMPLE 161

As mentioned previously, the statistical connections between circulation time and banknote state of the banknote are actually relatively well-known. However, particularly on the part of manufacturers of banknotes, there is a need to gain more exact and reliable statements on the actual causes of banknote wear in order to effect improvements in production that improve the durability of banknotes. For this purpose, provision can be made for one or more sensors to be integrated in the banknote paper to measure environmental influences.

These sensors can serve to measure chemical, physical or mechanical variables. Sensors, which measure humidity, temperature, salt content, pH value, bacterial infestation or fungal infestation, damages or tears, can be used, for example.

Said sensors can be preferentially integrated either into the chip itself or realized separately at another place of the banknote paper by means of thin layer technology. In a simple embodiment, it can be e.g. an FET transistor mounted in such a manner that its gate electrode enters into a reaction with the material to be detected on account of a special pre-treatment or coating.

In this context, the sensors will be connected to a chip of the banknote. Here, the chip will have a writable memory, such as an EEPROM, in order to store the measured values recorded by the sensors. The values, preferentially saved at regular intervals, e.g. daily, can be read out and evaluated at a later point in time by organizations authorized to do so, such as the central banks, when the particular banknote, which is in circulation again, is received by them.

It is not mandatory for all of the banknotes entering circulation to be equipped with the integrated sensors. It can already suffice to furnish only a portion of the banknotes with sensors in order to obtain sufficient measurement data for a reliable evaluation.

EXAMPLE 162

From the data stored in the electrical circuit of the banknote, such as information about production-relevant parameters, data from previous checking procedures or the sensor data, adjustments to the measurement parameters can be performed, in dependence on the stored data, by operating unit 160. In this way, the afore-mentioned color deviations, for example, can be taken into account when checking the signals of optical sensors, as a result of which the measurement result and thus processing of the banknotes by banknote processing machine 100 is improved.

EXAMPLE 163

The presence and/or the position and/or the authenticity of specific e.g. optical and/or magnetic locally present security features of banknote 1 can also be stored in chip 3 of banknote 1 during manufacture of banknote 1.

By reading out the chip data when such banknotes 1 are checked, one can achieve that checking will be performed more accurately at that particular place only, i.e. e.g. at a higher resolution. By way of example, for this purpose, for example, data on the location of the features on banknote 1 can be transferred by operating unit 160 according to FIG. 57 of sensor unit 145 in order to check such features at the pre-determined location only. It thereby becomes possible, for example, to avoid an elaborate preliminary check to determine the presence and location of the features, as e.g. is necessary according to WO 01/60047 A2. It thereby becomes possible to design the detection methods in banknote processing machines for such locally variant features significantly more simply.

EXAMPLE 164

Further, the data stored in the electrical circuit allow later processing of banknotes, which could not be clearly assigned and which, as described above, can for example be in output stacker 131. This data can be evaluated and taken into account during a later manual appraisal by an operator, as a result of which the appraisal is normally simplified, since the operator immediately recognizes which feature of the banknote appears suspicious.

Deposit Processing

Further advantages of storing processing-relevant data result when processing deposits, which each consist of several banknotes and stem from different depositors, so-called deposits. The banknotes of these deposits are usually separated from one another by separator cards, with the separator cards, for example, being able to contain data about the depositor. The data can e.g. be stored in electrical circuits of the separator cards, which are configured like the electrical circuits for banknotes like those described until now. Such separator cards can potentially be dispensed with if the data of the electrical circuits of the banknotes of the different deposits are available for processing in processing machine 100.

EXAMPLE 165

For that purpose, provision can be made that the depositor writes data to the electrical circuit, by which the banknotes can be identified as being associated with the particular depositor. Such data can, for example, be an account number or a customer number. The data can, for example, be written to the electrical circuit when the depositor receives the banknotes and e.g. places them in a cash register. During processing in processing machine 100, the data identifying the depositor can thus be used at any point in time in order to determine the depositor of the particular banknote.

EXAMPLE 166

A further possibility consists in, for example, recording the serial number or another unique feature of the particular first and/or last banknote of a deposit and to assign this serial number or, as the case may be, these serial numbers to the particular depositor, for example, by means of operating unit 166. During processing in banknote processing machine 100, the serial number of each banknote is then read during or after singling by the data exchange device in sensor unit 140 or, as the case may be, singler 111 or sensor unit 145, and operating unit 160 assigns the banknotes to the particular depositor when the recorded serial numbers appear. Moreover, all banknotes of the particular depositor can be marked by banknote processing machine 100, by the data characterizing the depositor being written to the electrical circuit of the banknotes, so that same can be recognized as being associated with a certain depositor at any time during processing.

EXAMPLE 167

Moreover, provision can be made for banknotes 1, which cannot be recognized because e.g. their chip 3 is defective, to be automatically sorted out and handled separately. Thus, their serial numbers e.g. can be scanned separately and then stored separately for further processing.

Authenticity Check and Data Security

To improve and safeguard the checking of authenticity and/or the data stored in the electrical circuit of the banknotes to be processed or parts of this data, in particular authenticity features, value or, as the case may be, denomination, serial number, etc., the data can be stored in encrypted form in the electrical circuit of the banknote and/or with a digital signature or, as the case may be, the data exchange between the banknote and the banknote processing machine can take place in encrypted or digitally signed form.

Likewise, the data can be stored in a special area of a memory of the banknote's electrical circuit, which is access protected. This data can then only be read or, as the case may be, written when the data exchange device utilized is correspondingly authorized. In order to check this, provision can be made for mutual authentication between the banknote and the banknote processing machine or, as the case may be, between the electrical circuit and the data exchange device to be carried out. This can e.g. take place according to the so-called challenge response procedure, with or without integration of a certificate.

PKI (Public Key Infrastructure) methods are especially suited to encryption, since they in particular enable a simple realization of the banknote processing machine, since no specially-protected security electronics are necessary for storage of the keys for decrypting the data. Rather, PKI constitutes a so-called asymmetrical encrypting procedure, wherein the data is encrypted using a secret key, whereas a so-called public key, i.e. a generally-accessible key, is used for decrypting. In this case, the secret keys could be kept at the particular national central banks, the public keys in the banknote processing machines.

If data encrypted by the banknote processing machine are also to be written into the electrical circuit of the banknote, it needs the secret key or its own secret key in order to e.g. be able to encrypt special data for processing in the banknote processing machine or a processing step that is downstream.

It is likewise possible to provide the data or portions of the data with a digital signature. For this purpose, a secret key is used to generate and likewise store in the electrical circuit a digital signature about the data stored in the electric memory of the banknote or, as the case may be, about a hash value formed from the data. Checking the data is now possible by checking the digital signature with a public key.

Different sets of keys can be used for the described encrypting of the data or, as the case may be, the forming of digital signatures, e.g. as described in the above for different applications and/or users; likewise, different sets of keys from secret and public keys can also be used for different currencies, series, denominations, etc.

The described procedures for securing the data or portions of the data can be applied individually or, in order to increase security, in a desired combination.

To further improve the checking of authenticity of banknotes, provision can be made for the electrical circuit, which contains the above-described encrypted or decrypted data, to contain further data, in particular in encrypted form, derived from features, which are permanently connected with the banknote and individualize same. In the simplest case, this can be the banknote's serial number, which e.g. is stored in encrypted form and/or with a digital signature in the electrical circuit.

EXAMPLE 168

During checking in banknote processing machine 100, the serial number of the banknote is read from the banknote's electrical circuit e.g. by sensor unit 140 and/or sensor unit 145 by means of data exchange device 142 and decrypted in operating unit 160, e.g. by means of the above-described PKI method. At the same time, sensor unit 140 and/or sensor unit 145 detects the serial number printed on the banknote by means of an optical sensor, e.g. sensor 143. If the two serial numbers match, this indicates an authentic banknote; otherwise, a forgery must be assumed. For a more precise check, a banknote suspected of being forged is e.g. transported in the first output stacker 131 in order to—as described above—permit a manual check of the banknote. For this purpose, data stored in the electrical circuit or in operating unit 160 can be drawn upon, which e.g. provide information on the results of the check by sensor units 140 and/or 145.

Instead of using features of the banknote that are visible to the human eye, such as the serial number for improving the authenticity check, features which are not readily recognizable, can also be used. Such features can be, for example, special materials which e.g. are luminescent, exhibit special magnetic properties, etc. The presence of these materials can then be proved by means of excitation by e.g. ultraviolet light or infrared light or magnetic excitation and be detected by corresponding sensors, e.g. also biochip sensors, and evaluated by operating unit 160. Further, such materials can be used to carry out coding e.g. in the form of a bar code, with the information that is coded with the features—as described above with respect to the serial numbers—being stored in the electrical circuit for a comparison, so as to check authenticity. Instead of disposing the features on or in the banknote in an ordered form, e.g. the bar code mentioned, the features can also be disposed randomly or pseudo-randomly on or in the banknote. The particular distribution of the features is determined, e.g. by the use of corresponding sensors, in this case and stored thereafter in the electrical circuit of the associated banknote. The above-described procedures for the protection of data can be used for this purpose.

As described in the above, it is thus possible for chip 3 to contain the data specific to the particular banknote 1, which e.g. can also comprise data about the paper, or, as the case may be, the feature substances contained therein, of banknote 1. Alternatively or additionally, it is also conceivable to permanently apply, in particular to print, onto the banknote the information, which couples banknote-specific paper data with chip data, such as the associated serial numbers of chip 3, which may or also may not correspond to the serial number imprinted on the banknote. This can be effected e.g. by printing on a bar code or a passive oscillating circuit. As described in detail in the scope of this application, the information is preferentially encrypted and/or digitally signed in order to be able to prevent forgery of the imprint correlating paper data with chip data. Paper data also refer to data about the paper of the sheet material and/or the feature substances contained therein and chip data refer to data about the chip, such as its serial number, etc.

An advantage of this variant consists in that the manufacture of such banknotes can take place simply and quickly. The data individually marking the chip, e.g. its serial number, which are established by the chip manufacturer, are e.g. simply read out from the chip in the end phase of banknote production and then imprinted e.g. in the form of a bar code, coupled with paper data, such as the serial number, which is established by the banknote manufacturer. This procedure avoids elaborate writing onto the chip during banknote production in comparison to the reading operation.

Special features, as described above in connection with the checking for authenticity of the banknote, can also be used for further tasks.

EXAMPLE 169

For example, the features can exhibit a certain dependence on external influences, e.g. a fluorescence effect can become weaker over time. A feature of this type can be utilized to make statements about changes to the banknote in order to e.g. be able to sort out banknotes that are no longer fit for circulation.

Further features, as described, are stored in the electrical circuit of the banknote, can be used to check the intactness of the banknote.

For example, if a pattern or a random distribution of features over essentially the entire surface of the banknote is saved, a comparison with the features detected anew during processing in the banknote processing machine can be used to determine whether the banknote is intact. The data of these features thus serve as a so-called "snip protection", which allows checking for the completeness of banknotes, or, as the case may be, the detection of parts of banknotes parts that do not belong together.

EXAMPLE 170

Further, it is possible to improve the above-described data security and authenticity check by means of electrical circuits, which e.g. are founded on the basis of silicon technology or on the basis of organic semiconductors. In this context, in the detection of authenticity, a premise starting with the check for the presence of the electric circuit, and going all the way to more complex procedures taking into account serial numbers and/or statement of value (also referred to as denomination or denomination)—as described above—is being assumed.

In the case of sole checking of the electrical circuit, a banknote processing machine or, as the case may be, its sensor can be deceived if the electrical circuit of an authentic banknote is removed from same and e.g. applied to a neutral sheet of paper or a copy. Additionally, the banknote without an electrical circuit can still be used further; e.g. in a person-to-person exchange, since in this case, the absence of the electrical circuit would not be noticed. The described combination of serial number and electrical circuit already improves security. Electrical circuits with a memory that can only be written to once (a so-called WORM memory) are sufficient for this purpose. It is thus possible, for example, to store the serial number and the statement of value on a banknote in the way known in the art. Further, an additional value is determined from other features of a banknote. However, a random number e.g. would also be suitable as an additional value.

For example, a banknote with an electrical circuit can contain the serial number of the banknote, the denomination and a check digit in the electrical circuit. By means of a secret algorithm, e.g. that described above, the check digit is derived from the data in the electrical circuit (denomination and serial number) and additional information. The derived check digit is subsequently compared with the check digit of the electrical circuit.

Further features of the banknote can be used for safeguarding, e.g. the statement of value of the banknote decrypted from a secret feature. These further features can be feature stored on a security thread as an optical, mechanical, magnetic or other code, measurement values can also be used, which are determined in the detection of a secret feature substance. This secret feature substance can cover the surface of the banknote, but it can also be applied to, applied on or incorporated in certain locations in a localized fashion. Likewise, a feature derived from the thickness profile or the dieprint of a banknote can be used. The format of the banknote, the position of the printed image, etc., can also be used.

Further features can also be derived from random measurement values, which can be determined on the banknote (so-called unique features). Thus, the transmission of the light on a certain small surface unit of the banknote can be determined, just as positional deviations of printed characters or other components of the banknote, such as security thread, optically-variable element, etc.

When linking the denomination and the serial number with one or more of the described other features, a measurable property derived from the check of the feature or of the other features, e.g. an intensity of a measuring signal of the other features, can be advantageously referred to. It is thus e.g. possible to depict a banknote's statement of value by a certain number of points or strips or by the positions of the other feature. In this case, the detection of the other feature allows a conclusion to be drawn; e.g. as to denomination, in which case the distribution (e.g. quantity, density) of the other feature can also vary at individual locations within significant tolerance limits, which, however, are immaterial, since it essentially suffices to faultlessly prove the presence of the other feature at the relevant locations. In actual practice, the minimum intensity necessary for this purpose is nearly always exceeded considerably. Therefore, additional information can be gained from the values of the intensity of the feature at the required locations, which, in a suitable fashion, can be stored or used to derive the check digit.

It is also possible to save the result of the check of the other feature as such in the banknote's electrical circuit. This is then particularly advantageous when the measuring results of the test are derived from a secret feature or feature substance. Direct knowledge of the particular value would then be harmless, because the origin of this value is of course unknown, since it is derived from the secret feature or feature substance by measurement. Linking of the features then consists in storing them together in the electrical circuit.

What is essential is that the procedure according to the invention creates a connection between the features that are easily read (e.g. denomination and serial number) on the one hand and a certain individual piece of the documents, represented by certain properties specific to this piece. Linking of the stored features to a feature on the banknote determined in another way will cause a checking result to result that varies from one banknote to the other, even when several banknotes have the same denominations or serial numbers, which is actually not possible, but occurs frequently with forgeries.

If a counterfeiter e.g. were to produce forgeries with self-manufactured electrical circuits, these would have to at least contain the correct data as to denomination and serial number. Even if this were to succeed, though, an own check digit would still need to be determined and stored for each banknote. This impedes forgeries so much that they are scarcely to be expected any more. This would also still be the case if the significance of the check digit were known to forgers.

If one uses e.g. the data of the value coded on a security thread as the other feature, then the stored features would force the data of the thread to be read as well. In another embodiment, one could also include further properties of a document in the check. By optical, magnetic or capacitive scanning of the cross profile of a banknote, e.g. a property that is typical for each banknote can be derived, which stands for the individuality of the banknote like a fingerprint. This measured value can be stored in the electrical circuit and compared later at any time with the measured value of renewed capacitive scanning (unique feature). Similarly, a feature can be derived from the position of an OVD (optically-variable element) strip and saved.

In a special embodiment, the denomination of a banknote is not stored in the electrical circuit. Instead, the serial number and the other feature are linked by means of an algorithm, and the result of such linking is stored in the electrical circuit. If the algorithm is concealed, only a suitable sensor can infer the serial number and/or the denomination of the banknote from the stored data. This would even impede a forgery in the case where suitable electrical circuits are available for the forgeries and where they can be provided with data. PKI procedures, wherein the properties measured on the banknote are entered in the chip of the banknote encrypted with the aid of a "secret key" and/or signed digitally, are particularly advantageous. The device checking for authenticity decodes with the aid of the public key and/or checks the signature.

EXAMPLE 171

When a banknote is produced, the serial number is stored in plain text in a circuit situated therein. Further, the distance from the first printed character in the upper left corner to the left edge of the banknote is determined. This value A is rounded to two digits (e.g. 3.243 mm would result in the value of 32). The serial number is now calculated modulo A and the result (a number between 0 and 31) likewise written into the integrated circuit. Here, "A" can be any two-digit number.

EXAMPLE 172

A bit code, which represents the numbers between 1 and 8, is generated on a security thread by means of magnetic printing ink. This value A is read during a check and first linked with the denomination B=denomination modulo A A value "B" between 0 and 7 results. The serial number is now multiplied by this value and a further modulo operation follows, so that the following results:

C=(serial number*B) modulo X

A fixed value can be used for X, but a different value determined from the information contents of the banknote can also be used. Result C is written into and stored in the integrated circuit.

EXAMPLE 173

In a metallic layer, e.g. a metallized strip, fine interruptions are generated in the metallization, which are almost invisible to the naked eye. The spacing of these interruptions is determined and a digital number derived therefrom. The result is linked in a suitable fashion with e.g. serial number and/or denomination. The result of the linking is stored in the integrated circuit.

EXAMPLE 174

A suitable quantity of a fluorescent feature substance is added in the manufacture of a banknote paper. Following printing and insertion of the integrated circuit, the serial number and the denomination are stored in the electrical circuit. Further, the intensity of the fluorescence caused by the feature substance is determined by a suitable sensor and likewise stored in the electrical circuit.

EXAMPLE 175

On a share, the serial number as well as the security identification number of the share are imprinted. These data are also stored in an integrated circuit situated in the share. Further, a random number in the form of a digital code (perhaps a bar code) is mounted by means of a non-visible feature substance. This random number is linked to the serial number and the result of the linking is likewise stored in the IC. When checking the share, the serial number and the identification number are read from the IC and compared with the stored data. Further, the non-visible random number is read by a corresponding sensor and linked to the stored data. The result of this linking must then agree with the stored result. If one uses a three-digit random number xyz, then multiplication by an eight-digit serial number would deliver a result with 11 to 12 digits. This procedure is naturally also applicable to other papers of value such as banknotes.

EXAMPLE 176

In a banknote printing works, an identifier of the electrical circuit is read by a numbering machine, i.e. a printing technology device, which provides banknotes with serial numbers, and printed on the particular banknote directly, or in a form altered by means of an algorithm, as plain text and/or bar code and/or pixel code or as another two-dimensional code. Since this is only possible at a very low processing speed with the high-pressure numbering machines normally used, numbering is performed by means of ink jet methods or other digital printing methods or by means of laser.

EXAMPLE 177

In the banknote printing works, an identifier of the electrical circuit is read and an optical structure that can be generated variably (e.g. lattice, hologram) is and transferred to the particular banknote uniquely assigned and a laterally resolved structural or chemical change is preferentially applied or incorporated.

EXAMPLE 178

In the banknote printing works, an identifier of the electrical circuit is read and a magnetic structure that can be generated variably is transferred to the particular banknote uniquely assigned and preferentially an individual one-dimensional or two-dimensional perforation is incorporated, preferentially by means of laser.

EXAMPLE 179

An oscillating circuit is situated on the banknote, which is preferentially realized by printing technology. In this context, several capacity surfaces, i.e. electroconductive surfaces, which preferentially consist of transparent conductive material, are electroconductively connected with one another. If the surfaces (e.g. n pieces) are at a particular ratio of size of 2:1, then 2n states can be coded. Thus, e.g. a check digit can be realized. By means of a laser, the surfaces, or portions thereof, can be separated from the oscillating circuit so that the desired coding can be effected. The particular advantage in this context consists in that the check digit can be determined contactlessly for a check via the resonance frequency of the oscillating circuit.

Instead of the hitherto-described electrical circuits, optical memories, e.g. TESA-ROM©, are also suited as a security element for storing the above-described data and/or features.

The three last-named examples are preferentially utilized in the case where the chip/IC has no memory area that can be written to by the user (e.g. ROM, WORM types). The examples described are, however, also applicable to other types of memory without a chip/IC, such as magnetic or optical types of memory (e.g. TESA-ROM).

EXAMPLE 180

In order to preserve the anonymity of a banknote with an electrical circuit, and, at the same time, enable monitoring of banknotes for certain properties, in particular their previous owners or, as the case may be, bearers, provision can be made to provide the electrical circuit on the banknote with a write-only memory area, which cannot be read out directly. In this case, provision is made that a comparison is performed of the information stored in the banknote with other predetermined information in the banknote or, as the case may be, its electrical circuit. Here, the banknote or, as the case may be, its electrical circuit merely generates a signal, which indicates whether the compared informations correspond.

Thus, the informations, which are to be checked, must be known, as a result of which anonymity of the banknote is given completely. At the same time, however, each banknote can be marked (e.g. banknotes from extortions, disenabling during transport, etc.) without this being detectable by an unauthorized user of the banknote (blackmailer, robber of the transport, etc.). In the context of standard evaluations by banks, e.g. after robberies, a series of identifications that have been made known can be checked. In this connection, it is particularly advantageous to provide several different memory areas, which can be written into in each case, e.g. one stack, according to different authorizations.

Further, for example, a depositor of a deposit can suitably mark his banknotes beforehand. If discrepancies are detected by the institution processing the deposit, the owners can be ascertained after the markings used by them, e.g. code numbers, are made known.

EXAMPLE 181

The write-only memory area can be used particularly advantageously to store information in the banknote such as the above-described random number or the different code numbers for access to the different functions of the banknote chip. For security-critical applications, the use of the write-only memory area in combination with the described error counter and the disabling or, as the case may be, marking of the banknote upon exceeding of abortive attempts, e.g. of the input of a code number for access to the banknote, proves to be advantageous.

Small Banknote Processing Machines

By making use of the above-described electrical circuits and the forgery-proof features of the banknotes, which are jointly incorporated in the authenticity check of the banknotes, as well as use of the corresponding data exchange devices, even especially compact banknote processing machines can be realized, which are more efficient and more reliable than previous banknote processing machines of comparable size. Such banknote processing machines are depicted in FIGS. 63 and 64.

EXAMPLE 182

FIG. 63 shows a second embodiment of a banknote processing machine, particularly for counting and/or evaluating banknotes with an electric circuit. Banknotes 1, which are to be counted and/or checked for authenticity and/or the total value or, as the case may be, the denomination of which is to be determined, are inserted into an input unit 110. For that purpose, banknotes 1 are grasped by singler 111 and singled and transported 1*b* via a transport path 120 into a stacker 131. Further stackers, which also permit sorting, are possible, but not depicted. The respective banknote 1*a* to be singled next, the lowermost banknote in this case, is detected by sensor unit 140 and the signals of sensor unit 140 are evaluated by an operating unit 160. The evaluation takes place as described above in connection with FIGS. 57-61. In particular, a sensor unit can also be present in singler 111, instead of or in addition to sensor unit 140, as described in connection with FIG. 60. Given appropriate interpretation of the banknote processing machine, a separate transport system 120 can be dispensed with. In this case, the banknotes are transported directly from singler 111 into stacker 131. The banknotes can be processed alternatively along their long side or along their short side.

A special advantage of the banknote processing machine according to FIG. 63 consists in the integration of the sensor unit in the area of the singler or, as the case may be, of the input unit. As a result, a measurement path or even the entire transport system can be omitted, to the effect that a particularly simple and compact structure results.

The small banknote processing machine designed in this way can, thus, depending on its internal structure, belong to the class of the banknote processing machines for processing single notes or to the class of banknote processing machines with stack processing. By the use of banknotes according to the invention, however, more complex tasks can also be performed by banknote processing machines with stack processing, as the following example illustrates.

EXAMPLE 183

FIG. 64 shows a third embodiment of a banknote processing machine, particularly for the counting and/or evaluating of banknotes with an electrical circuit. Here, a stack of banknotes 1 which are to be counted and/or checked for authenticity and/or the total value or, as the case may be, denomination of which is to be determined, are paged through in the direction T. A sensor unit 140 detects the banknotes la or, as the case may be, exchanges data with the electrical circuit, with the sensor signals being evaluated by an operating unit 160—as described above in connection with FIGS. 57-61. The evaluated banknotes 1*b* are held until all banknotes 1 are processed.

In this context, the checking of the banknotes for authenticity can take place after the authenticity features of the banknote have been detected and the corresponding data of the electrical circuit read out, by comparing the detected authenticity features with the data read out. Since the electrical circuit cannot be removed from the banknote and the authenticity features are forgery-proof, when the detected authenticity features and the read-out data match, this reliably yields the authenticity of the checked banknote.

EXAMPLE 184

FIG. 65 shows a further example of a so-called spindle counting machine 402, the essential points of which correspond to the construction according to FIG. 64. A stack of banknotes 1 is inserted into the spindle counting machine 420 and clamped and held there by holding device(s) 421. The stack is then situated at position la depicted by dashes. A mechanism 422 now singles banknotes 1 at the other side and counts them. Here, the counted banknotes 1 are grasped by rods 424 disposed on spindle 423, singled and crimped. After successful counting, the stack of banknotes, which is still clamped, is situated at position lb. Upon request, machine 420 releases the stack so that it can be removed.

If suitable information transfer devices are present inside and outside of the banknote, the principle described here of the small banknote processing machine with stack processing can be utilized very advantageously in order to be able to address the banknotes individually in the phase of deformation. The banknotes can be enabled very simply here by optical means, or can be addressed only during the page-through time period via electromagnetic waves by suitable communication devices.

EXAMPLE 185

The above-described energy gain from the deformation of the banknote, e.g. by elements with a piezoelectric effect, is now particularly advantageous here, since the banknote receives the energy at exactly that point in time when it can and should be addressed individually. Thus, anti-collision procedures can be avoided or, as the case may be, designed distinctly more efficiently. In addition, through this processing method, the number of banknotes not provided with a functional circuit or only provided with a non-operational one is determined without any additional effort.

The described spindle counting machine thus allows simple processing by a banknote processing system without transport, during which the banknotes can nevertheless be addressed individually.

EXAMPLE 186

If stack processing of banknotes driven by deformation energy is to be carried out at a banknote processing machine, a further alternative to the above example is offered, according to which the entire stack of banknotes 1 is clamped on both sides, similarly as in a vice, and the ends are moved relative to one another in periodic oscillations. Reading-out of the information from the banknote then takes place preferentially by means of light or electromagnetic waves.

EXAMPLE 187

This form of energy feed by deformation energy can also be utilized expediently for single-note processing of banknotes by machine. Banknote 1 can e.g. be detected at a place in the banknote processing machine where the banknote is deformed by the shape of the transport path. Such places can preferentially be situated everywhere where banknote 1 performs a change of direction or, alternatively, banknote 1 can be supplied with energy by the protrusion of the rollers driven with the transport speed of banknote 1 into the transport path of the note, which crimp same. A combination with a limpness sensor e.g. is especially advantageous, as e.g. described in the applicant's DE 195 436 74 A1, where the sheet is crimped and stimulated to oscillate by the banknote to be checked being contacted periodically by a rotary roller with several edges or, as the case may be, brushes, piezo elements or lever systems.

Such a limpness sensor or any other sensor, such as also a hole sensor, where the banknote to be checked is deformed for measurement(s) of paper properties, can hereby also be simultaneously used in a targeted way for the chip's energy supply and/or for reading out chip data, since the banknotes are deformed anyways for measurement of the paper properties and since a voltage in the banknote is thereby induced, which can supply the chip with energy.

EXAMPLE 188

Different kinds of banknote processing machines with stack processing are also conceivable, which perform jobs, which hitherto could not be performed this easily.

Such solutions consist in e.g. marking of all banknotes contained in a stack or a container for transport, collective switching-on or, as the case may be, switching-off of banknotes, group-wise recording of serial numbers in chips during banknote production and/or the evaluation of the special banknote data written in during production and quality control for static purposes.

For banknotes of variable denomination, a stack of worthless—i.e., with a value of "0" written on them—"blank" banknotes can even have the banknote values required for a delivery written on them. Some of the above-described security features, e.g. the random number that is written in, even allow reliable determination of the authenticity of the banknote in banknote processing machines with stack processing.

EXAMPLE 189

Banknote processing machines, which communicate with stacks of banknotes in their singler and/or in the stackers, reckon among the class of banknote processing machines with combined individual and stack processing.

Another form of the banknote processing machines with combined individual and stack processing preferentially provides own transport paths for both kinds of processing. Here, e.g. following input and, if necessary, a first stack processing, the banknotes are singled in the singler of the banknote processing machine and the individual banknotes are transported, e.g. by means of belt drives or roller drives.

In addition, however, there exists in the banknote processing machine a further form of transport, wherein entire groups of banknotes are transported together, loosely or preferentially in transport containers, within the machine. The transport containers can e.g. be filled up at stations, which correspond to the stackers of conventional banknote processing machines with individual processing; that is, e.g. spira-pocket stackers. The transport containers can either have their own drive or, however, also be driven by the banknote processing machine.

A particular advantage then results when the transport containers contain a memory, which contains processing steps to be conducted and/or that have been conducted on the banknotes and/or data about these banknotes contained therein. In particular, the variants described in the section entitled "Containers for banknote transport" may also be expedient for the transport container of such a banknote processing machine.

A version of the transport container in a form, which offers possibilities so that the banknote processing machine can deposit banknotes therein as well as be able to again single the banknotes out of the same containers again, is particularly advantageous is. However, the bands of banknote packets can also be explicitly regarded as transport containers. In order to achieve a uniform throughput, the stack transport can be distinctly slower than the single transport, whereby it is less susceptible to malfunction.

EXAMPLE 190

In addition, banknote processing machines with combined individual and stack processing can be realized in a more modular fashion, compared to those with purely individual processing. Namely, the individual modules can transfer the transport containers to one another, due to the optionally low transport speed and higher mechanical stability of a transport container with greater mechanical tolerances, than would be possible with individual banknotes. For example, an input station, an output station, a sensor station, a sorting station, a manual reworking station, a destruction station, a banding station, a packing station, etc. are possible as such modules.

EXAMPLE 191

Banknote processing machines with combined individual and stack processing permit tasks to be performed, which can not be performed by banknote processing machines with only stack processing. Such tasks consist e.g. in the sorting or packing of banknotes, the detecting and evaluating banknotes by sensors and the reliable recognition and destruction of banknotes without an electrical circuit according to the invention.

EXAMPLE 192

On the other hand, tasks can also be solved with banknote processing machines with combined individual and stack processing which cannot be solved or can only be solved given very large effort by those with individual transport.

This includes e.g. the provision of transport containers in a waiting position, in order to thus be able to temporarily store larger quantities of banknotes if jams or errors in certain parts of the machine limit the function of these machine parts.

This thus allows processing to continue in the banknote processing machine while jams are being remedied, which can significantly increase machine throughput. Several input stations for banknotes on one machine are also conceivable. If the waiting positions for the transport containers have sufficiently large capacity, it is even possible to have a greater number of operators inputting banknotes at the input stations than the machine's nominal processing rate would allow. The transport containers situated in the waiting position can then be processed automatically at times of lower machine utilization, e.g. at night.

In the same manner, the manual rework banknotes at the banknote processing machine can be automatically singled yet another time and reprocessed, whereby the rate of manual banknotes can be distinctly reduced.

EXAMPLE 193

In current banknote processing machines with individual processing, stackers are used, where the operator of the banknote processing machine removes the processed banknotes, and where a fixed assignment exists between the stacker and the sorting class. These stackers frequently still need to be run in pairs, in order not to have to halt the machine in those periods during which a stacker can not be charged with banknotes, e.g. during the removal of processed banknotes. The resulting potentially large number of stackers and their spatial extent can lead to a banknote processing machine becoming so long that its operator can only remove processed packets if he stands up and leaves his workstation for the input of banknotes.

In order to prevent this complication for the operator, which, in the long-term, also becomes noticeable in reduced machine throughput, a banknote processing machine with combined individual and stack processing can exhibit one or more output stations, which are situated in direct proximity to the operator, and in which the containers, which have been made ready for removal, are pushed out of the machine. Thus, several filling stations, wherein the containers are filled and subsequently transported to the associated output station, are assigned to at least one of the output stations from which the containers are output to the operator. Admittedly, the machine is not necessarily smaller spatially, but it can be designed distinctly more ergonomically.

Great advantages can also result in the destruction of banknotes if the banknotes to be destroyed can be moved directly out of the transport containers into the shredder, whereby neither jams in the transport system with effects on the shredder, nor disturbances from banknotes erroneously being moved into the shredder are possible.

The aforementioned variants, e.g. for stack transport in separate containers within the banknote processing machine, are also expediently applicable to banknotes without an electrical circuit. The use of banknotes according to the invention, however, enables distinct facilitation in realization.

EXAMPLE 194

For example, the sensor data and/or sorting classes determined by the sensor station, which can then be utilized by the sorting station, can be written into the banknotes. Such a procedure ensures that the container situated in the waiting position can be further processed without a loss of information after leaving the sensor path, even after major machine malfunctions. Even a continuation of the processing at another machine is possible.

EXAMPLE 195

Particular advantages result in deposit processing of banknotes by banknote processing machines with combined individual and stack processing.

An idea, which can also be employed with banknotes without an electrical circuit, consists in that individual processing stations, such as the singler, the sensor path, the stackers and the interjacent transport paths, which are preferentially realized as modular units, never contain more than one stack at the same time. This makes it possible to reliably avoid a mixing of different deposits. Thus, for example, if a jam occurs in a transport path, which must be remedied, there will thus be no need for a hard-to-effect assignment of the jammed banknotes to the different deposits, since banknotes of only a single deposit can be found in the transport path in each case.

Due to the expected increasing shifting of condition sorting tasks from the central banks to the commercial banks or cash centers, deposit processing in shredder mode will gain in importance. However, the banknotes to be destroyed, are certain to include a relatively large share of non-operable electrical circuits, since these are preferentially sorted out as no longer fit for circulation. By physical separation now being given by the spatial spacing of different deposits, the risk of so-called crossovers of such banknotes, i.e. a mixing up of the original banknote order, can be reliably avoided.

EXAMPLE 196

Preparation of the individual deposits for going through the machine will preferentially already take place in the singler. These can [also] be separated from each other by separating means, e.g. separator cards (U.S. Pat. No. 5,917,930), separate separating and information means (WO 02/29737), or separating means designed as container(s) (EP 1 1195 725 A2).

Advantageously, the separating means and/or information means are equipped with electrical circuits, which have the same communication interface as the banknotes according to the invention.

Advantages can be also, if the separating means can prevent the banknote processing machine from communicating with the banknotes. When coupled with electromagnetic fields, it is e.g. conceivable for the separating means to be electroconductive; e.g. a separator card made of metal, such as aluminum. With this, the banknote processing machine can communicate with all the banknotes of the current deposit to be processed, but not, however, with the banknotes of the next deposit separated by the separator card. Even if the banknotes are present in stacks and are separated from one another in the stack by separator cards, this makes it possible to achieve e.g. inductive coupling and processing of only a single deposit in the stack.

With such shielding, the retention of the separating means prior to separation can also be realized very effectively, e.g. in accordance with EP 1 253 560 A2. As soon as communication with the separating means of a deposit no longer achieves any responses, the singler is halted. After the machine has idled, separation can be restarted. This pause, during which no banknotes are separated, can be used to communicate with the banknotes and the separating means and/or information means of the next deposit.

Commercial Bank

As has been described in the above, the commercial banks constitute an essential component of the institutions of the circulation of money and are responsible for, among other things, dispensing cash, e.g. to trade and consumers or, as the case may be, for receiving cash, which is deposited by same. Within a broader sense, this is also understood to mean other service providers for cash handling, such as valuables transport entrepreneurs or so-called cash centers. In particular, money depositing machines, money disbursing machines and combined money depositing/money disbursing machines (moneychanger(s) or recycler(s)) and the above-described small counting and/or sorting devices are used to perform these transactions. It is to be noted that, within the meaning of the present invention, input "and/or" output machines or, as the case may be, payment machines are understood to mean payment machines, money depositing machines, as well as combined money depositing and payment machines.

Money Depositing Machines

Money depositing machines can, for example, be constructed such that they comprise an input device for the input of banknotes to be deposited and a transport device for transporting said input banknotes to a deposit device. The input device can be designed as a single note draw-in module for accepting only single notes or also as a stack input module for accepting stacks, i.e. several stacked banknotes. In this context, the storage device can exhibit a temporary storage, e.g. a foil storage, wherein the deposited banknotes are stored temporarily until such time as the depositor gives his final consent for actual withholding of the banknotes deposited in the current transaction. In particular, the deposit device will further comprise an end deposit means, such as a cassette described in greater detail in the above, wherein the deposited banknotes, optionally after temporary storage in the temporary storage are supplied to the end deposit means by means of the transport device and input. Here, the transport of the deposited banknotes can either take place singly and/or also in stacks.

EXAMPLE 197

FIG. 66 shows an example of such a money depositing machine 200, into which banknotes 1 can be deposited. Here, money depositing machine 200 comprises an input pocket 201 with an attached singler 202, a sensor device 203 for the checking of singled banknotes 1, a foil storage 204 as a temporary storage, a return pocket 205, into which the banknotes 1 not accepted by sensor device 203 or the banknotes 1 stored in foil storage 204 upon abortion of a current transaction are output again, an end cassette 206, wherein the banknotes 1 accepted by sensor device 203 and situated in foil storage 204 are ultimately stored following confirmation of a current transaction by the depositor, and a control unit 207, which controls the individual components of the money depositing machine 200 via signal lines depicted by dashes. Here, control unit 207, among other things, on the basis of measurement signals of sensor unit 203, determines data such as the total value and/or the amount per denomination of banknotes deposited in a transaction.

Money depositing machine 200 can be designed to accept both conventional banknotes without a chip as well as those with a chip. In order to check the authenticity and fitness for circulation of the deposited banknotes, sensor device 203 therefore comprises e.g. a magnetic sensor, a UV sensor and/or an infrared sensor for measuring the associated banknote paper properties, which, of course, is understood to mean not only the properties of the paper itself, but e.g. also the properties of the feature substances incorporated therein. In this context, a sensory system for checking chip properties can be mounted in the same area, e.g. in the same module housing as a sensory system for checking paper properties, although it is also of advantage additionally or alternatively if these two types of sensory systems are spaced spatially, e.g. accommodated in different module housings and/or particularly in different parts of processing, such as was explained by way of example in connection with a chip check in the singler.

Money depositing machine 200 can exhibit further components, as they e.g. were described in the above as a component of banknote counting and/or banknote sorting machines, for reading out from and/or writing to the chips of banknotes with a chip 1. Thus, for example, a reading unit, which e.g. checks the presence of and, optionally, the operability of banknote chip 3 and/or reads chip data such as the serial number, the denomination and/or data about authenticity and/or previous checking operations of the particular banknote 208, can be present in the area of singler 202 and/or in sensor device 203. An aforementioned intelligent light barrier e.g. can also be used. As was described above with reference to the banknote sorting and/or banknote counting devices, such data e.g. can be used to pre-adjust sensor modules that are downstream. Especially in the case of there being several reading units 208 mounted in the transport path of banknotes 1, the path of the banknotes 1 deposited in machine 200 can be clearly followed in a particularly simple and reliable way by reading the serial number or other individual data, as is not the case with known systems.

EXAMPLE 198

If it is ensured by the production process of the banknotes that the chip cannot be removed from the banknote paper without loss of its functional ability and, thus, that a fraudulent incorporation of the chip into authentic or forged banknote paper of a higher denomination can be prevented, it is e.g. also possible for the authenticity of the banknote chips and/or the denomination of the deposited banknotes to be able to be determined without further optical or other measurements just by reading out the associated chip data.

EXAMPLE 199

If the device is not designed for banknotes without a chip, but only for depositing banknotes with a chip, the device can also dispense with the presence of the associated sensor components for measuring magnetic, UV and/or infrared properties.

Such a testing system, where a signal coupling between the chip and the sensor unit and/or the receiving unit of an external evaluation device is only used for measurement or essentially only used for measurement, can, for example, then preferentially also be used when the depositor is known and/or determinable and the authenticity and/or the condition of the deposited banknotes is controlled only later e.g. in a competent state central bank.

EXAMPLE 200

In such a case, where the chip check itself indicates the presence of an authentic banknote, and where the banknote proves to be a forgery during a subsequent check, because e.g. the chip was incorporated into worthless paper, the depositor can then be retraced later via the serial number. For this purpose, data on the depositor can be stored in a memory of the banknote's chip and/or in a separate database.

This is a special example for a case, wherein a correlation of transaction data, such as data on the depositing person, the location and the time of deposit with the measurement data of the sensor device is expedient, by e.g. this data being assigned and saved together. In this connection, e.g. data about the depositor, the time of the deposit, about the authenticity, the condition, the denomination and/or the serial number of the individual banknotes, the total value of the deposited banknotes and/or the intended use of the deposited money, such as data about the account, to which it is to be credited, are summarized.

EXAMPLE 201

Given an anonymous deposit, however, the chip check does not suffice in those cases wherein such forgeries cannot be reliably excluded.

Moreover, in the money depositing machine, a write device 209, with which data can be written into chip 3 of banknotes 1, will preferentially be present downstream of sensor device 203.

Such data will be e.g. information, measured or, as the case may be, determined by sensor device 203, about test data and/or transaction data about the particular deposit transaction. Writing-in of such data will preferentially occur after temporary storage, when the banknotes are transported from temporary storage 204 to stacking cassette 206. As a result, an unnecessary write operation can be avoided, in case the banknotes are returned to the depositor into pocket 205 upon abortion of a current transaction.

EXAMPLE 202

Further, it is also possible for such data to be written into not all of, but only part of the basically functioning banknote chips. Thus, e.g. data can be written into only those banknote chips which potentially or very likely should or, as the case may be, need to be checked once more subsequently. In this context, these can be e.g. banknotes suspect of forgery, which do exhibit a functioning chip, but the data of which, though, indicates a forgery (see the "Recognition of duplicates" section) or the paper of which appears suspect of forgery. These banknotes suspect of forgery are preferentially stored in machine 200 and/or cassette 206 separately from the banknotes not suspect of forgery.

EXAMPLE 203

It can occur that, e.g. due to signs of aging, the chip of an otherwise authentic banknote is defective or not identifiable. These banknotes can, for example, be immediately output to the depositor and/or also stored separately in machine 200 or, as the case may be, retained in cassette 206 so that they can be checked later by means of other devices or procedures and possibly credited to the customer. Alternatively or additionally, it is also possible in the case of the banknote check not being limited to a chip check, that the check of e.g. authenticity and the determination of denomination is effected by means of the basically known check of the banknotes' paper properties. Thus, provision can also be made to read the serial number of the banknotes by means of an optical scanner as a camera system and to store these together with the other data about the retained banknotes in a memory of the automatic teller or, as the case may be, of the cassette.

EXAMPLE 204

In order, for example, in a transitional period after the introduction of banknotes with a chip, during which older banknotes without a chip are also to still be accepted as an authentic means of payment, provision can be made that, during an automatic check, e.g. by means of a scanner, the serial number on the banknote paper is always read or at least read in the case where a check is not recognized or not checked as authentic. This [serial number] is then preferentially compared with data, which give details about those banknotes, which were still put into circulation in a regular fashion without a chip. This check can either take place locally in the checking device itself or by means of a remote data transfer via a comparison with data in a central database. Moreover, provision can be made to achieve differentiation between authentic banknotes without a chip and authentic banknotes with a defective chip or, as the case may be, an antenna in that a two-dimensional image of the banknote, especially of those areas where the chip or, as the case may be, its antenna should be situated, is gained by means of a camera system. In this context, other common procedures, such as acoustic, electrical or other procedures, which permit detection of the presence of a chip, can also be used.

EXAMPLE 205

A further special embodiment is given when the banknote check is constructed multiple-staged, in particular two-staged. This means e.g. that different checking procedures are performed at different speeds and/or different checking procedures are performed at separate times. In particular, this can also mean that there is one checking and/or evaluation process before and another one after temporary storage in temporary storage 209. Thus, it is thus particularly preferential for e.g. the determination of value, chip authenticity and/or assignment of the serial numbers to the depositor in the sensor device 203 to take place prior to storage in temporary storage 203, while the authenticity check, e.g. of the banknote paper features or print banknote print features and/or the condition check is effected after the temporary storage.

An advantage of this kind of an procedure consists in that the subsequent checking steps, such as the check of condition, can take place at a slower speed than the checking steps prior to the temporary storage. This makes it possible for the depositor to have the deposit transaction completed quickly with the temporary storage and to have the condition check of the banknotes deposited during the transaction to be performed only slowly in a period by no later than by the beginning of the next deposit transaction. Due to the time saving, a significantly more inexpensive checking and evaluation device can thus also be used, which does perform checks such as the condition check accurately, but does so more slowly. At the same time, however, it is ensured that settlement of accounts with the customer, i.e. confirmation and thus completion of the deposit process, for example, takes place quickly and consequently, that the transaction time for the customer can decline. Therefore, e.g. a sensory system, which requires 1-5 seconds to evaluate one banknote, can also be used for the condition check.

Within the meaning of this concept, it is also possible e.g. to already record data by means of associated sensors prior to temporary storage, but to evaluate at least part of these data only later, e.g. partially or fully after completion of the deposit transaction for the customer. Thus, it is possible e.g. for a camera that contains sensor unit 203, to take an optical, two-dimensional picture of at least a partial area of the individually-deposited banknotes and for the data to be evaluated, e.g. with regard to the presence of tears, dirt or stains, only later in order to determine condition.

If, in that context, banknotes are e.g. classified as no longer fit for circulation, they can then be stored in machines 200 and/or cassette 206 separately from the banknotes which are still fit for circulation. In the case of banknotes with a chip, it is alternatively or additionally also possible to mark the banknotes that are fit for circulation and/or the banknotes that are not fit for circulation by writing associated data into the chip and storing these separately or together with the other banknotes. Due to the possibility of writing check data into the chip, simpler storage without the need for separate storage of banknotes that are not fit for circulation and banknotes that are fit for circulation can thus be produced It is to be emphasized that the aforementioned system of the multi-staged check can also be advantageously used with all other machines where banknotes are deposited. It is especially emphasized that this method is not limited to the use of banknotes with a chip, but rather that it can also be used with all banknotes without a chip.

EXAMPLE 206

Furthermore, as mentioned above, a money depositing machine is preferred that identifies the retained banknotes as disabled prior to their final storage in the cassette. This has the advantage that money stolen from the machine after it is broken open is not considered authentic and that it is therefore of no value to the thief, at least not if such disabling is also reproduced optically and/or acoustically or, as the case may be, reproducibly for humans without machine checking. Otherwise, this identifier of the banknotes, which continue to be considered authentic may at least help to better follow the circulation of these banknotes upon a subsequent check of the banknote by machine.

EXAMPLE 207

A further particularly advantageous embodiment provides for the banknotes to be fed in as a stack and processed in the stack, i.e. checked via measurement, among others. The methods and components of the apparatuses with which such a measurement in the stack can be carried out were explained and described by way of example previously in the section "Stack Measurement".

If e.g. the value of the stack is determined without singling, direct transport into the end cassette can take place with the money depositing machine. Singling, the transport of individual notes, the sensor technology for individual notes and escrow can consequently be eliminated. The reliability of such a device increases significantly due to the significantly simplified construction. In addition, the price can be reduced drastically.

An example of such a money depositing machine 210 is schematically illustrated in FIG. 67. It comprises an input pocket 211, wherein banknotes 1 with a chip are deposited as a stack onto a deposit surface 215. The banknotes 1 loaded into pocket 211 are measured as a stationary stack by means of a checking device 212 controlled by a control device 213. In this context, checking device 212 will be constructed and function in a manner as was described above in the section "Stack Measurement". In particular, this measurement will comprise a value determination for the determination of the total value of the deposited stack. Furthermore, the other, aforementioned processing steps can also be carried out by checking device 212, such as an authenticity check and/or a check of condition and/or a writing of check data and/or transactional data to the chip of the deposited banknotes.

Subsequently, the banknotes 1 thus tested are deposited stacked in the banknote cassette 214. This can e.g. occur in that a non-depicted electromechanical actuator is switched on and driven by the control device 213, by means of which drive the deposit surface 215, upon which the banknotes 1 in the input pocket 211 rest, is pulled away, such that the banknotes 1 in cassette 214 potentially fall upon the already stacked banknotes deposited therein. Subsequently, deposit surface 215 is again moved back to the position depicted in FIG. 67, upon which surface banknotes can again be deposited during a subsequent transaction.

In order to prevent unauthorized removal of banknotes after a check, but still prior to final storage in cassette 214, input pocket 211 will preferentially be lockable e.g. via a cover 216 that is pivotable by means of an electromechanical adjustment drive. This means that cover 216 is or, as the case may be, will be opened at the beginning of a deposit process to enable the insertion of the banknotes 1 to be deposited, and that, in particular prior to the beginning of the stack measurement, cover 216 will be closed to prevent an unauthorized access to the banknotes 1.

EXAMPLE 208

A further variation consists in the following: In many countries, lawmakers provide that, in the case of money depositing machines, banknotes that are considered suspect of forgery must be deposited in a separate pocket in order e.g. to ensure that banknotes that have actually been forged can be destroyed following a technical criminal investigation. The necessity of the separate pocket results in a not inconsiderable increase in costs for such money depositing machines, since the pockets themselves not only need to be constructed, but in addition, the entire transport path of the money depositing machines must also be modified such that the pocket can be filled with banknotes. Apart from this, the increase in space requirement for the money depositing machines is also not inconsiderable.

The necessity for such a separate pocket can be eliminated through the use of the banknotes according to the invention. To that end, the fact of the suspect of forgery is written into the memory area of each banknote suspect of forgery during the check in the deposit machines. This writing-in should preferentially be irreversible for the owner of the machine. Only the central bank can possess the privilege of lifting the counterfeit suspicion in case the suspicion is not confirmed after a closer investigation. This can be implemented e.g. through the use of various access privileges to the memory of the banknote.

The operator of the money depositing machines could then e.g. be obligated to check the banknotes removed from the money depositing machines with a reading device and to send the banknotes reported as suspect of forgery to the central bank. If the banknote contains its own display for displaying its condition, it would also be de facto impossible for the operator of the money depositing machine to proceed otherwise, since the banknotes would have been clearly identified as suspect of forgery.

A further possibility consists in the use of PKI encryption methods. The number of banknotes marked as suspect of forgery and/or other data, such as the time of emptying, an emptying counter of the machine that cannot be manipulated by the operator, etc. are encrypted by the machine with a public key assigned to the machine and can be decrypted at the central bank with the private key assigned to the machine. For example, the operator can be forced by law to effect uninterrupted delivery of such reports, with the variable portions, such as the time stamp or, as the case may be, the counter of the encrypted data being able to cancel the points of attack for a manipulation, because this would prevented data from older transactions from being used once more.

Combined Money Depositing and Money Dispensing Machines

In the case of combined money-deposit and money dispensing machines, such as money changers or, in particular, recyclers, the aforementioned embodiments that were described in relation to money depositing machines can be applied. This also applies in particular to the case where the deposited banknotes are not again dispensed and therefore e.g. also need not be stored separately by denomination. The aforementioned principles can, however, also be used for a recycler wherein the deposited banknotes are stored separately by denomination to be able to output them once again in subsequent money dispensing transactions. Thus, the reading/writing of chip data, the multistage checking method or, as the case may be, the stack processing also prove to be particularly advantageous here, for example.

Since only the actual input process and output process should occur quickly in a recycler, e.g. the sorting of banknotes stored intermediately by denomination can in turn also take place at a slower speed. I.e. the singling of the e.g. banknotes inputted and measured in the stack can potentially also be conducted after completion of the transaction. Furthermore, deposited banknotes that are outputted again should be checked for their authenticity in every case.

Money Dispensing Machines

In the case of money dispensing machines, too, some of the aforementioned concepts, which were described in relation to money depositing machines and combined money depositing and money disbursing machines can be adopted. Thus, the reading/writing of chip data and stack processing also prove to be particularly advantageous in this case, for example. Thus, the serial numbers of all banknotes stored in the supply cassettes of the money dispensing machine are captured e.g. by readout of the associated chip data and either stored in a database internal to the machine or in a database connected from the outside by means of a data line.

EXAMPLE 209

A particular improvement to the currently known systems then results if one unequivocally follows which banknote amounts have already been disbursed and which ones are still located in the machine momentarily.

This can be effected in that a serial number reader is interposed between the memory area of the banknote to be dispensed and the output pocket, which [reader] reads the serial numbers or other individual data of all of the banknotes subsequently dispensed. This is then expedient if the correlation between the serial number and the denomination was known or e.g. was determined or, as the case may be, measured in an automatic teller or another external apparatus.

EXAMPLE 210

In addition, the money flow can be controlled in that check data such as the banknote serial numbers, together with transactional data, such as data about the recipient, are stored when money is disbursed. The concept of temporary cancellation of the banknotes can likewise be advantageously applied. Thus, through prior writing to their chips, the banknotes inputted into the money dispensing machines by the commercial bank will be marked as cancelled and thus without value. By interposing a writing unit now for writing to the banknotes that are to be dispensed in an ongoing transaction between the deposit area of the banknotes to be dispensed and the output pocket, the banknotes to be dispensed immediately afterwards are enabled again by writing the associated data to the banknotes' chip.

EXAMPLE 211

In addition, provision can also be made to determine only the denomination of all of the banknotes situated in the automatic tellers, in place of or in addition to the serial numbers. Here, e.g. the aforementioned measurement methods can be realized and utilized. In particular, a stack measurement of the banknotes stored in the automatic teller is thus expedient.

This can in turn also be realized as a type of self control, so that the momentary amounts of cash in the automatic teller are always determinable on the basis of a stack measurement by a measurement device or, as the case may be, an evaluation device contained within the automatic teller or, as the case may be, its storage cassettes.

This make it possible for the cash stored within the machines to be acknowledged as a minimum reserve and thus as non-interest-bearing property of the Land Central Bank [FRG]. In known money dispensing machines, the commercial bank that inputs and stores the banknotes in the automatic tellers for later output to the customers must pay interest on these [banknotes] to the issuing Land Central Bank, since it cannot be continuously clarified which banknotes actually inputted into the machines at a certain point in time are still situated in the machines at later points in time, and which are not. By means of the unequivocal self control it can, however, always be clearly demonstrated which cash amounts were still located in the money dispensing machines when or, as the case may be, exactly when they were dispensed. This method will mean significant savings for the commercial banks.

Commerce

Cash registers, or registers for short, are used in all areas of commerce such as in supermarkets or department stores. As is commonly known, these registers serve to accept the customer's cash intended in payment for purchased goods and to deposit it in the register and to in turn give out change from the cash holdings in the register. In larger businesses, money depositing machines, wherein, for example, the cash holdings of the respective registers are inputted and automatically counted and reconciled, are used as well to levy and reconcile the individual registers of a department store.

Money Depositing Machines in Commerce

Within the meaning of the present invention, such money depositing machines preferentially have properties as were previously described in the section "Commercial banks/ money depositing machines". Moreover, it is also conceivable to use the above-described combined money depositing and money dispensing machines to not only reconcile the individual registers, but to also simultaneously dispense the necessary (cash) change, e.g. for the next day.

In comparison to the use of such devices with money depositing function at commercial banks, these devices for use in commerce will preferentially be not be designed as variations that are installed such that they are stationary, but rather as mobile i.e. transportable variations. If the device within this meaning e.g. is equipped with a rack on rollers, it can thus be readily moved between the various registers of a department store to be able to levy and clear the cash holdings directly on location, without the need to first refill the cash that was taken out of the register to be reconciled e.g. into a cassette and to transport it to a money depositing machine installed such that it is stationary in another room.

Registers

Since cash is likewise inputted and dispensed at registers, embodiments as described above for money depositing machines, money dispensing machines and combined money depositing and money dispensing machines can also be realized for these [registers].

In that context, the checking of banknote properties through communication between the chip of the banknotes and an evaluation device, e.g. by optical, inductive or capacitive means, is once again of particular advantage. In this context, particular reference is once again made to the use of a "light barrier" and/or processing in the stack. Here, the evaluation device can either be present as completely integrated in or on/at the register and/or at least partially external to it.

EXAMPLE 212

Reading device 220" of FIG. 48 for the checking of banknotes with capacitive coupling elements can thus be used for banknote checking at registers. An associated device can e.g. be present externally or integrated into the register itself. By depositing a stack of banknotes on the depositing surface 221, the authenticity and/or the value can be checked rapidly, for example.

Further, the use of banknotes with a chip allows particularly reliable, automatic inventory or, as the case may be, monitoring of the register. This can e.g. be realized in that the register contains a device to be able to register each removal or insertion of banknotes.

EXAMPLE 213

For one, this can take place in that it is recognized whether banknotes are taken out of the deposit area of the register or insertion into it. This is e.g. accomplished by at least one checking unit installed in the register as a type of light barrier, which determines, e.g. by means of optical, inductive or capacitive coupling with the banknote chip, whether same leave the deposit area of the register or not. Specifically, this can e.g. be determined by checking whether the banknote chips come into a certain predefined coverage range of the coupling or move out of same. Aside from the determination of the presence of such banknotes that have been deposited and/or dispensed, the checking unit can e.g. preferentially also be designed such that it reads properties such as the serial numbers of the banknotes and/or checks their authenticity. The authenticity check can e.g. also take place through the recognition of the chip and/or the checking of chip data.

EXAMPLE 214

Additionally or alternatively, provision can be made to ascertain the respective momentary stock of cash in the register itself. I.e. it is not directly ascertained whether banknotes are being taken in or, as the case may be, dispensed, but rather which Banknotes are situated in the register momentarily. To this end it can e.g. likewise comprise one or more checking units that, through communication with the banknotes in the register, determine their authenticity and/or number and/or serial number and/or total value. In this way, a type of self control of the cash holdings inside can also be realized for registers. In this context, the cash holdings thus determined can also be displayed on a display surface of the register.

If the banknotes in the register are deposited cleanly by denomination, i.e. the banknotes of different denominations are deposited separately in different slots, it can also suffice to merely determine the momentary number of banknotes per slot, for example by means of one of the aforementioned stack measurement methods. Among other things, several of the slots, in particular each slot, will exhibit an individual checking unit in this case as well. If it is predetermined which denomination of banknotes are, or, as the case may be, are supposed to be in which slot, the total value of banknotes per denomination and/or the total value of all banknotes of an arbitrary denomination can be determined e.g. by means of an evaluation device integrated in the register or connected to it by a signal line. In case the contents of a register can be determined free of doubt in this way, it is simple to document filling or removal by the register personnel at any time. One can therefore dispense with the currently customary procedure of personalized register drawers for banknotes.

EXAMPLE 215

E.g. in such a case, in order to prevent that the operating staff of the register unintentionally deposit banknotes incorrectly, e.g. insert a 10 €, note in the slot for 20 €, notes, the register will preferentially be provided with a checking unit that determines whether banknotes of only one individual denomination are present in the respective slot. By way of example, the case of an inductive or capacitive coupling to the banknote chip is explained. If the transponders of the banknotes of different denominations each exhibit a different frequency behavior, then e.g. an anticollision method that determines whether "false" response frequencies, i.e. signals from banknotes of incorrect denominations, are measured in the respective slot, will be able to be used to advantage.

Alternatively or additionally, a deposit surface corresponding to surface 221 of FIG. 48 can also be present in each of the individual slots to be able to determine and monitor the inventory of banknotes in the individual slots.

EXAMPLE 216

A further particularity of registers, as opposed to the money depositing machines or, as the case may be, money dispensing machines used in commercial banks, is that, not only must the capture of the amount of money taken in occur in registers, but also a comparison with the amount to be paid per se, i.e. the total value of the purchased goods, with the difference in the amounts being paid out again as change.

For that reason, the banknotes deposited in the register and/or taken in and/or dispensed from same are preferentially not only captured, but rather a comparison with the fixed total value of the purchased goods takes place e.g. by means of scanning of the barcodes on the price tags of the purchased goods. That means that e.g. in an evaluation device, a check is performed to determine whether the operating staff member takes too much and/or too little change from the register during a sales transaction. An incorrect disbursement of change can e.g. be displayed through an optical and/or acoustical warning. To the extent that the taking in and dispensing of coins is not also recognized automatically, no exact counterbalance can be conducted in this case. At least, however, one can determine whether or not banknotes with a total value that exceeds the amount of change due were dispensed.

Through above-described monitoring it can also be ensured that no money is removed from the register at a certain point in time or in a certain period of time, e.g. when no sales transaction is being carried out momentarily.

EXAMPLE 217

In order to also potentially be able to determine inconsistencies subsequently, it is preferentially possible for all of or a portion of the data captured by the checking unit to be stored in connection with a time capture for later evaluation.

EXAMPLE 218

The checking unit for the recognition and checking of banknote chips can also be connected with the scanner for the purchased goods. To the extent that the goods e.g. are likewise equipped by means of a transponder instead of an optical barcode, the scanner for the goods can simultaneously also fulfill the function of the checking unit for the recognition and checking of the banknote chips. That means that a single device or, as the case may be, components of the register can suffice for both the recording of the goods as well as the recording of the banknotes.

EXAMPLE 219

The checking unit for the recognition and checking of banknote chips, as was described in the above, can not only be integrated in permanently installed registers, but rather in mobile registers, cassettes or strongboxes as well.

EXAMPLE 220

According to a further preferred example, information on the intended use of the banknotes are stored in the memory of the chips of the banknotes. In this context, data with reference to the intended use are particularly preferentially displayed with an electrooptical and/or acoustical display device that e.g. is integrated in the banknote paper. Through the fact that the information on the intended use are also displayed such that they are visually visible or acoustically, one can, upon circulation of the money, also immediately recognize without additional aids whether the banknotes are disabled for a certain intended use.

EXAMPLE 221

Thus data, which indicate that the banknotes are only to be exchanged for certain goods or groups of goods, can be stored or are stored in the chip memory or, as the case may be, can be displayed or are displayed on the display, so that, for banknotes that e.g. are dispensed by the parents to their children as pocket money, symbols are displayed in the display that indicate that no goods such as alcohol or cigarettes can be purchased with the respective money.

In this case as well, provision can further be made that the checking units of the registers, which are set in accordance with the aforementioned, read the relevant memory contents of the banknote chips and refuse the acceptance of such banknotes in the payment process for excluded goods.

EXAMPLE 222

According to a further preferred embodiment, the display is used as an informational surface or an advertising surface on which information is depicted. In particular, an intended use for the document of value can be displayed. In this case, the use of the banknote it is not completely unrestricted, but rather a certain use such as the purchase in certain businesses or of certain goods is considered preferential or limited or excluded. This display of the intended use can function mandatorily or merely as a recommendation. In addition, e.g. correspondingly adjusted checking apparatuses may refuse the acceptance of such documents of value in the payment process for goods excluded by the display. Through the fact that the information on the intended use are displayed in visually visible fashion, one can, during circulation of the money, also immediately recognize without additional aids whether the banknotes have been released for a certain intended use.

EXAMPLE 223

In an embodiment, provision is made that a consumer can, at certain terminals intended for consumers, which are set up and operated by the company, call up the status of banknotes received. Likewise, manual devices that are offered commercially can find application for this purpose. To this end, a particular addressing and associated storage area is provided in the electrical circuit of the banknote, under which the company can write and store information for this banknote in the electrical circuit. This can be the serial number (that is optically visible on the BN for everyone), but also information about another intended use (e.g. gratuity, bonus, prize). The consumer can then retrieve the status of the banknote at the described devices. In this context, provision can also be made that the consumer likewise writes information under the particular address, e.g. his name, home address, customer number, etc.

To this end, the company writes informations to the electrical circuit of the banknote under the respective addressing. This can e.g. take place in that the company provides randomly selected banknotes, the serial numbers of which it has previously read in and e.g. stored on a data processing system, with an identifier prior to the dispensing of change at the registers. As described above, this informations are stored under the particular address so that these addressed informations are only read out at customer terminals provided by the company for that purpose and/or at the registers of the company. It is also conceivable that manual devices could be obtained by customers, with the help of which the customer could then read out the status of the banknotes received by him. This can take place on the premises of the company, but it is also conceivable that the customer calls up these informations e.g. at home by means up of an additional device or a network connection such as an Internet connection or a mobile radiotelephone connection (GSM, UMTS, etc.).

The information given out (e.g. presence of prize or no prize) is directly displayed or transmitted to the customer. A banknote provided with a prize is enabled (erased) again by the company after handing out the prize, preferentially at the register or at the customer terminal, for this purpose, the particular address is again enabled. Afterwards, the banknote can also be given back to the customer again. In order to be able to translate the procedural procedure described into practice, EEPROMs (electrically erasable programmable ROMs) are preferentially used as the memory of the electrical circuit of the banknote. However, magnetic and/or optical memory devices that are writable or, as the case may be, rewritable and erasable are also conceivable.

EXAMPLE 224

A further potential application example for a banknote with an electrical circuit is a tracking and tracing process. Here, the banknote or, as the case may be, its electrical circuit is previously provided with an identifier, e.g. through storage of the serial number. If the consumer then brings the banknote into the vicinity of one of the customer terminals described above, a register or a manual reading device, such register or device recognizes whether the banknote is specifically marked. For department store chains, this tracking must expressly not be limited to one branch. One can e.g. imagine that the customer in Department Store A in City B is given a marked banknote, but that it is first examined for an identifier mark at a terminal during a subsequent visit to Department Store C in City D. In this context, provision is made that the customer sends e.g. an SMS (short message service) to the department store via mobile telephone or internet application when he recognizes that the banknote is marked, and in a countermove thereupon receives a message whether a prize is associated with the present banknote and/or what type of prize is involved in this context.

EXAMPLE 225

A further example relates to a lottery function (similar to a raffle). Here, certain banknotes are marked and provided with a lottery ticket number as in a raffle. If the customer then checks the number during his visit to the department store he can see whether his BN is marked ("prize") or not ("dud"). Here, the prize can be visualized at a terminal, or the customer receives a message about his prize via SMS, surface mail etc. and it is later personally handed out or shipped.

EXAMPLE 226

In a particular application, provision can be made that the customer enters the serial number of his banknote received at the participating company on an internet page provided specifically for that purpose. He may then leave e.g. his name, address or similar. The company conducts a type of lottery at periodic intervals in which certain serial numbers are selected as prizes.

EXAMPLE 227

A particular form of the application according to the invention can e.g. also be that a casino or a gambling establishment gives out special coupons, jetons or stamps (special bank notes are also conceivable) upon the cashing of a check or during the exchange of cash at the beginning of a visit to the casino, which [items] are likewise marked by means of a chip. During certain games of chance (e.g. at the roulette table, but also other conceivable games such as blackjack, baccarat, slot machine, etc.), the jeton, the stamp or even the banknote are then examined for an identifier mark and, as applicable, the prize or bonus is handed out or credited to the customer.

EXAMPLE 228

In a further application example, provision can be made that a company writes a gratuity to the banknote in addition to the denomination of the marked banknote. E.g. a marked 50 €, note contains an additional gratuity of 10 €, that can then be redeemed in the same company, even at a later time, e.g. upon the purchase of a further article. This function can also be combined with the customer cards frequently issued nowadays, which can likewise have an electrical circuit. In this context, by means of specially marked banknotes, acquired gratuities can be transferred to the customer card or be credited directly upon the purchase of goods. In this context, it is particularly expressly provided that the above-described terminals for the recognition of the identifier marks of the banknotes can also simultaneously write to or read customer cards.

EXAMPLE 229

In this context, it is possible that a business e.g. allows its logo to be depicted on the display by writing corresponding data to the electronic memory of the banknote chip and accepts the banknotes thus marked as discount coupons upon purchase. For a banknote with a denomination of 100 €, the customer would receive e.g. goods in the value of 110 €, upon purchase. In case the business does not wish to reissue the coupon-banknote again, it will subsequently erase the displayed information which marks the coupon in that, e.g. control signals, which alter and/or erase the usage data in the memory of the chip of the banknotes in appropriate fashion, are transmitted to the chip of the banknote with the checking unit of the register.

EXAMPLE 230

In addition, if e.g. goods of lesser value than the denomination of the banknotes are purchased in the department store, the usage information can thus preferentially be applied to the change that will be dispensed to the customer. Consequently, the deposited banknote is automatically recognized in the register during the deposit process and, via a writing device integrated in the register or externally to it, the change is marked by means of a noncontacting coupling to the chip of the change in correspondence to the intended use displayed for the deposited banknote. In this context and in the above-described variations, the chip can not only be situated in the banknotes, but also in coins. In this context, the coin is preferentially nonconducting, e.g. except for the components of the chip and the antenna necessary for a transponder function, and e.g. manufactured of hard plastic.

EXAMPLE 231

A display of the banknote can also be advantageously used to indicate the momentary validity of a banknote. By way of example, it is conceivable that a code of correspondingly authorized banks can be written into the memory of the control device integrated in the banknotes, which [code] completely limits the use of the banknote, i.e. renders the banknote temporarily or permanently void. This state will be recognized by the associated reading devices for such banknotes, and the banknotes then classified as not authentic.

However, to be able to also recognize this invalidity without a reading device, the validity state is additionally depicted on the display. In this case, e.g. an LED in the banknote that is turned on or turned off for an invalid banknote already suffices. Preferentially, e.g. correspondingly-adjusted checking devices that are e.g. integrated into the register or mounted externally to it may refuse the acceptance of such documents of value during the payment process of goods that are excluded as per the display.

EXAMPLE 232

Preferentially, an apparatus will be provided that serves to process such sheet-shaped documents of value, wherein a writable memory such as an EPROM, EEPROM, and a display device is integrated, which displays an informational content optically and/or acoustically, with the apparatus being provided with a writing device for the writing of data to the memory in order to be able to alter a display condition of the display device e.g. in the aforementioned way by changing a data content of the memory.

The high-quality inventory check, authenticity check, and/or value check conducted by way of the communication with the banknote chip can, e.g. in the aforementioned cases, take place offline and/or online. This means that the evaluation device for the evaluation of the measurement data of the checking unit(s) is either integrated in the register itself or present outside of it and connected to the register via a signal line. The signal line can be wireless and/or wire-bound. In an external evaluation, the checking unit of the register will preferentially be connected with a central evaluation device by means of a network connection, such as an intranet connection, internet connection, fixed network connection or mobile radiotelephone connection, which evaluates and checks the data from several registers.

EXAMPLE 233

The data can e.g. be used to automatically capture the inventory of the individual registers so that before, when a prescribed minimum number of notes of a certain denomination is reached or fallen short of, such banknotes can be delivered in a timely fashion to the respective register.

EXAMPLE 234

In addition, the readout of the chip data from a banknote stored and/or placed in a register can be used e.g. for a capture of its serial numbers. Thus by way of example, the appearance of previously registered banknotes, e.g. that stem from an extortion for ransom money, can quickly be determined. Again, the evaluation takes place either "offline" in the register system itself, or "online" via a connection to an external database. In the latter case, the system is also suited for the determination of general data about the circulation of cash such as distribution speed, dwell time, etc.

EXAMPLE 235

If non-identifiable or, as the case may be, defective banknote chips appear during the payment procedures, the banknotes on which are present further e.g. visually discernible or tactilely palpable security features will thus be checked manually by register personnel or with the help of separate checking devices and/or ones that are also integrated in the register or at least connected to it. In case the register holdings are automatically monitored, the necessary data, such as the quantity of banknotes with a defective chip placed in a slot and/or their denomination, can be inputted by means of an input unit and transmitted to the evaluation device of the register. In this context, the banknotes with a defective chip are preferentially also stored in the register separately from the banknotes with an operable chip so that they are sorted out more readily and not dispensed to the customers again.

EXAMPLE 236

The chip 3 of a banknote 1 will typically contain information on the denomination of the banknote 1. In this context, a further idea of the present invention consists in providing such banknotes 1 with an alterable denomination. In this context, this alterable denomination can e.g. be displayed by means of optical or acoustic display devices likewise described within the scope of this invention.

In this context, the denomination that is stored in encrypted form in chip 3 should only be able to be altered by correspondingly authorized persons or, as the case may be, institutions with the aid of special reading devices, or as the case may be, writing devices that recognize the encryption code. This can e.g. be used to transfer the denomination of a banknote or a portion thereof from one banknote to another by means of an associated reading-writing device. Further, this can e.g. be used to the end that the equivalent value of banknote 1 or a portion thereof is transferred and credited to an account. It is likewise conceivable that the equivalent value of banknotes 1 with chip 3 contained in a container, such as a cassette or a vault of an automatic teller, is transferred to an account while the banknotes are stored in the container. By way of example, not until or shortly before issuance, are the banknotes then again equipped with the respectively appropriate denomination. In this way, the insurance premium necessary in principle or, as the case may be, interest can be avoided. So as to be able to still produce information about the momentary denomination of a certain banknote, even during a chip failure, the associated data, that is data on the denomination in conjunction with a unique feature, e.g. the serial number of the banknote, should be stored in an external database, such as a database that is central for a certain region.

EXAMPLE 237

It is likewise conceivable that the checking device according to FIG. 37 is integrated in a cash register and, in fact, preferentially in several or all deposit slots. The light source, such as a laser diode for the activation of an outermost banknote in the stack will again preferentially be integrated in the base of the respective deposit slots to illuminate the bottommost banknote in the deposit slot from below e.g. after closing of the register drawer. Here there can be an automatic switch that is coupled to the closing process of the drawer and activates the laser diodes. To achieve a better contacting between the individual banknotes in the stack, provision can be made for these to be pressed together with a clamp in the deposit slot.

Preferentially, the banknote illuminated first, i.e. bottommost in the stack, will now send its information to the checking unit of the deposit slot. After checking or, as the case may be, registration, the next successive banknote lying above is supplied with energy as described, in turn sends information to the checking unit in the drawer, etc. At the end, the status of the banknotes situated in the register drawer can thus be readily evaluated e.g. by serial numbers, denomination, quantity, total value, etc. and e.g. displayed on a register display.

Consumer

Since the chip of the banknote is only readable by machine, a person using cash can only then obtain increased security against forgeries if (s)he uses a suitable checking device. Advantageously, this device communicates with the chip of the banknote in order to e.g. check the value and/or the authenticity of the banknotes. As in the register systems, an additional brief visual or tactile check by the person remains unaffected by this as a rule.

A check of just a few features can already be sufficient since, in this application, as in the application in registers, a visual check of the banknotes to be examined is additionally carried out by the operating staff.

EXAMPLE 238

By way of example, this can be merely a check for the presence of the features described in greater detail in the above that aid the authenticity check, and/or it can merely be a check of the chip data by communication with the chip to provide a reliable, but cost-effective checking device.

EXAMPLE 239

Such checking devices are preferentially designed as portable manual checking devices. These can be carried along by the user as a compact, separate device or instead also be integrated e.g. in a key ring, glasses case, pocketknife, mobile telephone, cigarette case or a lighter etc.

This has the advantage that the consumer can also take the device with him when shopping, for example. In this context, aside from denomination and/or authenticity, e.g. the aforementioned information on intended use can be checked exclusively or particularly by means of the communication with the banknote chip as well.

EXAMPLE 240

In addition, such a device for the consumer can also be integrated in a change purse that serves to receive cash. The necessary energy supply of the checking unit is preferentially achieved by a compact battery, such as a button cell or a thin layer battery or a thin layer accumulator, or instead by a photovoltaic element that is attached to the outer side of the change purse. Energy supply by a piezo transducer is also conceivable, however. The checking unit can, at typically lesser dimensions, be designed like the checking units of the manual checking devices and/or the registers. I.e. preferentially, e.g. each removal or addition of banknotes from or, as the case may be, to the change purse can also be monitored and/or its banknote content monitored.

EXAMPLE 241

The aforementioned display devices can also be present in the checking devices themselves or the devices connected to them. Thus, the intended use e.g., an advertisement or the validity of the banknotes can be determined through the readout of chip data by the checking device and then displayed on the checking device. This is e.g. is of advantage for the variation wherein the checking the unit is integrated in a mobile telephone and thus the display of the mobile telephone is used for the display e.g. of the aforementioned data.

EXAMPLE 242

A particular need also exists for checking devices for the blind. These can e.g. be integrated in a manual device or, as the case may be, a change purse as was described in the preceding examples.

By way of example, if the banknote here is introduced to the checking the unit, then a signal output occurs which is different for different denominations. In this context, the reality of a signal output can already be viewed as a simpler demonstration of authenticity for the blind. The signal output occurs either as a clearly audible acoustical signal, such as a buzz tone, or else over a vibration generator that vibrates and whose signals can be clearly perceived tactilely. Preferentially, no signal output occurs while the banknotes are located in the coin purse, which e.g. can be controlled through software or realized in that the geometry of the checking unit is so designed that it does not react to banknotes in the interior of the coin purse.

If necessary, it is, however, also feasible to display the entire contents of the coin purse. By way of example, this stack reading can be triggered via an affixed pressure switch, with the signal output being coded or, as the case may be, modulated in a suitable manner or taking place directly via a speech module.

As a further alternative, it is conceivable to separate the acoustical signal output from the checking unit. Thus e.g. an earpiece can be connected with the checking unit via a cable.

However, it is also possible to only make the necessary energy and trigger available via the checking the unit. If the banknotes e.g. are equipped with a piezoelectrical foil element (e.g. PVDF) coupled to the transponder of the banknote, the banknote to be checked can itself emit a suitable acoustical signal. This an also then apply correspondingly if the banknotes e.g. are equipped with a magnetostrictive foil element, so that the banknote to be checked can itself emit a suitable vibratory signal.

The Handling of Banknotes with a Defective Chip

For all areas of the handling of banknotes wherein banknotes with defective or missing electrical circuits can appear, the question arises as to how the banknotes without such operable electrical circuit, hereinafter referred to as banknote circuit for short, can be processed along with the other bank notes in a consistent work process. In this context, possible areas of the aforementioned handling of banknotes that e.g. come into question include: the production of banknotes, banknote processing, the acceptance of banknotes at money depositing machines of commercial banks or of commerce, the acceptance of banknotes at register systems, the transport of such accepted banknotes or the destruction of such banknotes.

To be able to process the banknotes without operable banknote circuits in all of these processes in the same style and manner as the banknotes with operable banknote circuits, it is possible to subsequently provide these banknotes with an operable circuit, termed additional circuit for short.

In this context, it is fundamentally possible to use an electrical additional circuit that is identical to the banknote circuit employed in the banknotes. However, this approach holds problems, since the possibility of subsequently attaching such additional circuits to banknotes also offers points of attack for potential forgeries.

Therefore, the banknotes are preferentially provided with additional circuits that are different than the banknote circuits that are usually used. In this context, the additional circuit will in fact preferentially have a communication interface identical to that used in the banknote circuits of the banknotes, so as to ensure that these additional circuits, too, can react to interrogations of a reading device in the desired manner. In any event, they will, however, differ from the banknote circuits to such an extent, e.g. through their response signals to the interrogation for data of the circuit and/or over the functions implemented in the additional circuit, that confusion is ruled out.

A simple differentiation consists e.g. in the return of the serial number "0" and/or the return message of the banknote value of null upon interrogation by an external reading device. Such a banknote will immediately be able to be recognized as subsequently provided with an additional circuit by an appropriate reading device and only be addressed with the functions implemented on it.

On the other hand, such a banknote without an operable banknote circuit can, however, also place other demands on an additional circuit that the normal banknote circuit cannot meet. Since e.g. forgeries also often do not have a correctly functioning banknote circuit, the additional circuit can e.g. have a larger memory area than the banknote circuit, with additional data, which e.g. could be helpful to a technical criminal investigation, being able to be recorded in the additional circuit.

One obvious possibility of mounting such an additional circuit on the banknote consists in the use of suitable auxiliary carriers that contain the additional circuit and are connected with the banknote, or enclose same. Such auxiliary carriers could e.g. be the bands likewise described within the scope of the present invention, but it could also be pockets into which the banknotes are inserted.

A preferred embodiment of the above described auxiliary carrier consists in the use of adhesives that are attached to the banknotes, for which reason only the adhesives will be dealt with by way of example in the following. The adhesives can either be inseparably associated with the banknote, or instead, again detached and reused after the steps of handling have taken place.

Even if the use of the adhesives with an electrical additional circuit only appears to cause unnecessary costs at first, in this way, the entire handling process for the banknotes can, however, become significantly cheaper. Various possibilities of use will now be explained.

In banknote processing, many of the advantages described further above for the banknote with a circuit according to the invention are present to a significantly greater extent if the assumption can be made that all of the processed banknotes have an operable circuit. Thus e.g. an intelligent light barrier can only then reliably recognize the transport of overlapping banknotes or, instead, a mix-up in the order of banknotes if all banknotes exhibit an operable circuit.

Accordingly, to increase the reliability of processing, the adhesive can be attached at banknote processing machines with individual processing or those with combined individual processing and stack processing, e.g. during or immediately after singling, after an attempt at communication in the singler itself has failed, and the banknote is then processed individually or in groups with the same process reliability. Exclusive stack processing of such banknotes, as well, remains possible in those cases where the adhesives were attached to the banknote in previous process steps affecting the banknote e.g. by the depositor.

In order to e.g. be able to perform here the marking of banknotes suspect of having been counterfeited described further above, provision can be preferentially made to attach an above-described adhesive label to the banknotes without circuit, which [banknotes] can in principle be considered suspect of forgery, in order to write the data about the forgery suspicion into the memory of the circuit. With this, the report to be generated on the register contents described below can in some circumstances be avoided.

Even the variation of attaching adhesives with electrical circuits to the banknotes prior to destruction can have substantial advantages in relation to the tamperproofness of the destruction process. If all of the banknotes to be destroyed have circuits, i.e. of banknote circuits and/or additional circuits, the light barriers will thus be able to reliably uncover manipulations to the banknote flow prior to the mechanical destruction. In particular, such a procedure presents itself for the destruction of print-fresh reject banknotes, where only a small number of defective circuits is to be expected.

The invention claimed is:

1. An apparatus for processing documents of value that have at least one electrical circuit, the apparatus comprising:

a checking device for at least one of (A) the transfer of at least one of energy and data to the electrical circuit of one of said documents of value and (B) the reception of at least one of energy and data from the electrical circuit of the documents of value, with at least part of at least one of the transferred energy and data being used for processing, wherein the checking device is configured to initially determine individual data of one or more documents, in order to then be able to selectively address individual electrical circuits or a subset of all of the electrical circuits, to transfer an authentication signal to the electrical circuit to obtain authorization from said electrical circuit for carrying out certain processing operations, and, upon obtaining authorization from said electrical circuit, carrying out said processing operations, said processing operations including either reading from or writing to a memory of said electrical circuit.

2. An apparatus according to claim 1, wherein the checking device is designed to at least one of record, determine and check one or more properties of the documents of value from the transferred data.

3. An apparatus according to one of claim 1 or 2, wherein the checking device is equipped with the following transfer methods either alone or in combination: a contact-type coupling, a noncontacting coupling, an inductive coupling, a capacitive coupling, a galvanic coupling via contacts, a coupling by means of an electrical field, a coupling by a magnetic field, an optical coupling by electromagnetic waves, a coupling by deformation, such as piezoelectric elements, a coupling by electromechanical elements, a coupling by sound and a coupling by heat.

4. An apparatus according to one of claim 1 or 2, wherein the checking device has at least one coupling unit, a magnet for producing a magnetic field, a coil for inductive coupling, at least one of a light source for optical coupling and a sound source in order to irradiate an electric element of the documents of value that reacts to sound, with the coupling unit being provided in a base surface on which the documents are provided stacked for at least one of a measurement and integrated in another component of the processing apparatus.

5. An apparatus according to one of claim 1 or 2, wherein a plurality of different transfer methods are available to the checking device in each case for at least one of (C) the reception of at least one of energy and data of the electrical circuit and (D) the transfer of at least one of energy and data to the electrical circuit.

6. An apparatus according to claim 5, wherein selection of one or more of the different transfer methods is dependent on a control signal that is transferred to at least one of the circuit of the documents of value from the processing apparatus and to the processing apparatus of the circuit from the documents of value.

7. An apparatus according to one of claim 1 or 2, wherein the checking device for the reception of at least one of energy and data of the electrical circuit has a receiving unit that is configured to use at least one of (C) the same and (D) another transfer method for the transfer of at least one of energy and data to the electrical circuit.

8. An apparatus according to one of claim 1 or 2, wherein the checking device for the reception of at least one of energy and data from the electrical circuit has a receiving unit that is situated in at least one of the same and in another processing section of the processing apparatus as a transmitting unit for the transfer of at least one of energy and data to the electrical circuit.

9. An apparatus according to one of claim 1 or 2, wherein the checking device for at least one of the reception of energy from the electrical circuit and for the transfer of energy to the electrical circuit is configured to use at least one of (C) the same and (D) another transfer method as for at least one of the reception of data from the electrical circuit and the transfer of data to the electrical circuit.

10. An apparatus according to one of claim 1 or 2, wherein the checking device for the reception of at least one of energy and data from the electrical circuit is configured to use an optical coupling and that it is configured to use at least one of an inductive and capacitive coupling for the transfer of at least one of energy and data to the electrical circuit.

11. An apparatus according to one of claim 1 or 2, wherein the checking device is configured to measure at least one of (C) properties of a plurality of documents with at least one of a stationary stack of documents and a moving stack of documents, and (D) properties of individual documents with at least one of stationary and moving individual documents.

12. An apparatus according to one of claim 1 or 2, wherein the apparatus is configured to at least one of transport and process the documents of value, both individually and in a stack in the apparatus.

13. An apparatus according to one of claim 1 or 2, wherein the checking device is configured to at least one of successively measure properties of individual documents and simultaneously measure properties of several documents.

14. An apparatus according to one of claim 1 or 2, wherein the checking device is configured to at least one of (C) address several circuits of different documents at least one of simultaneously and in serial succession, and (D) receive response signals from several circuits of different documents that are addressed and configured to at least one of simultaneously and in serial succession send response signals back to the processing apparatus.

15. An apparatus according to one of claim 1 or 2, wherein the checking device is configured to not activate a circuit of one of the documents until a circuit of another of the documents to be processed has already sent out a response signal.

16. An apparatus according to one of claim 1 or 2, wherein the apparatus is configured to move, a position of a coupling field of the processing apparatus so that different documents in a stack can be addressed successively.

17. An apparatus according to one of claim 1 or 2, wherein the processing apparatus is configured to selectively increase a strength of a coupling field during a checking operation so that different documents in a stack can be addressed successively.

18. An apparatus according to one of claim 1 or 2, wherein the transfer of data is configured to be effected via at least one of (C) single-stage and multi-stage modulation of the transferred signal, (D) via load modulation and (E) via changing coefficients of at least one of optical transmission, reflection and absorption.

19. An apparatus according to one of claim 1 or 2, wherein when optical coupling is used, at least one of a spectral composition and time behavior depends on the data to be transferred.

20. An apparatus according to one of claim 1 or 2, further including a light source configured to irradiate at least one of an individual light guide of a document and several light guides of several documents of a stack.

21. An apparatus according to one of claim 1 or 2, wherein the checking device is configured to transfer data on a life history of the documents to the documents.

22. An apparatus according to one of claim 1 or 2, further including a singler for separating documents of value, which is configured to remove one document at a time from a stack of documents of value, with the checking device designed such that the transfer of at least one of energy and data between the circuit situated on a document that is to be pulled off and the device takes place at least one of before and as the document is being pulled from the stack.

23. An apparatus according to one of claim 1 or 2, wherein means for securing transfer of the data are provided.

24. An apparatus according to one of claim 1 or 2, wherein the checking device is configured to communicate with the circuit of the document of value via both or only one of two frequencies when documents of value with several coupling elements of different coupling frequencies is used.

25. An apparatus according to claim 24, wherein the checking device is configured to only communicate with the circuit of the documents of value via an other frequency if and only if a communication at one of the two coupling frequencies of the coupling elements fails.

26. An apparatus according to one of claim 1 or 2, wherein the checking device is configured to alter the circuit at a certain point in time following at least one of application to and incorporation in the documents of value such that writing of data is prevented in all or part of memory areas of the circuit.

27. An apparatus according to one of claim 1 or 2, wherein the checking device is configured to at least one of deactivate the circuit of a checked document and at least interrupt one connecting line that is connected with the circuit at least one of during and after a checking operation.

28. An apparatus according to one of claim 1 or 2, wherein the checking device is configured to irradiate an oscillating circuit of the documents of value with an alternating field such that signals produced by an oscillating circuit and received by the checking device can be evaluated so as to check the documents of value.

29. An apparatus according to one of claim 1 or 2, wherein the checking device is configured to check at least one of a presence a form a surface structure, a position and a distribution with several circuits at least one of in and on the documents of value as an authenticity feature.

30. An apparatus according to one of claim 1 or 2, wherein the checking device is configured to measure and evaluate a temperature when the documents of value is checked.

31. An apparatus according to one of claim 1 or 2, wherein, in order to examine contents of a container, the checking device is configured to compare data about the contents of the container, which are stored in a memory of the container, with data about the contents of the container, which are stored in a memory of the documents of value circuit of at least one of the documents in the container.

32. An apparatus according to one of claim 1 or 2, wherein, in a processing operation, the checking device is configured to transmit data to a container, which are intended for writing into the documents in the container, so that these data will be stored temporarily in a memory of the container in order to write data to a corresponding memory of at least one of the documents only at a later point in time after completion of a processing operation.

33. An apparatus according to one of claim 1 or 2, further including a circuit configured to be at least one of applied to and incorporated into a band already during production of a band or only during or after a banding operation in which a stack of documents is provided with a band.

34. An apparatus according to one of claim 1 or 2, wherein the checking device has a device for generating an alternating magnetic field that is configured to penetrate a stack of banknotes to be checked.

35. An apparatus according to claim 34 wherein a frequency of an alternating magnetic field generated by the device corresponds to at least one of a mechanical resonance frequency of a magnetostrictive element of the documents of value and a mechanical resonance frequency of a compound material of the documents of value with the magnetostrictive element.

36. An apparatus according to one of claim 1 or 2, wherein the checking device is configured to perform an anticollision detection procedure in at least one of the processing apparatus and in the documents of value circuit during a checking operation.

37. An apparatus according to one of claim 1 or 2, wherein the apparatus further has at least one of a pressing device, which is configured to compress the documents for a stack measurement, and the apparatus further has an aligning device, which is configured to align the documents such that they are flush with reference to one or two edges disposed perpendicularly to one another.

38. An apparatus according to one of claim 1 or 2, wherein the checking device has a sonic sensor for detecting sound waves that are radiated from a sonic source connected with the documents of value circuit.

39. An apparatus according to one of claim 1 or 2, wherein there is at least one of one or more keys and sets of keys, which are configured to be used alternatively, (C) for encryption of data to be at least one of stored, transferred and (D) for forming of a digital signature of data to be at least one of stored and transferred.

40. An apparatus according to one of claim 1 or 2, wherein the checking device is configured to include individual data in at least one of an encrypted and signed set of data of other data of the documents of value or for the documents of value.

41. An apparatus according to one of claim 1 or 2, wherein the checking device is configured to forward data of the circuit of the documents of value to be checked to a spatially removed evaluation unit for checking purposes, which is configured to evaluate the data and send a check result back to the processing apparatus.

42. An apparatus according to one of claim 1 or 2, wherein the checking device is configured to, in one check transfer to such electrical circuits a new identification number for storage in a memory area of the electrical circuit provided for this purpose, with the identification number also being able to be stored in an external database situated outside the documents of value together with individual data.

43. An apparatus according to claim 42, wherein the checking device is configured to compare the identification number and the individual data from the memory of the documents of value with associated data in the external database in a checking operation.

44. An apparatus according to claim 42, wherein the checking device or the external database is configured to at least one of regenerate and select the identification number from a set of predetermined identification numbers at the time of the checking operation.

45. An apparatus according to claim 42, wherein, in addition to the identification number, the checking device is configured to also at least one of (C) transfer to the electrical circuit at least one of a time stamp and a location stamp of at least one of a current checking operation and of one or more preceding checking operations for storage in a memory area of the electrical circuit provided for this purpose and (D) to store same in a memory of the checking device.

46. An apparatus according to claim 42, further including at least one of a newly generated identification number, a newly generated time stamp and location stamp that depends on at least one of a current or a previous identification number, a current or a previous time stamp and location stamp.

47. An apparatus according to claim 42, wherein there are several external databases, and that the checking device is configured to select one of the external databases for a subsequent check evaluation by means of a predetermined selection criterion.

48. An apparatus according to one of claim 1 or 2, wherein the checking device is configured to evaluate data obtained by a data transmission between the processing apparatus and the documents of value circuit, in dependence on data which stems from other checking operations that were performed independently of the documents of value circuit.

49. An apparatus according to one of claim 1 or 2, wherein the checking device is configured to compare data from a memory of the documents of value circuit with data which are specific to at least one of a respective paper of the documents of value and feature substances contained therein.

50. An apparatus according to one of claim 1 or 2, wherein the checking device is configured to refer to data obtained by a data transmission between the processing apparatus and the documents of value circuit for adjusting checking parameters of other checking operations performed independently of the documents of value circuit.

51. An apparatus according to one of claim 1 or 2, wherein, in a checking operation in which documents of value is rated or classified as still fit for circulation, the checking device is configured to at least one of transmit data to the documents of value circuit, which cause an irreversible, local change of the documents of value, whereby data about a change is configured to be stored in a memory of the circuit of the documents of value, and the checking device itself is configured to perform such an irreversible, local change of the documents of value.

52. An apparatus according to one of claim 1 or 2, wherein the checking device is formed such that a transmission of at least one of data and energy from at least one of the processing apparatus to the documents of value circuit and from the documents of value circuit to the processing apparatus is always possible independently of an orientation of at least one of the checking device of the documents of value and a transport direction of the documents of value with reference to the checking device.

53. An apparatus according to one of claim 1 or 2, wherein at least one of (C) the checking device has several segments which are configured to alternatively be electrically interconnected, (D) the checking device of the processing apparatus is formed by a singler and (E) the checking device of the processing apparatus has a device which produces at least one of a rotating and traveling field that is at least one of an electrical and magnetic field.

54. An apparatus according to one of claim 1 or 2, wherein, during transport of documents in the processing apparatus, the checking device is configured to determine a position of the documents in the processing apparatus in dependence on data which are transmitted to the processing apparatus from the documents of value circuit.

55. An apparatus according to one of claim 1 or 2, wherein the checking device is configured to use data which are transmitted to the processing apparatus from the documents of value circuit for detecting at least one of multiple picks and a state of the documents.

56. An apparatus according to one of claim 1 or 2, wherein, during or after a checking operation, the checking device is configured to transmit data to the documents of value circuit for storage in a memory of the documents of value circuit, whereby the data relate to the checking operation.

57. An apparatus according to one of claim 1 or 2, wherein, in a checking operation, the checking device is configured to compare paper data with circuit data of the documents of value.

58. An apparatus according to one of claim 1 or 2, wherein the processing apparatus has a singler, a sensor and a stacker, and is configured to transport documents of value directly from the singler to the stacker without a separate sensor path.

59. An apparatus according to one of claim 1 or 2, wherein a stack of documents is clamped on one side by means of a clamping device, and that on an other side, a mechanism is configured to single the documents clamped on one side, and the documents of value circuits are configured to be addressed by the checking device during a singled state.

60. An apparatus according to one of claim 1 or 2, further including a sensor wherein the documents of value to be checked is deformed for measurement of paper properties, whereby bending additionally serves a purpose of at least one of supplying energy to the documents of value circuit and transmitting data of the documents of value circuit to the processing apparatus.

61. An apparatus according to one of claim 1 or 2, wherein the processing apparatus has separate transport paths for single document processing and for stack processing.

62. An apparatus according to one of claim 1 or 2, further including containers for transporting documents of value within the processing apparatus that are configured to be transported.

63. An apparatus according to one of claim 1 or 2, wherein a processing apparatus with combined individual and stack processing has one or more output stations from which containers with documents of value deposited therein are configured to be outputted from the apparatus for removal of at least one of the containers and the documents contained therein, whereby the output stations each have assigned thereto one or more filling stations, in which the containers are filled with documents of value before they are transported to an associated output station.

64. An apparatus according to one of claim 1 or 2, wherein, in part of the individual processing parts of the processing apparatus, only at most one of a deposit or one stack of documents of value is configured to always be contained at a same time.

65. An apparatus according to one of claim 1 or 2, wherein, in the apparatus, a physical separation is given by spatial spacing of different deposits during processing of several deposits in the processing apparatus.

66. An apparatus according to one of claim 1 or 2, wherein there is a separating means for separating a number of documents into two subsets, whereby the separating means is equipped with an electrical circuit which has a same communication interface as the documents of value.

67. An apparatus according to one of claim 1 or 2, further including-separating means that prevent communication of the checking device with the documents of value circuits of one of two subsets.

68. An apparatus according to one of claim 1 or 2, further including a sensor for checking properties of the documents of value circuit is mounted in at least one of a same and a spatially spaced different area in comparison with a sensor for checking paper properties of the documents of value.

69. An apparatus according to one of claim 1 or 2, further including a unit for reading data from a memory of the documents of value circuit is disposed in at least one of a same and a spatially spaced different area as a unit for writing data to the memory of the documents of value circuit.

70. An apparatus according to one of claim 1 or 2, wherein at least one of a writing unit is downstream of a reading unit and the writing unit is downstream of a sensor device, which is configured to measure properties of at least one of the circuit and of a paper of the documents of value.

71. An apparatus according to one of claim 1 or 2, wherein, in a processing operation, the checking device is configured to only at least one of write data and transmit data to the documents of value circuit for writing to a part of basically functioning memories of the documents of value circuits.

72. An apparatus according to one of claim 1 or 2, wherein, in the processing apparatus, there are a plurality of reading units for reading individual data from the documents of value circuits in a transport path of the documents of value so that a position and identity of transported documents can be clearly traced.

73. An apparatus according to one of claim 1 or 2, wherein the checking device is configured to perform at least one check of the documents of value only in dependence on data transmitted from the documents of value circuit to the processing apparatus.

74. An apparatus according to one of claim 1 or 2, wherein a correlation of transaction data upon at least one of a deposit and disbursement of documents of value with measurement data for checking associated documents of value is configured to be performed, and that correlation data is configured to be stored in at least one of a memory of the documents of value circuit of at least one of the documents of value, in a memory of the processing apparatus and in an external database.

75. An apparatus according to one of claim 1 or 2, wherein, independently of an evaluation of signals for transmitting at least one of data and energy to the documents of value circuit, the checking device is configured to determine whether a documents of value circuit is present at least one of a predetermined position, in a predetermined form and at a predetermined location on or in the documents of value paper.

76. An apparatus according to one of claim 1 or 2, wherein, in a processing operation, the checking device is configured to perform at least one of different checking operations at different speeds on a documents of value and perform different checking operations at separate times.

77. An apparatus according to one of claim 1 or 2, wherein the checking device is configured to perform checking operations prior to an intermediate storage of checked documents of value at a higher speed than checking operations after an intermediate storage.

78. An apparatus according to one of claim 1 or 2, further including an input means for input of a stack of documents by an operator, and a final stacker from which inputted documents of value is configured to no longer be removed by an operator, whereby the inputted documents are configured to be checked by a checking unit connected to the checking device and transported directly from the input means to the final stacker.

79. An apparatus according to one of claim 1 or 2, wherein, in a processing apparatus having a documents of value output function, a checking unit, which is configured to determine at least one of a serial number or other individual data of the documents transported from a documents of value pocket to an output pocket, is interposed between a document sheet pocket and an output pocket.

80. An apparatus according to one of claim 1 or 2, wherein the banknote processing apparatus is part of at least one of a cash register, a tabletop unit, a manual checking device, a purse and a pocket checking device.

81. An apparatus according to one of claim 1 or 2, further including one or more stackers, wherein the checking device is designed for automatically checking a stock of documents of value which have an electrical circuit in all of or some of the stacker.

82. An apparatus according to one of claim 1 or 2, wherein the checking device is configured to at least one of (C) register all documents having an operable electrical circuit in a stacker and (D) register each at least one of removal and input of such documents having an operable electrical circuit at least one of into the stacker and out of the stacker.

83. An apparatus according to one of claim 1 or 2, wherein the checking device is configured to ascertain whether documents of only one kind are present in a stacker.

84. An apparatus according to one of claim 1 or 2, wherein the processing apparatus is a separate cash register unit, which is configured to both detect goods to be bought in a purchase transaction and check banknotes for authenticity.

85. An apparatus according to one of claim 1 or 2, further including a memory of the documents of value circuit is configured to store data about an intended use of the documents of value.

86. An apparatus according to one of claim 1 or 2, wherein, in a processing operation, the documents of value is configured to subsequently be provided with an additional electrical circuit.

87. An apparatus according to claim 86, wherein the additional circuit has different properties from the documents of value circuit, whereby each's communication interfaces are identical.

* * * * *